US006139650A

United States Patent [19]

Oda et al.

[11] Patent Number: 6,139,650

[45] Date of Patent: Oct. 31, 2000

[54] NON-ORIENTED ELECTROMAGNETIC STEEL SHEET AND METHOD FOR MANUFACTURING THE SAME

[75] Inventors: Yoshihiko Oda; Nobuo Yamagami; Akira Hiura; Yasushi Tanaka; Noritaka Takahashi; Hideki Matsuoka, all of Fukuyama; Atsushi Chino, Funabashi; Katsumi Yamada, Tokyo; Shunji Iizuka, Fukuyama, all of Japan

[73] Assignee: NKK Corporation, Tokyo, Japan

[21] Appl. No.: 09/041,335

[22] Filed: Mar. 12, 1998

[30] Foreign Application Priority Data

| | | | |
|---|---|---|---|
| Mar. 18, 1997 | [JP] | Japan | 9-083395 |
| Mar. 18, 1997 | [JP] | Japan | 9-083396 |
| Apr. 17, 1997 | [JP] | Japan | 9-114167 |
| Apr. 23, 1997 | [JP] | Japan | 9-118641 |
| May 26, 1997 | [JP] | Japan | 9-149922 |
| Jun. 27, 1997 | [JP] | Japan | 9-186053 |
| Sep. 22, 1997 | [JP] | Japan | 9-273359 |
| Sep. 22, 1997 | [JP] | Japan | 9-273360 |
| Oct. 20, 1997 | [JP] | Japan | 9-303305 |
| Dec. 24, 1997 | [JP] | Japan | 9-365991 |
| Dec. 24, 1997 | [JP] | Japan | 9-365992 |
| Jan. 19, 1998 | [JP] | Japan | 10-020194 |
| Jan. 30, 1998 | [JP] | Japan | 10-032277 |

[51] Int. Cl.[7] ..... H01F 1/047

[52] U.S. Cl. ..... 148/306; 148/307; 148/111

[58] Field of Search ..... 148/306, 307, 148/308, 111, 112, 120, 121; 420/117

[56] References Cited

U.S. PATENT DOCUMENTS

| | | | |
|---|---|---|---|
| 4,204,890 | 5/1980 | Irie et al. | 148/111 |
| 4,293,336 | 10/1981 | Matsumura et al. . | |
| 4,421,574 | 12/1983 | Lyudkovsky | 148/111 |
| 4,661,174 | 4/1987 | Miyoshi et al. | 148/111 |
| 4,946,519 | 8/1990 | Honda et al. | 148/307 |
| 5,258,080 | 11/1993 | Burger et al. | 148/307 |
| 5,676,770 | 10/1997 | Sato et al. | 148/307 |

FOREIGN PATENT DOCUMENTS

| | | |
|---|---|---|
| 28 48 867 A1 | 5/1979 | Germany . |
| 56-22931 | 12/1976 | Japan . |
| 2-50190 | 4/1984 | Japan . |
| 5-140647 | 6/1993 | Japan . |
| 1 514 375 | 6/1978 | United Kingdom . |

OTHER PUBLICATIONS

Patent Abstracts of Japan, vol. 008, No. 178 (C–238), Aug. 1984, of JP 59 074258, Apr. 1984.

Patent Abstracts of Japan, vol. 014, No. 559 (C–0787), Dec. 1990, of JP 02 240214, Sep. 1990.

*Primary Examiner*—John Sheehan

*Attorney, Agent, or Firm*—Frishauf, Holtz, Goodman, Langer & Chick, P.C.

[57] ABSTRACT

A non-oriented electromagnetic steel sheet contains 0.005 wt. % or less C, 0.2 wt. % or less P, 0.005 wt. % or less N, 4.5 wt. % or less Si, 0.05 to 1.5 wt. % Mn, 1.5 wt. % or less Al and 0.001 wt. % or less S, at least one element selected from the group of 0.001 to 0.05 wt. % Sb, 0.002 to 0.1 wt. % Sn, 0.0005 to 0.01 wt. % Se and 0.0005 to 0.01 wt. % Te; and the balance being Fe and inevitable impurities. The non-oriented electromagnetic steel sheet is produced by the steps of: hot-rolling a slab to form a hot-rolled steel sheet, cold-rolling the hot-rolled steel sheet to form a cold-rolled steel sheet; and finish annealing the cold-rolled steel sheet.

53 Claims, 40 Drawing Sheets

NON-ORIENTED ELECTROMAGNETIC STEEL SHEET AND METHOD FOR MANUFACTURING THE SAME

BACKGROUND OF THE INVENTION

1. Field of the Invention

The present invention relates to a non-oriented electromagnetic steel sheet which is advantageous for electric materials used for electric appliances, and to a method for producing the same.

2. Description of the Related Arts

Electromagnetic steel sheets with less iron loss have been desired in recent years from energy saving point of view of electric appliances. Since coarsening of crystal grains is effective for decreasing iron loss, it is attempted in the middle and high grade non-oriented electromagnetic steel sheets, which are especially required to have low iron loss values, containing 1 to 3% of (Si+Al) to coarsen crystal grains by increasing the finish anneal temperature up to 1000° C. or by lowering the line speed for annealing to prolong the annealing time.

It is effective for desirable grain growth during the finish annealing to diminish the content of impurities and precipitates in the steel sheet. For this purpose, many attempts have been made to lend impurities and precipitates harmless, especially to decrease S content in order to prevent MnS from precipitating in high glade materials.

Japanese Examined Patent Publication No. 56-22931 discloses, for example, an art for decreasing S content and O content to 50 ppm or less and 25 ppm or less, respectively, in order to decrease iron loss in the steel containing 2.5 to 3.5% of Si and 0.3 to 1.0% of Al.

Japanese Examined Patent Publication No. 2-50190 also discloses an art for decreasing S content, O content and N content to 15 ppm or less, 20 ppm or less and 25 ppm or less, respectively, in order to decrease iron loss in the steel containing 2.5 to 3.5% of Si and 0.25 to 1.0% of Al.

Japanese Unexamined Patent Publication No. 5-140647 further discloses an art for decreasing S content to 30 ppm or less, and Ti, Zr, Nb and V contents to 50 ppm or less, respectively, in order to decrease iron loss in the steel containing 2.0 to 4.0% of Si and 0.10 to 2.0% of Al.

However, it is the current situation that the iron loss value of the high grade steel sheet with S content of 10 ppm or less is in the order of $W_{15/50}$=2.4 W/kg (with a sheet thickness of 0.5 mm) and the iron loss values lower than this value have not been attained. The iron loss seems to be simply decreased more and more because MnS content is diminished accompanied by the decrease of the S content to facilitate crystal grain growth. However, the iron loss value described above is actually in its limit because decrease of the iron loss due to reduced S content will be saturated at a S content of about 10 ppm.

SUMMARY OF THE INVENTION

It is an object of the present invention to provide an electromagnetic steel sheet with low iron loss and a method for producing the same.

To attain the object, the present invention provides a non-oriented electromagnetic steel sheet consisting essentially of: 0.005 wt. % or less C, 0.2 wt. % or less P, 0.005 wt. % or less N, 4.5 wt. % or less Si, 0.05 to 1.5 wt. % Mn, 1.5 wt. % or less Al and 0.001 wt. % or less S, at least one element selected from the group consisting of 0.001 to 0.05 wt. % Sb, 0.002 to 0.1 wt. % Sn, 0.0005 to 0.01 wt. % Se and 0.0005 to 0.01 wt. % Te, and the balance being Fe and inevitable impurities.

It is preferable in the present invention that S content is 0.0005 wt. % or less. A content of Ti as an inevitable impurity is desirably 0.005 wt. % or less.

The at least one element is preferably selected from the group consisting of 0.001 to 0.005 wt. % Sb, 0.002 to 0.01 wt. % Sn, 0.0005 to 0.002 wt. % Se and 0.0005 to 0.002 wt. % Te.

The preferred embodiments in the non-oriented electromagnetic steel sheet according to the present invention are as follows:

Preferred Embodiment 1

The Si content is 4 wt. % or less, the Mn content is from 0.05 to 1 wt. %, the at least one element is Sb and Sn, and the content of Sb+0.5×Sn is from 0.001 to 0.05 wt. %. It is preferable that the content of Sb+0.5×Sn is from 0.001 to 0.005 wt. %. The S content is preferably 0.0005 wt. % or less.

Preferred Embodiment 2

The Si content is 4 wt. % or less; the Mn content is from 0.05 to 1 wt. %, the at least one element is Sb; and the Sb content is from 0.001 to 0.05 wt. %. It is preferable that Sb content is from 0.001 to 0.005 wt. %. The S content is preferably 0.0005 wt. % or less.

Preferred Embodiment 3

The Si content is 4 wt. % or less, the Mn content is from 0.05 to 1 wt. %, the at least one element is Sn, and the Sn content is from 0.002 to 0.1 wt. %. It is preferable that the Sn content is from 0.002 to 0.01 wt. %. The S content is preferably 0.0005 wt. % or less.

Preferred Embodiment 4

The Si content is 4 wt. % or less, the Mn content is from 0.05 to 1 wt. %, the Al content is from 0.1 to 1 wt. %, the at least one element is Se and Te, and the content of Se+Te is from 0.0005 to 0.01 wt. %. It is preferable that the content of Se+Te is from 0.0005 to 0.002 wt. %. The S content is preferably 0.0005 wt. % or less.

Preferred Embodiment 5

The Si content is 4 wt. % or less, the Mn content is from 0.05 to 1 wt. %, the Al content is from 0.1 to 1 wt. %, the at least one element is Se, and the Se content is from 0.0005 to 0.01 wt. %. It is preferable that Se content is from 0.0005 to 0.002 wt. %. The S content is preferably 0.0005 wt. % or less.

Preferred Embodiment 6

The Si content is 4 wt. % or less, the Mn content is from 0.05 to 1 wt. %, the Al content is from 0.1 to 1 wt. %, the at least one element is Te, and the Te content is from 0.0005 to 0.01 wt. %. It is preferable that the Te content is from 0.0005 to 0.002 wt. %. The S content is preferably 0.0005 wt. % or less.

Preferred Embodiment 7

The Si content is from 1.5 to 3 wt. %, the Al content is from 0.1 to 1 wt. %, the content of Si+Al is 3.5 wt. % or less, the at least one element is Sb and Sn, the content of Sb+0.5×Sn is from 0.001 to 0.05 wt. %, and the sheet thickness is from 0.1 to 0.35 mm. It is preferable that the content of Sb+0.5×Sn is from 0.001 to 0.005 wt. %. It is desirable that the electromagnetic steel sheet has a mean crystal grain diameter of 70 to 200 $\mu$m. The S content is preferably 0.0005 wt. % or less.

Preferred Embodiment 8

The Si content is from 1.5 to 3 wt. %, the Al content is from 0.1 to 1 wt. %, the content of Si+Al is 3.5 wt. % or less, the at least one element is Sb, the Sb content is from 0.001 to 0.05 wt. %, and the sheet thickness is from 0.1 to 0.35 mm. It is preferable that Sb content is from 0.001 to 0.005 wt. %. It is desirable that the electromagnetic steel sheet has a mean crystal grain diameter of 70 to 200 μm. The S content is preferably 0.0005 wt. % or less.

Preferred Embodiment 9

The Si content is from 1.5 to 3 wt. %, the Al content is from 0.1 to 1 wt. %, the content of Si+Al is 3.5 wt. % or less, the at least one element is Sn, the Sn content is from 0.002 to 0.1 wt. %, and the sheet thickness is from 0.1 to 0.35 mm. It is preferable that the Sn content is from 0.002 to 0.01 wt. %. It is preferable that the electromagnetic steel sheet has a mean crystal grain diameter of 70 to 200 μm. The S content is preferably 0.0005 wt. % or less.

Preferred Embodiment 10

The Si content is more than 3 wt. % and 4.5 wt. % or less, the Al content is from 0.1 to 1.5 wt. %, the content of Si+Al is 4.5 wt. % or less, the at least one element is Sb and Sn, the content of Sb+0.5×Sn is from 0.001 to 0.05 wt. %, and the sheet thickness is from 0.1 to 0.35 mm. The S content is preferably 0.0005 wt. % or less.

Preferred Embodiment 11

The Si content is more than 3 wt. % and 4.5 wt. % or less, the Al content is from 0.1 to 1.5 wt. %, the content of Si+Al is 4.5 wt. % or less, the at least one element is Sb, the Sb content is from 0.001 to 0.05 wt. %, and the sheet thickness is from 0.1 to 0.35 mm. The S content is preferably 0.0005 wt. % or less.

Preferred Embodiment 12

The Si content is more than 3 wt. % and 4.5 wt. % or less, the Al content is from 0.1 to 1.5 wt. %, the content of Si+Al is 4.5 wt. % or less, the at least one element is Sn, the Sn content is from 0.002 to 0.1 wt. %, and the sheet thickness is from 0.1 to 0.35 mm. The S content is preferably 0.0005 wt. % or less.

Further, the present invention provides a non-oriented electromagnetic steel sheet consisting essentially of:

4 wt. % or less Si, 0.05 to 1 wt. % Mn, 0.1 to 1 wt. % Al, 0.001 wt. % or less S and the balance being Fe and inevitable impurities; and nitride within an area of 30 μm from the surface of the steel sheet after a finish annealing being 300 ppm or less.

The present invention provides a method for producing a non-oriented electromagnetic steel sheet comprising the steps of:

(a) preparing a slab consisting essentially of 0.005 wt. % or less C, 0.2 wt. % or less P, 0.005 wt. % or less N, 4 wt. % or less Si, 0.05 to 1 wt. % Mn, 1.5 wt. % or less Al, 0.001 wt. % or less S, at least one element selected from the group consisting of 0.001 to 0.05 wt. % Sb, 0.002 to 0.1 wt. % Sn, 0.0005 to 0.01 wt. % Se and 0.0005 to 0.01 wt. % Te and the balance being Fe and inevitable impurities;

(b) hot-rolling the slab to form a hot-rolled steel sheet;

(c) cold-rolling the hot-rolled steel sheet to form a cold-rolled steel sheet; and (d) finish-annealing the cold-rolled steel sheet.

In the method according to the present invention, the at least one element may be selected from the group consisting of 0.001 to 0.05 wt. % Sb and 0.002 to 0.1 wt. % Sn.

Or, the at least one element may be selected from the group consisting of 0.0005 to 0.01 wt. % Se and 0.0005 to 0.01 wt. % Te.

In the method for producing the non-oriented electromagnetic steel sheet according to the present invention, preferred embodiments are as follows:

Preferred Embodiment 1

The slab consists essentially of 0.005 wt. % or less C, 0.2 wt. % or less P, 0.005 wt. % or less N, 1 to 4 wt. % Si, 0.05 to 1 wt. % Mn, 0.1 to 1 wt. % Al, 0.001 wt. % or less S, 0.001 to 0.05 wt. % or less of Sb+0.5×Sn and the balance being Fe and inevitable impurities.

The finish annealing comprises heating the cold-rolled steel sheet at a heating speed of 40° C./sec. or less.

Preferred Embodiment 2

The slab consists essentially of 0.005 wt. % or less C, 0.03 to 0.15 wt. % P, 0.005 wt. % or less N, 1 to 3.5 wt. % Si, 0.05 to 1 wt. % Mn, 0.1 to 1 wt. % Al, 0.001 wt. % or less S, 0.001 to 0.05 wt. % of Sb+0.5×Sn and the balance being Fe and inevitable impurities.

The finish annealing comprises continuously annealing the cold-rolled steel sheet in an atmosphere having a hydrogen concentration of 10% or more for a time of 30 seconds to 5 minutes.

Preferred Embodiment 3

The slab consists essentially of 0.005 wt. % or less C, 0.2 wt. % or less P, 0.005 wt. % or less N, less than 1.5 wt. % Si, 0.05 to 1 wt. % Mn, 0.1 to 1 wt. % Al, 0.001 wt. % or less S, 0.001 to 0.05 wt. % or less of Sb+0.5×Sn and the balance being Fe and inevitable impurities.

The finish annealing comprises continuously annealing the cold-rolled steel sheet in an atmosphere having a hydrogen concentration of 10% or more for a time of 30 seconds to 5 minutes.

Preferred Embodiment 4

The method according to the present invention further comprises the step of annealing the hot-rolled steel sheet.

The slab consists essentially of 0.005 wt. % or less C, 0.2 wt. % or less P, 0.005 wt. % or less N, 1.5 to 4 wt. % Si, 0.05 to 1 wt. % Mn, 0.1 to 1 wt. % Al, 0.001 wt. % or less of S, 0.001 to 0.05 wt. % or less of Sb+0.5×Sn and the balance being Fe and inevitable impurities.

The annealing of the hot-rolled steel sheet comprises annealing the hot-rolled steel sheet in a mixed atmosphere of hydrogen and nitrogen at a heating speed of 40° C./sec. or less.

Preferred Embodiment 5

The method according to the present invention further comprises the step of annealing the hot-rolled steel sheet.

The slab consists essentially of 0.005 wt. % or less C, 0.15 wt. % or less P, 0.005 wt. % or less N, 1.5 to 3.5 wt. % Si, 0.05 to 1 wt. % Mn, 0.1 to 1 wt. % Al, 0.001 wt. % or less of S, 0.001 to 0.05 wt. % or less of Sb+0.5×Sn and the balance being Fe and inevitable impurities.

The annealing of the hot-rolled steel sheet comprises heating the hot-rolled steel sheet in an atmosphere having a hydrogen concentration of 60% or more for 1 to 6 hours.

Preferred Embodiment 6

The method according to the present invention further comprises the step of annealing the hot-rolled steel sheet.

The annealing of the hot-rolled steel sheet comprises heating the hot-rolled steel sheet in an atmosphere having a hydrogen concentration of 10% or more for 1 to 5 minutes.

DESCRIPTION OF THE EMBODIMENT

Embodiment 1

The crucial point of the present invention is that formation of nitrides can be suppressed by allowing (Sb+Sn/2) to contain in 0.001 to 0.05% by weight, thereby lowering the iron loss, based on the new discovery that the iron loss could not be reduced even when the S content is controlled to a trace amount of 10 ppm or less because remarkable nitride layers are formed on the surface area containing a trace amount of S.

Accordingly, the foregoing problem can be solved by a non-oriented electromagnetic steel sheet consisting essentially of, in % by weight, 0.005% or less of C, 0.2% or less of P, 0.005% (including zero) or less of N, 4% or less of Si, 0.05 to 1.0% of Mn and 1.5% or less of Al, in addition to 0.001% (including zero) of S and 0.001 to 0.05% of (Sb+Sn/2), with a substantial balance of Fe and inevitable impurities.

When the content of (Sb+Sn/2) is adjusted in the range of 0.001 to 0.005%, the iron loss can be remarkably reduced.

The phrase "with a substantial balance of Fe and inevitable impurities" as used herein means that the steel sheet containing a trace amount of elements other than inevitable impurities in a range not interfering the function of the present invention falls within the patent property of the present invention. In the description hereinafter, "%" and "ppm" indicating the composition of the steel refer to "% by weight" and "ppm by weight", respectively.

Figure 1:
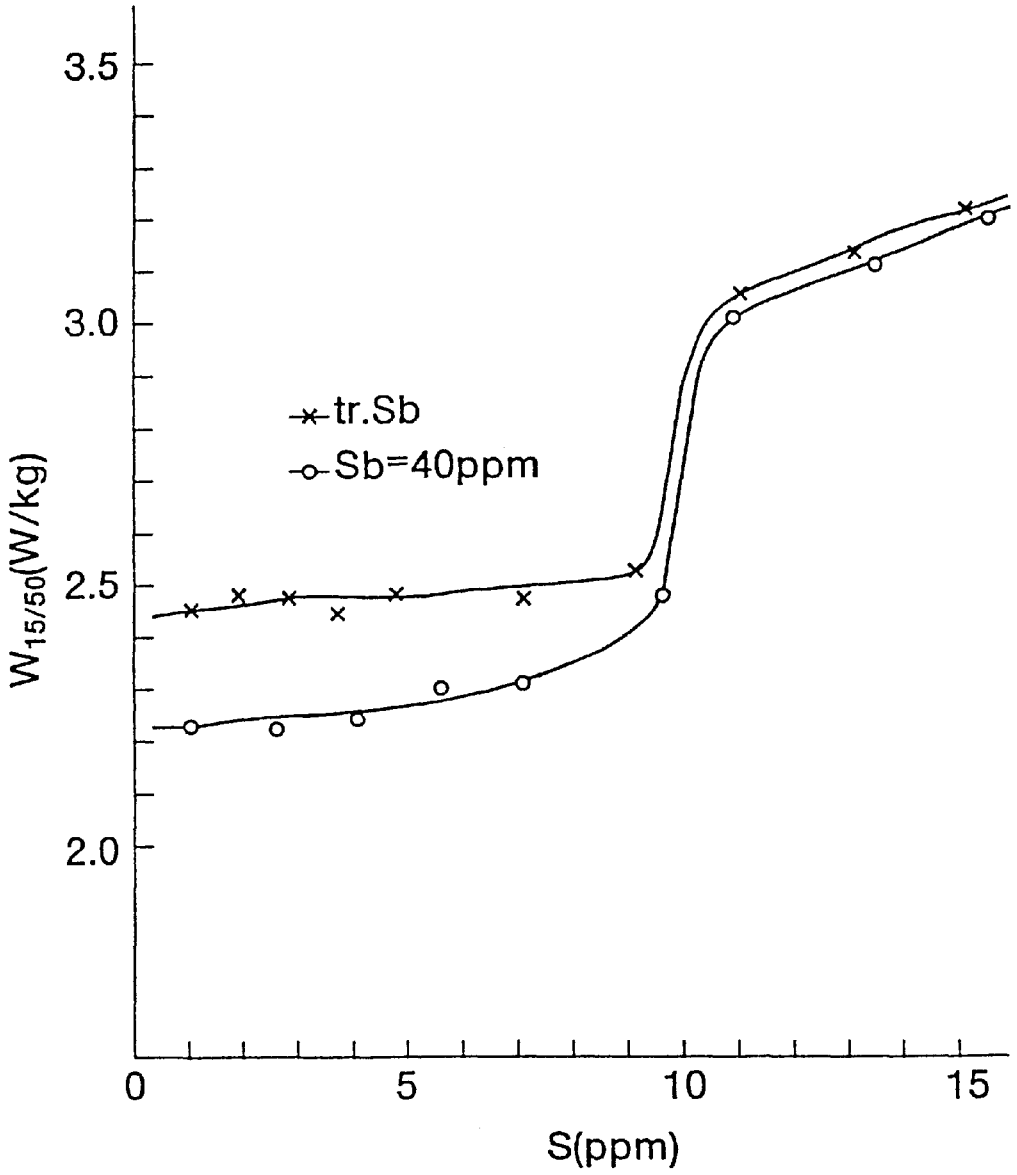
FIG. 1 is a graph indicating the relation between the S content and iron loss after the finish annealing.

Process of the Invention and the Reason for Limiting the Contents of S, Sb and Sn For the purpose of investigating the effect of S on iron loss, the inventors of the present invention melted a steel with a composition of 0.0025% of C, 2.85% of Si, 0.20% of Mn, 0.010% of P, 0.31% of Al and 0.0021% of N, with a change of S content from trace to 15 ppm, in the laboratory, followed by washing with an acid solution after a hot rolling. Subsequently, this hot-rolled sheet was annealed in an atmosphere of 75% $H_2$-25% $N_2$ at 830° C. for 3 hours, followed by a cold-rolling to a sheet thickness of 0.5 mm. The cold-rolled sheet was subjected to a finish annealing in an atmosphere of 25% $H_2$-75% $N_2$ at 900° C. for 1 minute. The relation between the S content and iron loss value $W_{15/50}$ of the sample thus obtained is shown in FIG. 1 (the mark × in FIG. 1). Magnetic measurements were carried out using 25 cm Epstein method.

FIG. 1 shows that a large amount of decrease of the iron loss is attained when the S content is adjusted to 10 ppm or less, indicating a critical point at around a S content of 10 ppm. This is because grains are made to be well developed by decreasing the s content. Therefore, the S content is limited to 10 ppm or less in the present invention.

When the S content has decreased below 10 ppm, however, decreasing speed of the iron loss becomes so slow that, even when a trace amount of S is contained, the iron loss can not made 2.4 W/kg or less.

The investigators of the present invention thought that the reason why decrease in the iron loss is disturbed in the material with an extremely low S content might be due to some unknown causes and observed its texture under an optical microscope. The results revealed that remarkable nitride layers were observed on the surface layer of the steel sheet in the area with a S content of 10 ppm or less. On the contrary, few nitride layers were found in the S content area more than 10 ppm.

The reason for accelerating the nitride forming reaction with the decrease in the S content may be as follows: Since S is liable to be concentrated on the surface layer and at grain boundaries, it suppresses absorption of nitrogen on the surface layer of the steel sheet from the atmosphere in the S content range of more than 10 ppm, preventing formation of nitride layers. In the S content region 10 ppm or less, on the other hand, preventive effect for nitrogen absorption by S is so deteriorated that nitride layers are formed on the surface layer of the steel sheet.

The investigators supposed that the nitride layer formed on the surface area might prevent crystal grain growth, thereby suppressing decrease of iron loss.

Based on this concept, the investigators had an idea that formation of the nitride layer might be suppressed while prompting crystal grain growth to decrease the iron loss by allowing some elements other than S that suppress absorption of nitrogen to contain. As a result of collective studies on these elements, Sb was found to be effective.

Samples prepared by allowing the foregoing sample denoted by the mark × to contain 40 ppm of Sb were tested by the same condition. The results are shown in FIG. 1 by the mark ○. Let the effect of Sb for decreasing the iron loss be noticed. Although the iron loss could not be reduced in the order of 0.02 to 0.04 W/kg by allowing Sb to contain in the sample containing more than 10 ppm of S, the value was decreased by about 0.2 W/kg in the S content region of 10 ppm or less, clearly indicating the iron loss diminishing effect when the S content is small. In addition, no nitride layers were observed in this sample irrespective of the S content. This result suggests that Sb was concentrated on the surface layer of the steel sheet to suppress absorption of nitrogen, consequently decreasing the iron loss because grain growth had not been disturbed.

For the purpose of investigating the optimum Sb content, a steel with a different compositions of 0.0026% of C, 2.70% of Si, 0.20% of Mn, 0.020% of P, 0.30% of Al, 0.0004% of S and 0.0020% of N, with a varying content of Sb of trace to 70 ppm, was melted in the laboratory, followed by washing with an acid solution after hot-rolling. This hot-rolled sheet was subsequently annealed in an atmosphere of 75% $H_2$-25% $N_2$ at 830° C. for 3 hours. Then, the hot-rolled sheet was cold-rolled to a sheet thickness of 0.5 mm, followed by a finish annealing in an atmosphere of 25% $H_2$-75% $N_2$ at 900° C. for 1 minute. The relation between the Sb content and $W_{15/50}$ is shown in FIG. 2.

Figure 2:
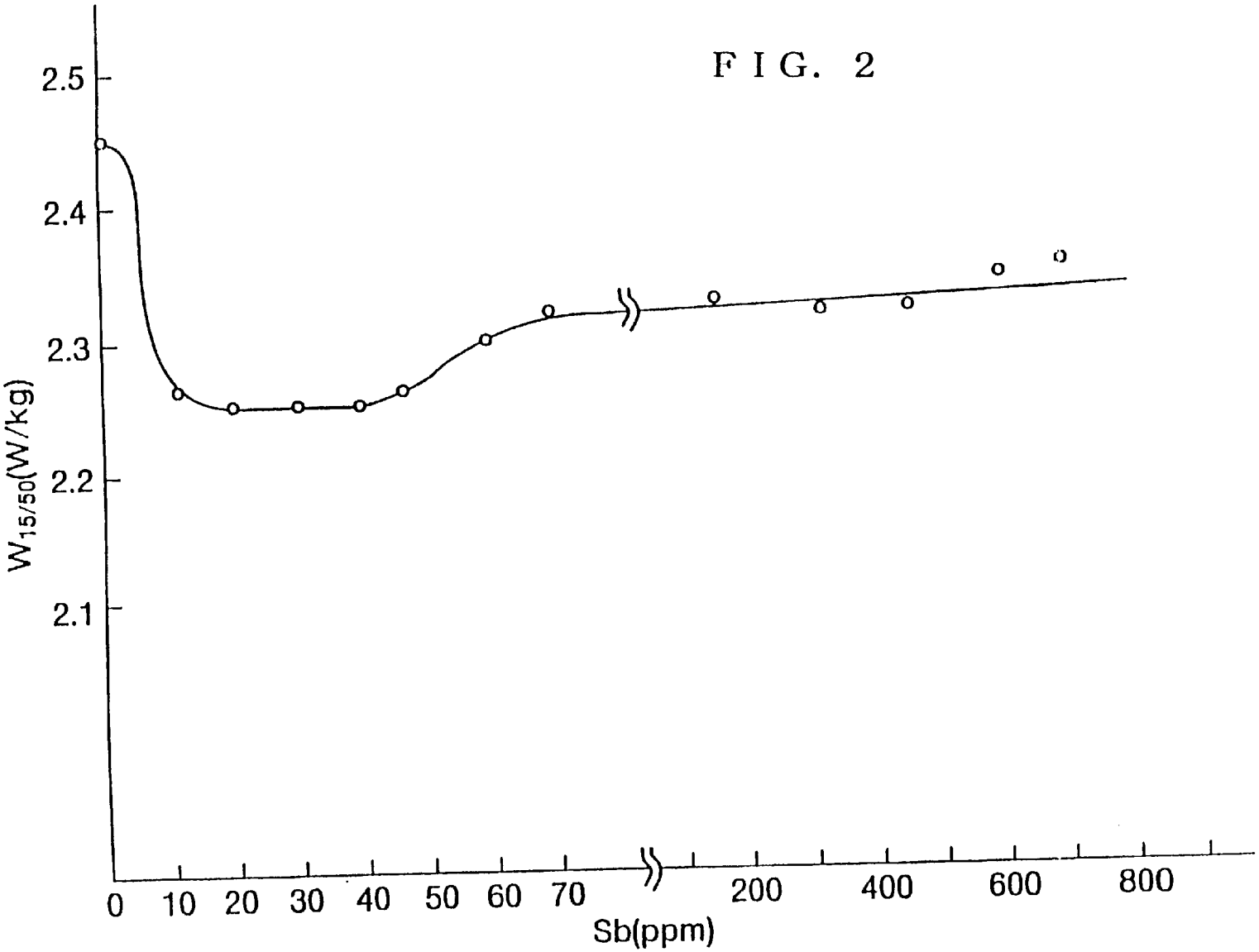
FIG. 2 is a graph indicating the relation between the Sb content and iron loss after the finish annealing.

FIG. 2 shows that the iron loss is decreased in the Sb content region of 10 ppm or less, attaining an iron loss value $W_{15/50}$ of 2.25 to 2.35 W/kg that has been never obtained in conventional electromagnetic steel sheets. When Sb is further added to a Sb content of more than 50 ppm, however, the iron loss is again increased. However, the increment of $W_{15/50}$ remains in the range of 2.25 to 2.35 W/kg up to a Sb content of at least 700 ppm, level never obtained in conventional electromagnetic steel sheets.

To investigate the reason of the iron loss increase in the Sb content region of more than 50 ppm, the texture of the material was observed under an optical microscope. The result showed that, although no texture of surface fine grains was observed, the mean crystal grain diameter seemed to be a little larger. Since Sb has a tendency to segregate at grain boundaries, although not certain, grain growth is supposed to be suppressed by a grain boundary drag effect of Sb.

By the reasons above, the Sb content is limited in the range of 10 ppm or more and, from the economical point of view, 500 ppm or less. However, it is preferable to limit the Sb content below 50 ppm, the range of 20 to 40 ppm being more preferable, by the reason described above.

Considering that the same effect could be obtained by adding different elements, the investigators carried out an experiment focusing on the effect of Sn.

Figure 3:
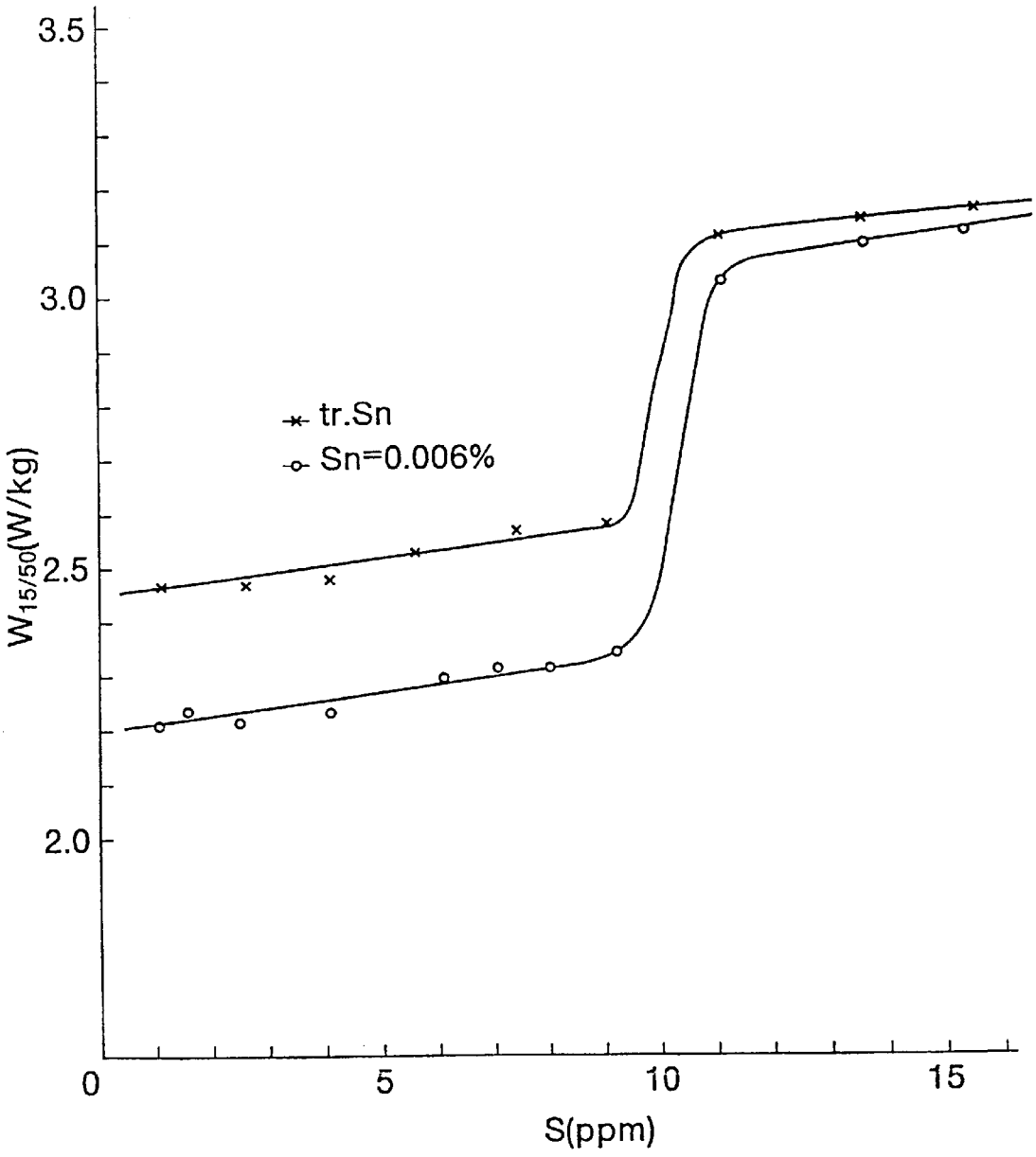
FIG. 3 is a graph indicating the relation between the S content and iron loss after the finish annealing.

To investigate the effect of S on the iron loss as in the foregoing experiments, a steel with a compositions of 0.0020% of C, 2.85% of Si, 0.18% of Mn, 0.01% of P, 0.30% of Al, 0.0018% of N, and 0.0020% of Ti, with a varying content of S from trace to 15 ppm, was melted in the laboratory, followed by washing with an acid solution after hot-rolling. This hot-rolled sheet was subsequently annealed in an atmosphere of 75% $H_2$-25% $N_2$ at 830° C. for 3 hours. Then, the steel sheet was cold-rolled to a sheet thickness of 0.5 mm, followed by a finish annealing in an atmosphere of 25% $H_2$-75% $N_2$ at 900° C. for 1 minute. The relation between the S content and $W_{15/50}$ is shown in FIG. 3 (the mark × in FIG. 3). The magnetic measurement was carried out using 25 cm Epstein method.

It can be confirmed from FIG. 3 that a large degree of decrease in the iron loss is attained at a S content of 10 ppm or less, indicating a critical point at a S content of around 10 ppm. Decrease in the iron loss becomes slow when the S content is 10 ppm or less, and the iron loss value can not be decreased below 2.4 W/kg even when the a trace amount of S is contained.

Samples prepared by allowing the foregoing sample denoted by a mark × to contain 60 ppm of Sb were tested under the same condition. The results are shown in FIG. 3 by the mark ○. Let the effect of Sn for decreasing the iron loss be noticed. While the iron loss decreased by only 0.02 to 0.04 W/kg when Sn is added in the sample with a S content region of more than 10 ppm, the iron loss has decreased by abound 0.2 W/kg in the S content region of 10 ppm or less, indicating that the effect of Sn for decreasing the iron loss is evident when the S content is small. No nitride layers were observed in this sample irrespective of the S content. This means that Sn is concentrated on the surface layer of the steel sheet to suppress absorption of nitrogen, consequently crystal grain growth was not disturbed thereby decreasing the iron loss.

To investigate the optimum content of Sn, a steel with a compositions of 0.0025% of C, 2.72% of Si, 0.20% of Mn, 0.020% of P, 0.30% of Al, 0.0002% of S, 0.0020% of N, and 0.0010% of Ti, with a varying content of Sn from trace to 1400 ppm, was melted in the laboratory, followed by washing with an acid solution after hot-rolling. This hot-rolled sheet was subsequently annealed in an atmosphere of 75% $H_2$-25% $N_2$ at 830° C. for 3 hours. Then, the steel sheet was cold-rolled to a sheet thickness of 0.5 mm, followed by a finish annealing in an atmosphere of 25% $H_2$-75% $N_2$ at 900° C. for 1 minute. The relation between the Sn content and $W_{15/50}$ is shown in FIG. 4.

Figure 4:
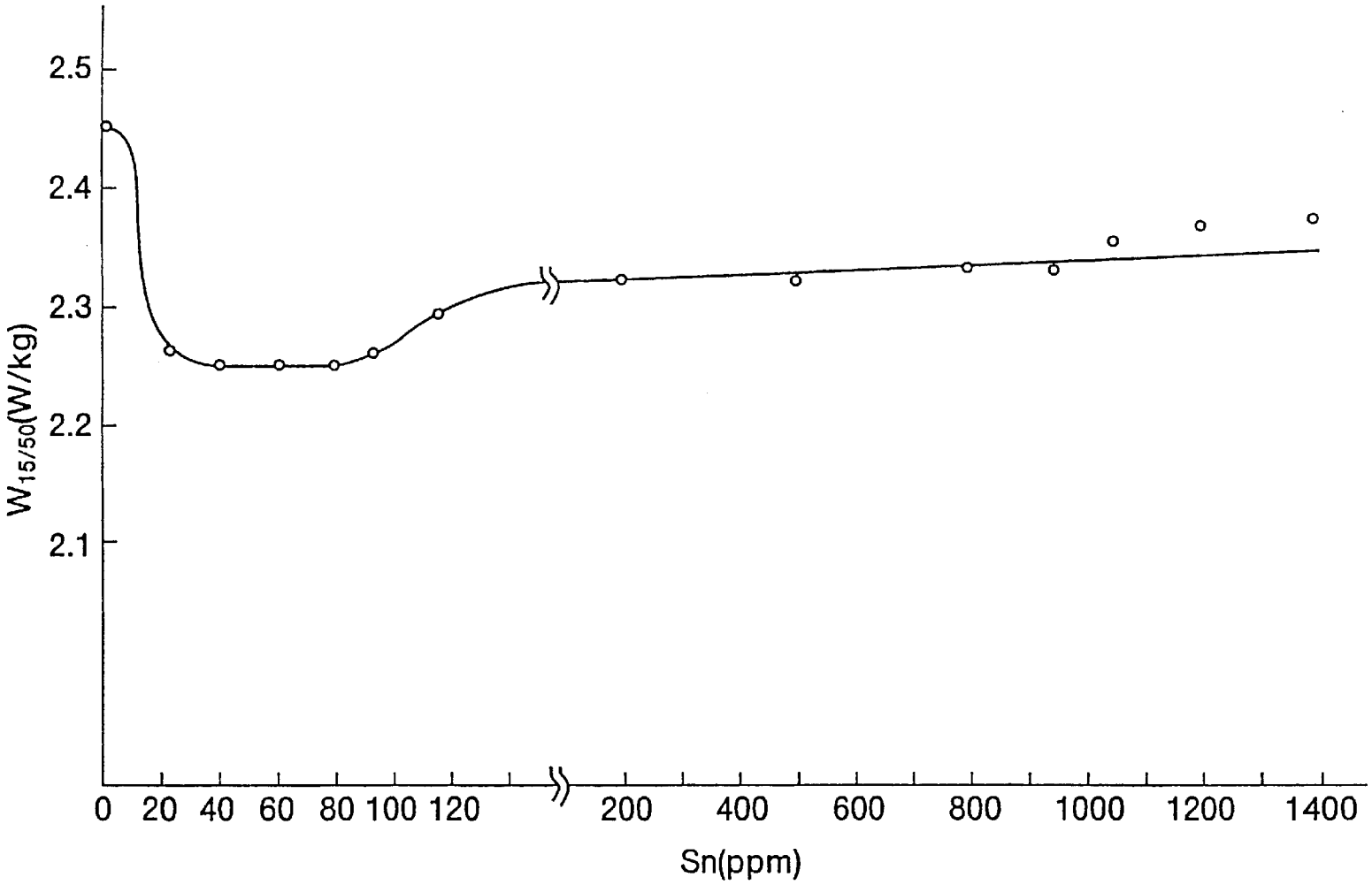
FIG. 4 is a graph indicating the relation between the Sn content and iron loss after the finish annealing.

FIG. 4 demonstrates that the iron loss is decreased in the Sn content range of 20 ppm or more, attaining $W_{15/50}$=2.25 to 2.35 w/kg that is a level never obtained in conventional electromagnetic steels. While the iron loss is increased again when the Sn content is more than 100 ppm, however, the value of $W_{15/50}$=2.25 to 2.35 w/kg, a value never obtained in conventional electromagnetic steels, could be attained in the Sn content range up to at least 1400 ppm.

To investigate the reason of the iron loss increment in the Sn content region of more than 100 ppm, the texture of the material was observed under an optical microscope. The results revealed that, although an surface grain texture was not observed, the mean crystal grain diameter was a little smaller. Since Sn has a tendency to segregate at grain boundaries, although not certain, grain growth is supposed to be suppressed by a grain boundary drag effect of Sn. Nitride layers were also not observed in this sample irrespective of the S content, which can be considered due to suppression of nitrogen absorption by the concentrated Sn on the surface layer of the steel sheet.

By the reasons above, the Sn content is limited in the range of 20 ppm or more in the present invention and, from the economical point of view, 1000 ppm or less. However, it is preferable to limit the Sn content below 100 ppm, the range of 40 to 80 ppm being more preferable, by the reason described above.

The foregoing results can be applied to the high grade electromagnetic steel sheet containing a high concentration of Si, that is 1% or more of Si. Expecting that the iron loss could be decreased by the same procedure as described previously in the low grade electromagnetic steel sheet containing 1% or less of Si, we have carried out the following experiment.

A steel with a composition of 0.0026% of C, 0.21% of Si, 0.55% of Mn, 0.10% of P, 0.27% of Al and 0.001% of N, with a change of S content from trace to 15 ppm, was melted in the laboratory, followed by washing with an acid solution after a hot rolling. Subsequently, this hot-rolled sheet was cold-rolled and finish-annealed in an atmosphere of 10% $H_2$-90% $N_2$ at 750° C. for 1 minute, followed by a magnetic annealing in 100% $N_2$ at 750° C. for 2 hour.

Figure 5:
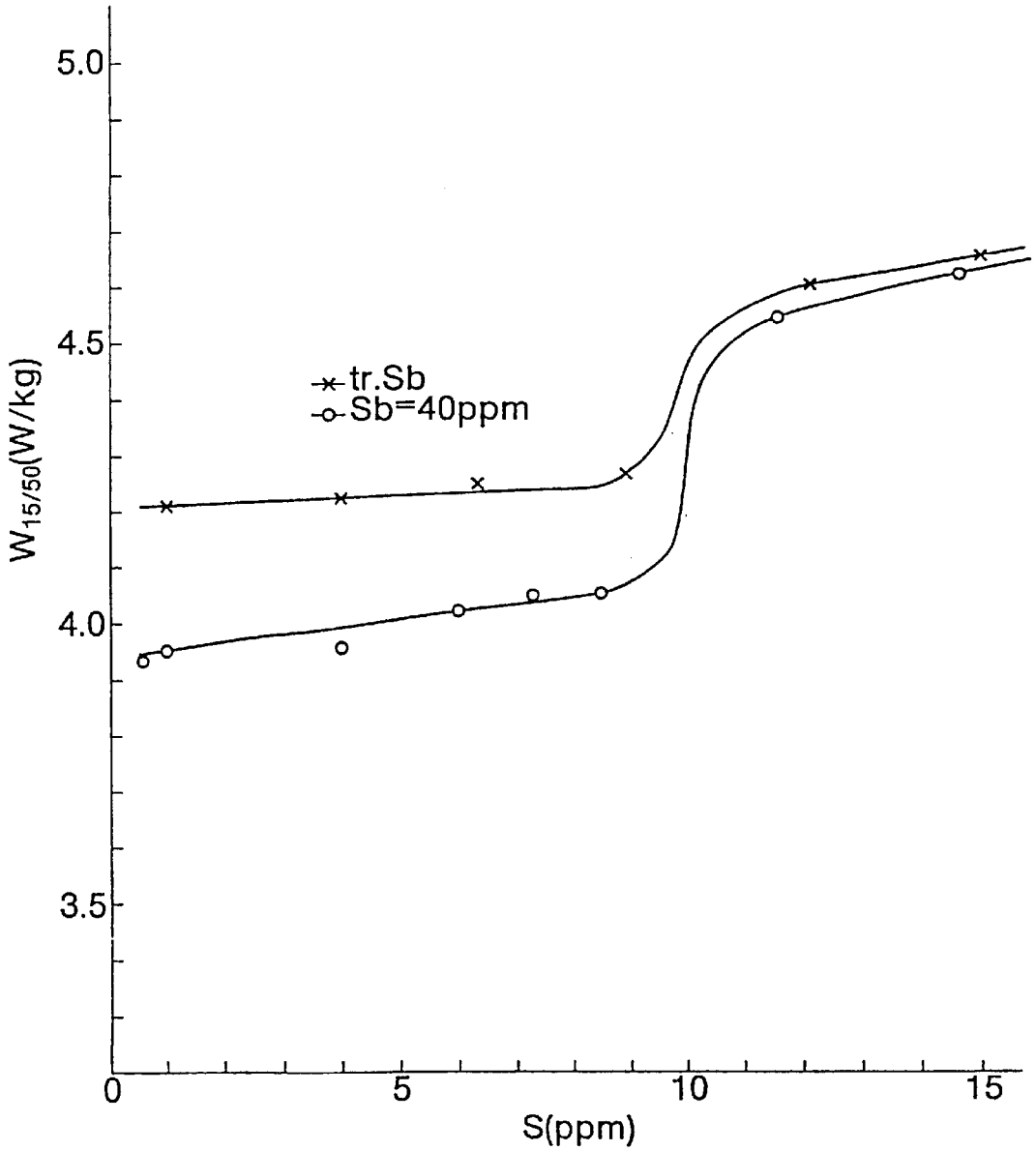
FIG. 5 is a graph indicating the relation between the S content and iron loss after the magnetic annealing.

FIG. 5 shows the relation between the S content and iron loss $W_{15/50}$ of the sample obtained (the mark × in the figure). The magnetic measurement was carried out using a 25 cm Epstein test piece.

FIG. 5 shows that the iron loss $W_{15/50}$ becomes 4.3 W/kg or less when the S content is 10 ppm or less, indicating that the iron loss is largely decreased. When the S content is 10 ppm or less, on the other hand, the decreasing speed of the iron loss becomes slow and finally reaches only to an iron loss value of 4.2 W/kg even when the S content has further decrease. The same tendency is observed when the Si content is more than 1%.

A sample containing 40 ppm of Sb in addition to the sample components previously denoted by a mark × was tested by the same condition as described above. The results are shown in FIG. 5 by the mark of ○.

Let the effect of Sb for decreasing the iron loss be noticed. While the iron loss is decreased only by 0.02 to 0.04 W/kg by adding Sb in the sample with a S content region of more than 10 ppm, the iron loss has decreased by 0.20 W/kg by adding Sb in the sample with a S content of 10 ppm or less, clearly indicating an iron loss decreasing effect of Sb when the S content is small. No nitride layer was observed in this sample irrespective of the S content, which is considered to be the result of concentrated Sb on the surface layer of the steel sheet to suppress absorption of nitrogen.

For the purpose of investigating the effect of optimum Sb content, a steel with a composition of 0.0026% of C, 0.20% of Si, 0.50% of Mn, 0.120% of P, 0.25% of Al, 0.0004% of S and 0.0020% of N, with a change of Sb content from trace to 700 ppm, was melted in the laboratory, followed by acid washing after a hot rolling. Subsequently, this hot-rolled sheet was cold-rolled to a sheet thickness of 0.5 mm and finish-annealed in an atmosphere of 10% $H_2$-90% $N_2$ at 750° C. for 1 minute, followed by a magnetic annealing in 100% $N_2$ at 750° C. for 2 hour.

Figure 6:
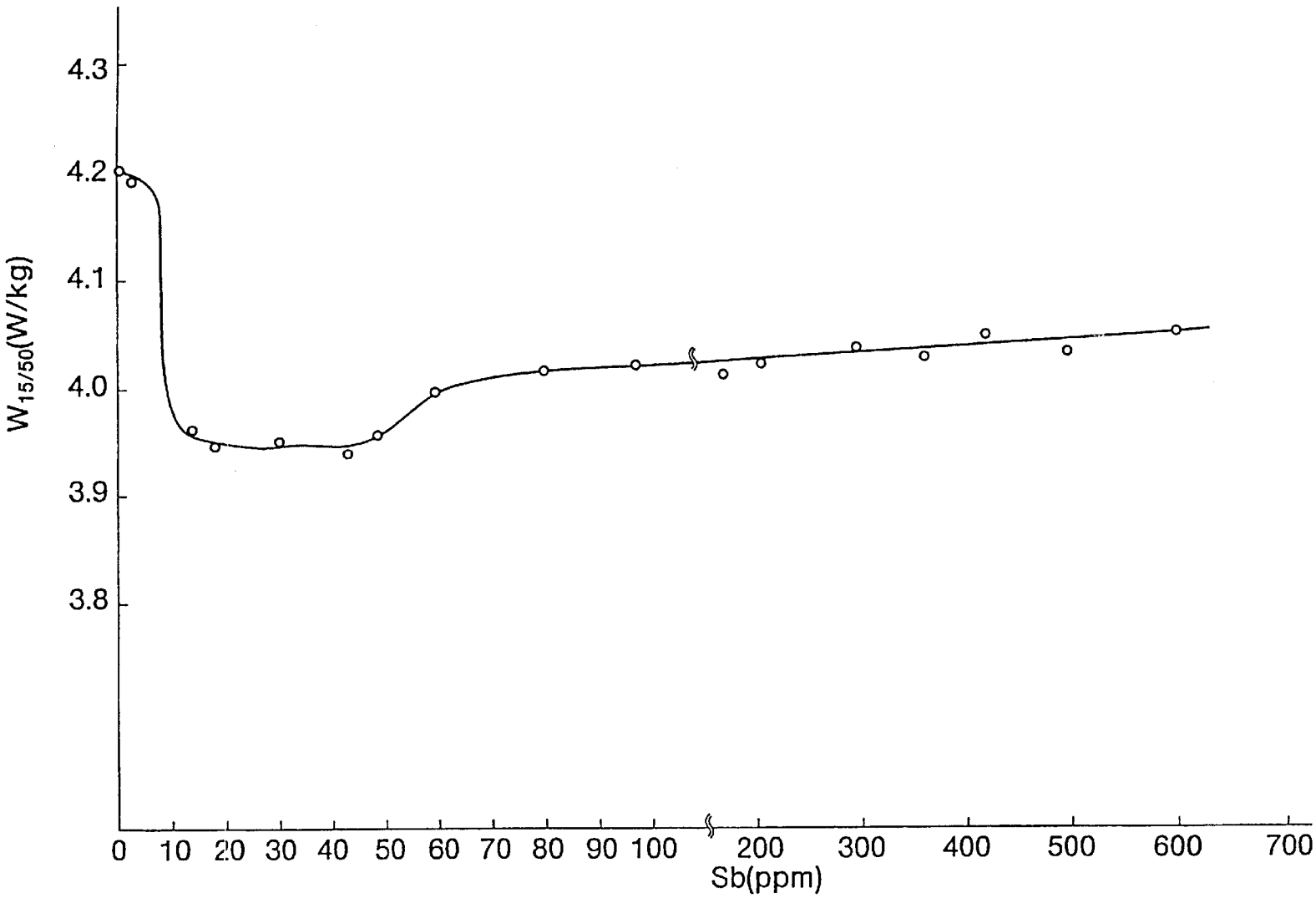
FIG. 6 is a graph indicating the relation between the Sb content and iron loss after the magnetic annealing.

FIG. 6 shows the relation between the Sb content in the sample and iron loss $W_{15/50}$. It can be understood from FIG. 6 that the iron loss decreases in the Sb region of 10 ppm or more, attaining an iron loss value $W_{15/50}$ of 4.0 W/kg or less. However, when Sb is further added to a Sb content of more than 50 ppm, the iron loss is slowly decreased with the increment of the Sb content.

The iron loss remains better than those of the steel without Sb even when the Sb content is increased up to 700 ppm.

Considering the results described above, the Sb content should be 10 ppm or more, its upper limit being 500 ppm from the economical point of view. Considering the iron loss, the content is desirably 10 ppm or more and 50 ppm or less with more desirable range of 20 to 40 ppm.

The investigators expected to obtain the same effect by adding Sn as in the case of addition of Sb in the low grade magnetic steel sheet with a Si content of 1% or less. Therefore, the following experiment was carried out.

To investigate the effect of S content on the iron loss, a steel with a composition of 0.0020% of C, 0.25% of Si, 0.55% of Mn, 0.11% of P, 0.25% of Al and 0.0018% of N, with a change of S content from trace to 15 ppm, was melted in the laboratory, followed by washing with an acid solution after hot rolling. Subsequently, this hot-rolled sheet was cold-rolled to a sheet thickness of 0.5 mm and finish-annealed in an atmosphere of 10% $H_2$-90% $N_2$ at 750° C. for 1 minute, followed by a magnetic annealing in 100% $N_2$ at 750° C. for 2 hour.

Figure 7:
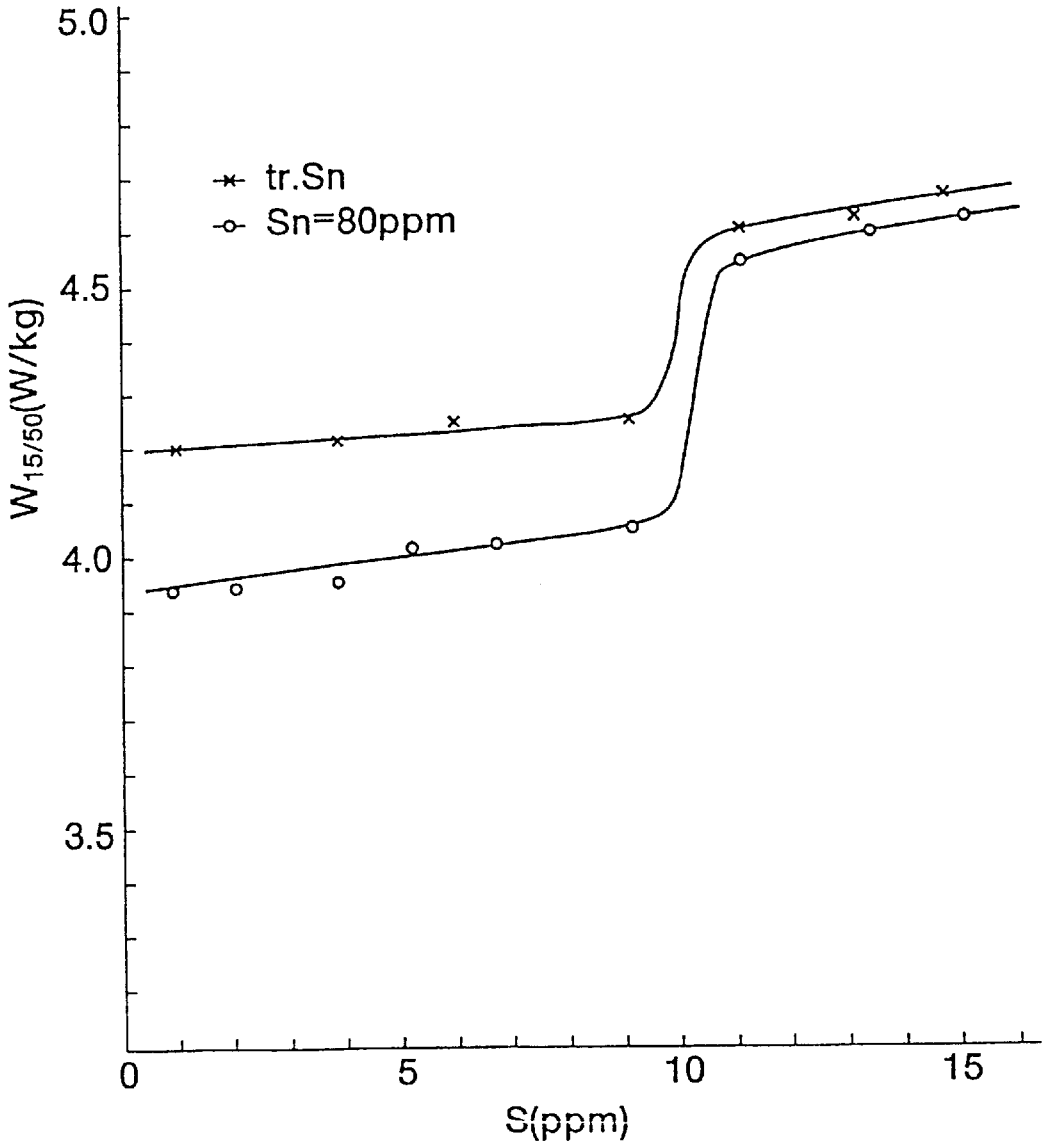
FIG. 7 is a graph indicating the relation between the S content and iron loss after the magnetic annealing.

FIG. 7 shows the relation between the S content in the sample obtained and the iron loss value $W_{15/50}$ (the mark × in the figure). The magnetic measurement was carried out using a 25 cm Epstein test piece.

It can be seen from FIG. 7 that while the iron loss $W_{15/50}$ is largely decreased to 4.3 W/kg as in the foregoing example in the S content range of 10 ppm or less, decrease in the iron loss becomes slow when the S content is 10 ppm or less, reaching only to 4.2 W/kg even when the S content is further decreased.

A sample containing 80 ppm of Sn in addition to the sample components previously denoted by a mark × was tested by the same condition as described above. The results are shown in FIG. 7 by the mark of ○. Let the effect of Sn for decreasing the iron loss be noticed. While the iron loss is decreased only by 0.02 to 0.04 W/kg by adding Sn in the sample with a S content of more than 10 ppm, the iron loss is decreased by 0.20 to 0.30 W/kg by adding Sn in the sample with a S content of 10 ppm or less, clearly indicating an iron loss decreasing effect of Sb when the S content is small. No nitride layer was observed in this sample irrespective of the S content, which is considered to be the result of concentrated Sn on the surface layer of the steel sheet to suppress absorption of nitrogen.

For the purpose of investigating the optimum Sn content, a steel with a composition of 0.0021% of C, 0.25% of Si, 0.52% of Mn, 0.100% of P, 0.26% of Al, 0.0003% of S and 0.0015% of N, with a change of Sn content from trace to 1300 ppm, was melted in the laboratory, followed by washing with an acid solution after a hot rolling. Subsequently, this hot-rolled sheet was cold-rolled to a sheet thickness of 0.5 mm and finish-annealed in an atmosphere of 10% $H_2$-90% $N_2$ at 750° C. for 1 minute, followed by a magnetic annealing in 100% $N_2$ at 750° C. for 3 hours.

Figure 8:
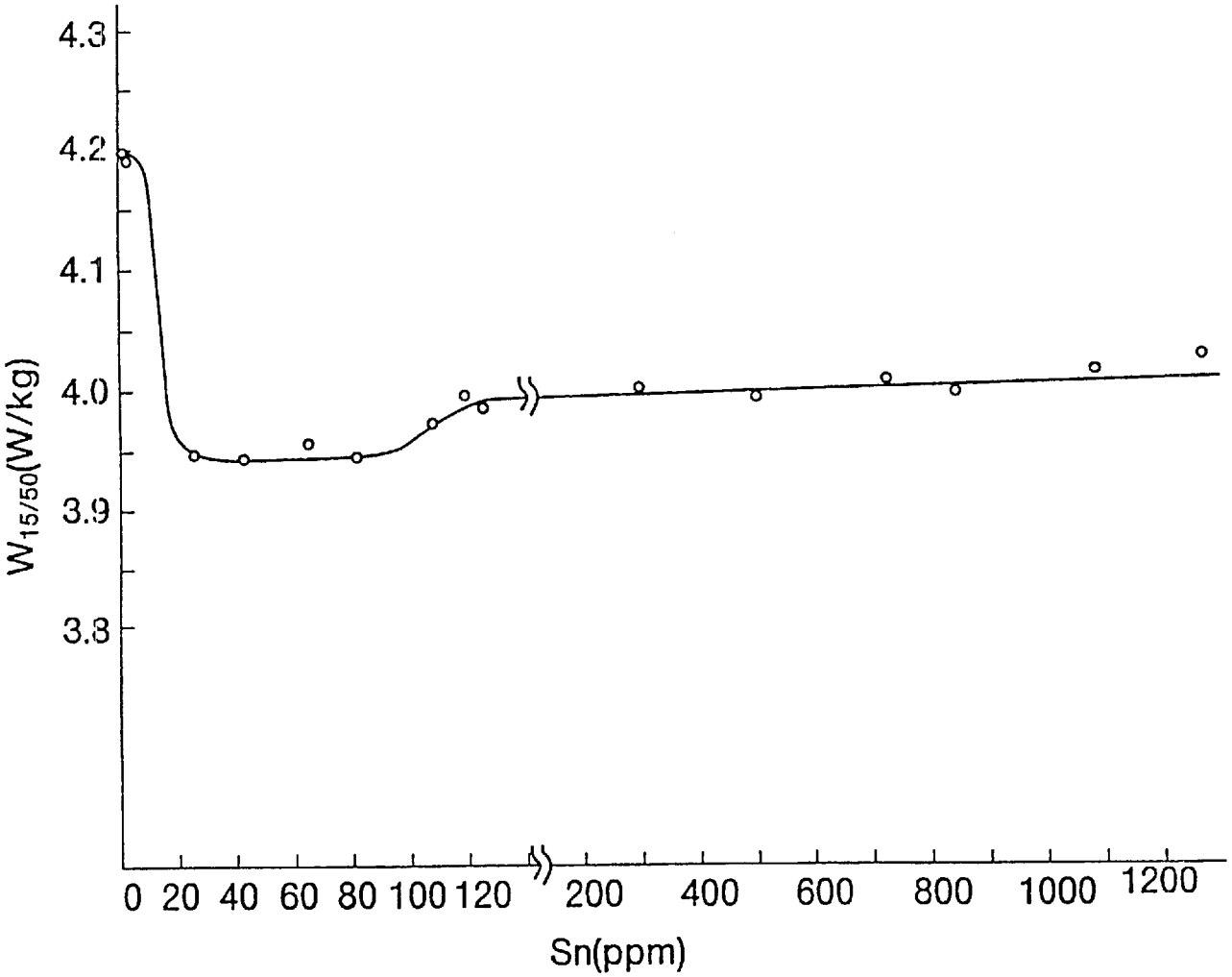
FIG. 8 is a graph indicating the relation between the Sn content and iron loss after the magnetic annealing.

FIG. 8 shows the relation between the Sn content in the sample thus obtained and $W_{15/50}$.

FIG. 8 suggests that the iron loss decreases in the Sn content range of 20 ppm or more reaching to an iron loss value $W_{15/50}$ of 4.0W/kg or less. When Sn is further added to a Sn content of more than 100 ppm, however, the iron loss slowly increases again.

The iron loss remains better than that of a steel without Sn even when Sn is contained up to 1300 ppm.

By the reasons above, the upper limit of the Sn content is determined to be 1000 ppm and, from the economical point of view, the upper limit is limited to 500 ppm. However, it is preferable to limit the Sn content below 100 ppm, the range of 40 to 80 ppm being more preferable, to obtain a low iron loss value.

The difference of the effects on the iron loss in Sn and Sb can be comprehended as follows.

Since Sn has a smaller sedimentation coefficient than Sb, a Sn content approximately twice the content of Sn is required. Accordingly, the iron loss is decreased by adding 20 ppm or more of Sn. On the other hand, the amount of addition of Sn that allows the iron loss to start increasing by the drag effect due to grain boundary sedimentation of Sn is also approximately twice of the amount of Sb, because Sn has a smaller sedimentation coefficient than Sb.

As hitherto described, the mechanism by which nitride formation is suppressed is identical between Sb and Sn. Accordingly, a simultaneous addition of Sb and Sn exhibits a suppression effect for the nitride formation as well. However, an amount twice of Sb is needed for Sn to exhibit the same effect with Sb.

In the present invention, Sb and Sn are classified in the same group and the amount of (Sb+Sn/2) is limited in the range of 0.001 to 0.05%. The more preferable range of (Sb+Sn/2) is limited in the range of 0.001 to 0.005%.

The Reason Why the Other Components are Limited

The reason why the other components are limited will be described hereinafter.

C: The content of C is limited to 0.005% or less owing to the problem of magnetic aging.

P: While P is an element required for improving punching property of the steel sheet, its content is limited to 0.2% or less because an addition of more than 0.2% makes the steel sheet fragile.

N: Since a large amount of N makes a lot of AlN to precipitate increasing the iron loss, its content is limited to 0.005% or less.

Si: While Si is an essential element for increasing inherent resistively of the steel sheet, the magnetic flux density tends to be decreased with decrease of saturation magnetic flux density when its content exceeds 4.0%. Therefore, the upper limit of its content is 4.0%.

Mn: More than 0.05% of Mn is needed in order to prevent red brittleness during hot-rolling. However, since the magnetic flux density is decreased at the Mn content of 1.0% or more, its range is limited to 0.05 to 1.0%.

Al: Although Al is, like Si, an essential element for increasing the inherent resistivity, an amount of exceeding 1.5% causes a decrease in the magnetic flux density along with the decrease in the saturation magnetic flux density. Therefore, the upper limit is 1.5%. The lower limit is 0.1% because, when the Al content is less than 0.1%, the grain size of AlN becomes so fine that grain growth is deteriorated.

Production Method

Conventional methods for producing the non-oriented electromagnetic steel sheet may be applied in the present invention provided the contents of S and (Sb+Sn/2) be in a given range. The molten steel refined in a converter is de-gassed to adjust to a prescribed composition, followed by subjecting to casting and hot-rolling. The finishing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing.

EXAMPLE

Example 1

By using a steel with a Si content of 1% or less as shown in Table 1, the steel was subjected to casting after adjusting it to a given composition by applying a de-gassing treatment after refining in the converter. The steel was hot-rolled to a sheet thickness of 2.0 mm after heating the slab at a temperature of 1160° C. for 1 hour. The finishing temperature and coiling temperature at the hot rolling were 800° C. and 670° C., respectively. Then, this hot-rolled sheet was washed with an acid solution and, after a cold-rolling to a sheet thickness of 0.5 mm, the steel sheet was subjected to an annealing in an atmosphere of 10% $H_2$-90% $N_2$ under the finish anneal conditions as shown in Table 1. Finally, a magnetic annealing in an atmosphere of 100% $N_2$ at 750° C. for 2 hours was applied to the steel sheet.

The magnetic measurement was carried out using a 25 cm Epstein test piece ((L+C)/2). The magnetic characteristics (iron loss $W_{15/50}$ and magnetic flux density $B_{50}$) is listed in Table 1 together.

No 1 to No. 17 in Table 1 are the examples according to the present invention, where Si content is in the order of 0.25%. No. 22 to No. 27 is the examples according to the present invention, where Si content is in the order of 0.75%. The iron loss $W_{15/50}$ in each example is far more lower than the value of 4.2 W/kg that is a level considered to be difficult to attain in the conventional steel sheets. The values are 3.94 to 4.05 W/kg and 3.36 to 3.45 W/kg in the samples containing Si in the order of 0.25% and 0.75%, respectively.

The magnetic flux density $B_{50}$ shows a high levels of 1.76T and 1. 73T in the steels with a Si content of the order of 0.25% and 0.75%, respectively.

On the other hand, S and (Sb+Sn/2) contents in the sample of No. 18 are out of the range of the present invention. The S content in No 19 and No. 20, and (Sb+Sn/2) content in No. 21 are also out of the range of the present invention. Accordingly, the iron loss $W_{15/50}$ is high in all cases.

Both of the S and (Sb+Sn/2) contents in the sample of No. 28, which has a Si level of 75%, are out of the range of the present invention. The S content in the sample of No. 29 and (Sb+Sn/2) content in the sample of No. 30 are also out of the range of the present invention, respectively. Accordingly, their iron loss $W_{15/50}$ is higher than that of the samples of the present invention having same level of Si content.

As is evident from these examples and comparative examples, a non-oriented electromagnetic steel sheet with a very low iron loss after the magnetic annealing without decreasing the magnetic flux density can be obtained when the composition of the steel sheet is controlled to the S and (Sb+Sn/2) content levels according to the present invention.

No. 46 according to the present invention with the Si levels described above were lower than iron loss value of the steel sheet not belonging to the present invention. The S and (Sb+Sn/2) contents of the steel sheets No. 38 and No. 47, the S content of the steel sheet No. 39 and (Sb+Sn/2) content of the steel sheets No. 40 and No. 48 were out of the range of the present invention, showing higher iron loss $W_{15/50}$ than the steel sheets with the same Si levels.

TABLE 1

| No. | C | Si | Mn | P | S | Al | N | Sb | Sn | Finish annealing temperature (° C.) × 1 min | W15/50 (W/kg) | B50 (T) | Note |
|---|---|---|---|---|---|---|---|---|---|---|---|---|---|
| 1 | 0.0018 | 0.26 | 0.55 | 0.101 | 0.0008 | 0.28 | 0.0020 | 0.0030 | tr. | 750 | 4.05 | 1.76 | present invention |
| 2 | 0.0023 | 0.24 | 0.51 | 0.100 | 0.0004 | 0.27 | 0.0015 | 0.0030 | tr. | 750 | 3.95 | 1.76 | present invention |
| 3 | 0.0023 | 0.24 | 0.56 | 0.090 | 0.0004 | 0.25 | 0.0018 | 0.0010 | tr. | 750 | 3.99 | 1.76 | present invention |
| 4 | 0.0023 | 0.23 | 0.54 | 0.101 | 0.0004 | 0.25 | 0.0015 | 0.0040 | tr. | 750 | 3.94 | 1.76 | present invention |
| 5 | 0.0015 | 0.25 | 0.53 | 0.101 | 0.0004 | 0.25 | 0.0026 | 0.0060 | tr. | 750 | 4.02 | 1.76 | present invention |
| 6 | 0.0015 | 0.25 | 0.53 | 0.101 | 0.0004 | 0.25 | 0.0026 | 0.0200 | tr. | 750 | 4.03 | 1.76 | present invention |
| 7 | 0.0015 | 0.25 | 0.53 | 0.101 | 0.0004 | 0.25 | 0.0026 | 0.0480 | tr. | 750 | 4.04 | 1.76 | present invention |
| 8 | 0.0022 | 0.26 | 0.53 | 0.105 | 0.0008 | 0.25 | 0.0022 | tr. | 0.0050 | 750 | 3.95 | 1.76 | present invention |
| 9 | 0.0023 | 0.24 | 0.50 | 0.101 | 0.0004 | 0.24 | 0.0020 | tr. | 0.0020 | 750 | 3.97 | 1.76 | present invention |
| 10 | 0.0022 | 0.23 | 0.56 | 0.105 | 0.0004 | 0.26 | 0.0017 | tr. | 0.0050 | 750 | 3.94 | 1.76 | present invention |
| 11 | 0.0025 | 0.23 | 0.54 | 0.101 | 0.0004 | 0.23 | 0.0018 | tr. | 0.0080 | 750 | 3.94 | 1.76 | present invention |
| 12 | 0.0015 | 0.25 | 0.53 | 0.103 | 0.0004 | 0.27 | 0.0026 | tr. | 0.0130 | 750 | 4.00 | 1.76 | present invention |
| 13 | 0.0016 | 0.25 | 0.53 | 0.103 | 0.0004 | 0.27 | 0.0024 | tr. | 0.0200 | 750 | 4.01 | 1.76 | present invention |
| 14 | 0.0015 | 0.25 | 0.53 | 0.103 | 0.0004 | 0.27 | 0.0025 | tr. | 0.0450 | 750 | 4.03 | 1.76 | present invention |
| 15 | 0.0023 | 0.23 | 0.54 | 0.101 | 0.0004 | 0.25 | 0.0015 | 0.0005 | 0.0018 | 750 | 3.96 | 1.76 | present invention |
| 16 | 0.0023 | 0.23 | 0.54 | 0.101 | 0.0004 | 0.25 | 0.0015 | 0.0030 | 0.0080 | 750 | 4.02 | 1.76 | present invention |
| 17 | 0.0023 | 0.23 | 0.54 | 0.101 | 0.0004 | 0.25 | 0.0015 | 0.0060 | 0.0100 | 750 | 4.03 | 1.76 | present invention |
| 18 | 0.0011 | 0.25 | 0.56 | 0.105 | 0.0040 | 0.27 | 0.0018 | tr. | tr. | 750 | 4.67 | 1.76 | Comparative steel |
| 19 | 0.0023 | 0.24 | 0.50 | 0.101 | 0.0040 | 0.27 | 0.0020 | 0.0030 | tr. | 750 | 4.65 | 1.76 | Comparative steel |
| 20 | 0.0015 | 0.24 | 0.53 | 0.106 | 0.0015 | 0.27 | 0.0017 | 0.0030 | tr. | 750 | 4.60 | 1.76 | Comparative steel |
| 21 | 0.0020 | 0.22 | 0.55 | 0.100 | 0.0003 | 0.25 | 0.0017 | tr. | tr. | 750 | 4.20 | 1.76 | Comparative steel |
| 22 | 0.0023 | 0.74 | 0.25 | 0.090 | 0.0008 | 0.31 | 0.0017 | 0.0040 | tr. | 850 | 3.38 | 1.73 | present invention |
| 23 | 0.0023 | 0.75 | 0.25 | 0.100 | 0.0002 | 0.31 | 0.0015 | 0.0040 | tr. | 850 | 3.36 | 1.73 | present invention |
| 24 | 0.0011 | 0.72 | 0.24 | 0.101 | 0.0004 | 0.33 | 0.0018 | 0.0060 | tr. | 850 | 3.40 | 1.73 | present invention |
| 25 | 0.0020 | 0.75 | 0.20 | 0.105 | 0.0002 | 0.30 | 0.0017 | tr. | 0.0080 | 850 | 3.36 | 1.73 | present invention |
| 26 | 0.0016 | 0.72 | 0.25 | 0.101 | 0.0002 | 0.33 | 0.0018 | tr. | 0.0130 | 850 | 3.42 | 1.73 | present invention |
| 27 | 0.0017 | 0.72 | 0.25 | 0.101 | 0.0002 | 0.33 | 0.0018 | tr. | 0.0300 | 850 | 3.45 | 1.73 | present invention |
| 28 | 0.0011 | 0.75 | 0.23 | 0.090 | 0.0040 | 0.31 | 0.0015 | tr. | tr. | 850 | 4.05 | 1.73 | Comparative steel |
| 29 | 0.0019 | 0.73 | 0.23 | 0.101 | 0.0040 | 0.30 | 0.0020 | 0.0040 | tr. | 850 | 4.00 | 1.73 | Comparative steel |
| 30 | 0.0018 | 0.72 | 0.25 | 0.103 | 0.0004 | 0.32 | 0.0025 | tr. | Tr. | 850 | 3.69 | 1.73 | Comparative steel |

Example 2

A steel was refined in a converter followed by de-gassing and subjected to casting after adjusting to prescribed compositions shown in FIG. 2 and FIG. 3. The slab was heated to 1200° C. for 1 hour and hot-rolled to a sheet thickness of 2.0 mm to obtain a steel sheet containing 1% of Si. The finishing temperature of the hot rolling was 800° C. The coiling temperatures of the hot rolling were 650° C. and 550° C. for the steel sheets of No. 31 to No. 40 and No. 41 to No. 72, respectively. The steel sheets of No. 41 to No. 72 were hot-rolled by the conditions shown in Table 2 and Table 3. The atmosphere for annealing the hot-rolled sheet was 75% $H_2$-25% $N_2$. The hot-rolled sheet was washed with an acid solution and then cold-rolled to a sheet thickness of 0.5 mm, finally subjecting to a finish annealing by the conditions shown in Table 2 and Table 3 in an atmosphere of 25% $H_2$-75% $N_2$.

The magnetic measurement was carried out using a 25 cm Epstein test piece ((L+C)/2). Magnetic properties (iron loss $W_{15/50}$ and magnetic flux density $B_{50}$) of each steel sheet is also shown Table 2 and Table 3.

Of the steel sheets shown in Table 2, Si contents of No. 31 to No. 40 were in a level of 1.05% while Si contents of No. 41 to No. 48 were in a level of 1.85%. The iron loss values of the steel sheets of No. 31 to No. 37 and No 41 to Table 3 shows the experimental results of the steels with Si level of 2.5 to 3.0%, the contents of which being identical to those in Table 2. No. 49 to No. 63 correspond to the steels according to the present invention that show lower iron loss values than the other steels. The S and (Sb+Sn/2) contents of No. 64, S content of the No. 65 and (Sb+Sn) content of No. 66 and No. 67 were out of the range of the present invention, showing higher iron loss values $W_{15/50}$ than the steels of the present invention with the same Si level.

Since the steel No. 68 contains a higher level of C than the level of the present invention, it has not only a high iron loss $W_{15/50}$ but also involves a problem of magnetic aging.

Since the Mn content of the steel No. 69 is out of the range of the present invention, it has not only a high iron loss $W_{15/50}$ but also low magnetic flux density B50.

The iron loss $W_{15/50}$ of the steel No. 70 is lowered while the magnetic flux density $B_{50}$ is low because the Al content is out of the range of the present invention.

Since the N content of No. 71 is out of the range of the present invention, the iron loss $W_{15/50}$ becomes high.

Although the iron loss $W_{15/50}$ is suppressed to a lower level, its magnetic flux density $B_{50}$ becomes small since the Si content is out of the range of the present invention.

When the Si content is over 1% and within any Si levels according to the present invention, the iron loss value of the steel sheet remains low without decreasing the magnetic flux density provided that the contents of other components are within the range of the present invention.

TABLE 2

| No. | C | Si | Mn | P | S | Al | Sb | Sn | N | Annealing of hot rolled sheet Temp. (° C.) | Annealing of hot rolled sheet Time (min) | Finish annealing temperature (° C.) × 1 min | W15/50 (W/kg) | B50 (T) | Note |
|---|---|---|---|---|---|---|---|---|---|---|---|---|---|---|---|
| 31 | 0.0020 | 1.07 | 0.21 | 0.020 | 0.0004 | 0.30 | 0.0017 | tr. | 0.0026 | — | — | 850 | 3.40 | 1.74 | Steel of the present invention |
| 32 | 0.0021 | 1.08 | 0.19 | 0.021 | 0.0004 | 0.29 | 0.0040 | tr. | 0.0023 | — | — | 850 | 3.35 | 1.74 | Steel of the present invention |
| 33 | 0.0018 | 1.05 | 0.18 | 0.025 | 0.0004 | 0.30 | 0.0080 | tr. | 0.0025 | — | — | 850 | 3.42 | 1.74 | Steel of the present invention |
| 34 | 0.0023 | 1.06 | 0.21 | 0.018 | 0.0004 | 0.30 | tr. | 0.0040 | 0.0026 | — | — | 850 | 3.37 | 1.74 | Steel of the present invention |
| 35 | 0.0021 | 1.07 | 0.19 | 0.020 | 0.0004 | 0.29 | tr. | 0.0080 | 0.0018 | — | — | 850 | 3.33 | 1.74 | Steel of the present invention |
| 36 | 0.0021 | 1.07 | 0.19 | 0.020 | 0.0004 | 0.29 | tr. | 0.0120 | 0.0018 | — | — | 850 | 3.40 | 1.74 | Steel of the present invention |
| 37 | 0.0018 | 1.05 | 0.18 | 0.025 | 0.0004 | 0.30 | tr. | 0.0300 | 0.0020 | — | — | 850 | 3.43 | 1.74 | Steel of the present invention |
| 38 | 0.0021 | 1.05 | 0.20 | 0.020 | 0.0020 | 0.30 | tr. | tr. | 0.0025 | — | — | 850 | 4.30 | 1.74 | Comparative steel (S, Sb + Sn out of the range) |
| 39 | 0.0020 | 1.05 | 0.20 | 0.020 | 0.0020 | 0.30 | 0.0040 | tr. | 0.0023 | — | — | 850 | 4.27 | 1.74 | Comparative steel (S out of the range) |
| 40 | 0.0021 | 1.10 | 0.20 | 0.018 | 0.0004 | 0.30 | tr. | tr. | 0.0020 | — | — | 850 | 3.60 | 1.74 | Comparative steel (Sb + Sn out of the range) |
| 41 | 0.0020 | 1.84 | 0.21 | 0.020 | 0.0004 | 0.30 | 0.0015 | tr. | 0.0026 | 770 | 180 | 900 | 2.45 | 1.72 | Steel of the present invention |
| 42 | 0.0021 | 1.86 | 0.19 | 0.018 | 0.0004 | 0.29 | 0.0030 | tr. | 0.0025 | 770 | 180 | 900 | 2.40 | 1.72 | Steel of the present invention |
| 43 | 0.0018 | 1.85 | 0.18 | 0.020 | 0.0004 | 0.30 | 0.0060 | tr. | 0.0025 | 770 | 180 | 900 | 2.45 | 1.72 | Steel of the present invention |
| 44 | 0.0020 | 1.84 | 0.21 | 0.020 | 0.0004 | 0.30 | tr. | 0.0030 | 0.0023 | 770 | 180 | 900 | 2.42 | 1.72 | Steel of the present invention |
| 45 | 0.0021 | 1.80 | 0.19 | 0.020 | 0.0004 | 0.29 | tr. | 0.0060 | 0.0020 | 770 | 180 | 900 | 2.40 | 1.72 | Steel of the present invention |
| 46 | 0.0018 | 1.85 | 0.18 | 0.020 | 0.0004 | 0.30 | tr. | 0.0120 | 0.0018 | 770 | 180 | 900 | 2.46 | 1.71 | Steel of the present invention |
| 47 | 0.0021 | 1.85 | 0.20 | 0.020 | 0.0020 | 0.30 | tr. | tr. | 0.0025 | 770 | 180 | 900 | 3.60 | 1.72 | Comparative steel (S, Sb + Sn out of the range) |
| 48 | 0.0021 | 1.85 | 0.20 | 0.024 | 0.0004 | 0.30 | tr. | tr. | 0.0025 | 770 | 180 | 900 | 2.65 | 1.72 | Comparative steel (Sb + Sn out of the range) |

TABLE 3

| No. | C | Si | Mn | P | S | Al | Sb | Mn | N | annealing of hot rolled sheet Temp. (° C.) | annealing of hot rolled sheet Time (min) | Finish annealing temp. (° C.) × 1 min | W15/50 (W/kg) | B50 (T) | Note |
|---|---|---|---|---|---|---|---|---|---|---|---|---|---|---|---|
| 49 | 0.0022 | 2.85 | 0.19 | 0.023 | 0.0002 | 0.30 | 0.0015 | tr. | 0.0015 | 900 | 3 | 920 | 2.25 | 1.71 | present invention |
| 50 | 0.0022 | 2.85 | 0.19 | 0.018 | 0.0002 | 0.30 | 0.0023 | tr. | 0.0020 | 830 | 180 | 920 | 2.24 | 1.71 | present invention |
| 51 | 0.0022 | 2.78 | 0.18 | 0.021 | 0.0002 | 0.31 | 0.0040 | tr. | 0.0017 | 830 | 180 | 920 | 2.24 | 1.71 | present invention |
| 52 | 0.0025 | 2.80 | 0.18 | 0.020 | 0.0002 | 0.32 | 0.0060 | tr. | 0.0015 | 830 | 180 | 920 | 2.32 | 1.71 | present invention |
| 53 | 0.0018 | 2.80 | 0.18 | 0.020 | 0.0002 | 0.32 | 0.0100 | tr. | 0.0020 | 830 | 180 | 920 | 2.33 | 1.71 | present invention |
| 54 | 0.0025 | 2.80 | 0.18 | 0.020 | 0.0002 | 0.32 | 0.0400 | tr. | 0.0017 | 830 | 180 | 920 | 2.34 | 1.71 | present invention |
| 55 | 0.0022 | 2.85 | 0.19 | 0.018 | 0.0002 | 0.30 | tr. | 0.0020 | 0.0023 | 930 | 3 | 920 | 2.25 | 1.71 | present invention |
| 56 | 0.0018 | 2.85 | 0.19 | 0.023 | 0.0002 | 0.30 | tr. | 0.0060 | 0.0020 | 830 | 180 | 920 | 2.24 | 1.71 | present invention |
| 57 | 0.0020 | 2.78 | 0.17 | 0.018 | 0.0007 | 0.31 | tr. | 0.0120 | 0.0015 | 830 | 180 | 920 | 2.30 | 1.71 | present invention |
| 58 | 0.0022 | 2.75 | 0.18 | 0.021 | 0.0002 | 0.31 | tr. | 0.0300 | 0.0020 | 830 | 180 | 920 | 2.32 | 1.71 | present invention |
| 59 | 0.0021 | 2.78 | 0.15 | 0.021 | 0.0002 | 0.31 | tr. | 0.0700 | 0.0023 | 830 | 180 | 920 | 2.33 | 1.71 | present invention |
| 60 | 0.0020 | 2.78 | 0.15 | 0.021 | 0.0002 | 0.31 | 0.0005 | 0.0010 | 0.0017 | 830 | 180 | 920 | 2.25 | 1.71 | present invention |
| 61 | 0.0025 | 2.78 | 0.15 | 0.021 | 0.0002 | 0.31 | 0.0030 | 0.0080 | 0.0020 | 830 | 180 | 920 | 2.31 | 1.71 | present invention |
| 62 | 0.0020 | 3.00 | 0.18 | 0.021 | 0.0002 | 0.10 | 0.0040 | tr. | 0.0015 | 830 | 180 | 920 | 2.25 | 1.71 | present invention |
| 63 | 0.0021 | 2.50 | 0.18 | 0.021 | 0.0002 | 0.60 | 0.0040 | tr. | 0.0016 | 830 | 180 | 920 | 2.23 | 1.71 | present invention |
| 64 | 0.0022 | 2.80 | 0.18 | 0.022 | 0.0030 | 0.31 | tr. | tr. | 0.0018 | 830 | 180 | 920 | 3.40 | 1.71 | Comparative steel |
| 65 | 0.0018 | 2.82 | 0.18 | 0.022 | 0.0030 | 0.32 | 0.0035 | tr. | 0.0016 | 830 | 180 | 920 | 3.37 | 1.71 | Comparative steel |
| 66 | 0.0022 | 2.80 | 0.18 | 0.018 | 0.0002 | 0.31 | tr. | tr. | 0.0026 | 830 | 180 | 920 | 2.45 | 1.71 | Comparative steel |
| 67 | 0.0025 | 2.80 | 0.18 | 0.020 | 0.0002 | 0.32 | 0.0700 | tr. | 0.0015 | 830 | 180 | 920 | 2.40 | 1.71 | Comparative steel |
| 68 | 0.0060 | 2.85 | 0.19 | 0.021 | 0.0004 | 0.30 | 0.0040 | tr. | 0.0015 | 830 | 180 | 920 | 2.45 | 1.69 | Comparative steel |
| 69 | 0.0018 | 2.85 | 1.30 | 0.021 | 0.0004 | 0.30 | 0.0040 | tr. | 0.0017 | 830 | 180 | 920 | 2.60 | 1.66 | Comparative steel |
| 70 | 0.0021 | 2.30 | 0.19 | 0.025 | 0.0004 | 1.60 | 0.0040 | tr. | 0.0015 | 830 | 180 | 920 | 2.20 | 1.65 | Comparative steel |
| 71 | 0.0022 | 2.85 | 0.19 | 0.018 | 0.0004 | 0.30 | 0.0040 | tr. | 0.0060 | 830 | 180 | 920 | 2.5O | 1.69 | Comparative steel |
| 72 | 0.0022 | 4.20 | 0.19 | 0.025 | 0.0004 | 0.30 | 0.0040 | tr. | 0.0015 | 830 | 180 | 920 | 2.20 | 1.63 | Comparative steel |

For the purpose of investigating the stable productivity of the steel according to the present invention, a steel with a composition of 0.0025% of C, 2.85% of Si, 0.20% of Mn, 0.01% of P, 0.31% of Al, 0.0021% of N, 0.0003% of S and 40 ppm of Sb was melted followed by washing with an acid solution after hot rolling. The hot-rolled sheet was subsequently annealed in an atmosphere of 75% $H_2$-25% $N_2$ at 830° C. for 3 hours. Then, the hot-rolled sheet was cold-rolled to a sheet thickness of 0.5 mm followed by a finish annealing in an atmosphere of 25% $H_2$-75% $N_2$at 900° C. for 1 min. The result indicated that the iron loss values were largely dispersed between 2.2 to 2.6 W/kg.

To investigate the reasons of the above result, a thin film was prepared from the sample after the finish annealing to observe by TEM. While no fine precipitates were observed in the sample with low iron loss, TiN grains with a grain size of about 50 nm were observed in the sample with high iron loss. This result indicates that the cause of dispersion in the iron loss might be due to precipitation of fine TiN grains.

Figure 9:
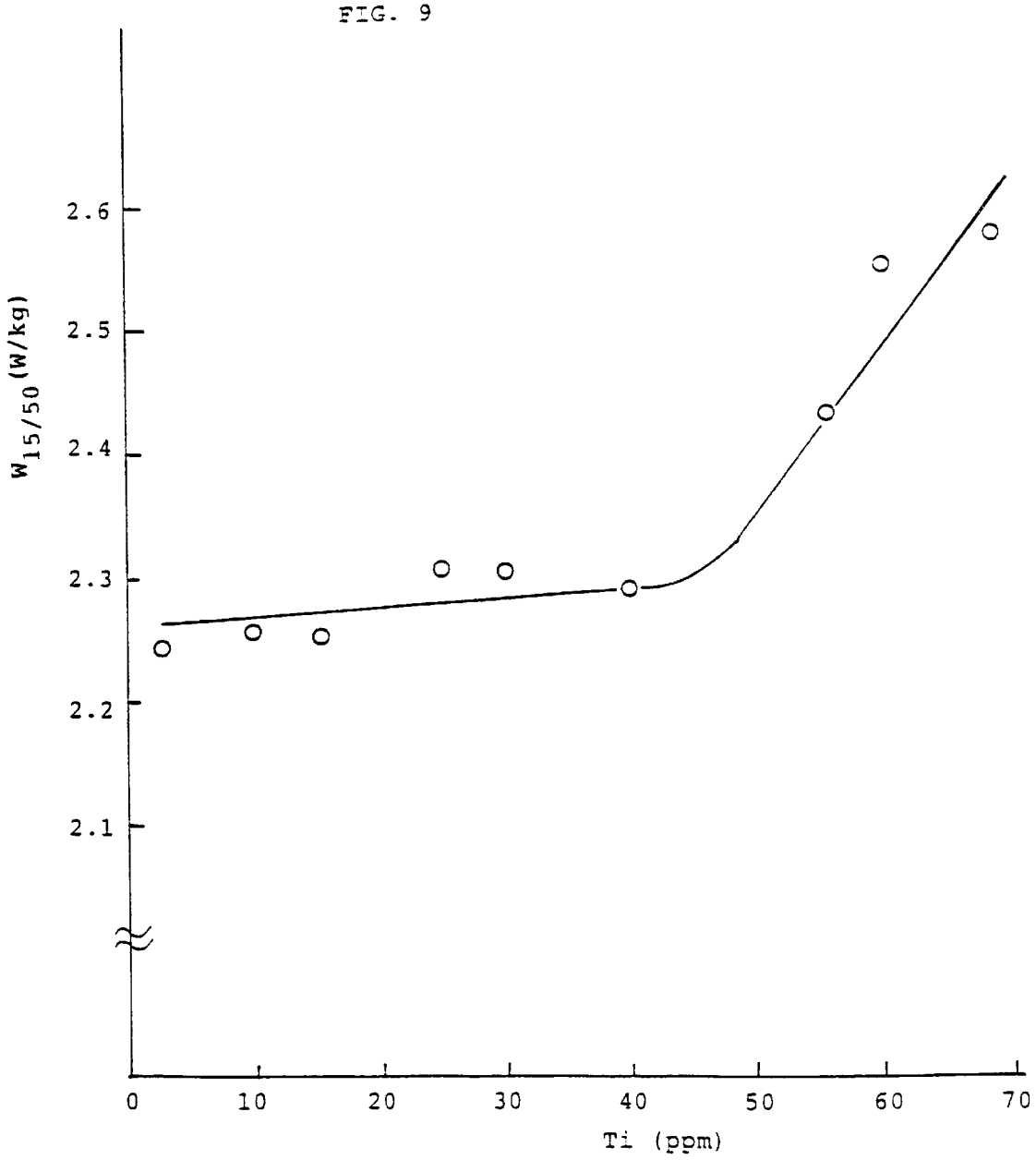
FIG. 9 is a graph indicating the relation between the Ti content and iron loss after the finish annealing.

To investigate the effect of Ti on the grain growth, a steel with a composition of 0.0015% of C, 2.87% of Si, 0.20% of Mn, 0.01% of P, 0.31% of Al, 0.0021% of N, 0.0003% of S and 40 ppm of Sb, with a varying amount of Ti, was melted in the laboratory followed by washing with an acid solution after hot-rolling. This hot-rolled sheet was subsequently annealed in an atmosphere of 75% $H_2$-25% $N_2$ at 830° C. for 3 hours. After a cold-rolling to a sheet thickness of 0.5 mm, the sheet was subjected to a finish annealing in an atmosphere 25% $H_2$-75% $N_2$ at 900° C. for 1 minute. FIG. 9 shows the relation between the Ti content in the sample and iron loss $W_{15/50}$ after the finish annealing.

It can be comprehended that the iron loss $W_{15/50}$ becomes 2.35 W/kg or less when the Ti content is 50 ppm or less from FIG. 9, indicating that steels with a stable iron loss can be obtained.

Accordingly, the Ti content is limited to 50 ppm or less, more preferably to 20 ppm or less.

Accordingly, the investigators have intensively studied the method for further decreasing the iron loss by suppressing nitride formation, thereby finding that the iron loss of the material containing a trace amount of S can be largely decreased by adding at least one element selected from the group consisting of Se and Te in an amount of 0.0005 to 0.01%.

The Reason Why the Contents of S, Se and Te are Limited

The present invention will be described in more detail referring to the experimental results.

For the purpose of investigating the effect of S on the iron loss, a steel with a composition of 0.0025% of C, 2.85% of Si, 0.20% of Mn, 0.01% of P and 0.31% of Al, with a varying amount of S from trace to 15 ppm, was melted in the laboratory followed by washing with an acid solution after hot-rolling. This hot-rolled sheet was subsequently annealed in an atmosphere of 75% $H_2$-25% $N_2$ at 830° C. for 3 hours. The sheet was then cold-rolled to a sheet thickness of 0.5 mm, followed by a finish annealing in an atmosphere of 10% $H_2$-90% $N_2$ at 900° C. for 1 minute.

TABLE 4

| No. | C | Si | Mn | P | S | Al | Ti | Sb | N |
|---|---|---|---|---|---|---|---|---|---|
| 73 | 0.0020 | 2.85 | 0.20 | 0.018 | 0.0002 | 0.31 | tr. | 0.0040 | 0.0013 |
| 74 | 0.0020 | 2.79 | 0.17 | 0.021 | 0.0002 | 0.31 | 0.0040 | 0.0040 | 0.0013 |
| 75 | 0.0023 | 2.78 | 0.20 | 0.023 | 0.0002 | 0.30 | 0.0060 | 0.0040 | 0.0018 |

| No. | Hot-roll plate annealing temperature (° C.) | Hot-roll plate annealing time (min) | Finish annealing temperature (° C.) × 1 min | W15/50 (W/kg) | B50 (T) | Note |
|---|---|---|---|---|---|---|
| 73 | 830 | 180 | 920 | 2.24 | 1.72 | Steel of the present invention |
| 74 | 830 | 180 | 920 | 2.32 | 1.71 | Steel of the present invention |
| 75 | 830 | 180 | 920 | 2.55 | 1.71 | Comparative steel (Ti out of the range) |

Embodiment 2

The crucial point of the present invention is that, in the material containing a trace amount of S of 10 ppm or less, the iron loss of the non-oriented electromagnetic steel sheet can be largely reduced by allowing either Se or Te or both of them to contain in a range of the total concentration of 0.0005 to 0.01%.

The foregoing problem can be solved by a non-oriented electromagnetic steel sheet with a low iron loss characterized by containing, in % by weight, 0.005% or less of C, 4.0% or less of Si, 0.05 to 1.0% of Mn, 0.2% or less of P, 0.005% or less (including zero) of N, 0.1 to 1.0% of Al, 0.001% or less (including zero) of S and 0.0005 to 0.01% of at least one element selected from the group consisting of Se and Te, with a substantial balance of Fe.

A low iron loss value can be obtained by limiting the content of at least one element selected from the group consisting of Se and Te to 0.0005 to 0.002%.

The phrase of "a substantial balance of Fe" as used herein means that the steel to which trace amount of elements other than inevitable impurities are added in a range not interfering the effect of the present invention is within the scope of the present invention.

Procedure of the Invention

The investigators of the present invention investigated the detailed causes of inhibition of iron loss decrease in the material containing trace amount of S of 10 ppm or less. It was made clear from the result that notable nitride layers were formed on the surface layer of the steel, indicating that this nitride layer interferes reduction of the iron loss.

Figure 10:
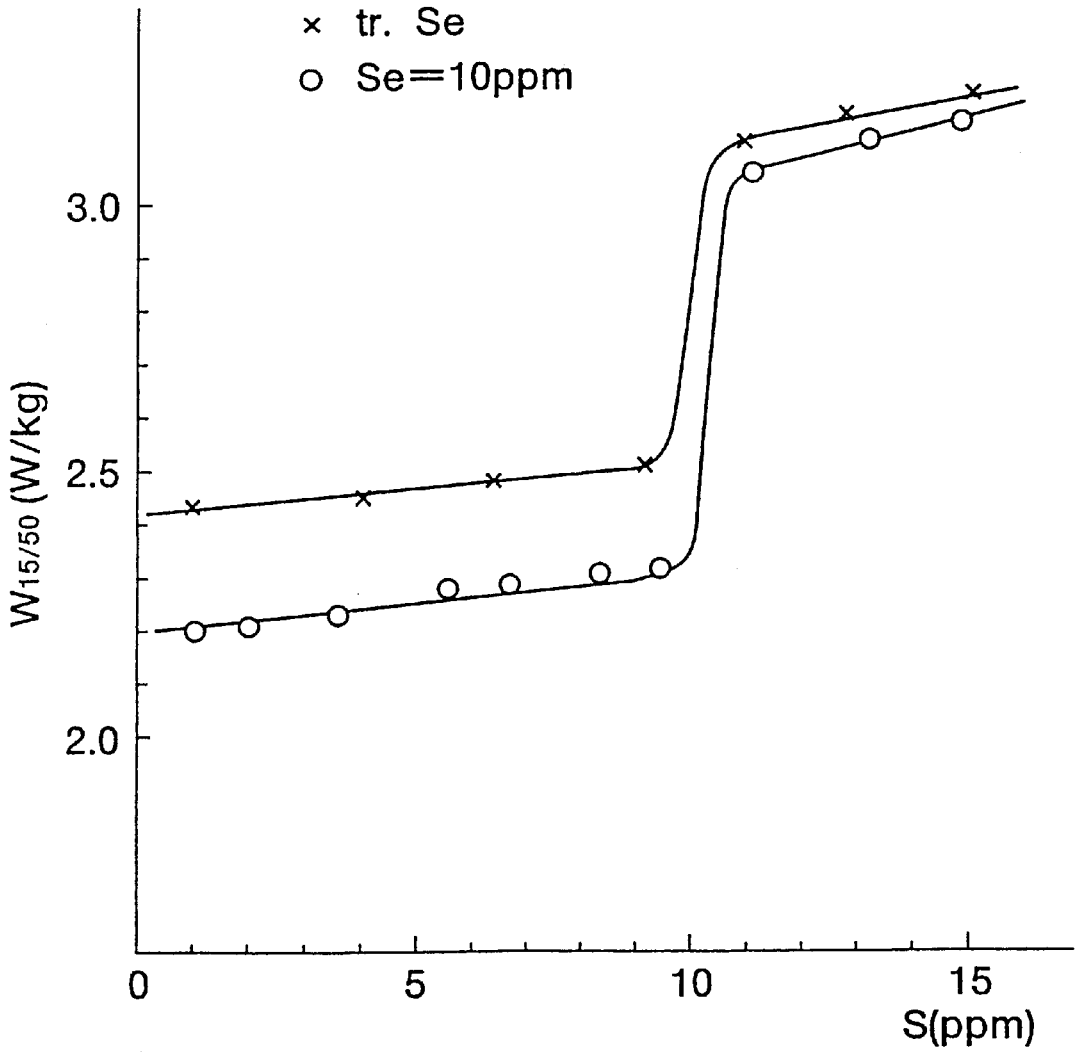
FIG. 10 is a graph indicating the relation between the S content and iron loss after the finish annealing.

FIG. 10 shows the relation between the S content of the sample thus obtained and the iron loss $W_{15/50}$ (the mark × in the figure). It can be understood from FIG. 10 that a large decrease in the iron loss, i.e., $W_{15/50}$=2.5 W/kg, was attained when the S content is adjusted to 10 ppm or less. This is because the grains were allowed to be well developed by decreasing the S content.

By the reason above, the S content is limited to 10 ppm or less, desirably to 5 ppm or less, in the present invention.

However, when the S content has decreased to 10 ppm or less, reduction rate of the iron loss becomes so slow that its value finally reaches to only 2.4 W/kg even when the S content is further decreased.

The investigators supposed that the reason why decrease of the iron loss is inhibited in the material containing a trace amount of S of 10 ppm or less may be due to unknown causes other than MnS, and observed the tissue under an optical microscope to find remarkable nitride layers on the steel surface layer in the S content range of 10 ppm or less. On the contrary, the nitride layers were rarely found in the sample with the S indent of more than 10 ppm. This nitride layer is supposed to be formed at the time of annealing and finish annealing the hot-rolled sheet carried out in a nitrogen atmosphere.

The reason why the nitride-forming reaction is accelerated with the decrease of S content may be as follows: Since S is an element liable to be concentrated at the surface and grain boundaries, S concentration is high at the surface layer of the steel sheet in the S content region of more than 10 ppm, thereby suppressing absorption of nitrogen at the time of annealing and finish annealing of the hot-rolled sheet. The suppressing effect for nitrogen absorption by S is reduced, on the other hand, in the S content region 10 ppm or less.

The investigators suspected that the prominent nitride layer in the material containing a trace amount of S might be preventing crystal grain growth on the surface layer of the steel sheet thereby suppressing decrease in the iron loss. Based on this concept, the investigators had an idea that the iron loss in the material containing a trace amount of S could be further reduced if elements capable of suppressing nitrogen absorption and being not liable to inhibit good grain growth in the material containing a trace amount of S are allowed to contain in the material. As a result of intensive studies, we found that a trace amount of Se is effective.

The sample in which 10 ppm of Se is added in addition to the components of the foregoing sample denoted by a mark × was tested under the same condition as described previously. The results are shown in FIG. 10. Let the effect of Se for decreasing the iron loss be noticed. While the iron loss is decreased by only 0.02 to 0.04 W/kg by the addition of Se in the sample containing more than 10 ppm of S, the iron loss is decreased by about 0.20 W/kg by the addition of Se in the sample containing 10 ppm or less of S. Therefore, the effect of Se for decreasing the iron loss is evident when the S content is small.

No nitride layers were observed in this sample irrespective of the S content. This is because Se is concentrated on the surface layer of the steel sheet to suppress absorption of nitrogen.

To investigate the optimum amount of addition of Se, a steel with a composition of 0.0026% of C, 2.70% of Si, 0.20% of Mn, 0.020% of P, 0.30% of Al, 0.0004% of S and 0.0020% of N, with a varying concentration of Se in the range of trace to 130 ppm, was melted in the laboratory followed by washing with an acid solution after hot-rolling. This hot-rolled sheet was subsequently annealed in an atmosphere of 75% $H_2$-15% $N_2$ at 830° C. for 3 hours. Then, the sheet was cold-rolled to a sheet thickness of 0.5 mm followed by a finish annealing in an atmosphere of 10% $H_2$-90% $N_2$ at 900° C. for 1 minute.

Figure 11:
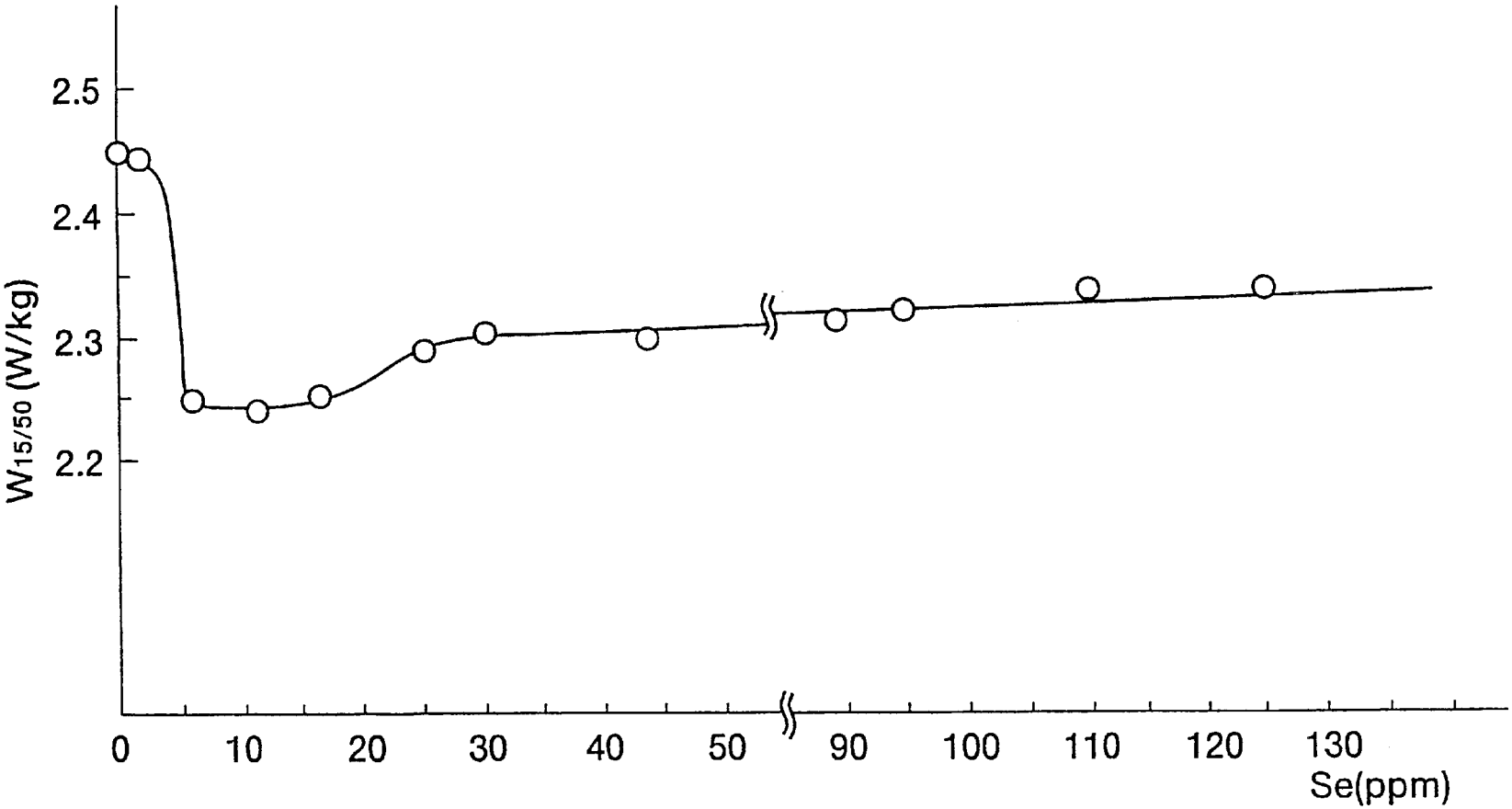
FIG. 11 is a graph indicating the relation between the Se content and iron loss after the finish annealing.

FIG. 11 shows the relation between the Se content and the iron loss $W_{15/50}$. It is evident from FIG. 11 that the iron loss decreases in the area of Se addition of 5 ppm or more, attaining a $W_{15/50}$ value of 2.25 W/kg that is a value never obtained in the conventional electromagnetic steel sheet with a (Si+Al) content of 3 to 3.5%. It is also evident that the iron loss starts to increase again when Se is further added to a content of more than 20 ppm.

For the purpose of investigating the reason why the iron loss has increased in the area of Se>20 ppm, the sample was observed under an optical microscope. The result revealed that, while no fine grain texture was found on the surface layer, the mean crystal grain size was a little smaller. This is because, though not certain, the grain growth had been deteriorated due to a grain boundary drag effect of Se because Se is liable to sediment at the grain boundaries.

When Se is added up to 130 ppm, the iron loss value is lower than value of the steel not containing Se. Accordingly, the Se content is adjusted to 5 ppm or more and its upper limit is defined to 100 ppm from the economical point of view. The desirable content is 5 ppm or more and 20 ppm or less for keeping the iron loss value low.

The same effect for decreasing the iron loss was also observed when Te was added. Therefore, the amount of addition of Te is, as in Se, limited to 5 ppm or more, the upper limit being 100 ppm from the economical point of view. The desirable content is 5 ppm or more and 20 ppm or less for keeping the iron loss value low.

Similar effects of simultaneous addition of Se and Te were also confirmed. Accordingly, the combined amount of addition of Se and Te was limited to 5 ppm or more, the upper limit being 100 ppm from the economical point of view. The desirable content is 5 ppm or more and 20 ppm or less for keeping the iron loss low.

The Reason Why the Contents of Other Components are Limited

The reason will be described hereinafter.

C: The C content was limited to 0.005% or less due to magnetic aging.

Si: While Si is an effective element for enhancing the inherent specific resistivity, the magnetic flux density is decreased with the decrease of the saturation magnetic flux density when the content exceeds 4.0%. Therefore, the upper limit was determined to be 4.0%.

Mn: Although 0.05% or more of Mn is required for preventing red brittleness at hot-rolling, the magnetic flux density is decreased when the content is 1.0% or more. Accordingly, the Mn content is limited in the range of 0.05 to 1.0%.

P: P is an essential element for improving punching property. However, since the steel sheet becomes fragile when Mn is added in excess of 0.2%, the content is limited to 0.2% or less.

N: When N is contained in a large amount, a lot of AlN is precipitated to increase the iron loss. Therefore, the content is limited to 0.005% or less.

Al: While Al is essential for increasing the inherent resistivity, a content of more than 1.0% makes the magnetic flux density to decrease with the decrease of the saturation magnetic flux density. Therefore, its upper limit was determined to be 1.0%. The lower limit was determined to be 0.1% because fine AlN grains are formed to deteriorate crystal grain growth when the content is less than 0.1%.

Production Method

Conventional methods for producing the non-oriented electromagnetic steel sheet may be applied in the present invention provided the contents of S, Se and Te be in a given range. The molten steel refined in a converter is de-gassed to adjust to a prescribed composition, followed by subjecting to casting and hot-rolling. The finish annealing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing.

Example

By using a steel listed in Table 5, the steel was subjected to casting after adjusting it to a given composition by applying a de-gassing treatment after refining in the converter. The steel was hot-rolled to a sheet thickness of 2.0 mm after heating the slab at a temperature of 1200° C. for 1 hour. The finishing temperature of the hot-rolled sheet was 800° C. while the coiling temperature was 800° C. for No. 1 to No. 6 steel sheet and 550° C. for the other steel sheets. Annealing treatments of the hot-rolled sheet under the conditions listed in Table 6 were applied to the steel sheet No. 7 to 35. The sheets were cold-rolled to a sheet thickness of 0. 5 mm followed by annealing under the finish annealing conditions listed in Table 6. The sheets with the same No.'s in Table 5 and Table 6 corresponds to the same steel sheet. The annealing atmosphere of the hot-rolled sheet and finish annealing atmosphere were 75% $H_2$-25% $N_2$ and 10% $H_2$-90% $N_2$, respectively.

The magnetic properties were measured using 25 cm Epstein test pieces. The magnetic properties of each steel sheet is also shown in Table 6.

The Si levels of the samples No. 1 to 6, No. 7 to 11 and No. 12 to 35 are 1.0 to 1.1%, 1.8 to 1.9% and 2.7 to 3.0% (with a small number of exceptions), respectively. When the samples with the same level of Si content are compared with each other, it is evident that the steel according to the present invention has a lower iron loss $W_{15/50}$ compared with the comparative steels.

The results above indicate that a steel sheet with a very low iron loss after the finish annealing can be obtained when the contents of S, Se and Se in the composition of the steel sheet according to the present invention are controlled.

The S and (Se+Te) contents in the steel sheet No. 4, S content in the steel sheet No. 5 and (Se+Te) content in the steel sheet No. 6 are all out of the range of the present invention. Therefore, their iron loss values $W_{15/50}$ are high.

Similarly, the S and (Se+Te) contents in the steel sheet No. 10, (Se+Te) content in the steel sheet No. 11 are out of the range of the present invention, showing high iron loss values $W_{15/50}$.

Furthermore, S and (Se+Te) contents in the steel sheet No. 27, S content in the steel sheet No. 28 and (Se+Te) content in the steel sheet No. 29 and 30 are all out of the range of the present invention. Therefore, their iron loss values $W_{15/50}$ are high.

The steel sheet No. 31 has a problem in the magnetic aging because the C content exceeds the range of the present invention.

The steel sheet No. 32 has a low iron loss $W_{15/50}$ but the magnetic flux density is small because the Si content exceeds the range of the present invention.

The magnetic flux density $B_{50}$ of the steel sheet No. 33 is small because the Mn content exceeds the range of the present invention.

The steel sheet No. 34 has a low iron loss $W_{15/50}$ but the magnetic flux density is small because the Al content exceeds the range of the present invention.

The steel sheet No. 35 has a large iron loss $W_{15/50}$ because the N content exceeds the range of the present invention.

TABLE 5

| No. | C | Si | Mn | P | S | Al | Se | Te | N |
|---|---|---|---|---|---|---|---|---|---|
| 1 | 0.0019 | 1.07 | 0.21 | 0.020 | 0.0004 | 0.30 | 0.0006 | tr. | 0.0023 |
| 2 | 0.0022 | 1.08 | 0.19 | 0.021 | 0.0004 | 0.29 | 0.0010 | tr. | 0.0024 |
| 3 | 0.0022 | 1.05 | 0.18 | 0.025 | 0.0004 | 0.30 | 0.0050 | tr. | 0.0018 |
| 4 | 0.0020 | 1.03 | 0.21 | 0.020 | 0.0020 | 0.31 | tr. | tr. | 0.0020 |
| 5 | 0.0018 | 1.05 | 0.22 | 0.020 | 0.0020 | 0.30 | 0.0010 | tr. | 0.0021 |
| 6 | 0.0017 | 1.10 | 0.20 | 0.018 | 0.0004 | 0.30 | tr. | tr. | 0.0022 |
| 7 | 0.0025 | 1.83 | 0.21 | 0.020 | 0.0004 | 0.30 | 0.0005 | tr. | 0.0018 |
| 8 | 0.0018 | 1.86 | 0.19 | 0.018 | 0.0004 | 0.29 | 0.0015 | tr. | 0.0019 |
| 9 | 0.0025 | 1.85 | 0.18 | 0.020 | 0.0004 | 0.30 | 0.0040 | tr. | 0.0016 |
| 10 | 0.0022 | 1.86 | 0.22 | 0.020 | 0.0020 | 0.30 | tr. | tr. | 0.0015 |
| 11 | 0.0022 | 1.85 | 0.20 | 0.024 | 0.0004 | 0.30 | tr. | tr. | 0.0016 |
| 12 | 0.0022 | 2.85 | 0.19 | 0.023 | 0.0002 | 0.32 | 0.0005 | tr. | 0.0021 |
| 13 | 0.0022 | 2.85 | 0.19 | 0.018 | 0.0002 | 0.30 | 0.0010 | tr. | 0.0022 |
| 14 | 0.0022 | 2.78 | 0.18 | 0.021 | 0.0002 | 0.31 | 0.0018 | tr. | 0.0017 |
| 15 | 0.0025 | 2.80 | 0.18 | 0.020 | 0.0002 | 0.32 | 0.0025 | tr. | 0.0015 |
| 16 | 0.0018 | 2.80 | 0.18 | 0.020 | 0.0002 | 0.32 | 0.0050 | tr. | 0.0020 |
| 17 | 0.0025 | 2.80 | 0.18 | 0.020 | 0.0002 | 0.32 | 0.0080 | 0.0005 | 0.0017 |
| 18 | 0.0020 | 2.85 | 0.19 | 0.023 | 0.0002 | 0.30 | tr. | 0.0012 | 0.0023 |
| 19 | 0.0018 | 2.85 | 0.19 | 0.018 | 0.0002 | 0.30 | tr. | 0.0030 | 0.0020 |
| 20 | 0.0017 | 2.78 | 0.17 | 0.021 | 0.0007 | 0.31 | tr. | 0.0050 | 0.0015 |
| 21 | 0.0019 | 2.75 | 0.18 | 0.021 | 0.0002 | 0.31 | tr. | 0.0070 | 0.0020 |
| 22 | 0.0022 | 2.78 | 0.15 | 0.021 | 0.0002 | 0.31 | tr. | 0.0005 | 0.0023 |
| 23 | 0.0020 | 2.78 | 0.15 | 0.021 | 0.0002 | 0.31 | 0.0005 | 0.0020 | 0.0017 |
| 24 | 0.0025 | 2.78 | 0.15 | 0.021 | 0.0002 | 0.31 | 0.0020 | tr. | 0.0020 |
| 25 | 0.0020 | 3.00 | 0.18 | 0.021 | 0.0002 | 0.10 | 0.0015 | tr. | 0.0015 |
| 26 | 0.0021 | 2.50 | 0.18 | 0.021 | 0.0002 | 0.60 | 0.0015 | tr. | 0.0016 |
| 27 | 0.0025 | 2.81 | 0.18 | 0.022 | 0.0030 | 0.31 | tr. | tr. | 0.0018 |
| 28 | 0.0018 | 2.82 | 0.18 | 0.022 | 0.0030 | 0.32 | 0.0015 | tr. | 0.0017 |
| 29 | 0.0022 | 2.82 | 0.18 | 0.018 | 0.0002 | 0.31 | tr. | tr. | 0.0020 |
| 30 | 0.0025 | 2.80 | 0.18 | 0.020 | 0.0002 | 0.32 | 0.0050 | tr. | 0.0015 |
| 31 | 0.0060 | 2.85 | 0.19 | 0.021 | 0.0004 | 0.33 | 0.0015 | tr. | 0.0015 |
| 32 | 0.0020 | 4.20 | 0.19 | 0.025 | 0.0004 | 0.30 | 0.0015 | tr. | 0.0015 |
| 33 | 0.0025 | 2.85 | 1.30 | 0.021 | 0.0004 | 0.30 | 0.0015 | tr. | 0.0017 |
| 34 | 0.0021 | 2.30 | 0.19 | 0.025 | 0.0004 | 1.60 | 0.0015 | tr. | 0.0015 |
| 35 | 0.0022 | 2.85 | 0.19 | 0.018 | 0.0004 | 0.30 | 0.0015 | tr. | 0.0060 |

TABLE 6

| No. | Annealing of hot-rolled sheet temperature (° C.) | Annealing of hot-rolled sheet time (min) | Finish annealing temperature (° C.) × 1 min | W15/50 (W/kg) | B50 (T) | Note |
|---|---|---|---|---|---|---|
| 1 | — | — | 840 | 3.38 | 1.74 | Steel of the present invention |
| 2 | — | — | 840 | 3.35 | 1.74 | Steel of the present invention |
| 3 | — | — | 840 | 3.42 | 1.74 | Steel of the present invention |
| 4 | — | — | 840 | 4.30 | 1.74 | Comparative steel (S, Se + Te out of the range) |
| 5 | — | — | 840 | 4.28 | 1.74 | Comparative steel (S out of the range) |
| 6 | — | — | 840 | 3.61 | 1.74 | Comparative steel (Se + Te out of the range) |
| 7 | 770 | 180 | 900 | 2.43 | 1.72 | Steel of the present invention |
| 8 | 770 | 180 | 900 | 2.41 | 1.72 | Steel ofthe present invention |
| 9 | 770 | 180 | 900 | 2.48 | 1.72 | Comparative steel (S, Se + Te out of the range) |
| 10 | 770 | 180 | 900 | 3.62 | 1.72 | Comparative steel (Se + Te out of the range) |
| 11 | 770 | 180 | 900 | 2.66 | 1.72 | Steel of the present invention |
| 12 | 900 | 3 | 920 | 2.26 | 1.71 | Steel of the present invention |
| 13 | 830 | 180 | 920 | 2.24 | 1.71 | Steel of the present invention |
| 14 | 830 | 180 | 920 | 2.24 | 1.71 | Steel of the present invention |
| 15 | 830 | 180 | 920 | 2.30 | 1.71 | Steel of the present invention |
| 16 | 830 | 180 | 920 | 2.31 | 1.71 | Steel of the present invention |
| 17 | 830 | 180 | 920 | 2.32 | 1.71 | Steel of the present invention |
| 18 | 830 | 3 | 920 | 2.25 | 1.71 | Steel of the present invention |
| 19 | 830 | 180 | 920 | 2.24 | 1.71 | Steel of the present invention |
| 20 | 830 | 180 | 920 | 2.30 | 1.71 | Steel of the present invention |
| 21 | 830 | 180 | 920 | 2.32 | 1.71 | Steel of the present invention |
| 22 | 830 | 180 | 920 | 2.33 | 1.71 | Steel of the present invention |
| 23 | 830 | 180 | 920 | 2.24 | 1.71 | Steel of the present invention |
| 24 | 830 | 180 | 920 | 2.31 | 1.71 | Steel of the present invention |
| 25 | 830 | 180 | 920 | 2.25 | 1.71 | Steel of the present invention |
| 26 | 830 | 180 | 920 | 2.23 | 1.71 | Steel of the present invention |
| 27 | 830 | 180 | 920 | 3.41 | 1.71 | Comparative steel (S, Se + Te out of the range) |
| 28 | 830 | 180 | 920 | 3.38 | 1.71 | Comparative steel (S out of the range) |
| 29 | 830 | 180 | 920 | 2.46 | 1.71 | Comparative steel (Se + Te out of the range) |
| 30 | 830 | 180 | 920 | 2.35 | 1.71 | Comparative steel (Se + Te out of the range) |
| 31 | 830 | 180 | 920 | 2.46 | 1.69 | Comparative steel (C out of the range) |
| 32 | 830 | 180 | 920 | 2.22 | 1.63 | Comparative steel (Si out of the range( |
| 33 | 830 | 180 | 920 | 2.62 | 1.66 | Conparative steel (Mn Out of the range) |
| 34 | 830 | 180 | 920 | 2.21 | 1.65 | Comparative steel (Al out of the range) |
| 35 | 830 | 180 | 920 | 2.50 | 1.69 | Comparative steel (N out of the range) |

Embodiment 3

The crucial point of the present invention is to obtain an electromagnetic steel sheet with a high magnetic flux density and low iron loss in a wide frequency region required in electric car motors by adjusting the thickness of a steel sheet, in which the S content is adjusted to 0.001% or less and a given amount Sb or Sn is added, to 0.1 to 0.35 mm.

The problem described above can be solved by an electromagnetic steel sheet with a thickness of 0.1 to 0.35 mm containing, in % by weight, 0.005% or less of C, 1.5 to 3.0% of Si, 0.05 to 1.5% by weight of Mn, 0.2% or less of P, 0.005% or less (including zero) of N and 0.1 to 1.0% of Al, 3.5% or less of (Si+Al), 0.001% or less of S (including zero) and 0.001 to 0.05% of (Sb+Sn/2), with a substantial balance of Fe.

In addition, lower iron loss values can be also obtained by limiting the (Sb+Sn/2) content in the range of 0.001 to 0.005%.

The phrase of "a substantial balance of Fe" as used herein means that the steel to which trace amount of elements other than inevitable impurities are added in a range not interfering the effect of the present invention is within the scope of the present invention.

In the following description, "%" representing the composition of the steel refers to "% by weight", "ppm" to "ppm by weight" as well.

Procedure of the Invention

To investigate the effect of the S content on the iron loss at first, the investigators of the present invention melted a steel with a composition of 0.0026% of C, 2.80% of Si, 0.21% of Mn, 0.01% of P, 0.32% of Al and 0.0015% of N, with varying amount of S from trace to 15 ppm, in vacuum in the laboratory, followed by an annealing of the hot-rolled sheet in an atmosphere of 75% $H_2$-25% $N_2$ at 830° C. for 3 hours after a hot rolling and washing with an acid solution.

Subsequently, this hot-rolled and annealed sheet was cold-rolled to a sheet thickness of 0.5 and 0.35 mm, followed by a finish annealing in an atmosphere of 10% $H_2$-90% $N_2$ at 900° C. for 2 minutes. Magnetic properties were measured by a 25 cm Epstein method.

Figure 12:
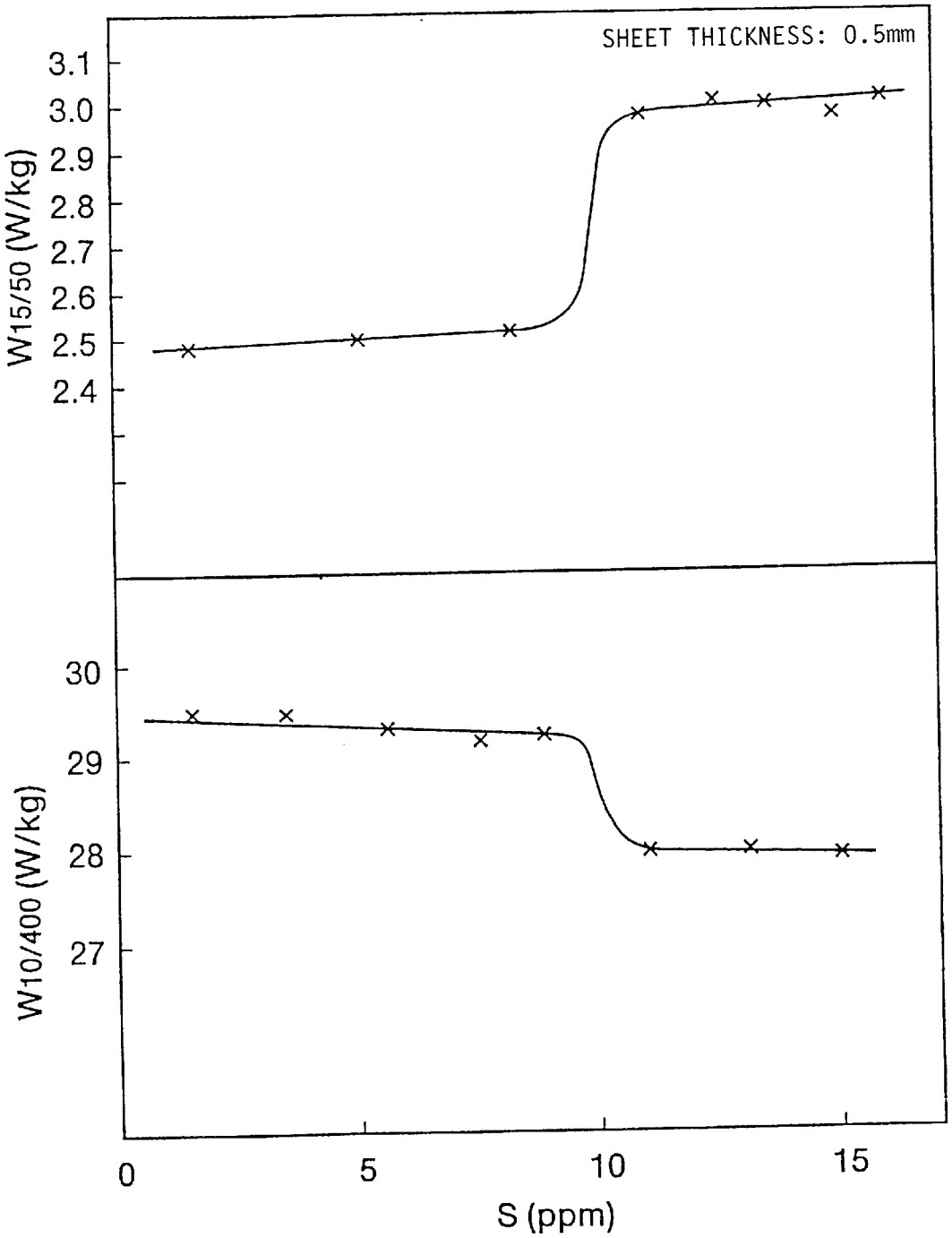
FIG. 12 is a graph indicating the relation between the S content and iron loss after the finish annealing in a steel sheet with a thickness of 0.5 mm.

Since a high torque is usually required at a low frequency region of around 50 Hz in an electric car, the steel sheet is magnetized at about 1.5T. Not so high torque is necessary at a high frequency region of about 400 Hz that the steel sheet may be magnetized at about 1.0T. Therefore, the iron loss $W_{15/50}$ when the sheet was magnetized to 1.5T was evaluated at a frequency of 50 Hz while the iron loss $W_{15/50}$ when magnetized to 1.0T was used for evaluation at a frequency of 400 Hz. FIG. 12 shows the relation between the S content of a material with a thickness of 0.5 mm and iron loss $W_{15/50}$.

FIG. 12 indicates that the iron loss $W_{15/50}$ at 50 Hz in the material with a thickness of 0.5 mm is largely decreased when the S content is less than 10 ppm.

The iron $W_{15/50}$ loss at 400 Hz is, on the contrary, largely increased when the S content is lowered. To investigate the cause of this iron loss changes accompanied by the decrease of the S content, the texture of the material was observed under an optical microscope. The result revealed that crystal grains were coarsened when the S content is 0.001% or less.

This is probably because the content of MnS in the steel had been decreased.

From this texture change, the S content dependency of the iron loss at frequencies of 50 Hz and 400 Hz can be comprehended as follows:

Generally, the iron loss is classified into two categories of hysteresis loss and eddy current loss. It is known that hysteresis loss is decreased while eddy current loss is increased when the crystal grain diameter is increased. Since the hysteresis loss is a predominant factor at a frequency of 50 Hz, decrease in S content and accompanying coarsening of crystal grains will cause a decrease in hysteresis loss, thereby the iron loss is decreased. However, since the eddy current loss is predominant at a frequency of 400 Hz, the eddy current loss is increased due to decrease of the S content and accompanying coarsening of crystal grains to increase the iron loss.

From the discussions above, it can be concluded that, while decreasing the S content in the material with a thickness of 0.5 mm is effective for decreasing the iron loss at low frequency regions, it has an inverse effect for reduction of the iron loss at high frequency regions.

Figure 13:
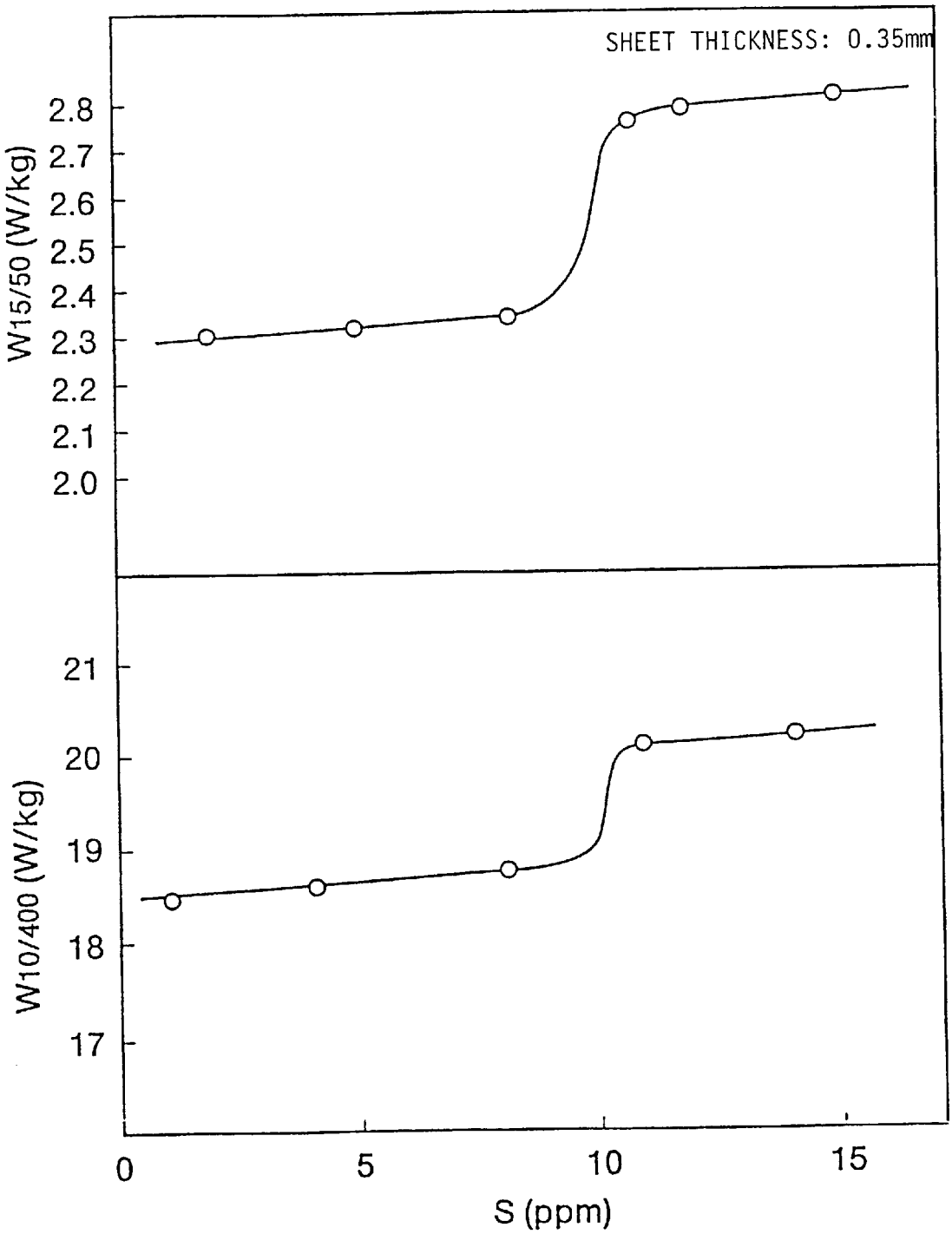
FIG. 13 is a graph indicating the relation between the S content and iron loss after the finish annealing in a steel sheet with a thickness of 0.35 mm.

FIG. 13 shows the relation between the S content in the material with a thickness of 0.35 mm and iron loss. The figure indicate that the iron loss $W_{15/50}$ of the material with a thickness of 0.35 mm at a frequency of 50 Hz is, as in the material with a thickness of 0.5 mm, largely decreased when the S content is 10 ppm or less.

However, different from the result in the material with a thickness of 0.5 mm, the iron loss $W_{15/50}$ at 400 Hz is also decreased when the S content is lowered. This is because, since the eddy current loss in the material with a thickness of 0.35 mm is largely decreased as compared with that of the material with a thickness of 0.5 mm due to reduced sheet thickness, reduction of the hysteresis loss as a result of coarsening of crystal grain size causes a decrease of total iron loss.

It is made clear from the above discussions that reduction of the S content in the sheet with a thickness of 0.35 mm allows the iron loss to be reduced in the high to low frequency regions. Accordingly, the S content and sheet thickness are limited to 10 ppm or below and 0.35 mm or less, respectively.

Reduction in the iron loss in the high to low frequency regions with the decrease of S content was more evident as the sheet thickness became thinner in the electromagnetic steel sheet with a thickness of 0.35 mm or less. However, when the sheet thickness is less than 0.1 mm, applying a cold rolling becomes so difficult along with burdening clients with much labor for laminating the steel sheets. Accordingly, the film thickness is limited to 0.1 mm or more in the present invention.

The method how the iron loss can be more diminished in the material with a thickness of 0.35 mm was further investigated.

It is usually effective for decreasing the iron loss to increase the Si and Al content in order to increase the inherent resistivity. However, increments in the Si content and Al content in electric car motors are not desirable because decrease of torque is caused. Therefore, some methods other than increasing the Si and Al contents were investigated.

As shown in FIG. 13, the decrease rate of the iron loss is slowed when the S content is 10 ppm or less, finally reaching to an iron loss level of 2.3 W/kg in $W_{15/50}$ and 18.5 W/kg in $W_{10/400}$.

On the assumption that decrease of the iron loss in a material containing trace amount of S of 10 ppm or less might be inhibited by some unknown factors other than MnS, the investigators of the present invention observed the texture of the material under an optical microscope. The result indicated that notable nitride layers were found on the surface layer of the steel in the S content region of 10 ppm or less, whereas few nitride layers were formed in the S content region of more than 10 ppm. This nitride layer is supposed to be formed during annealing and finish annealing of the hot-rolled sheet.

The reason why the nitride forming reaction was accelerated with the decrease of S content may be as follows: Since S is an element liable to be concentrated on the surface and at grain boundaries, concentrated S on the surface of the steel sheet suppresses absorption of nitrogen during annealing in the S content region of more than 10 ppm. In the S content region of 10 ppm or less, on the other hand, the suppression effect for nitrogen absorption due to the presence of S may be decreased.

The investigators supposed that the nitride layer notably formed in the material containing a trace amount of S may inhibit the iron loss to decrease. Based on this concept, the investigators had an idea that addition of elements that is capable of suppressing absorption of nitrogen and do not interfere grains to be well developed might enable the iron loss of the material containing a trace amount of S to be further decreased. After collective studies, we found the that addition of Sb and Sn is effective.

Figure 14:
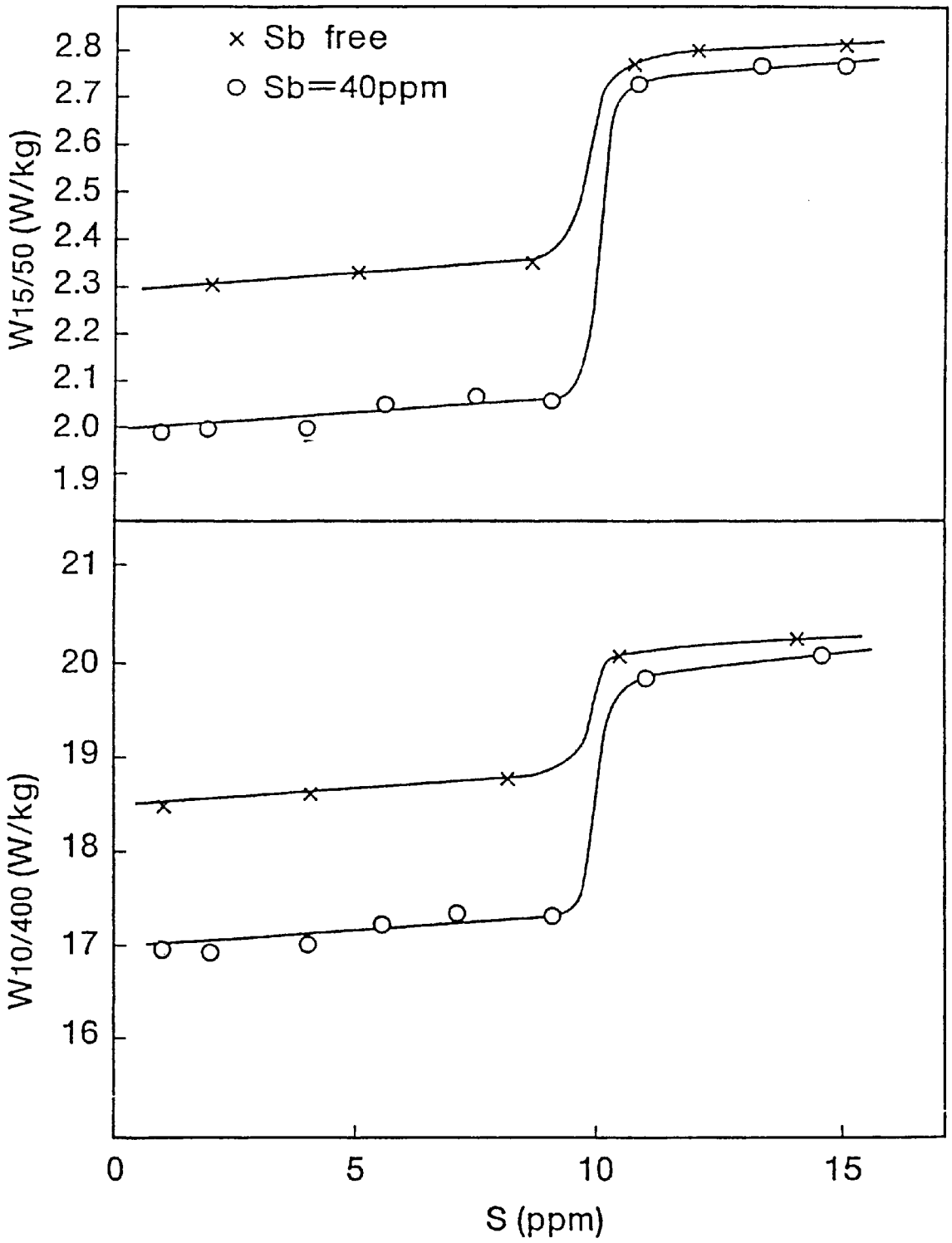
FIG. 14 is a graph indicating the relation between the S and Sb contents and iron loss after the finish annealing.

The test results obtained by adding 40 ppm of Sb in the sample shown in FIG. 14 and FIG. 13 will be described hereinafter. Let the iron loss reduction effect of Sb be noticed. While the iron loss values $W_{15/50}$ and $W_{10/400}$decreases only by 0.02 to 0.04 W/kg and 0.2 to 0.3 W/kg, respectively, by adding Sb in the S content region of more than 10 ppm, the values have decreased by 0.20 to 0.30 W/kg and 1.5 W/kg in $W_{15/50}$ and $W_{10/400}$, respectively, by the addition of Sb in the S content region of 10 ppm or less, showing an evident iron loss decreasing effect of Sb when the S content is low. No nitride layers were observed in this sample irrespective of the S content, probably due to concentrated Sb on the surface layer of the steel sheet to suppress absorption of nitrogen.

The results above clearly indicate that a large degree of decrease in the iron loss in a wide frequency region is made possible without causing a decrease in the magnetic flux density by adding Sb in the material with a sheet thickness of 0.35 mm containing a trace amount of S.

Figure 15:
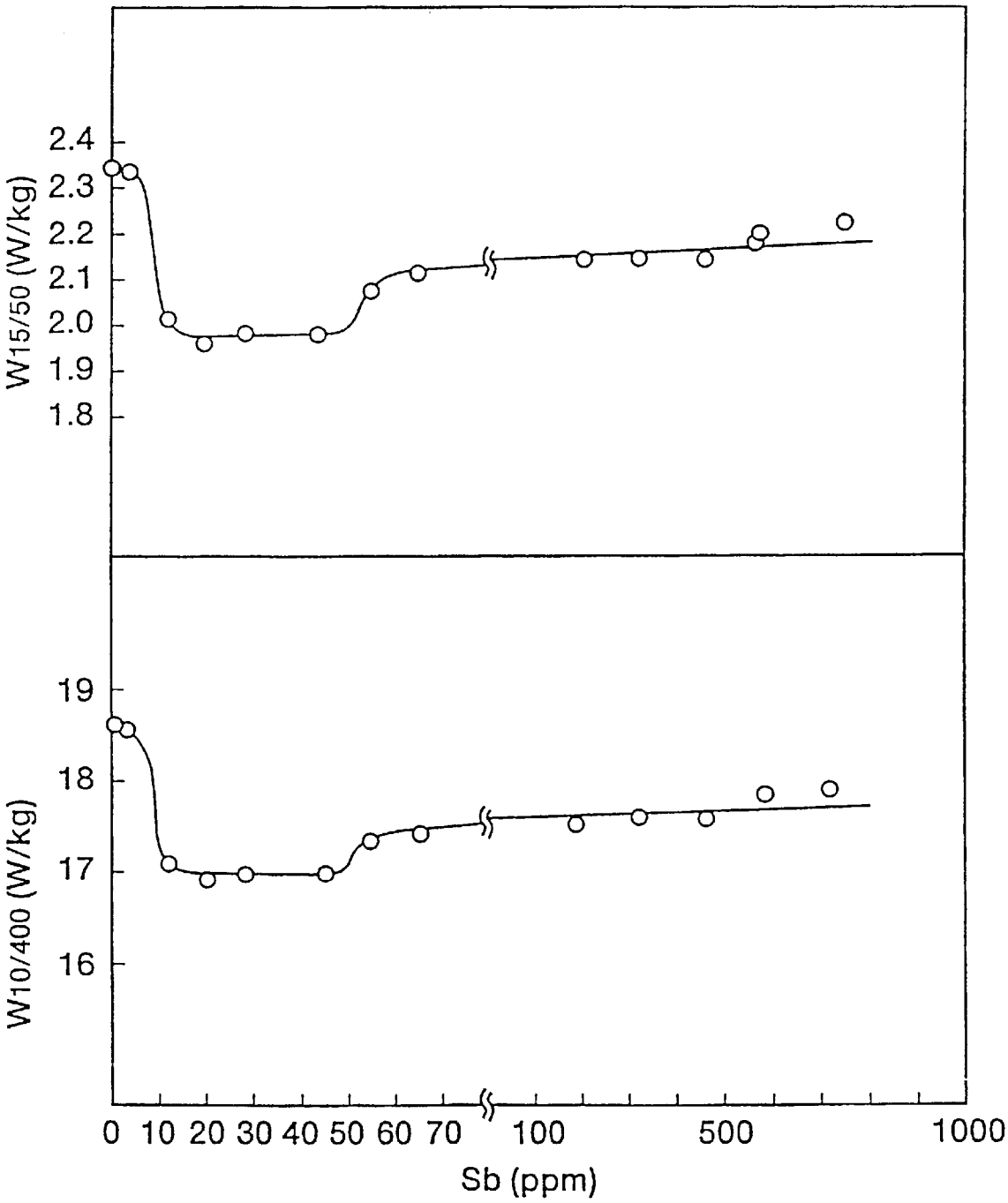
FIG. 15 is a graph indicating the relation between the Sb content and iron loss after the finish annealing.

To investigate the optimum amount of addition of Sb, a steel with a composition of 0.0026% of C, 2.75% of Si, 0.30% of Mn, 0.02% of P, 0.35% of Al, 0.0004% of S and 0.0020% of N, with a varying amount of Sb from trace to 700 ppm, was melted in vacuum in the laboratory followed by washing with an acid solution after hot-rolling. Subsequently, this hot-rolled sheet was annealed in an atmosphere of 75% $H_2$-25% $N_2$at 830° C. for 3 hours. The sheet was cold-rolled to a thickness of 0.35 mm followed by a finish annealing in an atmosphere of 10% $H_2$-90% $N_2$at 900° C. for 2 minutes. FIG. 15 shows the relation between the Sb content of the sample thus obtained and the iron loss $W_{15/50}$ and $W_{10/400}$.

It can be seen from FIG. 15 that the iron loss decreases in the region of Sb addition of 10 ppm or more, attaining the $W_{15/50}$ and $W_{10/400}$ values of 2.0 W/kg and 17 W/kg, respectively. When the Sb content has increased to more than 50 ppm by adding more Sb, however, the iron loss slowly decreases with the increment of the Sb content.

For the purpose of investigating the cause of the iron loss increase in the Sb content region of more than 50 ppm, the texture was investigated under an optical microscope. The result indicated that, though no nitride layers were found on the surface, the crystal grain diameter became a little small. Although the exact reasons are not clear, grain growth might be hindered by a grain boundary drag effect of Sb since Sb is an element liable to be segregated at grain boundaries.

Even when Sb is added up to 700 ppm, a lower iron loss values is obtained compared with the steel without Sb. From these results, the Sb content was defined to be 10 ppm and its upper limit was limited to 500 ppm from the economical point of view. Considering the iron loss values, the content should be 10 ppm or more and 50 ppm or less, more preferably 20 ppm or more and 40 ppm or less.

Since Sn is also an element, like Sb, liable to be segregated at grain boundaries, the same effect for suppressing nitride formation may be expected. To investigate the optimum amount of addition of Sn, a steel with a composition of 0.0020% of C, 2.85% of Si, 0.31% of Mn, 0.02% of P, 0.30% of Al, 0.0003% of S and 0.0015% of N, with a varying amount of Sb from trace to 1400 ppm, was melted in vacuum in the laboratory followed by washing with an acid solution after hot-rolling. Subsequently, this hot-rolled sheet was annealed in an atmosphere of 75% $H_2$-25% $N_2$at 830° C. for 3 hours. The sheet was cold-rolled to a thickness of 0.35 mm followed by a finish annealing in an atmosphere of 10% $H_2$-90% $N_2$ at 900° C. for 2 minutes.

Figure 16:
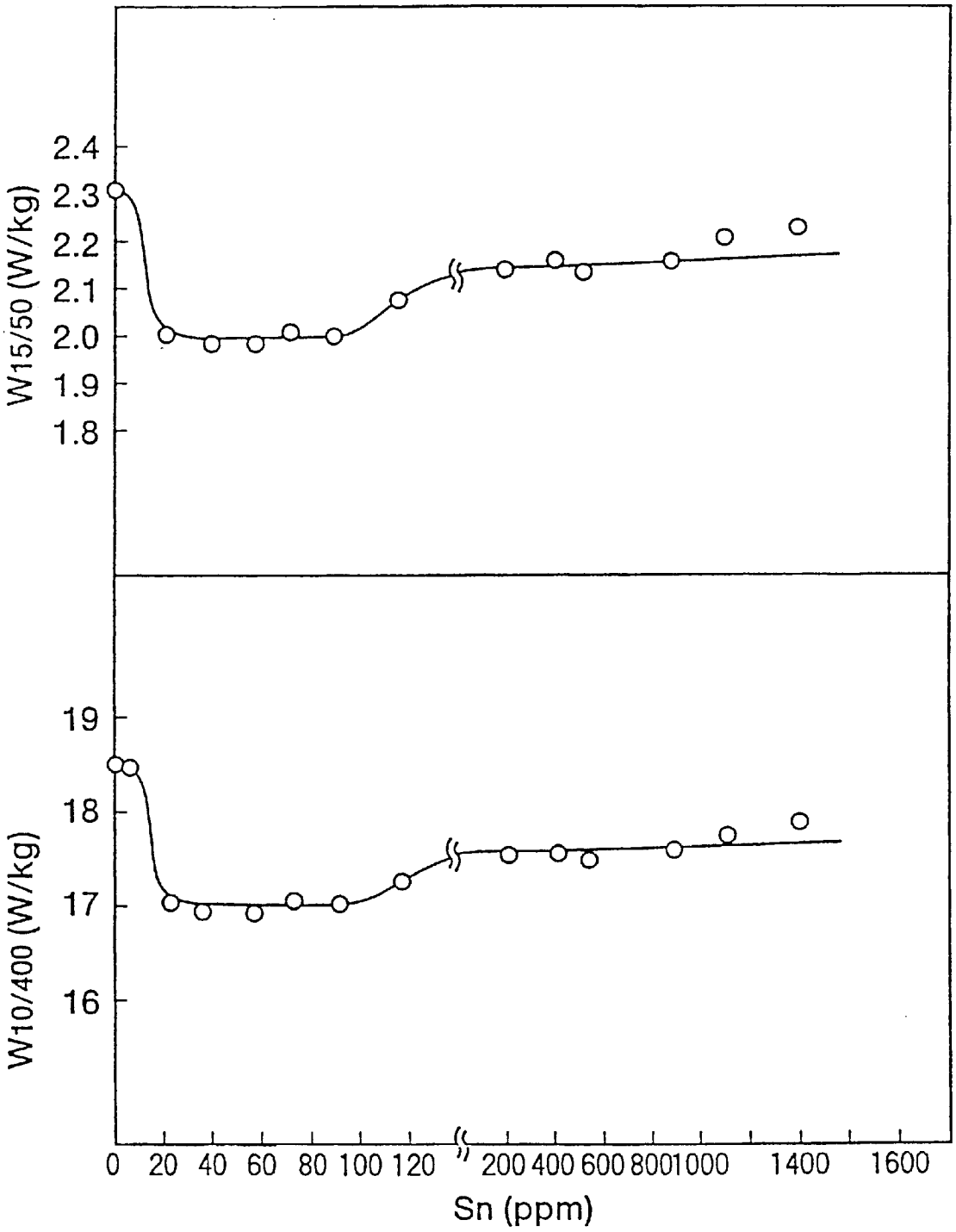
FIG. 16 is a graph indicating the relation between the Sn content and iron loss after the finish annealing.

FIG. 16 shows the relation between the Sn content of the sample thus obtained and the iron loss $W_{15/50}$ and $W_{10/400}$.

It can be understood from FIG. 16 that the iron loss decreases in the region of Sn addition of 20 ppm attaining $W_{15/50}$ and $W_{10/400}$ of 2.0 W/kg and 17 W/kg, respectively. When the Sn content is further increased to 100 ppm or more, the iron loss gradually increases with the increment of the Sn content. However, the iron loss remains low compared with a steel without Sn even when Sn is added up to 1400 ppm.

The difference of the effect on the iron loss by Sn and Sb can be comprehended as follows.

Since Sn has a smaller segregation coefficient than Sb, about two hold of Sn than Sb is needed for suppressing nitride formation by surface segregation of Sn. Therefore, the iron loss is decreased by the addition of Sn of 20 ppm or more. The required amount of addition by which the iron loss starts to increase due to a drag effect by segregation of Sn at the grain boundaries is also about twice of the Sb content because Sn has a smaller segregation coefficient than Sb. Accordingly, an addition of 100 ppm or more of Sn allows the iron loss to be slowly increased.

From the facts above, the Sn content is determined to be 20 ppm or more and its upper limit is limited to 1000 ppm from the economical point of view. By considering the iron loss, the desirable content is 20 ppm or more and 100 ppm or less, more preferably 30 ppm or more and 90 ppm or less.

As hitherto discussed, the mechanisms of Sb and Sn for suppressing the nitride formation are identical with each other. Therefore, a simultaneous addition of Sb and Sn makes it possible to obtain similar suppression effect for the nitride formation as well. However, Sn should be added twice as large as the amount of Sb in order to allow Sn to displayed the same degree of effect as that of Sb. Accordingly, the amount of (Sb+Sn/2) should be 0.001% or more and 0.05% or less, more desirably 0.001% or more and 0.005% or less, when Sb and Sn are simultaneously added.

The Reason Why the Contents of Other Components are Limited

The reason why the contents of other components should be limited will be described hereinafter.

The C content was limited to 0.005% or less because of the magnetic aging.

Since Si is an effective element for increasing inherent resistivity of the steel sheet, it is added in an amount of 1.5% or more. The upper limit of the Si content was limited to 3.0%, on the other hand, because the magnetic flux density is decreased with the decrease of saturation magnetic flux density when its content exceeds 3.0%.

More than 0.05% of Mn is needed in order to prevent red brittleness during hot-rolling. However, since the magnetic flux density is decreased at the Mn content of 1.5% or more, its range was limited to 0.05 to 1.5%.

While P is an element required for improving punching property of the steel sheet, its content was limited to 0.2% or less because an addition of more than 0.2% makes the steel sheet fragile.

Since a large amount of N makes a lot of AlN to precipitate and, when AlN grains are coarsened, grains can not be well developed and the iron loss increases. Therefore, its content was limited to 0.005% or less.

Fine AlN grains formed by adding a trace amount Al tend to deteriorate the magnetic properties. Therefore, its lower limit should be 0.1% or less to coarsen the AlN grains. The upper limit is determined to be 1.0% or less, on the other hand, because the magnetic flux density is decreased at an Al content of 1.0% or more. However, when the amount of (Si+Al) exceeds 3.5%, the magnetic flux density is decreased along with increasing the magnetization current, so that the value of (Si+Al) is limited to 3.5% or less.

Production Method

Conventional methods for producing the electromagnetic steel sheet may be applied in the present invention provided the contents of S, Sb and Sn be in a given range. The molten steel refined in a converter is de-gassed to adjust to a prescribed composition, followed by subjecting to casting and hot-rolling. The finish annealing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing.

Example

By using a steel shown in Table 7, the steel was subjected to casting after adjusting it to a given composition by applying a de-gassing treatment after refining in the converter. The steel was hot-rolled to a sheet thickness of 2.0 mm after heating the slab at a temperature of 1150° C. for 1 hour. The finishing temperature and coiling temperature were 750° C. and 610° C., respectively. Then, this hot-rolled sheet was washed with an acid solution followed by hot-rolling and annealing under the conditions shown in Table 7. The hot-rolling and annealing atmosphere was 75% $H_2$-25% $N_2$. Then, the sheet was cold-rolled to a thickness of 0.1 to 0.5 mm and finally subjected to an annealing under the finish anneal conditions shown in Table 8 and Table 9. The atmosphere for the finish annealing was 10% $H_2$-90% $N_2$.

The magnetic measurement was carried out using a 25 cm Epstein test piece ((L+C)/2). The magnetic characteristics of each steel sheet are listed in Table 7 to Table 9 together. The attached steel sheet numbers are common in both table.

The steel sheets of No. 7 to 13, No. 15 to 21 and No. 24 to 27 in Table 7 to table 9 are the steel sheets according to the present invention. It is evident that the iron loss values of $W_{15/50}$, $W_{10/400}$ and $W_{5/1k}$ are lower and the magnetic flux densities $B_{50}$ are higher in all of these steel sheets than the other steel sheets.

In the steel sheet No. 1, on the contrary, the iron loss is very high because the content of S and 8Sb+Sn) and the sheet thickness are all out of the range of the present invention. The iron loss in the steel sheet No. 2 is also very high because the value of (Sb+Sn) and the sheet thickness are out of the range of the present invention.

Since the sheet thickness is out of the range of the present invention in the steel sheet No. 3, the iron loss $W_{15/50}$ is low while $W_{10/400}$ and $W_{5/1k}$ are high.

The S and (Sb+Sn) contents in the steel sheets No. 4 and No. 22, S content in the steel sheet No. 5 and (Sb+Sn) content in the steel sheets No. 6, No. 14 and No. 23 are out of the range of the present invention, respectively. Therefore, the iron loss $W_{15/50}$ is high.

The (Si+Al) and (Sb+Sn) contents in the steel sheet No. 28 are out of the range of the present invention, so that the magnetic flux density $B_{50}$ is low.

Since the Si and (Si+Al) contents in the steel sheet No. 29 and (Si+Al) content in the steel sheet No. 30 are out of the range of the present invention, respectively, the iron loss is low nut the magnetic flux density $B_{50}$ is also low The Al content in the steel sheet No. 31 is out of the lower limit of the present invention, thereby the iron loss is high and magnetic flux density is low.

The Al content is out of the upper limit and (Si+Al) content is out of the range of the present invention, so that the magnetic flux density $B_{50}$ is low.

The iron loss is large in the steel sheet No. 33 because its Al content is lower than the lower limit of the present invention while, since the Mn content in the steel sheet No. 34 is higher than the upper limit of the present invention, the magnetic flux density $B_{50}$ is low.

The C content in the steel sheet No. 35 is out of the range of the present invention, so that the iron loss is high besides having a problem of magnetic aging.

Since the N content of the steel sheet No. 36 is out of the range of the present invention, the iron loss is high.

TABLE 7

| No. | C | Si | Mn | P | S | Al | Sb | Sn | N |
|---|---|---|---|---|---|---|---|---|---|
| 1 | 0.0021 | 2.80 | 0.20 | 0.020 | 0.0020 | 0.30 | tr. | tr. | 0.0025 |
| 2 | 0.0020 | 2.81 | 0.20 | 0.020 | 0.0004 | 0.30 | tr. | tr. | 0.0023 |
| 3 | 0.0020 | 2.81 | 0.20 | 0.020 | 0.0004 | 0.30 | 0.0040 | tr. | 0.0023 |
| 4 | 0.0021 | 2.79 | 0.20 | 0.018 | 0.0020 | 0.30 | tr. | tr. | 0.0020 |
| 5 | 0.0021 | 2.79 | 0.20 | 0.018 | 0.0020 | 0.30 | 0.0040 | tr. | 0.0020 |
| 6 | 0.0020 | 2.85 | 0.21 | 0.020 | 0.0004 | 0.30 | tr. | tr. | 0.0026 |
| 7 | 0.0021 | 2.80 | 0.19 | 0.021 | 0.0004 | 0.29 | 0.0010 | tr. | 0.0023 |
| 8 | 0.0018 | 2.81 | 0.18 | 0.025 | 0.0004 | 0.30 | 0.0040 | tr. | 0.0025 |
| 9 | 0.0015 | 2.81 | 0.18 | 0.025 | 0.0008 | 0.30 | 0.0040 | tr. | 0.0025 |
| 10 | 0.0018 | 2.81 | 0.18 | 0.025 | 0.0004 | 0.30 | 0.0040 | tr. | 0.0020 |
| 11 | 0.0021 | 2.79 | 0.20 | 0.020 | 0.0004 | 0.30 | 0.0060 | tr. | 0.0025 |
| 12 | 0.0021 | 2.85 | 0.20 | 0.024 | 0.0004 | 0.30 | 0.0200 | tr. | 0.0025 |
| 13 | 0.0020 | 2.80 | 0.21 | 0.020 | 0.0004 | 0.30 | 0.0400 | tr. | 0.0026 |
| 14 | 0.0022 | 2.82 | 0.23 | 0.020 | 0.0004 | 0.30 | 0.0600 | tr. | 0.0020 |
| 15 | 0.0021 | 2.81 | 0.19 | 0.018 | 0.0004 | 0.29 | tr. | 0.0020 | 0.0025 |
| 16 | 0.0018 | 2.79 | 0.18 | 0.020 | 0.0004 | 0.30 | tr. | 0.0060 | 0.0025 |
| 17 | 0.0022 | 2.80 | 0.18 | 0.022 | 0.0004 | 0.31 | tr. | 0.0120 | 0.0018 |
| 18 | 0.018 | 2.82 | 0.18 | 0.022 | 0.0004 | 0.32 | tr. | 0.0400 | 0.0016 |
| 19 | 0.0022 | 2.80 | 0.18 | 0.018 | 0.0004 | 0.31 | tr. | 0.0800 | 0.0026 |
| 20 | 0.0022 | 2.80 | 0.18 | 0.018 | 0.0004 | 0.31 | 0.0010 | 0.0020 | 0.0026 |
| 21 | 0.0022 | 2.80 | 0.18 | 0.018 | 0.0004 | 0.31 | 0.0040 | 0.0080 | 0.0026 |
| 22 | 0.0022 | 2.85 | 0.19 | 0.023 | 0.0040 | 0.30 | tr. | tr. | 0.0015 |
| 23 | 0.0022 | 2.85 | 0.19 | 0.023 | 0.0002 | 0.30 | tr. | tr. | 0.0015 |
| 24 | 0.0022 | 2.85 | 0.19 | 0.023 | 0.0002 | 0.30 | 0.0040 | tr. | 0.0015 |
| 25 | 0.0022 | 2.85 | 0.19 | 0.023 | 0.0002 | 0.30 | tr. | 0.0050 | 0.0015 |
| 26 | 0.0018 | 2.98 | 1.00 | 0.025 | 0.0004 | 0.45 | 0.0040 | tr. | 0.0025 |
| 27 | 0.0018 | 1.85 | 0.50 | 0.025 | 0.0004 | 0.90 | 0.0040 | tr. | 0.0025 |
| 28 | 0.0022 | 2.98 | 0.19 | 0.018 | 0.0040 | 0.95 | tr. | tr. | 0.0015 |
| 29 | 0.0022 | 4.00 | 0.19 | 0.018 | 0.0004 | 0.50 | 0.0040 | tr. | 0.0015 |
| 30 | 0.0019 | 2.98 | 0.17 | 0.018 | 0.0004 | 0.90 | 0.0040 | tr. | 0.0017 |
| 31 | 0.0020 | 2.78 | 0.18 | 0.021 | 0.0002 | 0.02 | 0.0040 | tr. | 0.0018 |
| 32 | 0.0020 | 2.78 | 0.18 | 0.021 | 0.0002 | 1.20 | 0.0040 | tr. | 0.0018 |
| 33 | 0.0025 | 2.80 | 0.02 | 0.020 | 0.0002 | 0.32 | 0.0040 | tr. | 0.0015 |
| 34 | 0.0020 | 2.85 | 1.80 | 0.021 | 0.0004 | 0.30 | 0.0040 | tr. | 0.0060 |
| 35 | 0.0060 | 2.80 | 0.19 | 0.025 | 0.0004 | 0.30 | 0.0040 | tr. | 0.0015 |
| 36 | 0.0022 | 2.85 | 0.18 | 0.021 | 0.0004 | 0.30 | 0.0040 | tr. | 0.0065 |

TABLE 8

| No. | Hot-rolled sheet annealing temperature (° C.) | Hot-roll sheet annealing time (min) | Sheet thickness (mm) | Finish annealing temperature (° C.) × 2 min | W15/50 (W/kg) | W10/400 (W/kg) | W5/1k (W/kg) | B50 (T) | Note |
|---|---|---|---|---|---|---|---|---|---|
| 1 | 830 | 180 | 0.50 | 900 | 3.10 | 28.00 | 31.50 | 1.72 | Comparative steel (S, Sb + Sn sheet thickness out of range) |

TABLE 8-continued

| No. | Hot-rolled sheet annealing temperature (° C.) | Hot-roll sheet annealing time (min) | Sheet thickness (mm) | Finish annealing temperature (° C.) × 2 min | W15/50 (W/kg) | W10/400 (W/kg) | W5/1k (W/kg) | B50 (T) | Note |
|---|---|---|---|---|---|---|---|---|---|
| 2 | 830 | 180 | 0.50 | 900 | 2.50 | 29.40 | 34.00 | 1.72 | Comparative steel (Sb + Sn, sheet thickness out of range) |
| 3 | 830 | 180 | 0.50 | 900 | 2.24 | 28.70 | 33.50 | 1.72 | Comparative steel (sheet thickness out of range) |
| 4 | 830 | 180 | 0.35 | 900 | 2.83 | 20.50 | 23.05 | 1.70 | Comparative steel (S, Sb + Sn out of range) |
| 5 | 830 | 180 | 0.35 | 900 | 2.76 | 20.10 | 22.61 | 1.70 | Comparative steel (S out of range) |
| 6 | 830 | 180 | 0.35 | 900 | 2.31 | 18.60 | 20.93 | 1.70 | Comparative steel (Sb + Sn out of the range) |
| 7 | 830 | 180 | 0.35 | 900 | 2.02 | 17.03 | 19.15 | 1.70 | Steel of the present invention |
| 8 | 830 | 180 | 0.35 | 900 | 2.00 | 17.00 | 19.12 | 1.70 | Steel of the present invention |
| 9 | 830 | 180 | 0.35 | 900 | 2.05 | 17.30 | 19.46 | 1.70 | Steel of the present invention |
| 10 | 830 | 2 | 0.35 | 900 | 2.01 | 17.10 | 19.24 | 1.70 | Steel of the present invention |
| 11 | 830 | 180 | 0.35 | 900 | 2.10 | 17.50 | 19.69 | 1.70 | Steel of the present invention |
| 12 | 830 | 180 | 0.35 | 900 | 2.15 | 17.60 | 19.80 | 1.70 | Steel of the present invention |
| 13 | 830 | 180 | 0.35 | 900 | 2.16 | 17.70 | 19.90 | 1.70 | Steel of the present invention |
| 14 | 830 | 180 | 0.35 | 900 | 2.21 | 17.91 | 20.15 | 1.70 | Comparative steel (Sb + Sn out of the range) |
| 15 | 830 | 180 | 0.35 | 900 | 2.01 | 17.04 | 19.17 | 1.70 | Steel of the present invention |
| 16 | 830 | 180 | 0.35 | 900 | 1.99 | 17.01 | 19.14 | 1.70 | Steel of the present invention |
| 17 | 830 | 180 | 0.35 | 900 | 2.11 | 17.52 | 19.71 | 1.70 | Steel of the present invention |
| 18 | 830 | 180 | 0.35 | 900 | 2.16 | 17.61 | 19.81 | 1.70 | Steel of the present invention |
| 19 | 830 | 180 | 0.35 | 900 | 2.18 | 17.75 | 19.97 | 1.70 | Steel of the present invention |
| 20 | 830 | 180 | 0.35 | 900 | 2.00 | 16.99 | 19.11 | 1.70 | Steel of the present invention |

TABLE 9

| No. | Hot-rolled sheet annealing temperature (° C.) | Hot-rolled sheet annealing time (min) | Sheet thickness (mm) | Finish annealing temperature (° C.) × 2 min | W15/50 (W/kg) | W10/400 (W/kg) | W5/1k (W/kg) | B50 (T) | Note |
|---|---|---|---|---|---|---|---|---|---|
| 21 | 830 | 180 | 0.35 | 900 | 2.11 | 17.51 | 19.70 | 1.70 | Steel of the present invention |
| 22 | 830 | 180 | 0.20 | 900 | 2.36 | 13.01 | 14.64 | 1.68 | Comparative steel (S, Sb + Sn, out of range) |
| 23 | 830 | 180 | 0.20 | 900 | 2.30 | 12.80 | 14.40 | 1.68 | Comparative steel (Sb + Sn out of range) |
| 24 | 830 | 180 | 0.20 | 900 | 1.65 | 11.00 | 12.38 | 1.68 | Steel of the present invention |
| 25 | 830 | 180 | 0.20 | 900 | 1.66 | 11.02 | 12.40 | 1.68 | Steel of the present invention |
| 26 | 830 | 180 | 0.35 | 900 | 1.90 | 16.50 | 18.56 | 1.69 | Steel of the present invention |
| 27 | 830 | 180 | 0.35 | 900 | 2.35 | 18.10 | 20.36 | 1.72 | Steel of the present invention |
| 28 | 830 | 180 | 0.35 | 900 | 2.10 | 17.01 | 19.14 | 1.65 | Comparative steel (Si + Al, S, Sb + Sn out of the range) |
| 29 | 830 | 180 | 0.35 | 900 | 1.80 | 15.50 | 17.44 | 1.64 | Comparative steel (Si, Si + Al out of the range) |
| 30 | 830 | 180 | 0.35 | 900 | 1.89 | 16.40 | 18.45 | 1.66 | Comparative steel (Si + Al out of the range) |
| 31 | 830 | 180 | 0.35 | 900 | 3.35 | 21.50 | 24.19 | 1.69 | Comparative steel (Al out of the range) |
| 32 | 830 | 180 | 0.35 | 900 | 1.95 | 16.90 | 19.01 | 1.65 | Comparative steel (Al, Si + Al out of the range) |
| 33 | 830 | 180 | 0.35 | 900 | 3.00 | 22.10 | 24.86 | 1.70 | Comparative steel (Mn out of the range) |
| 34 | 830 | 180 | 0.35 | 900 | 1.95 | 16.50 | 18.56 | 1.65 | Comparative steel (Mn out of the range) |
| 35 | 830 | 180 | 0.35 | 900 | 2.40 | 18.50 | 20.81 | 1.70 | Comparative steel (C out of the range) |
| 36 | 830 | 180 | 0.35 | 900 | 2.85 | 19.50 | 21.95 | 1.70 | Comparative steel (N out of the range) |

Embodiment 4

The crucial point of the present invention is to obtain an electromagnetic steel sheet with a high magnetic flux density and low iron loss in a wide frequency region required in electric car motors by adjusting the thickness of a steel sheet, in which the S content is adjusted to 0.001% or less and a given amount Sb or Sn is added, to 0.1 to 0.35 mm.

The problem described above can be solved by an electromagnetic steel sheet with a thickness of 0.1 to 0.35 mm and a mean crystal grain diameter in the steel sheet of 70 to 200 $\mu$m, containing, in % by weight, 0.005% or less of C, 1.5 to 3.0% of Si, 0.05 to 1.5% by weight of Mn, 0.2% or less of P, 0.005% or less (including zero) of N, 0.1 to 1.0% of Al, 3.5% or less of (Si+Al), 0.001% or less of S (including zero) and 0.001 to 0.05% of (Sb+Sn/2), with a substantial balance of Fe.

In addition, lower iron loss values can be also obtained by limiting the content of (Sb+Sn/2) in the range of 0.001 to 0.005%.

The phrase of "a substantial balance of Fe" as used herein means that the steel to which trace amount of elements other than inevitable impurities are added in a range not interfering the effect of the present invention is within the scope of the present invention.

In the following description, "%" and "ppm" representing the composition of the steel refers to "% by weight" and "ppm by weight", respectively, unless otherwise stated.

Procedure of the Invention

To investigate the effect of the S content on the iron loss first, the investigators of the present invention melted a steel with a composition of 0.0026% of C, 2.80% of Si, 0.21% of Mn, 0.01% of P, 0.32% of Al and 0.0015% of N, with varying amount of S from trace to 15 ppm, in vacuum in the laboratory, followed by an annealing of the hot-rolled sheet in an atmosphere of 75% $H_2$-25% $N_2$ at 830° C. for 3 hours after a hot rolling and washing with an acid solution.

Subsequently, this hot-rolled and annealed sheet was cold-rolled to a sheet thickness of 0.5 and 0.35 mm, followed by a finish annealing in an atmosphere of 10% $H_2$-90% $N_2$ at 900° C. for 2 minutes. Magnetic properties were measured by a 25 cm Epstein method.

Figure 17:
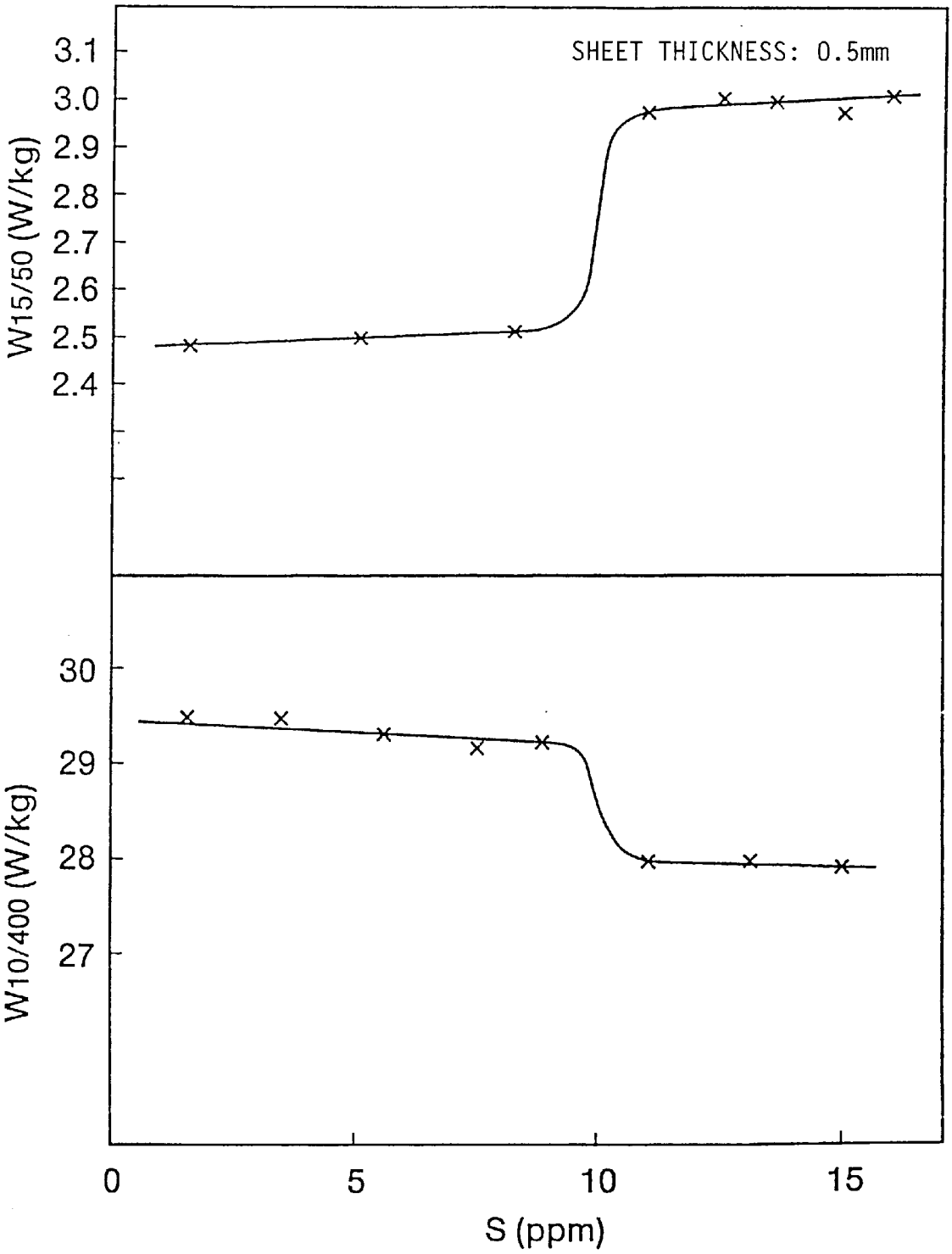
FIG. 17 is a graph indicating the relation between the S content and iron loss after the finish annealing in a steel sheet with a thickness of 0.5 mm.

Since a high torque is usually required at a low frequency region of around 50 Hz in an electric car, the steel sheet is magnetized at about 1.5T. Not so high torque is necessary, on the other hand, at a high frequency region of about 400 Hz that the steel sheet may be magnetized at about 1.0T. Therefore, the iron loss $W_{15/50}$ when the sheet was magnetized to 1.5T was evaluated at a frequency of 50 Hz while the iron loss $W_{15/50}$ when magnetized to 1.0T was used for evaluation at a frequency of 400 Hz. FIG. 17 shows the relation between the S content of a material with a thickness of 0.5 mm and iron loss $W_{15/50}$ and $W_{10/400}$.

FIG. 17 indicates that the iron loss $W_{15/50}$ at 50 Hz in the material with a thickness of 0.5 mm is largely decreased when the S content is less than 10 ppm.

The iron $W_{15/50}$ loss at 400 Hz is, on the contrary, largely increased when the S content is lowered. To investigate the cause of this iron loss changes accompanied by the decrease of the S content, the texture of the material was observed under an optical microscope. The result revealed that crystal grains were coarsened to about 100 $\mu$m when the S content is 0.001% or below. This is probably because the content of MnS in the steel had been decreased.

From this texture change, the S content dependency of the iron loss at frequencies of 50 Hz and 400 Hz can be comprehended as follows:

Generally, the iron loss is classified into two categories of hysteresis loss and eddy current loss. It is known that hysteresis loss is decreased while eddy current loss is increased when the crystal grain diameter is increased. Since the hysteresis loss is a predominant factor for the iron loss at a frequency of 50 Hz, decrease in S content and accompanying coarsening of crystal grains will cause a decrease in hysteresis loss, thereby the iron loss is decreased. However, since the eddy current loss is a predominant factor for the iron loss at a frequency of 400 Hz, the eddy current loss is increased due to decrease of the S content and accompanying coarsening of crystal grains to increase the iron loss.

From the discussions above, it can be concluded that, while decreasing the S content in the material with a thickness of 0.5 mm is effective for decreasing the iron loss at low frequency regions, it has an inverse effect for reduction of the iron loss at high frequency regions.

Figure 18:
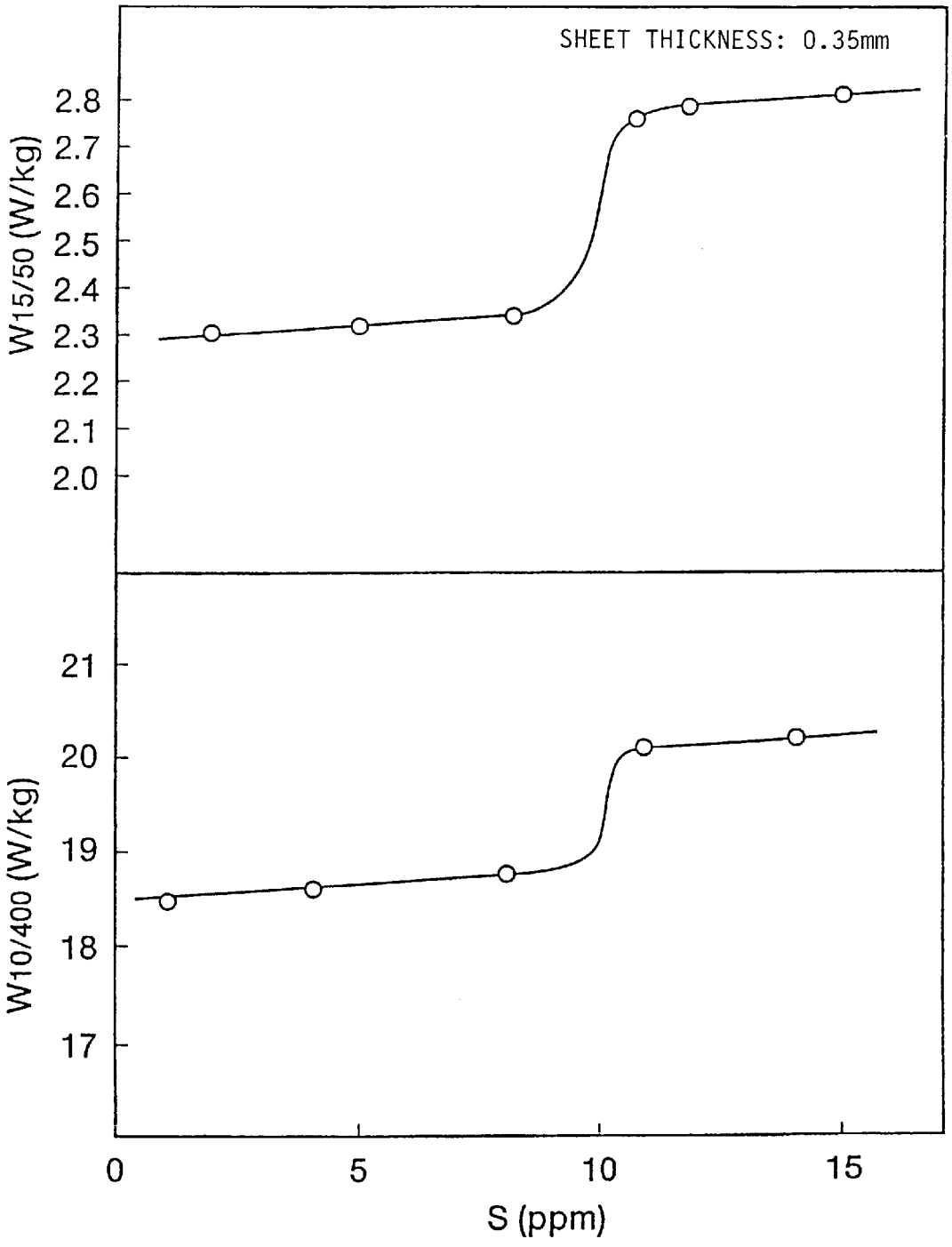
FIG. 18 is a graph indicating the relation between the S content and iron loss after the finish annealing in a steel sheet with a thickness of 0.35 mm.

FIG. 18 shows the relation between the S content in the material with a thickness of 0.35 mm and iron loss. FIG. 18 indicate that the iron loss $W_{15/50}$ of the material with a thickness of 0.35 mm at a frequency of 50 Hz is, as in the material with a thickness of 0.5 mm, largely decreased when the S content is 10 ppm or less.

However, different from the result in the material with a thickness of 0.5 mm, the iron loss $W_{15/50}$ at 400 Hz is also decreased when the S content is lowered. This is because, since the eddy current loss in the material with a thickness of 0.35 mm is largely decreased as compared with that of the material with a thickness of 0.5 mm due to reduced sheet thickness, reduction of the hysteresis loss as a result of coarsening of crystal grain size causes a decrease of total iron loss.

It is made clear from the above discussions that reduction of the S content in the sheet with a thickness of 0.35 mm allows the iron loss to be reduced in the high to low frequency regions. Accordingly, the S content and sheet thickness are limited to 10 ppm or below and 0.35 mm or less, respectively.

Reduction in the iron loss in the high to low frequency regions with the decrease of S content was more evident as the sheet thickness became thinner in the electromagnetic steel sheet with a thickness of 0.35 mm or less. However, when the sheet thickness is less than 0.1 mm, applying a cold rolling becomes so difficult along with burdening clients with much labor for laminating the steel sheets. Accordingly, the film thickness is limited to 0.1 mm or more in the present invention.

The method how the iron loss can be more diminished in the material with a thickness of 0.35 mm was further investigated.

It is usually effective for decreasing the iron loss to increase the Si and Al contents in order to increase the inherent resistivity. However, increments in the Si content and Al content in electric car motors are not desirable because decrease of torque is caused. Therefore, some methods other than increasing the Si and Al contents were investigated.

As shown in FIG. 18, the decrease rate of the iron loss is slowed when the S content is 10 ppm or less, finally reaching to an iron loss level of 2.3 W/kg in $W_{15/50}$ and 18.5 W/kg in $W_{10/400}$.

On the assumption that decrease of the iron loss in a material containing trace amount of S of 10 ppm or less might be inhibited by some unknown factors other than MnS, the investigators of the present invention observed the texture of the material under an optical microscope. The result indicated that notable nitride layers were found on the surface layer of the steel in the S content region of 10 ppm or less, whereas few nitride layers were formed in the S content region of more than 10 ppm. This nitride layer is supposed to be formed during annealing and finish annealing of the hot-rolled sheet.

The reason why the nitride forming reaction was accelerated with the decrease of S content may be as follows: Since S is an element liable to be concentrated on the surface and at grain boundaries, concentrated S on the surface of the steel sheet suppresses absorption of nitrogen during annealing in the S content region of more than 10 ppm. In the S content region of 10 ppm or less, on the other hand, the suppression effect for nitrogen absorption due to the presence of S may be decreased.

The investigators supposed that the nitride layer notably formed in the material containing a trace amount of S may inhibit the iron loss to decrease. Based on this concept, the investigators had an idea that addition of elements that are capable of suppressing absorption of nitrogen and do not interfere grains to be well developed might enable the iron loss of the material containing a trace amount of S to be further decreased. After collective studies, we found the that addition of Sb and Sn is effective.

Figure 19:
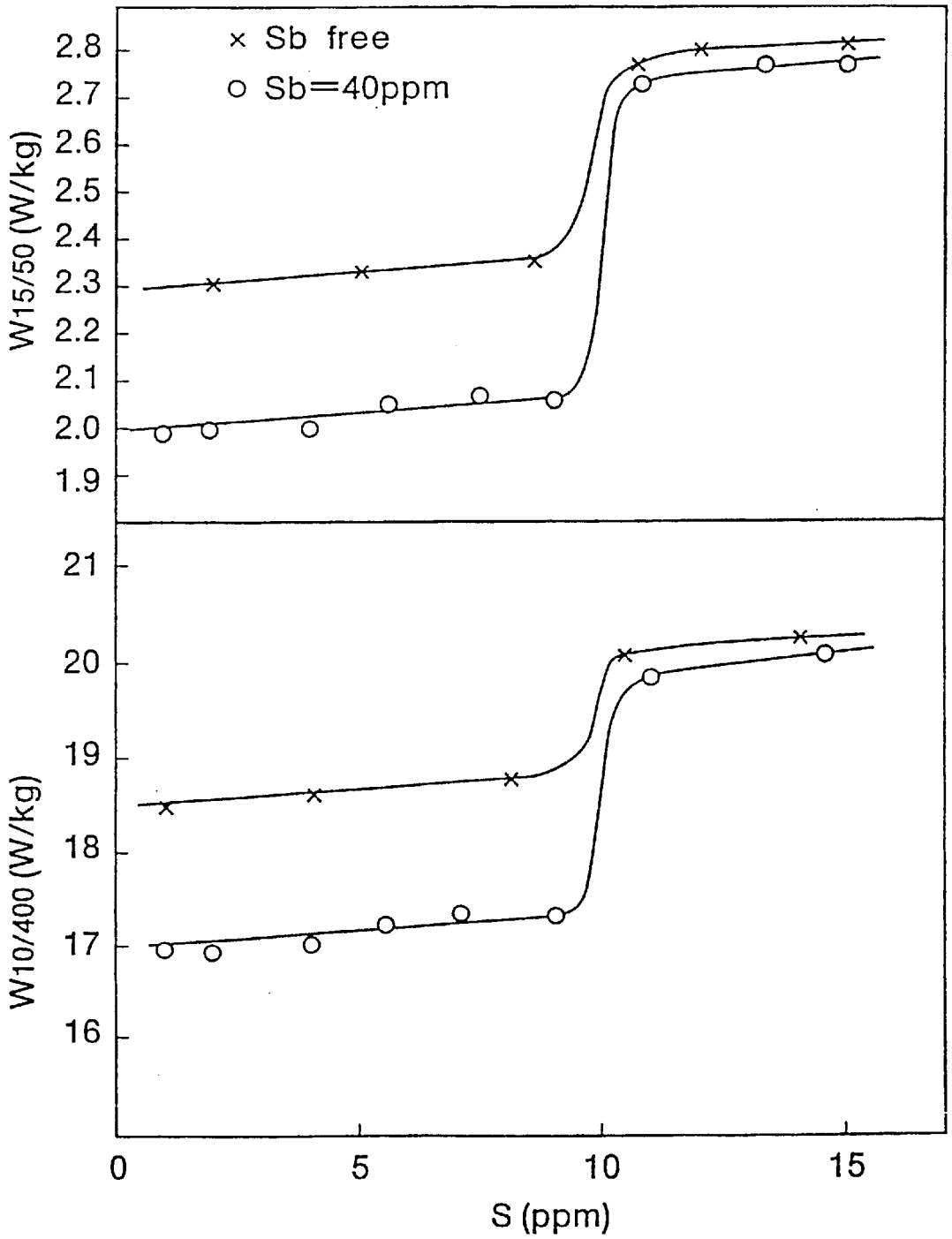
FIG. 19 is a graph indicating the relation between the S and Sb contents and iron loss after the finish annealing.

The sample prepared by adding 40 ppm of Sb in the sample shown in FIG. 18 was tested under the same conditions and the results are shown in FIG. 19. Let the iron loss reduction effect of Sb be noticed. While the iron loss values $W_{15/50}$ and $W_{10/400}$ decreases only by 0.02 to 0.04 W/kg and 0.2 to 0.3 W/kg, respectively, by adding Sb in the S content region of more than 10 ppm, the values have decreased by 0.20 to 0.30 W/kg and 1.5 W/kg in $W_{15/50}$ and $W_{10/400}$, respectively, by the addition of Sb in the S content region of 10 ppm or less, showing an evident iron loss decreasing effect of Sb when the S content is low. No nitride layers were observed in this sample irrespective of the S content, probably due to concentrated Sb on the surface layer of the steel sheet to suppress absorption of nitrogen.

The results above clearly indicate that a large degree of decrease in the iron loss in a wide frequency region is made possible without causing a decrease in the magnetic flux density by adding Sb in the material with a sheet thickness of 0.35 mm containing a trace amount of S.

Figure 20:
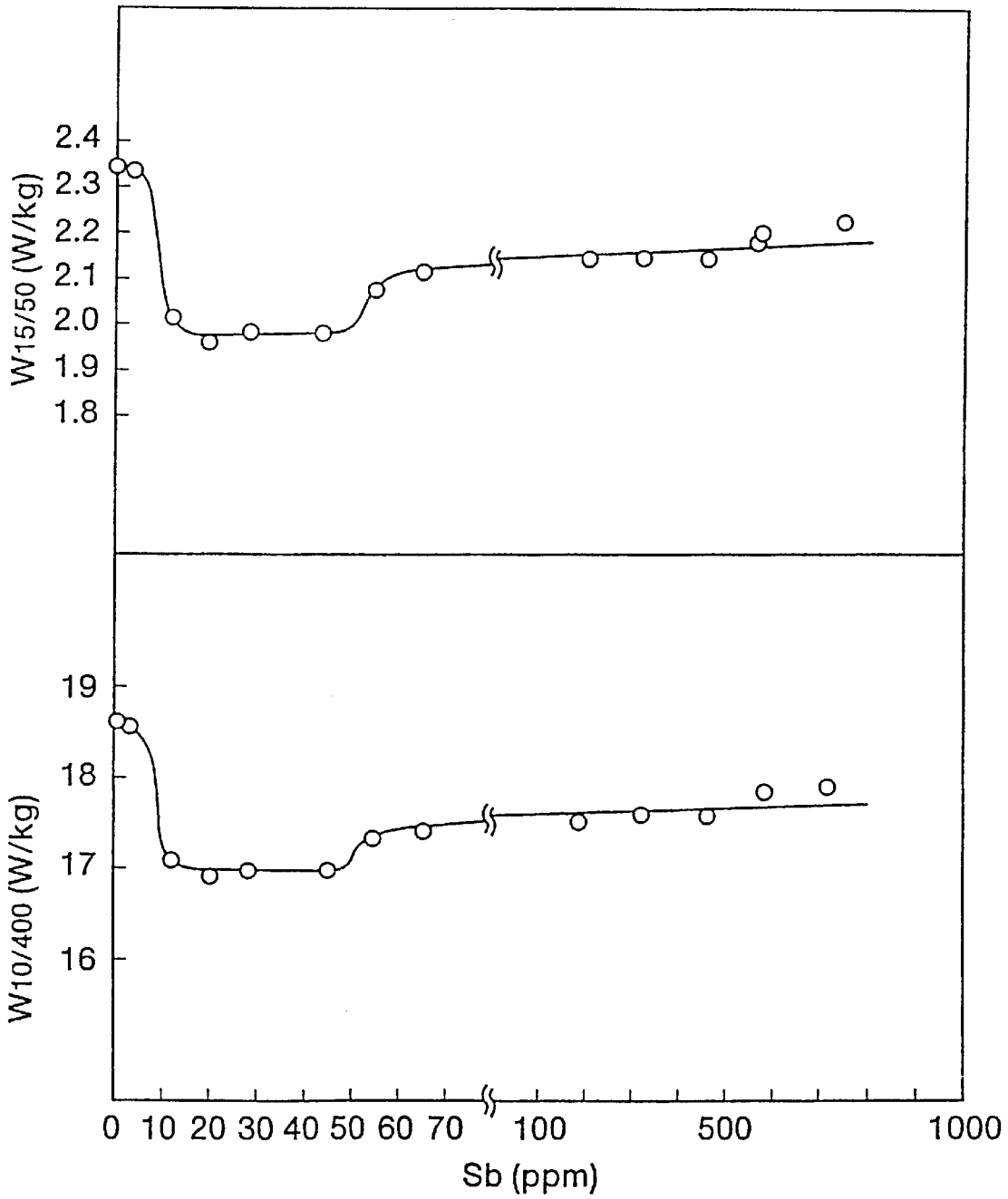
FIG. 20 is a graph indicating the relation between the Sb content and iron loss after the finish annealing.

To investigate the optimum amount of addition of Sb, a steel with a composition of 0.0026% of C, 2.75% of Si, 0.30% of Mn, 0.02% of P, 0.35% of Al, 0.0004% of S and 0.0020% of N, with a varying amount of Sb from trace to 700 ppm, was melted in vacuum in the laboratory followed by washing with an acid solution after hot-rolling. Subsequently, this hot-rolled sheet was annealed in an atmosphere of 75% $H_2$-25% $N_2$at 830° C. for 3hours. The sheet was cold-rolled to a thickness of 0.35 mm followed by a finish annealing in an atmosphere of 10% $H_2$-90% $N_2$at 900° C. for 2minutes. FIG. 20 shows the relation between the Sb content of the sample thus obtained and the iron loss $W_{15/50}$ and $W_{10/400}$.

It can be seen from FIG. 20 that the iron loss decreases in the region of Sb addition of 10 ppm or more, attaining the $W_{15/50}$ and $W_{10/400}$ values of 2.0 W/kg and 17 W/kg, respectively. When the Sb content has increased to more than 50 ppm by adding more Sb, however, the iron loss slowly decreases with the increment of the Sb content.

For the purpose of investigating the cause of the iron loss increase in the Sb content region of more than 50 ppm, the texture was observed under an optical microscope. The result indicated that, though no nitride layers were found on the surface, the crystal grain diameter became a little small. Although the exact reasons are not clear, grain growth might be hindered by a grain boundary drag effect of Sb since Sb is an element liable to be segregated at grain boundaries.

Even when Sb is added up to 700 ppm, a lower iron loss values is obtained compared with the steel without Sb.

From these results, the Sb content was defined to 10 ppm and its upper limit was limited to 500 ppm from the economical point of view. Considering the iron loss values, the content should be 10 ppm or more and 50 ppm or less, more desirably 20 ppm or more and 40 ppm or less.

Since Sn is also an element, like Sb, liable to be segregated at grain boundaries, the same effect for suppressing nitride formation may be expected. To investigate the optimum amount of addition of Sn, a steel with a composition of 0.0020% of C, 2.85% of Si, 0.31% of Mn, 0.02% of P, 0.30% of Al, 0.0003% of S and 0.0015% of N, with a varying amount of Sb from trace to 1400 ppm, was melted in vacuum in the laboratory followed by washing with an acid solution after hot-rolling. Subsequently, this hot-rolled sheet was annealed in an atmosphere of 75% $H_2$-25% $N_2$at 830° C. for 3 hours. The sheet was cold-rolled to a thickness of 0.35 mm followed by a finish annealing in an atmosphere of 10% $H_2$-90% $N_2$ at 900° C. for 2 minutes.

Figure 21:
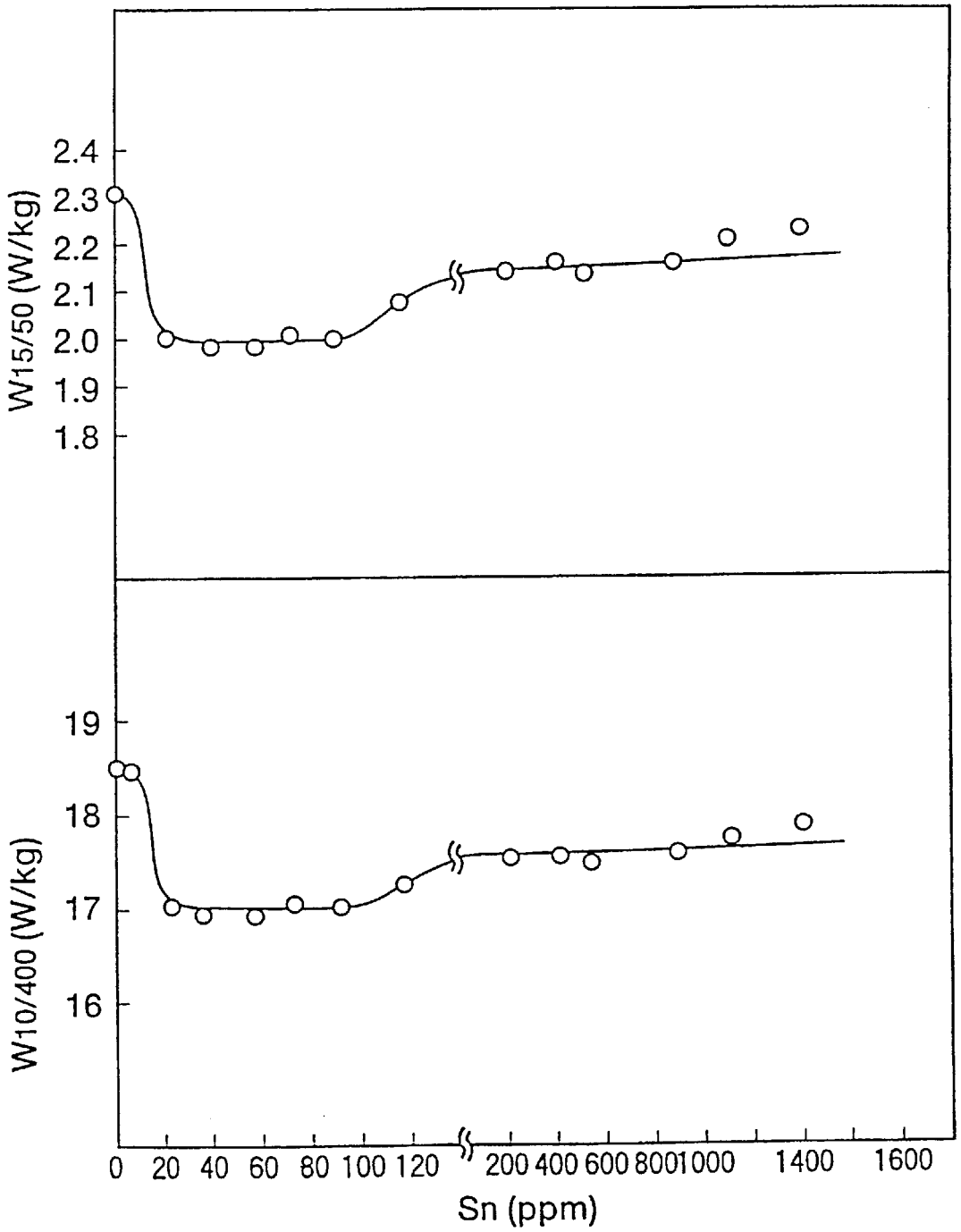
FIG. 21 is a graph indicating the relation between the Sn content and iron loss after the finish annealing.

FIG. 21 shows the relation between the Sn content of the sample thus obtained and the iron loss $W_{15/50}$ and $W_{10/400}$.

It can be understood from FIG. 21 that the iron loss decreases in the region of Sn addition of 20 ppm, attaining $W_{15/50}$ and $W_{10/400}$ of 2.0 W/kg and 17 W/kg, respectively. When the Sn content is further increased to 100 ppm or more, it can be seen that the iron loss gradually increases with the increment of the Sn content. However, the iron loss remains low compared with a steel without Sn even when Sn is added up to 1400 ppm.

The difference of the effect on the iron loss by Sn and Sb can be comprehended as follows.

Since Sn has a smaller segregation coefficient than Sb, about two hold of Sn than Sb is needed for suppressing nitride formation by surface segregation of Sn. Therefore, the iron loss is decreased by the addition of Sn of 20 ppm or more. The required amount of addition by which the iron loss starts to increase due to a drag effect by segregation of Sn at the grain boundaries is also about twice of the Sb content because Sn has a smaller segregation coefficient than Sb. Accordingly, an addition of 100 ppm or more of Sn allows the iron loss to be slowly increased.

From the facts above, the Sn content is determined to be 20 ppm or more and its upper limit is defined to be 1000 ppm from the economical point of view. By considering the iron loss, the desirable content is 20 ppm or more and 100 ppm or less, more preferably 30 ppm or more and 90 ppm or less.

As hitherto discussed, the mechanisms of Sb and Sn for suppressing the nitride formation are identical with each other. Therefore, a simultaneous addition of Sb and Sn makes it possible to obtain similar suppression effect for the nitride formation as well. However, Sn should be added twice as large as the amount of Sb in order to allow Sn to displayed the same degree of effect as that of Sb. Accordingly, the amount of (Sb+ Sn/2) should be 0.001% or more and 0.05% or less, more desirably 0.001% or more and 0.005% or less, when Sb and Sn are simultaneously added.

To investigate the optimum grain diameter of the steel having a composition system according to the present invention, a steel with a composition of 0.0026% of C, 2.65% of Si, 0.18% of Mn, 0.01% of P, 0.30% of Al, 0.0004% of S, 0.0015% of N and 0.004% of Sb was melted in vacuum followed by washing with an acid solution after a hot-rolling. The hot-rolled sheet was subsequently annealed in an atmosphere of 75% $H_2$-25% $N_2$ at 830° C. for 3 hours, followed by a cold rolling to a thickness of 0.35 mm. By applying a finish rolling in an atmosphere of 10% $H_2$-90% $N_2$ at 705 to 1100° C. for 2 minutes, the crystal grains after the finish rolling can be largely changed.

Figure 22:
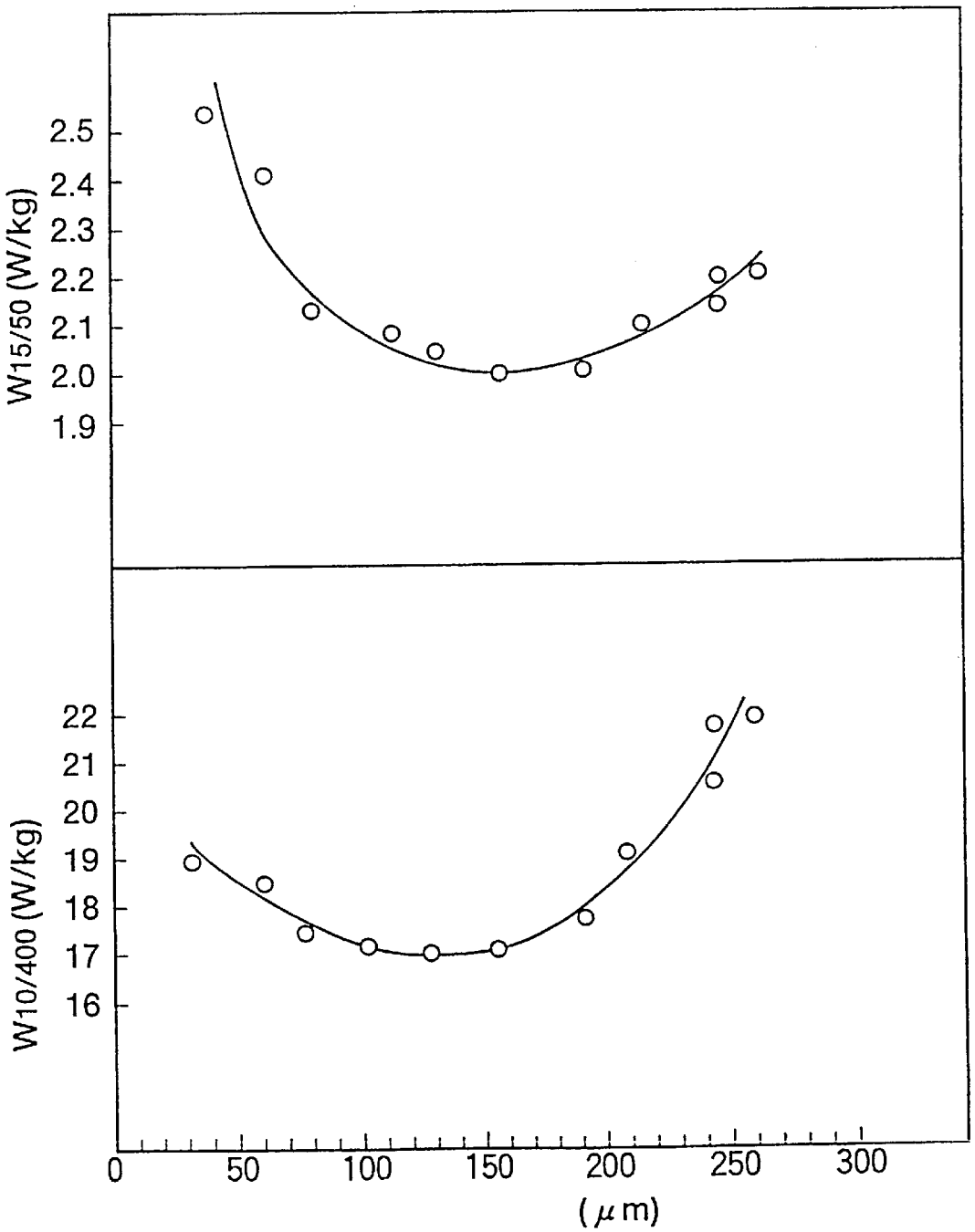
FIG. 22 is a graph indicating the relation between the mean crystal grain diameter and iron loss after the finish annealing.

FIG. 22 shows the relation between the mean crystal grain diameter and iron loss $W_{15/50}$ and $W_{10/400}$. It can be understood from FIG. 22 that the iron loss value $W_{15/50}$ at a frequency of 50 Hz is rapidly increased when the mean grain diameter is less than 70 $\mu$m while the iron loss value $W_{10/400}$ at a frequency of 400 Hz is rapidly increased when the mean grain diameter exceeds 200 $\mu$m. From this result, the mean crystal grain diameter of the steel sheet is limited to 70 to 200 $\mu$m in the present invention. It is more preferable to adjust the mean crystal grain diameter within 100 to 180 $\mu$m.

The Reason Why the Contents of Other Components are Limited

The reason why the contents of other components should be limited will be described hereinafter.

The C content was limited to 0.005% or less because of the magnetic aging.

Since Si is an effective element for increasing inherent resistivity of the steel sheet, it is added in an amount of 1.5% or more. The upper limit of the Si content was limited to 3.0%, on the other hand, because the magnetic flux density is decreased with the decrease of saturation magnetic flux density when its content exceeds 3.0%.

More than 0.05% of Mn is needed in order to prevent red brittleness during hot-rolling. However, since the magnetic flux density is decreased at the Mn content of 1.5% or more, its range was limited to 0.05 to 1.5%.

While P is an element required for improving punching property of the steel sheet, its content was limited to 0.2% or less because an addition of more that 0.2% makes the steel sheet fragile.

Since a large amount of N makes a lot of AlN to precipitate and, when AlN grains are coarsened, grains can not be well developed and the iron loss increases. Therefore, its content was limited to 0.005% or less.

Fine AlN grains formed by adding a trace amount Al tend to deteriorate the magnetic properties. Therefore, its lower limit should be 0.1% or less to coarsen the AlN grains. The upper limit is determined to be 1.0% or less, on the other hand, because the magnetic flux density is decreased at an Al content of 1.0% or more. However, when the amount of (Si+Al) exceeds 3.5%, the magnetic flux density is decreased along with increasing the magnetization current, so that the value of (Si +Al) is limited to 3.5% or less.

Production Method

Conventional methods for producing the electromagnetic steel sheet may be applied in the present invention provided the contents of S, Sb and Sn be in a given range. The molten steel refined in a converter is de-gassed to adjust to a prescribed composition, followed by subjecting to casting and hot-rolling. The finish annealing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing. The crystal grain diameter prescribed in the present invention can be obtained by varying the temperature of the final annealing.

Example

By using a steel shown in Table 10, the steel was molded after adjusting it to a given composition by applying a de-gassing treatment after refining in the converter. The steel was hot-rolled to a sheet thickness of 2.0 mm after heating the slab at a temperature of 1150° C. for 1 hour. The finishing temperature and coiling temperature were 750° C. and 610° C., respectively. Then, this hot-rolled sheet was washed with an acid solution followed by hot-rolling and annealing under the conditions shown in Table 11 and Table 12. The hot-rolling and annealing atmosphere was 75% $H_2$-25% $N_2$. Then, the sheet was cold-rolled to a thickness of 0.1 to 0.5 mm and finally subjected to an annealing under the finish anneal conditions shown in Table 11 and Table 12. The atmosphere for the finish annealing was 10% $H_2$-90% $N_2$.

The magnetic measurement was carried out using a 25 cm Epstein test piece ((L+C)/2). The magnetic characteristics of each steel sheet are listed in Table 10 to 12 together. The attached steel sheet numbers are common in Table 10 to 12.

As seen in Table 10 to 12, the thickness of the steel sheets No. 1 to 31, No. 32 to No. 35 and No. 36 to No. 38 are 0.35 mm, 0.20 mm and 0.50 mm, respectively. When the steel sheets having the same thickness of 0.35 mm are compared with each other, all of the sheets No. 1 to No. 16 in the examples of the present invention have low iron loss values $W_{15/50}$ and $W_{10/400}$.

The steel sheet No. 17, on the other hand, has a crystal grain diameter lower than the range of the present invention, so that the value of $W_{15/50}$ becomes higher as compared with the values of the steel according to the present invention. Since the crystal grain diameter is above the range of the present invention in the steel sheet No. 18, the iron loss value $W_{10/400}$ is higher as compared with the values of the steel according to the present invention.

The S and (Sb+Sn/2) contents in the steel sheet No. 19 are out of the range of the present invention, so that both of the iron loss values $W_{15/50}$ and $W_{10/400}$ are high. In the steel sheet No. 20, the iron loss values $W_{15/50}$ and $W_{10/400}$ are high because the (Sb+Sn/2) content is out of the range of the present invention. Both of the (Sb+Sn/2) content and crystal grain diameter are out of the range of the present invention, thereby the iron loss values $W_{15/50}$ and $W_{10/400}$ are high.

The iron loss values $W_{15/50}$ and $W_{10/400}$ as well as the magnetic flux density $B_{50}$ are small in the steel sheet No. 22 because the (Si+Al) and (Sb+Sn/2) contents are out of the range of the present invention. The steel sheet No. 23 has high the iron loss values $W_{15/50}$ and $W_{10/400}$ since the Si content is below the range of the present invention. Since the Si and (Si+Al) contents are higher than the range of the present invention in the steel sheet No. 24, the iron loss values $W_{15/50}$ and $W_{10/400}$ are low but the magnetic flux density $B_{50}$ is small. The steel sheet No. 25 also has low iron loss values $W_{15/50}$ and $W_{10/400}$ but small magnetic flux density $B_{50}$ since the (Si+Al) content is above the range of the present invention.

The steel sheet No. 26 has not only high iron loss values $W_{15/50}$ and $W_{10/400}$ but also small magnetic flux density B50 because the Al content and crystal grain diameter are out of the range of the present invention. Both of the Al and (Si+Al) contents are out of the range of the present invention in the steel sheet No. 27, so that the iron loss values $W_{15/50}$ and $W_{10/400}$ are low but the magnetic flux density $B_{50}$is small. The steel sheet No. 28 has high iron loss values $W_{15/50}$ and $W_{10/400}$ because the crystal grain diameter is out of the range of the present invention. The sheet also has a problem of red brittleness during hot-rolling since its Mn content is lower than the range of the present invention. The magnetic flux density $B_{50}$ in the steel sheet No. 29 is small because the Mn content is higher than the range of the present invention.

The crystal grain diameter of the steel sheet No. 30 is out of the range of the present invention, thereby the iron loss values $W_{15/50}$ and $W_{10/400}$ are high. This sheet has a problem of magnetic aging because the C content is also out of the range of the present invention. The iron loss values $W_{15/50}$ and $W_{10/400}$ of the steel sheet No. 31 are high because the N content and crystal grain diameter are out of the range of the present invention.

With respect to the steel sheets having a thickness of 0.20 mm, the steel sheet No. 32 and No. 33 according to the present invention have lower iron loss values $W_{15/50}$ and W 10/400 as compared with the comparative steel sheets No. 34 and No. 35. The S and (Sb+Sn/2) contents in the steel sheet No. 35 are out of the range of the present invention, so that the iron loss values $W_{15/50}$ and $W_{10/400}$ become high.

All of the steel sheets No. 36 to 38 having a thickness of 0.5 mm have high iron loss values $W_{15/50}$ and $W_{10/400}$.

TABLE 10

| No. | C | Si | Mn | P | S | Al | Sb | Sn | N |
|---|---|---|---|---|---|---|---|---|---|
| 1 | 0.0021 | 2.80 | 0.19 | 0.021 | 0.0004 | 0.29 | 0.0010 | tr. | 0.0023 |
| 2 | 0.0018 | 2.81 | 0.18 | 0.025 | 0.0004 | 0.30 | 0.0040 | tr. | 0.0025 |
| 3 | 0.0015 | 2.81 | 0.18 | 0.025 | 0.0008 | 0.30 | 0.0040 | tr. | 0.0025 |
| 4 | 0.0018 | 2.81 | 0.18 | 0.025 | 0.0004 | 0.30 | 0.0040 | tr. | 0.0020 |
| 5 | 0.0021 | 2.79 | 0.20 | 0.020 | 0.0004 | 0.30 | 0.0060 | tr. | 0.0025 |
| 6 | 0.0021 | 2.85 | 0.20 | 0.024 | 0.0004 | 0.30 | 0.0200 | tr. | 0.0025 |
| 7 | 0.0020 | 2.80 | 0.21 | 0.020 | 0.0004 | 0.30 | 0.0400 | tr. | 0.0026 |
| 8 | 0.0015 | 2.81 | 0.18 | 0.025 | 0.0004 | 0.30 | 0.0040 | tr. | 0.0015 |
| 9 | 0.0021 | 2.81 | 0.19 | 0.018 | 0.0004 | 0.29 | tr. | 0.0020 | 0.0025 |
| 10 | 0.0018 | 2.79 | 0.18 | 0.020 | 0.0004 | 0.30 | tr. | 0.0060 | 0.0025 |
| 11 | 0.0022 | 2.80 | 0.18 | 0.022 | 0.0004 | 0.31 | tr. | 0.0120 | 0.0018 |
| 12 | 0.0018 | 2.82 | 0.18 | 0.022 | 0.0004 | 0.32 | tr. | 0.0400 | 0.0016 |
| 13 | 0.0022 | 2.80 | 0.18 | 0.018 | 0.0004 | 0.31 | tr. | 0.0800 | 0.0026 |
| 14 | 0.0022 | 2.80 | 0.18 | 0.018 | 0.0004 | 0.31 | 0.0010 | 0.0020 | 0.0026 |
| 15 | 0.0022 | 2.60 | 0.18 | 0.018 | 0.0004 | 0.31 | 0.0040 | 0.0080 | 0.0026 |
| 16 | 0.0018 | 2.98 | 1.00 | 0.025 | 0.0004 | 0.45 | 0.0040 | tr. | 0.0025 |
| 17 | 0.0015 | 2.81 | 0.18 | 0.025 | 0.0004 | 0.30 | 0.0040 | tr. | 0.0015 |
| 18 | 0.0015 | 2.81 | 0.18 | 0.025 | 0.0004 | 0.30 | 0.0040 | tr. | 0.0015 |
| 19 | 0.0021 | 2.79 | 0.20 | 0.018 | 0.0020 | 0.30 | tr. | tr. | 0.0020 |
| 20 | 0.0020 | 2.85 | 0.21 | 0.020 | 0.0004 | 0.30 | tr. | tr. | 0.0026 |
| 21 | 0.0022 | 2.82 | 0.23 | 0.020 | 0.0004 | 0.30 | 0.0600 | tr. | 0.0020 |
| 22 | 0.0022 | 2.98 | 0.19 | 0.018 | 0.0040 | 0.95 | tr. | tr. | 0.0015 |
| 23 | 0.0022 | 1.40 | 0.19 | 0.018 | 0.0002 | 0.50 | 0.0040 | tr. | 0.0015 |
| 24 | 0.0022 | 4.00 | 0.19 | 0.018 | 0.0004 | 0.50 | 0.0040 | tr. | 0.0015 |
| 25 | 0.0019 | 2.98 | 0.17 | 0.018 | 0.0004 | 0.90 | 0.0040 | tr. | 0.0017 |
| 26 | 0.0020 | 2.78 | 0.18 | 0.021 | 0.0002 | 0.02 | 0.0040 | tr. | 0.0018 |
| 27 | 0.0020 | 2.78 | 0.18 | 0.021 | 0.0002 | 1.20 | 0.0040 | tr. | 0.0018 |
| 28 | 0.0025 | 2.80 | 0.02 | 0.020 | 0.0002 | 0.32 | 0.0040 | tr. | 0.0015 |
| 29 | 0.0020 | 2.85 | 1.80 | 0.021 | 0.0004 | 0.30 | 0.0040 | tr. | 0.0060 |
| 30 | 0.0060 | 2.80 | 0.19 | 0.025 | 0.0004 | 0.30 | 0.0040 | tr. | 0.0015 |
| 31 | 0.0022 | 2.85 | 0.18 | 0.021 | 0.0004 | 0.30 | 0.0040 | tr. | 0.0065 |
| 32 | 0.0022 | 2.85 | 0.19 | 0.023 | 0.0002 | 0.30 | 0.004O | tr. | 0.0015 |
| 33 | 0.0022 | 2.85 | 0.19 | 0.023 | 0.0002 | 0.30 | tr. | 0.0050 | 0.0015 |
| 34 | 0.0022 | 2.85 | 0.19 | 0.023 | 0.0040 | 0.30 | tr. | tr. | 0.0015 |
| 35 | 0.0022 | 2.85 | 0.19 | 0.023 | 0.0002 | 0.30 | tr. | tr. | 0.0015 |
| 36 | 0.0021 | 2.80 | 0.20 | 0.020 | 0.0020 | 0.30 | tr. | tr. | 0.0025 |
| 37 | 0.0020 | 2.81 | 0.20 | 0.020 | 0.0004 | 0.30 | tr. | tr. | 0.0023 |
| 38 | 0.0020 | 2.81 | 0.20 | 0.020 | 0.0004 | 0.30 | 0.0040 | tr. | 0.0023 |

TABLE 11

| No. | Hot-rolled sheet annealing temperature (° C.) | Hot-rolled sheet annealing time (min) | Sheet thickness (mm) | Finish annealing temperature (° C.) × 2 min | Crystal grain diameter (μm) | W15/50 (W/kg) | W10/400 (W/kg) | W5/1k (W/kg) | B50 (T) | Note |
|---|---|---|---|---|---|---|---|---|---|---|
| 1 | 830 | 180 | 0.35 | 900 | 102 | 2.02 | 17.03 | 19.15 | 1.70 | present invention |
| 2 | 830 | 180 | 0.35 | 900 | 106 | 2.00 | 17.00 | 19.12 | 1.70 | present invention |
| 3 | 830 | 180 | 0.35 | 900 | 98 | 2.05 | 17.30 | 19.46 | 1.70 | present invention |
| 4 | 900 | 2 | 0.35 | 900 | 107 | 2.01 | 17.10 | 19.24 | 1.70 | present invention |
| 5 | 830 | 180 | 0.35 | 900 | 100 | 2.10 | 17.50 | 19.69 | 1.70 | present invention |
| 6 | 830 | 180 | 0.35 | 900 | 90 | 2.15 | 17.60 | 19.80 | 1.70 | present invention |
| 7 | 830 | 180 | 0.35 | 900 | 85 | 2.16 | 17.70 | 19.90 | 1.70 | present invention |
| 8 | 830 | 180 | 0.35 | 950 | 130 | 2.01 | 17.06 | 19.19 | 1.70 | present invention |
| 9 | 830 | 180 | 0.35 | 900 | 107 | 2.01 | 17.04 | 19.17 | 1.70 | present invention |
| 10 | 830 | 180 | 0.35 | 900 | 106 | 1.99 | 17.01 | 19.14 | 1.70 | present invention |
| 11 | 830 | 180 | 0.35 | 900 | 98 | 2.11 | 17.52 | 19.71 | 1.70 | present invention |
| 12 | 830 | 180 | 0.35 | 900 | 90 | 2.16 | 17.61 | 19.81 | 1.70 | present invention |
| 13 | 830 | 180 | 0.35 | 900 | 84 | 2.18 | 17.75 | 19.97 | 1.70 | present invention |
| 14 | 830 | 180 | 0.35 | 900 | 108 | 2.00 | 16.99 | 19.11 | 1.70 | present invention |
| 15 | 830 | 180 | 0.35 | 900 | 101 | 2.11 | 17.51 | 19.70 | 1.70 | present invention |
| 16 | 830 | 180 | 0.35 | 900 | 105 | 1.90 | 16.50 | 18.56 | 1.69 | present invention |

Magnetic measurement: Epstein (L + C)/2
Hot-roll sheet annealing temperature: 75% H2 - 15% N2
Finish annealing atmosphere: 10% H2 - 90% N2

TABLE 12

| No. | Hot-rolled sheet annealing temperature (° C.) | Hot-rolled sheet annealing time (min) | Sheet thickness (mm) | Finish annealing temperature (° C.) × 2 min | Crystal grain diameter (μm) | W15/50 (W/kg) | W10/400 (W/kg) | W5/1k (W/kg) | B50 (T) | Note |
|---|---|---|---|---|---|---|---|---|---|---|
| 17 | 830 | 180 | 0.35 | 800 | 59 | 2.75 | 17.30 | 19.46 | 1.71 | Comparative steel |
| 18 | 830 | 180 | 0.35 | 1050 | 250 | 2.20 | 21.50 | 24.19 | 1.69 | Comparative steel |
| 19 | 830 | 180 | 0.35 | 900 | 51 | 2.83 | 20.50 | 23.05 | 1.70 | Comparative steel |
| 20 | 830 | 180 | 0.35 | 900 | 105 | 2.31 | 18.60 | 20.93 | 1.70 | Comparative steel |
| 21 | 830 | 180 | 0.35 | 900 | 65 | 2.21 | 17.91 | 20.15 | 1.70 | Comparative steel |
| 22 | 830 | 180 | 0.35 | 1000 | 120 | 2.10 | 17.01 | 19.14 | 1.65 | Comparative steel |
| 23 | 830 | 180 | 0.35 | 900 | 110 | 2.70 | 21.00 | 23.63 | 1.72 | Comparative steel |
| 24 | 830 | 180 | 0.35 | 900 | 110 | 1.80 | 15.50 | 17.44 | 1.64 | Comparative steel |
| 25 | 830 | 180 | 0.35 | 900 | 107 | 1.89 | 16.40 | 18.45 | 1.66 | Comparative steel |
| 26 | 830 | 180 | 0.35 | 900 | 48 | 3.35 | 21.50 | 24.19 | 1.69 | Comparative steel |
| 27 | 830 | 180 | 0.35 | 900 | 115 | 1.95 | 16.90 | 19.01 | 1.65 | Comparative steel |
| 28 | 830 | 180 | 0.35 | 900 | 50 | 3.00 | 22.10 | 24.86 | 1.70 | Comparative steel |
| 29 | 830 | 180 | 0.35 | 900 | 90 | 1.95 | 16.50 | 18.56 | 1.65 | Comparative steel |
| 30 | 830 | 180 | 0.35 | 900 | 72 | 2.40 | 18.50 | 20.81 | 1.70 | Comparative steel |
| 31 | 830 | 180 | 0.35 | 900 | 67 | 2.85 | 19.50 | 21.95 | 1.70 | Comparative steel |
| 32 | 830 | 180 | 0.20 | 900 | 124 | 1.65 | 11.00 | 12.38 | 1.68 | present invention |
| 33 | 830 | 180 | 0.20 | 900 | 123 | 1.66 | 11.02 | 12.40 | 1.68 | present invention |
| 34 | 830 | 180 | 0.20 | 900 | 60 | 2.36 | 13.01 | 14.64 | 1.68 | Comparative steel |
| 35 | 830 | 180 | 0.20 | 900 | 125 | 2.30 | 12.80 | 14.40 | 1.68 | Comparative steel |
| 36 | 830 | 180 | 0.50 | 900 | 53 | 3.10 | 28.00 | 31.50 | 1.72 | Comparative steel |
| 37 | 830 | 180 | 0.50 | 900 | 130 | 2.50 | 29.40 | 34.00 | 1.72 | Comparative steel |
| 38 | 830 | 180 | 0.50 | 900 | 129 | 2.24 | 28.70 | 33.50 | 1.72 | Comparative steel |

Embodiment 5

The crucial point of the present invention is to reduce the S content in an electromagnetic steel sheet with a prescribed composition and a sheet thickness of 0.1 to 0.35 mm, along with decreasing the high frequency iron loss by adding Sb and Sn.

The problem described above can be solved by an electromagnetic steel sheet with a thickness of 0.1 to 0.35 mm and low iron loss in the high frequency region, containing, in % by weight, 0.005% or less of C, more than 3.0% and 4.5% or less of Si, 0.05 to 1.5% by weight of Mn, 0.2% or less of P, 0.005% or less of N, 0.1 to 1.5% of Al, 4.5% or less of Si+Al, 0.001% or less of S and 0.001 to 0.05% of Sb+Sn/2, with a substantial balance of Fe.

In addition, lower iron loss values can be also obtained by limiting the Sb+Sn/2 content in the range of 0.001 to 0.005%.

The phrase of "a substantial balance of Fe" as used herein means that the steel to which trace amount of elements other than inevitable impurities are added in a range not interfering the effect of the present invention is within the scope of the present invention. In the specification of the present invention, "%" and "ppm" representing the composition of the steel refers to "% by weight" and "ppm by weight", respectively, unless otherwise stated.

The Reason Why the S Content is Limited

To investigate the effect of the S content on the iron loss at first, the investigators of the present invention melted a steel with a composition of 0. 00 15% of C, 3.51% of Si, 0.18% of Mn, 0.1% of P, 0.50% of Al and 0.0020% of N, with varying amount of S from trace to 40 ppm, in vacuum in the laboratory, followed by washing with an acid solution after hot-rolling.

The hot-rolled sheet was then annealed in an atmosphere of 75% $H_2$-25% $N_2$ at 830° C. for 3 hours, cold-rolled to a sheet thickness of 0.35 mm, followed by a finish annealing in an atmosphere of 10% $H_2$-90% $N_2$ at 950° C. for 2 minutes. Magnetic properties were measured by a 25 cm Epstein method. The iron loss was evaluated by $W_{10/400}$, because electric appliances driven at a high frequency region of around 400 Hz can be magnetized to about 1.0T.

Figure 23:
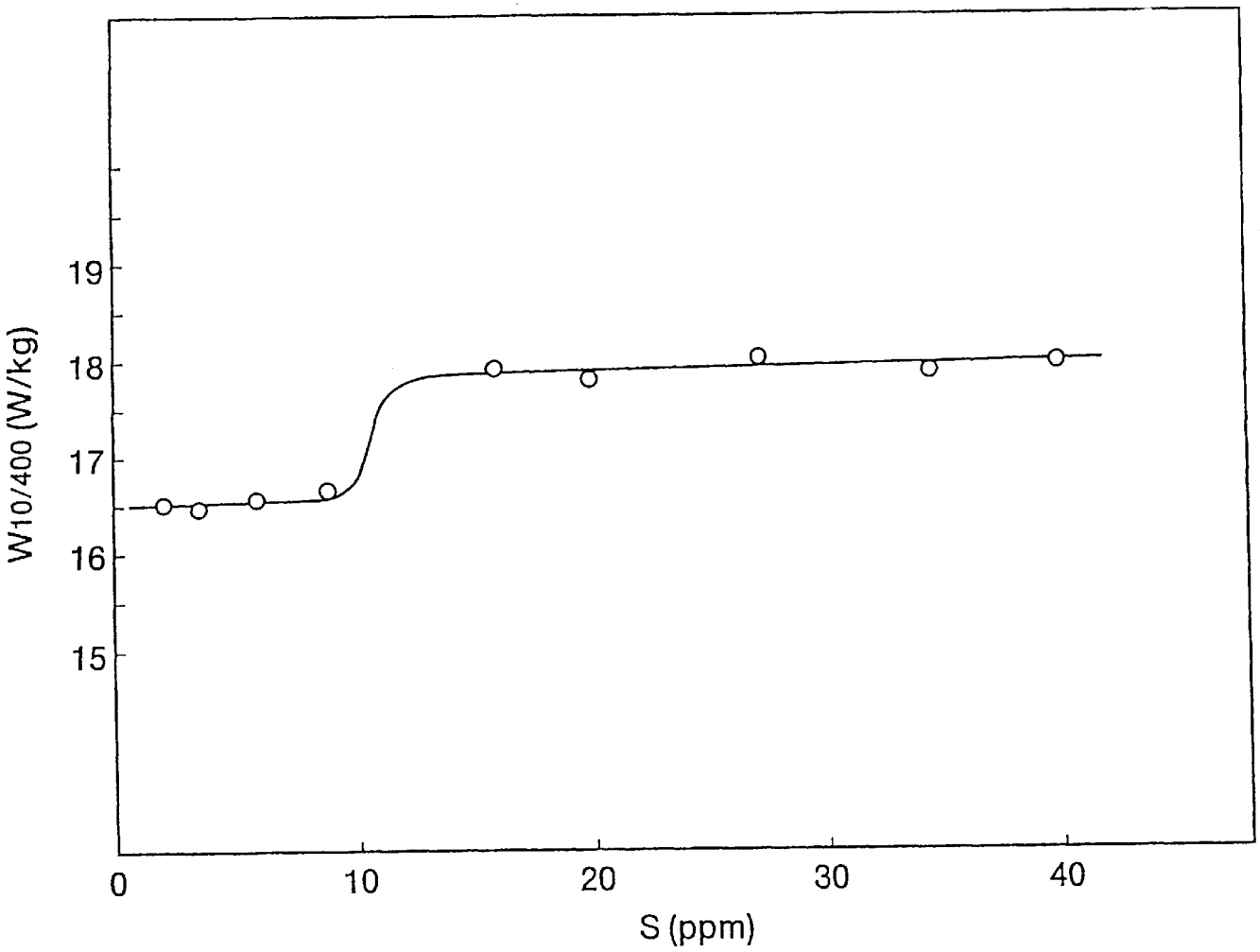
FIG. 23 a graph indicating the relation between the S content and iron loss after the finish annealing.

The relation between the S content of the material with a thickness of 0.35 mm and the iron loss is shown in FIG. 23. It may be clear from FIG. 23 that the iron loss $W_{10/400}$ at a frequency of 400 Hz in the material with a thickness of 0.35 mm is largely decreased when the S content is 10 ppm or less. To investigate the cause of this iron loss change due to decrease of the S content, the texture of the material was observed under an optical microscope. The result revealed that crystal grains were coarsened when the S content is 0.001% or less. This is probably because the MnS content in the steel has decreased.

It is generally recognized that the iron loss at high frequencies is increased when the crystal grains in the electromagnetic steel with a thickness of 0.5 mm are coarsened. In the present experiment, on the contrary, the iron loss at high frequency regions had decreased with coarsening of the crystal grains. This fact may be comprehended that the eddy current loss had largely decreased in the steel sheet with a thickness of 0.35 mm compared with that of steel sheet of 0.5 mm thickness since decrease in the hysteresis loss due to coarsening of the crystal grains effectively contributes for decreasing the iron loss at high frequency regions, even when the frequency is 400 Hz.

From the foregoing discussions, it can be concluded that reduction of the S content in the steel sheet with a thickness of 0.35 mm is effective for reducing the iron loss at high frequencies. Accordingly, the S content is limited to 10 ppm or less in the present invention.

The Reason Why Sheet Thickness is Limited

Reduction in the high frequency iron loss accompanying to the reduced S content was evident in the electromagnetic steel sheet with a thickness of 0.35 mm or less as the sheet thickness becomes thinner. However, since the cold-rolling would be difficult in the sheet with a thickness of 0.1 mm or less, along with burdening clients with much labor for laminating the steel sheets, the sheet thickness was determined to be 0.1 to 0.35 mm in the present invention.

The methods for reducing the high frequency iron loss were further investigated.

The reason Why the Sb and Sn Contents are Limited

Increasing the Si and Al contents to increase the inherent resistivity is usually effective for decreasing the high frequency iron loss. However, when the content of Si+Al is over 4.5%, cold-rolling be comes difficult since the steel sheet becomes fragile, so that merely using the methods for increasing the Si and Al contents soon encounter the limit for decreasing the iron loss. Therefore, the investigators of the present invention fumbled for some methods for decreasing the iron loss by adding quite different elements in the component.

As seen in FIG. 23, the iron loss exhibits a gentle decline when the S content is 10 ppm or less, finally reaching to an iron loss of only about 16.5 W/kg provided the S content be further reduced.

Based on the inventors' idea that decrease of the iron loss in the material with a trace amount of S of 10 ppm or less might be hindered by some unknown factors other than MnS, the texture of the material was observed under an optical microscope, whereby notable nitride layers were found on the steel surface layer in the area of the S content of 10 ppm or less. The nitride layer was rare in the S content region of less than 10 ppm. This nitride layer might be formed during annealing of the hot-rolled sheet and finish annealing.

The cause of acceleration of the nitride forming reaction with the decrease of the S content is supposed as follows. Since S is an element liable to be concentrated on the surface and at the grain boundaries, it is concentrated on the steel sheet surface in the S content region of more than 10 ppm to suppress absorption of nitrogen during annealing. In the S content region of 10 ppm or less, on the other hand, the suppression effect for absorption of nitrogen ascribed to S may be deteriorated.

The investigators expected that the nitride layer predominantly formed in the material with a trace amount of S might interfere the iron loss to be reduced. Based on this concept, the investigators had an idea that the iron loss could be further reduced when some elements that is capable of suppressing the absorption of nitrogen and does not prevent the crystal grains from being well developed. Through intensive studies, the investigators found that addition of Sb and Sn is effective.

Figure 24:
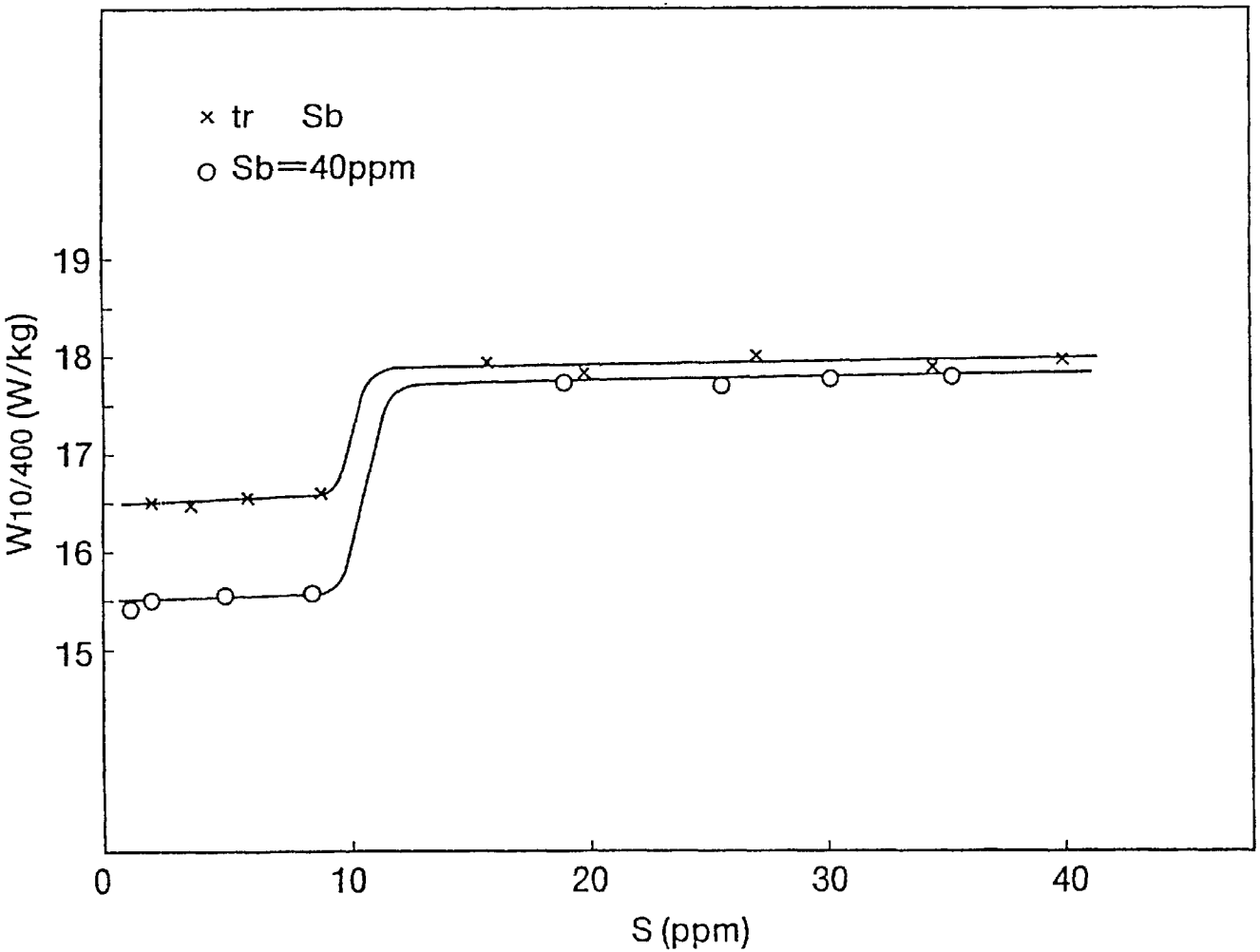
FIG. 24 is a graph indicating the relation between the S and Sb contents and iron loss after the finish annealing.

The sample prepared by adding 40 ppm of Sb to the sample shown in FIG. 23 was tested under same conditions as those in the foregoing examples. The results are shown in FIG. 24. Let the effect for reducing the iron loss be noticed. While the iron loss is reduced only by about 0.2 to 0.3 W/kg in the S content region of more than 10 ppm by the addition of Sb, the value is lowered by 1.0 W/kg by the addition of Sb, indicating a remarkable effect of Sb on reduction of the iron loss when the S content is small. No nitride layers were not observed in this sample irrespective of the S content. This results suggests that Sb is concentrated on the surface layer of the steel sheet to suppress absorption of nitrogen.

From the discussions above, addition of Sb in the material with a trace amount of S with a sheet thickness of 0.35 mm clearly makes it possible to largely decrease the iron loss at high frequency regions.

To investigate the optimum amount of addition of Sb, a steel with a composition of 0.0023% of C, 3.51% of Si, 0.30% of Mn, 0.02% of P, 0.50% of Al, 0.0004% of S and 0.0015% of N, with a varying amount of Sb from trace to 700 ppm, was melted in vacuum in the laboratory followed by washing with an acid solution after hot-rolling. Subsequently, this hot-rolled sheet was annealed in an atmosphere of 75% $H_2$-25% $N_2$ at 830° C. for 3hours. The sheet was cold-rolled to a thickness of 0.35 mm followed by a finish annealing in an atmosphere of 10% $H_2$-90% $N_2$ at 950° C. for 2 minutes.

Figure 25:
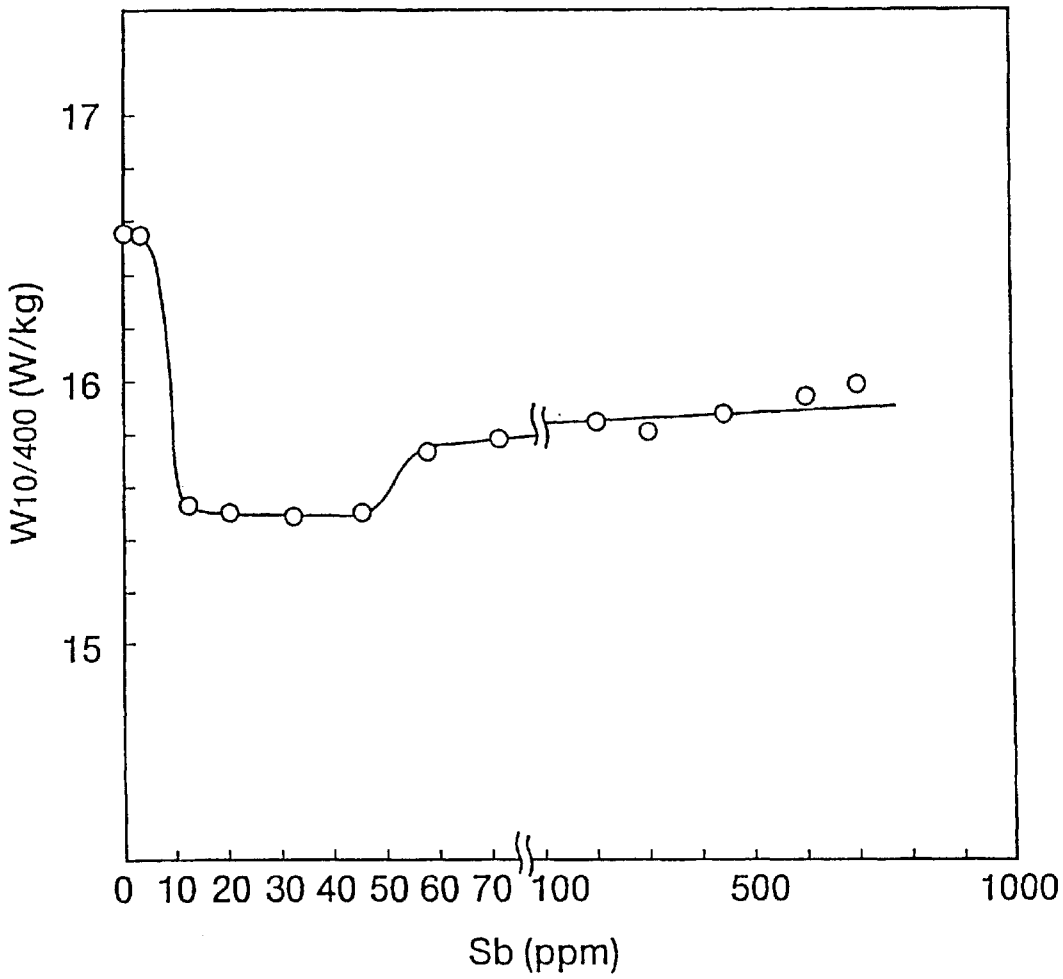
FIG. 25 is a graph indicating the relation between the Sb content and iron loss after the finish annealing.

FIG. 25 shows the relation between the Sb content of the sample thus obtained and the iron loss $W/_{10/400}$. It can be understood from FIG. 25 that the iron loss decreases in the Sb content region of 20 ppm, attaining $W_{10/400}$ of 15.5 W/kg. When the Sb content is further increased to 50 ppm or more, the iron loss gradually increases with the increment of the Sb content.

To investigate the cause of the iron loss increment in the Sb content region of 50 ppm or more, the texture of the material was observed under an optical microscope, finding that, though no nitride layers were found, the mean crystal grain diameter had became a little smaller. This is probably because, though not certain, the grains could not be grown well due to a grain boundary drag effect of Sb.

However, the iron loss of the steel sheet remains low compared with the steel sheet not containing Sb even when Sb is added to an amount of 700 ppm.

From these results, the Sb content was defined to 10 ppm and its upper limit was limited to 500 ppm from the economical point of view. Considering the iron loss values, the content should be 10 ppm or more and 50 ppm or less, more desirably 20 ppm or more and 40 ppm or less.

Since Sn is also an element, like Sb, liable to be segregated at grain boundaries, the same effect for suppressing nitride formation may be expected. To investigate the optimum amount of addition of Sn, a steel with a composition of 0.0020% of C, 3.00% of Si, 0.20% of Mn, 0.02% of P, 1.05% of Al, 0.0003% of S and 0.0015% of N, with a varying amount of Sn from trace to 1400 ppm, was melted in vacuum in the laboratory followed by washing with an acid solution after hot-rolling. Subsequently, this hot-rolled sheet was annealed in an atmosphere of 75% $H_2$-25% $N_2$ at 830° C. for 3 hours. The sheet was cold-rolled to a thickness of 0.35 mm followed by a finish annealing in an atmosphere of 10% $H_2$-90% $N_2$ at 950° C. for 2 minutes.

Figure 26:
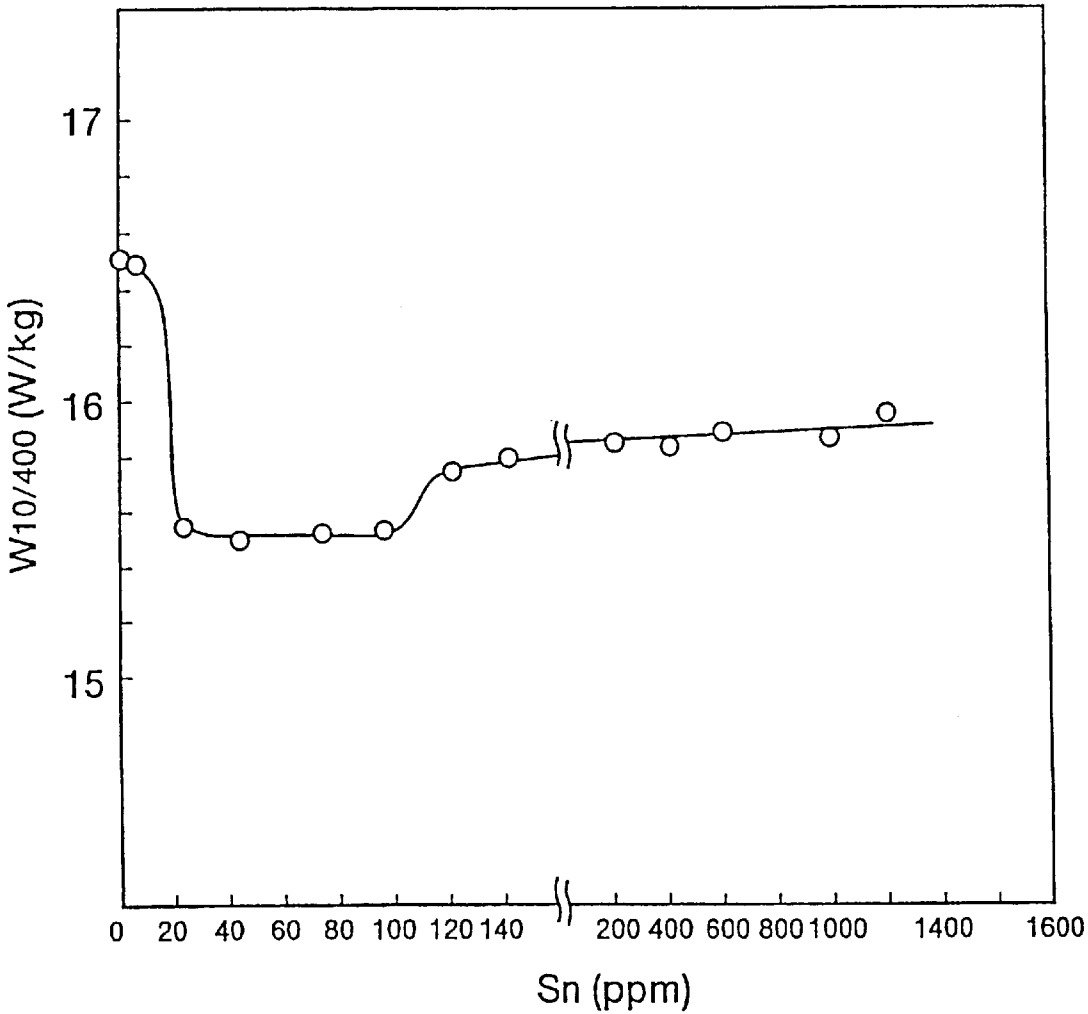
FIG. 26 is a graph indicating the relation between the Sn content and iron loss after the finish annealing.

FIG. 26 shows the relation between the Sn content of the sample thus obtained and the iron loss $W_{10/400}$. It is understood from FIG. 26 that the iron loss decreases in the Sn content region of 20 ppm or more, attaining an iron loss value $W_{10/400}$ of 5.5 W/kg. When the Sn content is further increased to more than 100 ppm, however, the iron loss gradually increases with the increase of the Sn content. However, the iron loss remains lower than the steel without any Sn even when Sn is added to a concentration of 1400 ppm.

The difference of the effect between Sn and Sb can be recognized as follows.

Since Sn has a smaller segregation coefficient than Sb, about two hold of Sn than Sb is needed for suppressing nitride formation by surface segregation of Sn. Therefore, the iron loss is decreased by the addition of Sn of 20 ppm or more. The required amount of addition by which the iron loss starts to increase due to a drag effect by segregation of Sn at the grain boundaries is also about twice of the Sb content because Sn has a smaller segregation coefficient than Sb. Accordingly, an addition of 100 ppm or more of Sn allows the iron loss to be slowly increased.

From the facts described above, the Sn content is determined to be 20 ppm or more, the upper limit being 1000 ppm considering the economical performance. From the point of iron loss, the content is desirably 20 ppm or more and 100 ppm or less and more preferably 30 ppm or more and 90 ppm or less.

As hitherto discussed, the mechanisms of Sb and Sn for suppressing the nitride formation are identical with each other. Therefore, a simultaneous addition of Sb and Sn makes it possible to obtain similar suppression effect for the nitride formation as well. However, Sn should be added twice as large as the amount of Sb in order to allow Sn to displayed the same degree of effect as that of Sb. Accordingly, the amount of Sb+Sn/2 should be 0.001% or more and 0.05% or less, more desirably 0.001% or more and 0.005% or less, when Sb and Sn are simultaneously added.

The Reason Why the Content of the Other Elements are Limited

The C content is limited to 0.005% or less owing to the problem of magnetic aging.

Since Si is an effective element for increasing inherent resistivity of the steel sheet, it is added in an amount of more than 3%. The upper limit of the Si content was limited to 4.5%, on the other hand, because cold-rolling becomes difficult when its content is more than 4.5%.

More than 0.05% of Mn is needed in order to prevent red brittleness during hot-rolling. However, since the magnetic flux density is decreased at the Mn content of 1.5% or more, its range was limited to 0.05 to 1.5%.

While P is an element required for improving punching property of the steel sheet, its content was limited to 0.2% or less because an addition of more than 0.2% makes the steel sheet fragile.

Since a large amount of N makes a lot of AlN to precipitate and, when AlN grains are coarsened, grains can not be well developed and the iron loss increases. Therefore, its content was limited to 0.005% or less.

Fine AlN grains formed by adding a trace amount Al tend to deteriorate the magnetic properties. Therefore, its lower limit should be 0.1% or less to coarsen the AlN grains. The upper limit is determined to be 1.5% or less, on the other hand, because the magnetic flux density is decreased at an Al content of 1.5% or more.

When the amount of (Si+Al) exceeds 4.5%, cold-rolling becomes so difficult that its upper limit is adjusted to 4.5%.

Production Method

Conventional methods for producing the electromagnetic steel sheet may be applied in the present invention provided the contents of S, Sb and Sn as well as the content of the prescribed elements be in a given range. The molten steel refined in a converter is de-gassed to adjust to a prescribed composition, followed by subjecting to casting and hot-rolling. The finishing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing.

Example

By using a steel shown in Table 13, the steel was subjected to casting after adjusting it to a given composition by applying a de-gassing treatment after refining in the converter. The steel was hot-rolled to a sheet thickness of 2.0 mm after heating the slab at a temperature of 1150° C. for 1 hour. The finishing temperature and coiling temperature were 750° C. and 610° C., respectively. Then, this hot-rolled sheet was washed with an acid solution followed by hot-rolling and annealing under the conditions shown in Table 14 and Table 15. Then, the sheet was cold-rolled to a thickness of 0.1 to 0.5 mm and finally subjected to a finish annealing under the finish anneal conditions shown in Table 14 and Table 15. The No.'s in Table 13, Table 14 and Table 15 denote the steel sheet number that is common among the tables.

The magnetic measurement was carried out using a 25 cm Epstein test piece. The magnetic characteristics of each steel sheet are listed in Table 14 to Table 15 together. The annealing atmosphere of the hot-rolled sheet was 75% $H_2$-25% $N_2$ while that of the finish annealing was 7510% $H_2$-90 5 $N_2$.

The steel sheet numbers 1 to 16 correspond to the steel sheet of the example according to the present invention. Both of the iron loss values $W_{10/400}$ and $W_{5/1k}$ in these examples are smaller than the corresponding values in the comparative examples having the same sheet thickness.

In the comparative examples, the steel sheet No. 17 has a very large iron loss since the S and (Sb+Sn) contents are out of the range of the present invention.

The iron loss in the steel sheet No. 18 is very large because the (Sb+Sn) content and sheet thickness are out of the range of the present invention.

The iron in the steel sheet No. 19 is also so large because its sheet thickness is out of the range of the present invention.

The S and (Sb;Sn) contents in the steel sheets No. 20 and No. 24 are out of the range of the present invention thereby their iron loss values are larger than those of the steel sheet according to the present invention.

The steel sheets No. 22, No. 23 and No. 25 also have the (Sb+Sn) content out of the range of the present invention, so that their iron loss values are larger than those of the steel sheets according to the present invention having the same sheet thickness.

The iron loss of the steel sheet No. 26 is large because of its Si content out of the range of the present invention.

The Si and (Si+Al) contents of the steel sheet No. 27 is over the range of the present invention. Therefore, the steel could not be processed as a commercial product because the steel sheet was broken during rolling process.

The steel sheet No. 28 has a lower Al content than the range of the present invention, so that the iron loss is large.

Although the iron loss is small in the steel sheet No. 29, the magnetic flux density B50 is also small because the Al and (Si+Al) contents are larger than the range of the present invention.

The steel sheet No. 30 has a large iron loss because the Mn content is smaller than the range of the present invention. On the other hand, the iron loss is small but the magnetic flux density is also small in the steel sheet No. 31 because the Mn content exceeds the range of the present invention.

The steel sheet No. 32 has a large iron loss besides having a problem of magnetic aging since the C content is over the range of the present invention.

The steel sheet No. 33 has a N content larger than the range of the present invention, so that the iron loss is large.

TABLE 13

| No. | C | Si | Mn | P | S | Al | Sb | Sn | N |
|---|---|---|---|---|---|---|---|---|---|
| 1 | 0.0021 | 3.50 | 0.19 | 0.021 | 0.0004 | 0.50 | 0.0010 | tr. | 0.0023 |
| 2 | 0.0018 | 3.51 | 0.18 | 0.025 | 0.0004 | 0.50 | 0.0040 | tr. | 0.0025 |
| 3 | 0.0015 | 3.51 | 0.18 | 0.025 | 0.0008 | 0.50 | 0.0040 | tr. | 0.0025 |
| 4 | 0.0018 | 3.51 | 0.18 | 0.025 | 0.0004 | 0.50 | 0.0040 | tr. | 0.0020 |
| 5 | 0.0021 | 3.49 | 0.20 | 0.020 | 0.0004 | 0.50 | 0.0060 | tr. | 0.0025 |
| 6 | 0.0021 | 3.55 | 0.20 | 0.024 | 0.0004 | 0.50 | 0.0200 | tr. | 0.0025 |
| 7 | 0.0020 | 3.50 | 0.21 | 0.020 | 0.0004 | 0.50 | 0.0400 | tr. | 0.0026 |
| 8 | 0.0021 | 3.51 | 0.19 | 0.018 | 0.0004 | 0.50 | tr. | 0.0020 | 0.0025 |
| 9 | 0.0018 | 3.49 | 0.18 | 0.020 | 0.0004 | 0.50 | tr. | 0.0060 | 0.0025 |
| 10 | 0.0022 | 3.50 | 0.18 | 0.022 | 0.0004 | 0.50 | tr. | 0.0120 | 0.0018 |
| 11 | 0.0018 | 3.52 | 0.18 | 0.022 | 0.0004 | 0.50 | tr. | 0.0400 | 0.0016 |
| 12 | 0.0022 | 3.50 | 0.18 | 0.018 | 0.0004 | 0.50 | tr. | 0.0800 | 0.0026 |
| 13 | 0.0022 | 3.50 | 0.18 | 0.018 | 0.0004 | 0.50 | 0.0010 | 0.0020 | 0.0026 |
| 14 | 0.0022 | 3.50 | 0.18 | 0.018 | 0.0004 | 0.50 | 0.0040 | 0.0080 | 0.0026 |
| 15 | 0.0022 | 3.55 | 0.19 | 0.023 | 0.0002 | 0.50 | 0.0040 | tr. | 0.0015 |
| 16 | 0.0022 | 3.70 | 0.19 | 0.023 | 0.0002 | 0.50 | tr. | 0.0050 | 0.0015 |
| 17 | 0.0021 | 3.50 | 0.20 | 0.020 | 0.0020 | 0.50 | tr. | tr. | 0.0025 |
| 18 | 0.0020 | 3.51 | 0.20 | 0.020 | 0.0004 | 0.50 | tr. | tr. | 0.0023 |
| 19 | 0.0020 | 3.51 | 0.20 | 0.020 | 0.0020 | 0.50 | 0.0040 | tr. | 0.0023 |
| 20 | 0.0021 | 3.49 | 0.20 | 0.018 | 0.0020 | 0.50 | tr. | tr. | 0.0020 |
| 21 | 0.0021 | 3.49 | 0.20 | 0.018 | 0.0020 | 0.50 | 0.0040 | tr. | 0.0020 |
| 22 | 0.0020 | 3.55 | 0.21 | 0.020 | 0.0004 | 0.50 | tr. | tr. | 0.0026 |
| 23 | 0.0022 | 3.52 | 0.23 | 0.020 | 0.0004 | 0.50 | 0.0600 | tr. | 0.0020 |
| 24 | 0.0022 | 3.55 | 0.19 | 0.023 | 0.0040 | 0.50 | tr. | tr. | 0.0015 |
| 25 | 0.0022 | 3.55 | 0.19 | 0.023 | 0.0002 | 0.50 | tr. | tr. | 0.0015 |
| 26 | 0.0022 | 2.55 | 0.19 | 0.018 | 0.0002 | 0.50 | 0.0040 | tr. | 0.0015 |
| 27 | 0.0022 | 4.70 | 0.19 | 0.018 | 0.0004 | 0.50 | 0.0040 | tr. | 0.0015 |
| 28 | 0.0020 | 3.48 | 0.18 | 0.021 | 0.0002 | 0.02 | 0.0040 | tr. | 0.0018 |
| 29 | 0.0020 | 3.48 | 0.18 | 0.021 | 0.0002 | 1.70 | 0.0040 | tr. | 0.0018 |
| 30 | 0.0025 | 3.50 | 0.02 | 0.020 | 0.0002 | 0.52 | 0.0040 | tr. | 0.0015 |
| 31 | 0.0020 | 3.55 | 1.80 | 0.021 | 0.0004 | 0.50 | 0.0040 | tr. | 0.0050 |
| 32 | 0.0060 | 3.50 | 0.19 | 0.025 | 0.0004 | 0.50 | 0.0040 | tr. | 0.0015 |
| 33 | 0.0022 | 3.55 | 0.18 | 0.021 | 0.0004 | 0.50 | 0.0040 | tr. | 0.0065 |

TABLE 14

| No. | Hot-rolled sheet annealing temperature (° C.) | Hot-rolled sheet annealing time (min) | Sheet thickness (mm) | Finish annealing temperature (° C.) × 2 min | W10/400 (W/kg) | W5/1k (W/kg) | B10 (T) | Note |
|---|---|---|---|---|---|---|---|---|
| 1 | 830 | 180 | 0.35 | 920 | 15.53 | 17.92 | 1.44 | present invention |
| 2 | 830 | 180 | 0.35 | 920 | 15.50 | 17.90 | 1.44 | present invention |
| 3 | 830 | 180 | 0.35 | 920 | 15.55 | 17.95 | 1.44 | present invention |
| 4 | 950 | 2 | 0.35 | 920 | 15.55 | 17.95 | 1.44 | present invention |
| 5 | 830 | 180 | 0.35 | 920 | 15.79 | 18.19 | 1.44 | present invention |
| 6 | 830 | 180 | 0.35 | 920 | 15.83 | 18.23 | 1.44 | present invention |
| 7 | 830 | 180 | 0.35 | 920 | 15.84 | 18.25 | 1.44 | present invention |
| 8 | 830 | 180 | 0.35 | 920 | 15.52 | 17.92 | 1.44 | present invention |
| 9 | 830 | 180 | 0.35 | 920 | 15.50 | 17.90 | 1.44 | present invention |
| 10 | 830 | 180 | 0.35 | 920 | 15.77 | 18.17 | 1.44 | present invention |
| 11 | 830 | 180 | 0.35 | 920 | 15.82 | 18.22 | 1.44 | present invention |
| 12 | 830 | 180 | 0.35 | 920 | 15.89 | 18.29 | 1.44 | present invention |
| 13 | 830 | 180 | 0.35 | 920 | 15.51 | 17.91 | 1.44 | present invention |
| 14 | 830 | 180 | 0.35 | 920 | 15.80 | 18.20 | 1.44 | present invention |
| 15 | 830 | 180 | 0.20 | 920 | 10.50 | 11.91 | 1.44 | present invention |
| 16 | 830 | 180 | 0.20 | 920 | 10.55 | 11.95 | 1.42 | present invention |

TABLE 15

| No. | Hot-rolled sheet annealing temperature (° C.) | Hot-rolled sheet annealing time (min) | Sheet thickness (mm) | Finish annealing temperature (° C.) × 2 min | W10/400 (W/kg) | W5/1k (w/kg) | B10 (T) | Note |
|---|---|---|---|---|---|---|---|---|
| 17 | 830 | 180 | 0.50 | 920 | 22.00 | 24.41 | 1.45 | Comparative steel |
| 18 | 830 | 180 | 0.50 | 920 | 25.00 | 27.39 | 1.45 | Comparative steel |
| 19 | 830 | 180 | 0.50 | 920 | 24.50 | 26.90 | 1.45 | Comparative steel |
| 20 | 950 | 180 | 0.35 | 920 | 18.00 | 20.40 | 1.44 | Comparative steel |
| 21 | 830 | 180 | 0.35 | 920 | 17.80 | 20.20 | 1.44 | Comparative steel |
| 22 | 830 | 180 | 0.35 | 920 | 16.50 | 18.91 | 1.44 | Comparative steel |
| 23 | 830 | 180 | 0.35 | 920 | 15.92 | 18.36 | 1.44 | Comparative steel |
| 24 | 830 | 180 | 0.20 | 920 | 12.00 | 14.25 | 1.42 | Comparative steel |
| 25 | 830 | 180 | 0.20 | 920 | 11.90 | 14.20 | 1.42 | Comparative steel |
| 26 | 830 | 180 | 0.35 | 920 | 17.00 | 19.40 | 1.44 | Comparative steel |
| 27 | 830 | 180 | Sheet is broken at cold rolling | | — | — | — | Comparative steel |
| 28 | 830 | 180 | 0.35 | 920 | 18.50 | 20.90 | 1.44 | Comparative steel |
| 29 | 830 | 180 | 0.35 | 920 | 15.31 | 17.71 | 1.40 | Comparative steel |
| 30 | 830 | 180 | 0.35 | 920 | 17.10 | 19.51 | 1.44 | Comparative steel |
| 31 | 830 | 180 | 0.35 | 920 | 15.20 | 17.60 | 1.41 | Comparative steel |
| 32 | 830 | i80 | 0.35 | 920 | 16.00 | 18.40 | 1.44 | Comparative steel |
| 33 | 830 | 180 | 0.35 | 920 | 16.50 | 18.90 | 1.44 | Comparative steel |

Embodiment 6

The crucial point of the present invention is to obtain a non-oriented electromagnetic steel sheet with a low iron loss by suppressing the amount of the nitride on the surface of the steel sheet to a trace amount after the finish annealing, based on the novel discovery that the iron loss is not reduced even when the S content is limited to a trace amount of 10 ppm or less because a notable nitride layer is formed on the surface area in the composition range containing a trace amount of S.

The purpose above can be attained by a non-oriented electromagnetic steel sheet characterized by containing, in % by weight, 4.0% or less of C, 0.05 to 1.0% of Mn, 0.1 to 1.0% of Al and 0.001% of S (including zero) with a substantial balance of Fe, wherein the content of nitride within an area of 30 $\mu$m from the surface of the steel after finish annealing is 300 ppm or less.

Figure 27:
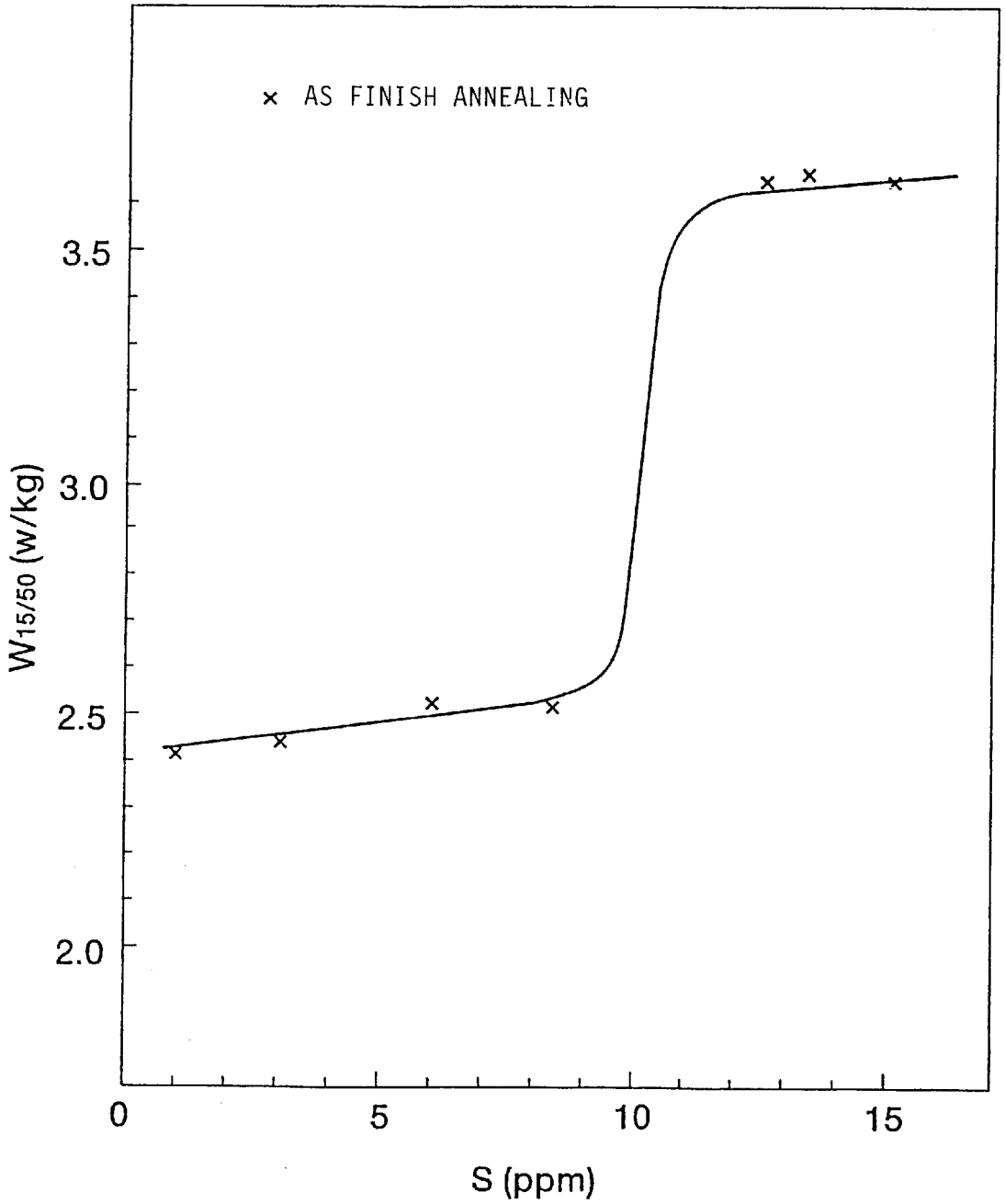
FIG. 27 is a graph indicating the relation between the S content and iron loss after the finish annealing.

Procedure of the Invention and the Reason Why the Contents of S and Nitride are Limited To investigate the effect of S on the iron loss, the investigators of the present invention melted a steel with a composition of 0.0025% of C, 2.75% of Si, 0.20% of Mn, 0.010% of P, 0.31% of Al and 0.0018% of N, with a varying content of S from trace to 15 ppm, in the laboratory followed by washing with an acid solution after hot-rolling. This hot-rolled sheet was subsequently annealed in an atmosphere of 75% $H_2$-25% of $N_2$ at 830° C. for 3 hours. Then, the steel sheet was cold-rolled to a thickness of 0.5 mm followed by a finish annealing in an atmosphere of 10% $H_2$-90% $N_2$ at 900° C. for 2 minutes. The relation between the S content of the sample and iron loss $W_{15/50}$ is shown in FIG. 27 (the mark × in FIG. 27). The magnetic properties were measured using a 25 cm Epstein method.

It is evident from FIG. 27 that a large degree of decrease in the iron loss ($W_{15/50}$=2.5 W/kg) was attained with a critical point at around S=10 ppm when the S content was adjusted to 10 ppm or less. This is because grains were made to be well developed when the S content was decreased. Based on this result, the S content is limited in a range of 10 ppm or less and 5 ppm or more.

However, decrease rate of the iron loss becomes slow when the S content is 10 ppm or less, making it impossible to reduce the iron loss below 2.4 W/kg.

On the assumption that decrease of iron loss in the material containing a trace amount of S of 10 ppm or less might be inhibited by some unknown factors other than MnS, the investigators of the present invention observed the texture of the material under an optical microscope, finding notable nitride layers on the surface of the steel sheet in the region of the S content of 10 ppm or less. On the contrary, few nitride layers were found in the S content region of more than 10 ppm. These nitride layers may be probably formed during annealing of the hot-rolled sheet and finish annealing carried out in a nitride forming atmosphere.

The reason why the nitride forming reaction has been accelerated with decrease of the S content is supposed as follows. Since S is an element liable to be concentrated on the surface and at grain boundaries, S is concentrated on the surface of the steel in the S content region of more than 10 ppm, thereby suppressing nitrogen absorption from the atmosphere on the surface of the steel sheet during annealing of the hot-press sheet or finish annealing. Accordingly, few nitride layer can be formed or can not be formed at all. In the S content region of 10 ppm or less, on the other hand, the nitrogen absorption suppressing effect is so decreased in the S content region of 10 ppm or less that some nitride layers are formed on the steel surface.

The investigators supposed that the nitride layer notably formed in the S content region of 10 ppm or less might prevent crystal grains from being developed on the surface of the steel sheet to suppress decrease of the iron loss.

Based on this concept, the investigators had an idea that the iron loss of the material containing a trace amount of S might be decreased when the nitride layer on the surface of the steel sheet could be controlled within a given range.

Figure 28:
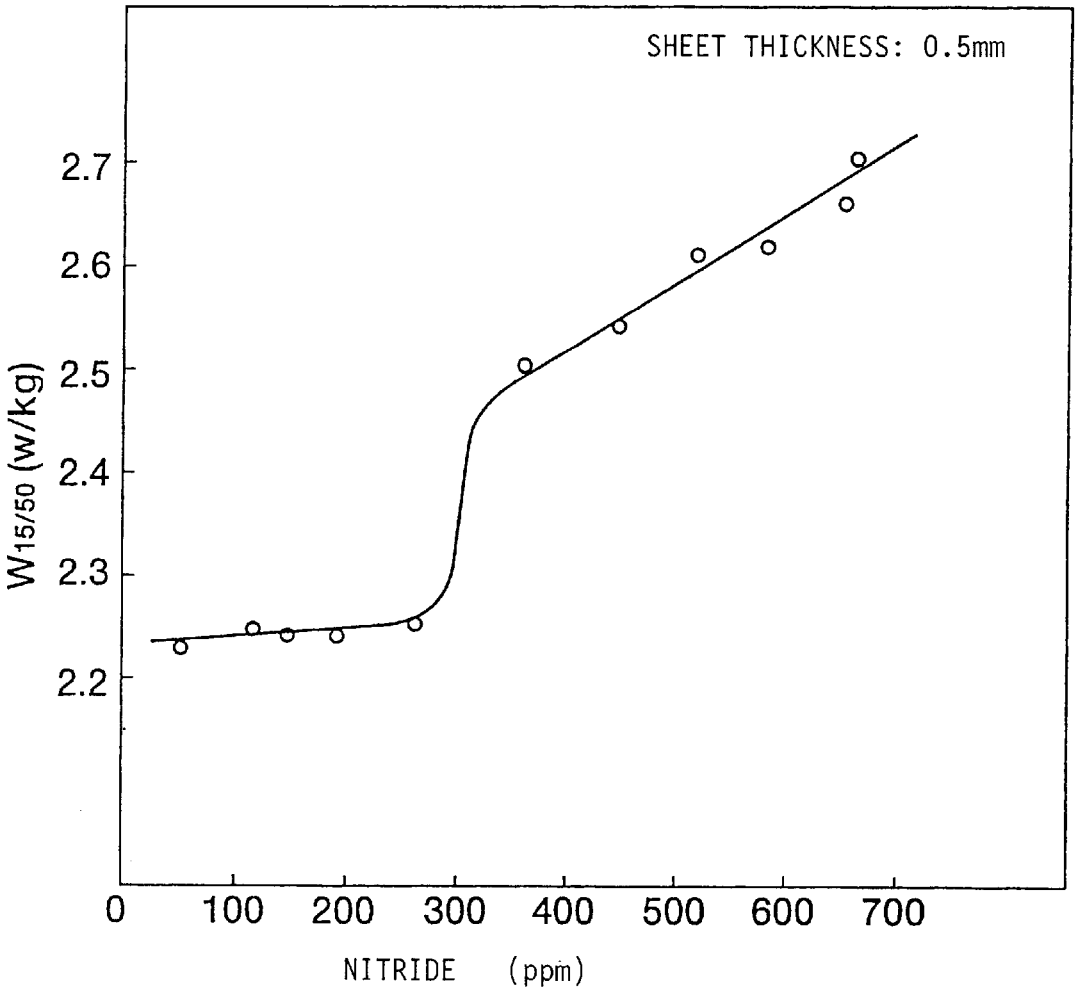
FIG. 28 is a graph indicating the nitride content within an area of 30 $\mu$m from the steel surface and magnetic characteristics after the finish annealing.

FIG. 28 shows the relation between the amount of the nitride within an area of 30 $\mu$m from the surface of the steel sheet and $W_{15/50}$. The nitrides were composed of AlN, $Si_3N_4$ and TiN. The area of 30 $\mu$m from the steel surface was noticed because 80 to 90 percentage of the nitrides were present within this area and they could be rarely found in deeper area. Therefore, it would be sufficient for evaluating the iron loss to determine the amount of the nitride within the area of 30 $\mu$m from the steel surface.

FIG. 28 indicates that the iron loss is decreased when the nitride content within 30 $\mu$m from the steel surface is 300 ppm or less, reaching to the iron loss value of $W_{15/50}$=2.25 W/kg.

From the result above, the nitride content within the area of 30 μm from the steel surface is limited to 300 ppm or less in the present invention.

The Reason Why the Contents of Other Elements are Limited

The reason why the contents of other components should be limited will be described hereinafter.

Si: While Si is an effective element for increasing inherent resistivity of the steel sheet, the upper limit of the Si content is limited to 4.0% because the magnetic flux density is decreased with the decrease of saturation magnetic flux density when its content exceeds 4.0%.

Mn: More than 0.05% of Mn is needed in order to prevent red brittleness during hot-rolling. However, since the magnetic flux density is decreased at the Mn content of 1.0% or more, its range is limited to 0.05 to 1.0%.

Al: Although Al is, like Si, an effective element for enhancing the inherent resistivity, the upper limit of the Al content was limited to 1.0% because the magnetic flux density is decreased with the decrease of saturation magnetic flux density when its content exceeds 1.0%. The lower limit is determined to be 0.1% because AlN grains becomes too fine for the grains to be well developed when the Al content is less than 0.1%.

Production Method

Conventional methods for producing the electromagnetic steel sheet may be applied in the present invention provided the S content and the nitride content on the surface layer of the steel sheet be in a given range. The molten steel refined in a converter is de-gassed to adjust to a prescribed composition, followed by subjecting to casting and hot-rolling. The finishing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing.

The method for adjusting the nitride content on the surface layer of the steel sheet within a given range should not be specifically defined.

Embodiment 7

The crucial point of the present invention is to obtain a non-oriented electromagnetic steel sheet with a low iron loss by limiting the contents of S, Sb and Sn in the steel sheet within a given range along with optimizing the finish annealing condition.

The purpose above can be attained by a method for producing a non-oriented electromagnetic steel sheet characterized by cold-rolling, after a hot rolling, a slab comprising, in % by weight, 0.005% or less of C, 1.0 to 4.0% of Si, 0.05 to 1.0% of Mn, 0.2% or less of P, 0.005% or less of N, 0.1 to 1.0% of Al, 0.001% or less of S and 0.001 to 0.05% of (Sb+Sn/2), with a substantial balance of Fe, followed by a finish rolling at a heating speed of 40° C./sec or less. The heating speed as used herein refers to a mean heating speed from the room temperature to the soaking temperature. A more preferable result will be obtained by limiting the content of (Sb+Sn/2) in a range of 0.001 to 0.005%.

The phrase of "a substantial balance of Fe" as used herein means that the steel to which trace amount of elements other than inevitable impurities are added in a range not invalidating the effect of the present invention is within the scope of the present invention.

Procedure of the Invention and the Reason Why S, Sb and Sn Contents and the Finish Annealing Condition are Limited The investigators of the present invention made a detail investigation of the factors for inhibiting the iron loss reduction in the material containing a trace amount of S of 10 ppm or less.

To investigate the effect of S on the iron loss first, a steel containing 0.0025% of C, 1.65% of Si, 0.20% of Mn, 0.01% of P, 0.31% of Al and 0.0021% of N, with a varying amount of S from trace to 15 ppm, was melted in the laboratory. The slab was hot rolled and annealed in an atmosphere of 100% $N_2$ at 950° C. for 3 minutes followed by a cold rolling to a thickness of 0.5 mm after washing with an acid solution. The subsequent finish anneal was carried out in an annealing atmosphere of 10% $H_2$-90% $N_2$ at a heating speed of 20° C./sec and soaking temperature of 93° C. for 2 minutes. The heating speed as used herein refers to a mean heating speed from the room temperature to the soaking temperature.

Figure 29:
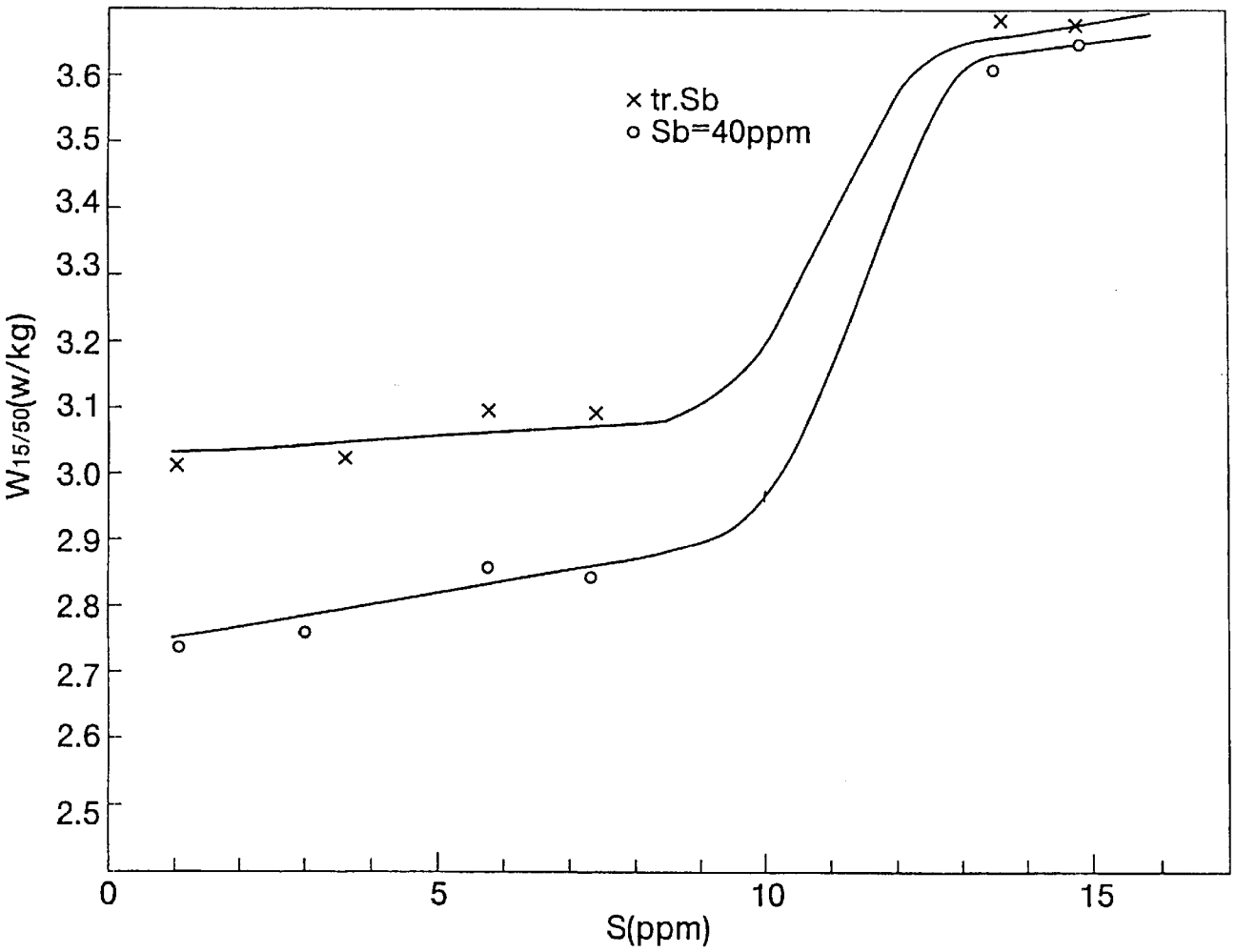
FIG. 29 is a graph indicating the relation between the S content and iron loss after the finish annealing.

FIG. 29 shows the relation between the S content of the sample thus obtained and iron loss $W_{15/50}$ (the mark × in the figure). Magnetic properties were measured by a 25 cm Epstein method. It can be seen from FIG. 29 that a large degree of decrease in the iron loss when the S content is 10 ppm or less, obtaining a material with $W_{15/50}$=3.2 W/kg. This is because grains was made to grow well by decreasing the S content. From the this reason, the S content is limited to 10 ppm or less in the present invention.

However, decrease rate of the iron loss becomes slow when the S content is 10 ppm or less, making it impossible to reduce the iron loss below 3.1 W/kg.

On the assumption that decrease of iron loss in the material containing a trace amount of S of 10 ppm or less might be inhibited by some unknown factors other than MnS, the investigators of the present invention observed the texture of the material under an optical microscope, finding notable nitride layers on the surface of the steel sheet in the region of the S content of 10 ppm or less. On the contrary, few nitride layers were found in the S content region of more than 10 ppm. These nitride layers may be probably formed during annealing of the hot-rolled sheet and finish annealing carried out in a nitride forming atmosphere.

The reason why the nitride forming reaction has been accelerated with decrease of the S content is supposed as follows. Since S is an element liable to be concentrated on the surface and at grain boundaries, S is concentrated on the surface of the steel in the S content region of more than 10 ppm, thereby suppressing nitrogen absorption from the atmosphere on the surface of the steel sheet during finish annealing. In the S content region of 10 ppm or less, on the other hand, the nitrogen absorption suppressing effect is decreased in the S content region of 10 ppm or less.

The investigators supposed that the nitride layer notably formed in the S content region of 10 ppm or less might prevent crystal grains from being developed on the surface of the steel sheet to suppress decrease of the iron loss. Based on this concept, the investigators had an idea that the iron loss of the material containing a trace amount of S might be further decreased when some elements that is capable of suppressing absorption of nitrogen and do not interfere crystal grains to be well developed in the material containing a trace amount of S could be added. Through intensive studies, the investigators found that a trace amount of addition of Sb is effective.

The sample prepared by adding 40 ppm of Sb in the foregoing sample denoted by a mark × was tested under the same conditions and the results are shown in FIG. 29 by a mark ○. Let the iron loss reduction effect of Sb be noticed.

While the iron loss value decreases only by 0.02 to 0.04 W/kg by adding Sb in the S content region of more than 10 ppm, the value has decreased by 0.20 W/kg by the addition of Sb in the S content region of 10 ppm or less, showing an evident iron loss decreasing effect of Sb when the S content is low. Any nitride layers were not observed in this sample irrespective of the S content, probably due to concentrated Sb on the surface layer of the steel sheet during the heating process in the finish annealing to suppress absorption of nitrogen.

To investigate the optimum amount of addition of Sb, a steel containing 0.0026% of C, 1.60% of Si, 0.20% of Mn, 0.020% of P, 0.30% of Al, 0.0004% of S and 0.0020% of N, with a varying amount of Sb from trace to 130 ppm, was melted in the laboratory. The slab was hot rolled and annealed in an atmosphere of 100% $N_2$ at 950° C. for 3 minutes followed by a cold rolling to a thickness of 0.5 mm after washing with an acid solution. The subsequent finish anneal was carried out in an annealing atmosphere of 10% $H_2$-90% $N_2$ at a heating speed of 20° C./sec and soaking temperature of 93° C. for 2 minutes.

Figure 30:
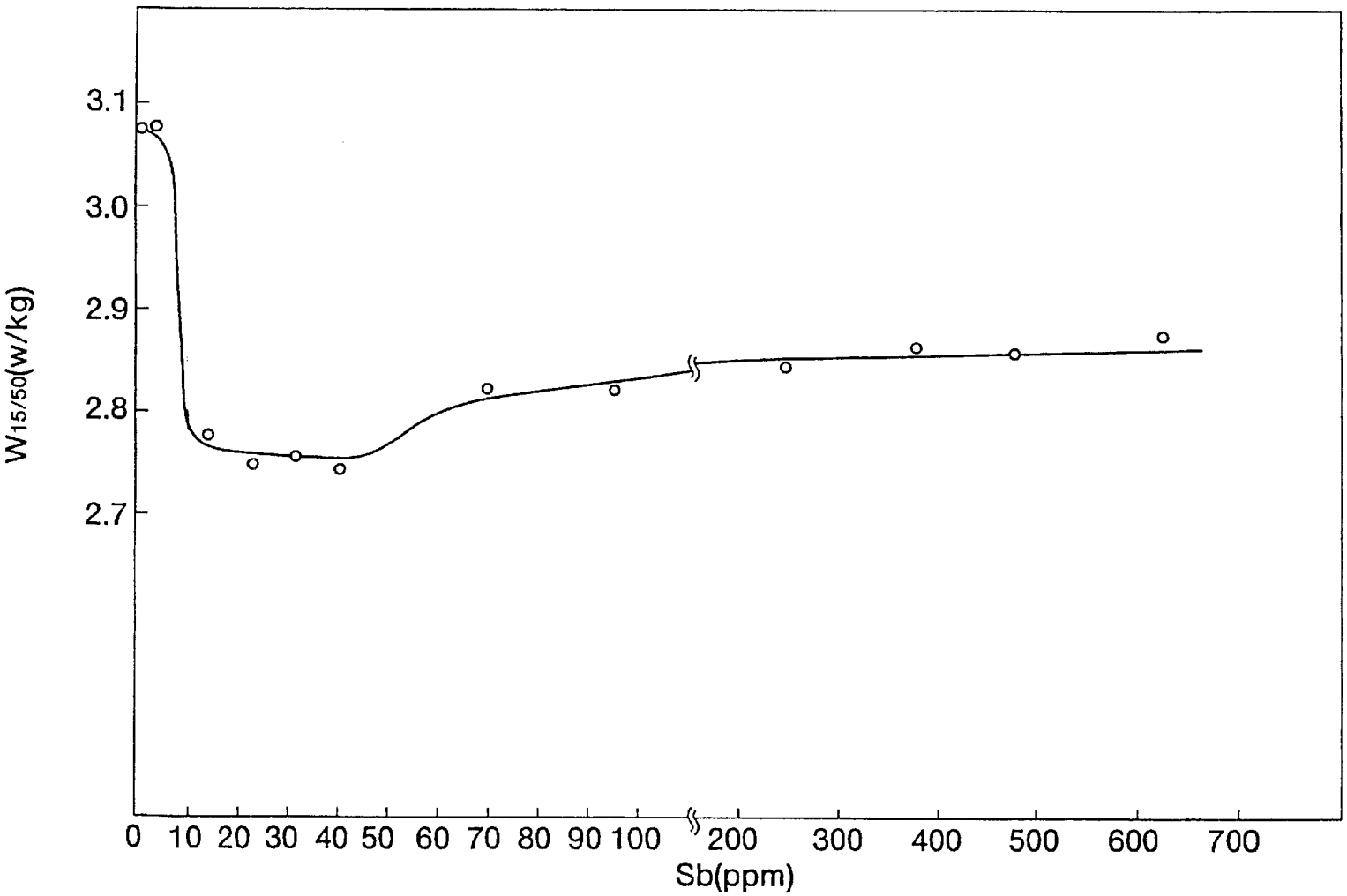
FIG. 30 is a graph indicating the relation between the Sb content and iron loss after the finish annealing.

FIG. 30 shows the relation between the Sb content and iron loss $W_{15/50}$. It can be understood that the iron loss is decreased at the Sb content region of 10 ppm or more. However, the iron loss is decreased again when Sb id further added to a Sb content of more than 50 ppm.

An optical microscopic observation was carried out to investigate the reason of the iron loss increment in the Sb content region of more than 50 ppm. The result revealed that, although no texture of surface fine grain layer was observed, the mean crystal grain diameter was made a little smaller. Since Sb is an element liable to segregate at grain boundaries, though not certain, grains could not be well developed due to a grain boundary drag effect of Sb.

However, the iron loss remains low as compared with the steel without Sb even when Sb is added up to a concentration of 700 ppm. From the results above, the Sb content is determined to be 10 ppm or more, its upper limit being 500 ppm from the economical point of view.

The same iron loss decreasing effect as Sb was also observed when Sn, similarly an element liable to segregate on the surface, was added in a concentration of 20 ppm or more. However, a lower low iron loss as compared with the steel without Sn is maintained even when Sn is added up to 1400 ppm. Accordingly, the Sn content is determined to be 20 ppm or more, the upper limit being 1000 ppm from the economical point of view. By considering the iron loss, its content is limited within a region of 20 ppm or more and 100 ppm or less.

When Sb and Sn was simultaneously added, the iron loss was decreased in the region of the (Sb+Sn/2) content of 10 ppm or more, with a substantial increase of the iron loss when 50 ppm or more of (Sb+Sn/2) was added.

A lower iron loss value compared with that of the steel sheet without Sb and SN was obtained at a (Sb+Sn/2) level of 700 ppm or less. Accordingly, the (Sb+Sn/2) content in the simultaneous addition of Sb and Sn was determined to be 10 ppm or more and its upper limit was limited to 500 ppm from the economical point of view. By considering the iron loss, the desirable concentration is 10 ppm or more and 50 ppm or less.

To investigate the optimum finish annealing conditions, a steel with a composition of 0.0026% of C, 1.62% of Si, 0.20% of Mn, 0.010% of P, 0.0004% of S, 0.0020% of N and 0.004% of Sb was melted in vacuum in the laboratory. After a hot-rolling, the steel sheet was annealed in an atmosphere of 100% H2 at 950° C. for 5 minute, followed by a cold-rolling to a thickness of 0.5 mm after an acid washing. The finish annealing was carried out by variously changing the heating speed up to a temperature of 930° C. and the steel sheet was cooled in the air after 2 minutes' soaking. The finish annealing atmosphere was 10% $H_2$-90% $N_2$.

Figure 31:
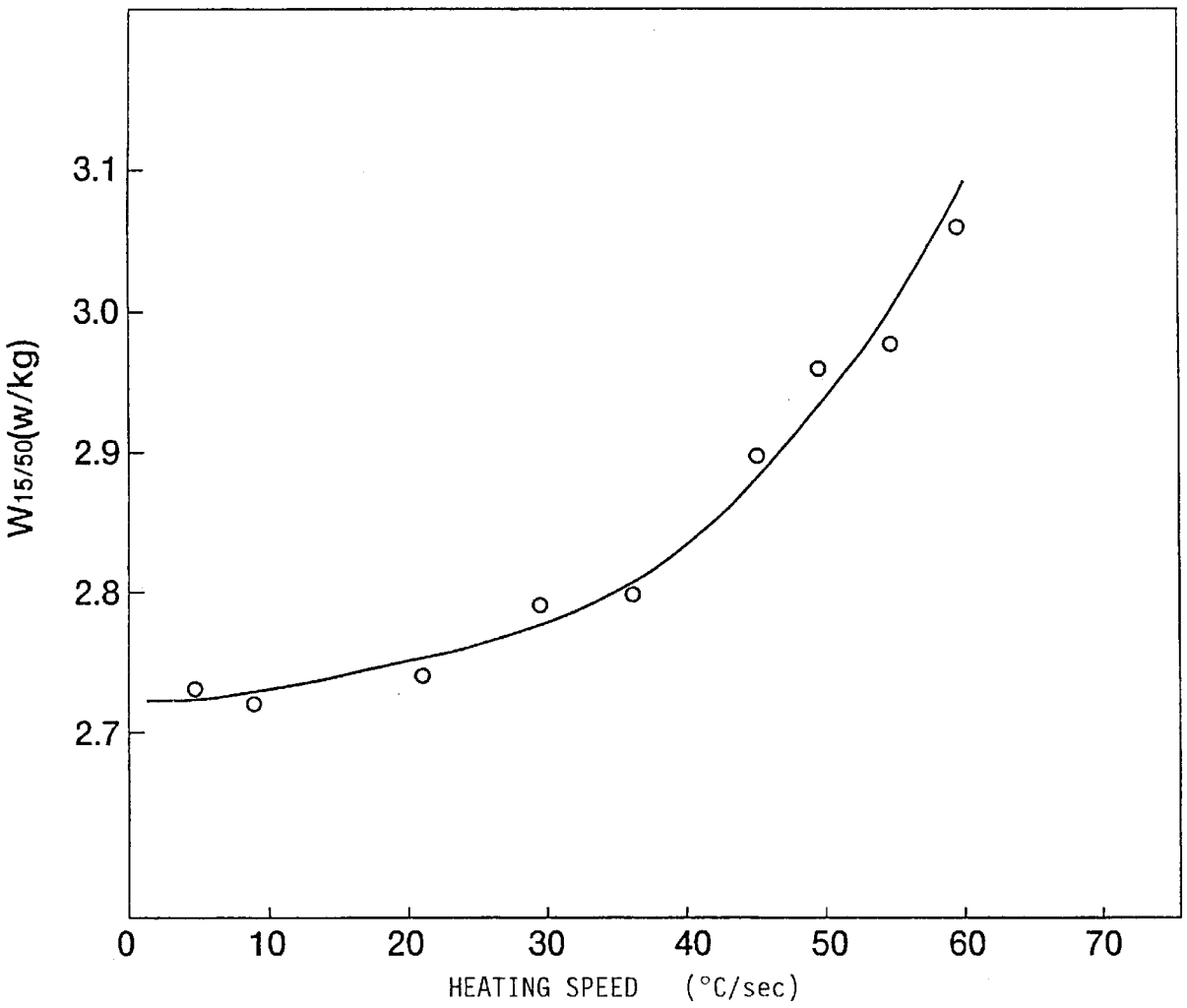
FIG. 31 is a graph indicating the relation between the heating speed at the finish annealing and iron loss after the finish annealing.

FIG. 31 shows the relation between the heating speed at finish annealing and the iron loss $W_{15/50}$. It is evident from FIG. 31 that the iron loss increases in the heating speed range of more than 40° C./sec. An observation of the texture of these sample revealed that nitride formation was noticed on the surface layer of the steel sheet in the sample heated at a speed of more than 40° C./sec although Sb had been added.

The phenomenon described above can be elucidated that the nitride formation suppressing effect of Sb could not be fully displayed for preventing the nitride formation when the heating speed was high because the steel sheet was exposed to a high temperature atmosphere before Sb had segregated on the surface of the steel sheet when the heating speed was high. Accordingly, the heating speed at the finish annealing is determined to be 40° C./sec or less, desirably 25° C./sec or less considering the iron loss.

The Reason Why the Contents of Other Elements are Limited

The reason why the contents of other components should be limited will be described hereinafter.

C: Since C involves a problem of magnetic aging, its content is limited to 0.005% or less.

Si: Since Si is an effective element for increasing inherent resistivity of the steel sheet, 1.0% or more of Si is added. The upper limit of the Si content is limited to 4.0% because the magnetic flux density is decreased with the decrease of saturation magnetic flux density when its content exceeds 4.0%.

Mn: Through 0.05% or more of Mn is needed for preventing red brittleness during hot rolling, its content was limited to 0.05 to 1.0% because the magnetic flux density is lowered at the Mn content of 1.0% or more.

P: While P is an element essential for improving punching applicability of the steel sheet, its content was limited to 0.2% or less because an addition exceeding 0.2% makes the steel sheet fragile.

N: Since the magnetic flux density is decreased at a larger N content, its range is limited to 0.005% or less.

Al: Although Al is, like Si, an effective element for enhancing the inherent resistivity, the upper limit of the Al content was limited to 1.0% because the magnetic flux density is decreased with the decrease of saturation magnetic flux density when its content exceeds 1.0%. The lower limit is determined to be 0.1% because AlN grains becomes too fine for the grains to be well developed when the Al content is less than 0.1%.

Production Method

Conventional methods for producing the electromagnetic steel sheet may be applied in the present invention provided the S, Sb and Sn contents and the heating speed at the finish annealing be in a given range. The molten steel refined in a converter is de-gassed to adjust to a prescribed composition, followed by subjecting to casting and hot-rolling. The finish temperature and coiling temperature at the hot rolling is not necessarily prescribed, but it may be an ordinary temperature range for producing conventional electromagnetic steel sheet. Annealing after the hot rolling is, though not prohibited, not essential. After washing with an acid solution and forming the steel into a sheet with a prescribed thickness by one cold rolling, or by twice or more of cold-rolling with an intermediate annealing inserted thereto, the steel sheet is subjected to a final annealing at a heating speed of 40° C./sec or less.

Example

The steel shown in FIG. 16 was used and the molten steel refined in a converter is de-gassed to adjust to a prescribed composition, followed by subjecting to casting and hot-rolling. After heating the slab at 1140° C. for 1 hour, the sheet was hot-rolled to a sheet thickness of 2.3 mm. The finish annealing temperature of the hot-rolled sheet was 800° C. The coiling temperature was 610° C. with an annealing of the hot-rolled sheet under the conditions shown in Table 17. After washing with an acid solution and cold-rolling, the sheet was subjected to a finish annealing under the conditions shown in FIG. 17. The annealing atmosphere of the hot-rolled sheet and the finish annealing atmosphere were 100% $H_2$ and 10% $H_2$-90% $N_2$, respectively. The term "heating speed" as used in Table 17 refers to a mean heating speed from the room temperature to the soaking temperature during finish annealing. Magnetic properties were measured using a 25 cm Epstein test piece. The magnetic characteristics are also listed in Table 17. The No.'s in Table 16 and Table 17 corresponds with each other.

It can be understood from Table 16 and Table 17 that a steel sheet with a very low iron loss after the finish annealing can be obtained in the steel according to the present invention in which the component of the steel has been controlled to the S, Sb and Sn contents of the present invention and the heating speed at the finish annealing has been adjusted within the range of the present invention.

The iron loss $W_{15/50}$ is low, on the other hand, in the steel sheet No. 12 since the S and (Sb+Sn/2) contents are out of the range of the present invention.

The steel sheets No. 14 and No. 15 have lower iron loss values $W_{15/50}$ than those of the steel sheets No. 12 and No. 13 but higher iron loss values $W_{15/50}$ as compared with that of the present invention because the heating speed at the finish annealing is out of the range of the present invention.

The steel sheet No. 16 not only has a high iron loss $W_{15/50}$ but also involves a problem of magnetic aging since the C content is over the range of the present invention.

Although the iron loss $W_{15/50}$ is low, the steel sheet No. 17 has a low magnetic flux density $B_{50}$ because the Si content exceeds the range of the present invention.

Because the Mn content is lower then the range of the present invention, the iron loss $W_{15/50}$ in the steel sheet No. 18 is high. The iron loss $W_{15/50}$ is low but the magnetic flux density $B_{50}$ is also low since the Mn content is over the range of the present invention in the steel sheet No. 19.

The N content in the steel sheet No. 20 is over the range of the present invention, so that the iron loss $W_{15/50}$ is high.

The Al content in the steel sheet No. 21 is lower than the range of the present invention, thereby the iron loss $W_{15/50}$ is high. In the steel sheet No. 22, on the other hand, the Al content is over the range of the present invention, thereby the iron loss $W_{15/50}$ is low besides having a low magnetic flux density $B_{50}$.

TABLE 16

| No. | C | Si | Mn | P | S | Al | N | Sb | Sn |
|---|---|---|---|---|---|---|---|---|---|
| 1 | 0.025 | 1.83 | 0.19 | 0.010 | 0.0003 | 0.30 | 0.0017 | 0.0020 | tr. |
| 2 | 0.018 | 1.64 | 0.20 | 0.013 | 0.0003 | 0.29 | 0.0019 | 0.0040 | tr. |
| 3 | 0.025 | 1.60 | 0.17 | 0.015 | 0.0003 | 0.30 | 0.0016 | 0.0070 | tr. |
| 4 | 0.018 | 1.65 | 0.18 | 0.010 | 0.0003 | 0.29 | 0.0019 | 0.0400 | tr. |
| 5 | 0.025 | 1.65 | 0.18 | 0.012 | 0.0003 | 0.30 | 0.0018 | tr. | 0.0040 |
| 6 | 0.018 | 1.66 | 0.18 | 0.011 | 0.0003 | 0.29 | 0.0020 | tr. | 0.0080 |
| 7 | 0.020 | 1.67 | 0.17 | 0.012 | 0.0003 | 0.30 | 0.0018 | tr. | 0.0120 |
| 8 | 0.022 | 1.60 | 0.19 | 0.010 | 0.0003 | 0.28 | 0.0019 | 0.0020 | 0.0030 |
| 9 | 0.024 | 1.65 | 0.18 | 0.013 | 0.0003 | 0.25 | 0.0017 | 0.0040 | tr. |
| 10 | 0.024 | 1.65 | 0.18 | 0.013 | 0.0003 | 0.25 | 0.0017 | 0.0040 | tr. |
| 11 | 0.024 | 1.65 | 0.18 | 0.013 | 0.0003 | 0.25 | 0.0017 | 0.0040 | tr. |
| 12 | 0.022 | 1.60 | 0.18 | 0.010 | 0.0020 | 0.25 | 0.0015 | tr. | tr. |
| 13 | 0.022 | 1.63 | 0.17 | 0.012 | 0.0003 | 0.30 | 0.0016 | tr. | tr. |
| 14 | 0.017 | 1.60 | 0.20 | 0.012 | 0.0003 | 0.30 | 0.0019 | 0.0040 | tr. |
| 15 | 0.018 | 1.65 | 0.21 | 0.013 | 0.0003 | 0.29 | 0.0019 | 0.0040 | tr. |
| 16 | 0.065 | 1.60 | 0.20 | 0.012 | 0.0003 | 0.30 | 0.0019 | 0.0040 | tr. |
| 17 | 0.018 | 4.20 | 0.19 | 0.012 | 0.0003 | 0.30 | 0.0019 | 0.0040 | tr. |
| 18 | 0.018 | 1.60 | 0.02 | 0.012 | 0.0003 | 0.30 | 0.0019 | 0.0040 | tr. |
| 19 | 0.018 | 1.60 | 1.50 | 0.012 | 0.0003 | 0.30 | 0.0019 | 0.0040 | tr. |
| 20 | 0.018 | 1.66 | 0.18 | 0.015 | 0.0003 | 0.29 | 0.0065 | 0.0040 | tr. |
| 21 | 0.020 | 1.65 | 0.18 | 0.010 | 0.0003 | 0.05 | 0.0018 | 0.0040 | tr. |
| 22 | 0.018 | 1.63 | 0.17 | 0.012 | 0.0003 | 1.20 | 0.0015 | 0.0040 | tr. |

TABLE 17

| No. | Hot-roll sheet annealing temperature (° C.) | Hot-rolled sheet annealing time (min) | Sheet thickness (° C./s) | Finish annealing temperature (° C) × 2 min | W15/50 (W/kg) | B50 (T) | Note |
|---|---|---|---|---|---|---|---|
| 1 | 950 | 3 | 10 | 930 | 2.73 | 1.72 | Steel of the present invention |
| 2 | 950 | 3 | 10 | 930 | 2.72 | 1.72 | Steel of the present invention |
| 3 | 950 | 3 | 10 | 930 | 2.82 | 1.72 | Steel of the present invention |
| 4 | 950 | 3 | 10 | 930 | 2.86 | 1.72 | Steel of the present invention |
| 5 | 950 | 3 | 10 | 930 | 2.73 | 1.72 | Steel of the present invention |
| 6 | 950 | 3 | 10 | 930 | 2.72 | 1.72 | Steel of the present invention |
| 7 | 950 | 3 | 10 | 930 | 2.81 | 1.72 | Steel of the present invention |
| 8 | 950 | 3 | 10 | 930 | 2.75 | 1.72 | Steel of the pnesent invention |
| 9 | 900 | 180 | 10 | 930 | 2.71 | 1.72 | Steel of the present invention |
| 10 | 950 | 3 | 23 | 930 | 2.74 | 1.72 | Steel of the present invention |
| 11 | 950 | 3 | 30 | 930 | 2.79 | 1.72 | Steel of the present invention |
| 12 | 950 | 3 | 10 | 930 | 3.62 | 1.72 | Comparative steel (S, Sb + Sn/2 out of the range) |
| 13 | 950 | 3 | 10 | 930 | 3.05 | 1.72 | Comparative steel (Sb + Sn/2 out of the range) |
| 14 | 950 | 3 | 44 | 930 | 2.89 | 1.72 | Comparative steel (heating speed out of the range) |
| 15 | 950 | 3 | 57 | 930 | 2.98 | 1.72 | Comparative steel (heating speed out of the range) |
| 16 | 950 | 3 | 20 | 930 | 3.05 | 1.72 | Comparative steel (C out of the range) |
| 17 | 1000 | 3 | 20 | 930 | 2.05 | 1.63 | Comparative steel (Si out of the rangc) |
| 18 | 950 | 3 | 20 | 930 | 3.01 | 1.72 | Comparative steel (Mn out of the range) |
| 19 | 950 | 3 | 20 | 930 | 2.30 | 1.68 | Comparative steel (Mn out of the range) |
| 20 | 950 | 3 | 20 | 930 | 3.55 | 1.70 | Comparative steel (N out of the range) |
| 21 | 950 | 3 | 20 | 930 | 3.60 | 1.71 | Comparative steel (Al out of thc range) |
| 22 | 950 | 3 | 20 | 930 | 2.30 | 1.68 | Comparative steel (Al out of the range) |

Embodiment 8

The crucial point of the present invention is to largely reduce the iron loss of a non-oriented electromagnetic steel sheet, in the material containing a trace amount of S of 10 ppm or less, by allowing 0.03 to 0.15% of P, or at least one of Sb and Sn in a combined amount of (Sb+Sn/2) in a range of 0.001 to 0.05% to contain and controlling the annealing atmosphere during continuous final annealing and soaking time.

The 1st means for solving the foregoing problem comprises a method for producing a non-oriented electromagnetic steel sheet with a low iron loss, characterized by the steps of hot-rolling a slab comprising, in % by weight, 0.005% or less of C, 1.5 to 3.5% of Si, 0.05 to 1.0% of Mn, 0.005% or less (including zero) of N, 0.1 to 1.0% of Al, 0.001% or less (including zero) of S and 0.03 to 0.15% of P, with a substantial balance of Fe; forming a steel sheet with a given thickness by one cold-rolling or twice or more of cold rolling with an intermediate annealing inserted thereto after an annealing of the hot-rolled sheet if necessary; and subjecting to a final annealing in an atmosphere of a $H_2$ concentration of 10% or more for a soaking time of 30 seconds to 5 minutes.

The 2nd means for solving the foregoing problem comprises a method for producing a non-oriented electromagnetic steel sheet with a low iron loss, characterized by the steps of hot-rolling a slab comprising, in % by weight, 0.005% or less of C, 1.5 to 3.5% of Si, 0.05 to 1.0% of Mn, 0.005% or less (including zero) of N, 0.1 to 1.0% of Al, 0.001% or less (including zero) of S and at least one of Sb and Sn in a combined amount of (Sb+Sn/2) in a range of 0.001 to 0.05%, with a substantial balance of Fe; forming a steel sheet with a given thickness by one cold-rolling or twice or more of cold rolling with an intermediate annealing inserted thereto after an annealing of the hot-rolled sheet if necessary; and subjecting to a final annealing in an atmosphere of a $H_2$ concentration of 10% or more for a soaking time of 30 seconds to 5 minutes.

The 3rd mean for solving the foregoing problem comprises a method for producing a non-oriented electromagnetic steel sheet with a low iron loss, characterized by the steps of hot-rolling a slab comprising, in % by weight, 0.005% or less of C, 1.5 to 3.5% of Si, 0.05 to 1.0% of Mn, 0.005% or less (including zero) of N, 0.1 to 1.0% of Al, 0.001% or less (including zero) of S, 0.03 to 0.15% of P and at least one of Sb and Sn in a combined amount of (Sb+Sn/2) in a range of 0.001 to 0.05%, with a substantial balance of Fe; forming a steel sheet with a given thickness by one cold-rolling or twice or more of cold rolling with an intermediate annealing inserted thereto after an annealing of the hot-rolled sheet if necessary; and subjecting to a final annealing in an atmosphere of a $H_2$ concentration of 10% or more for a soaking time of 30 seconds to 5 minutes.

The 4th mean for solving the foregoing problem comprises a non-oriented electromagnetic steel sheet produced by any of 1st to 3rd means or an non-oriented electromagnetic steel sheet with a low iron loss identical thereto.

The phrase of "a substantial balance of Fe" as used herein means that the steel to which trace amount of elements other than inevitable impurities are added in a range not invalidating the effect of the present invention is within the scope of the present invention. In the descriptions hereinafter, "%" an "ppm" representing the composition of the steel refer to "% by weight" and "ppm by weight", respectively.

Procedure of the Invention and the Reason Why the Contents of S and Annealing Conditions are Limited The investigators of the present invention made a detailed investigation on the factors for preventing the iron loss to be reduced in the material containing a trace amount of S in a range of 10 ppm or less. It was consequently made clear that notable nitride layers were observed on the surface layer of the steel sheet with the decrease in the S content and this nitride layer prevented the iron loss from being reduced.

The investigators made intensive studies on the methods for suppressing nitride layer formation to further reduce the iron loss, thereby finding that the iron loss of the material containing a trace amount of S can be largely reduced by allowing the material to contain 0.03 to 0.15% of P, or at least one of Sb and Sn in a combined amount of (Sb+Sn/2)

in a range of 0.001 to 0.05%, along with controlling the annealing atmosphere during the continuous final annealing and soaking time.

The present invention will be described hereinafter in more detail referring to the experimental results.

For the purpose of investigating the effect of the S content on the iron loss, the steels with the composition systems in (1), (2) and (3) below, with a varying concentration of S in the range of trace to 15 ppm, were melted in vacuum followed by washing with an acid solution. The hot-rolled sheets obtained were annealed in an atmosphere of 75% $H_2$-15% $N_2$ at 800° C. for 3 hours. Subsequently, the sheet was cold-rolled to a thickness of 0.5 mm followed by a finish annealing at 900° C. by three kind of combinations of the annealing atmosphere and soaking temperature.

(1) C: 0.0025%, Si: 1.85%, Mn: 0.20%, P: 0.040%, Al: 0.31%, N: 0.0018%

(2) C: 0.0025%, Si: 1.85%, Mn: 0.20%, P: 0.010%, Al: 0.31%, N: 0.0018%, Sn: 0.0050%

(3) C: 0.0025%, Si: 1.85%, Mn: 0.20%, P: 0.010%, Al: 0.31%, N: 0.0018%, Sb: 0.0040%

Figure 32:
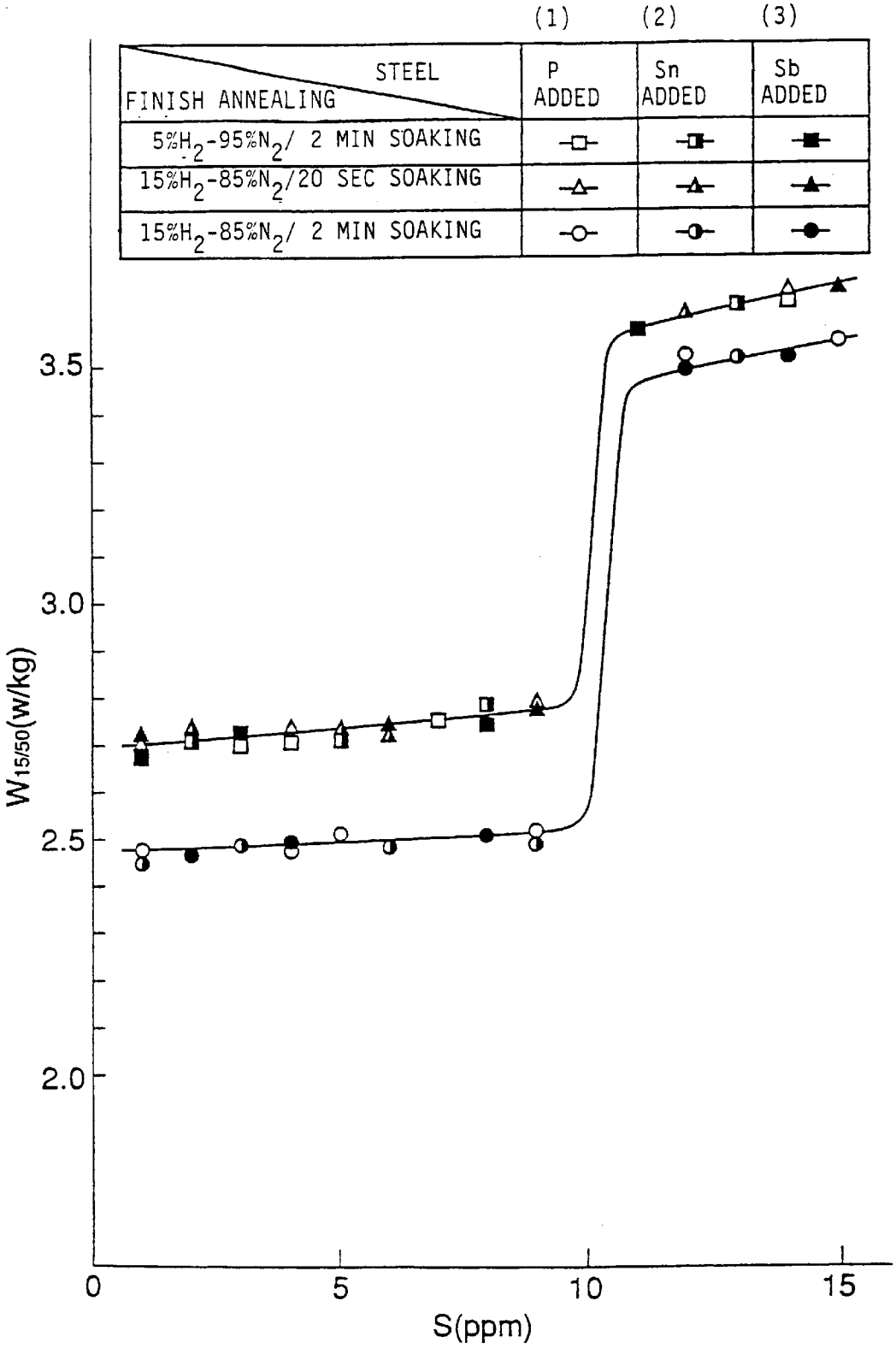
FIG. 32 is a graph indicating the relation between the S content and iron loss after the finish annealing.

FIG. 32 shows the relation between the S content of the sample thus obtained and the iron loss $W_{15/50}$. It can be seen from FIG. 32 that the iron loss is largely reduced when the S content is 10 ppm or less, attaining a $W_{15/50}$ value of 2.5 W/kg. This is because grains are made to be well developed by decreasing the S content. Through the S content is limited to 10 ppm or less in the present invention, the content is desirably 5 ppm or less.

However, it was made clear that the decreasing level of the iron loss at a S content of 10 ppm or less differs depending on the combination of the annealing atmosphere and soaking time. To investigate the causes why the decreasing level of the iron loss differs depending on the combination of the annealing atmosphere and soaking time, the investigators observed the texture of the material under an optical microscope. The results showed that notable nitride layers are observed on the surface layer of the steel sheet with all of the three the component systems when the combination is 5% $H_2$/2 minutes' soaking and 15% $H_2$/20 seconds' soaking. In the combination of 15% $H_2$/2 minutes' soaking, on the other hand, few nitride layers were found. This nitride layer seems to be formed during the annealing of the hot-rolled sheet and finish annealing.

The reason why a different nitride forming reaction occurred depending on the difference of the S content can be comprehended as follows. Since S is an element liable to be concentrated on the surface and at the grain boundaries, S was concentrated on the steel surface in the S content region of more than 10 ppm to suppress absorption of nitrogen during the finish annealing. In the S content region of 10 ppm or less, on the other hand, the nitrogen absorption suppressing effect was decreased. Although deterioration of this suppressing effect was attempted to be supplemented by controlling the contents of P or Sn, or by changing the combination of the annealing atmosphere and the condition of finish annealing (annealing atmosphere—soaking time), there were some differences in the nitrogen absorption suppressing ability by the combination of the annealing atmosphere—soaking time. These results were supposed to reflect on the iron loss revel.

For the purpose of investigating the optimum combination range of the annealing atmosphere—soaking time, the steels with the composition systems in (4), (5) and (6) below were melted in vacuum followed by washing with an acid solution after a hot-rolling. The hot-rolled sheets obtained were subjected to an annealing in an atmosphere of 75% $H_2$-15% $N_2$ at 800° C. for 3 hours. Subsequently, the sheet was cold-rolled to a thickness of 0.5 mm followed by a finish annealing at 930° C. by varying the combinations of the annealing atmosphere and soaking temperature.

(4) C: 0.0020%, Si: 1. 87%, Mn: 0.0%, P: 0.040%, Al: 0.30%, S: 0.0003%, N: 0.0017%

(5) C: 0.0020%, Si: 1.87%, Mn: 0.20%, P: 0.010%, Al: 0.31%, S: 0.0003%, N: 0.0017%, Sn: 0.0050%

(6) C: 0.0020%, Si: 1.87%, Mn: 0.20%, P: 0.010%, Al: 0.30%, S: 0.0003%, N: 0.0017%, Sb: 0.0040%

Figure 33:
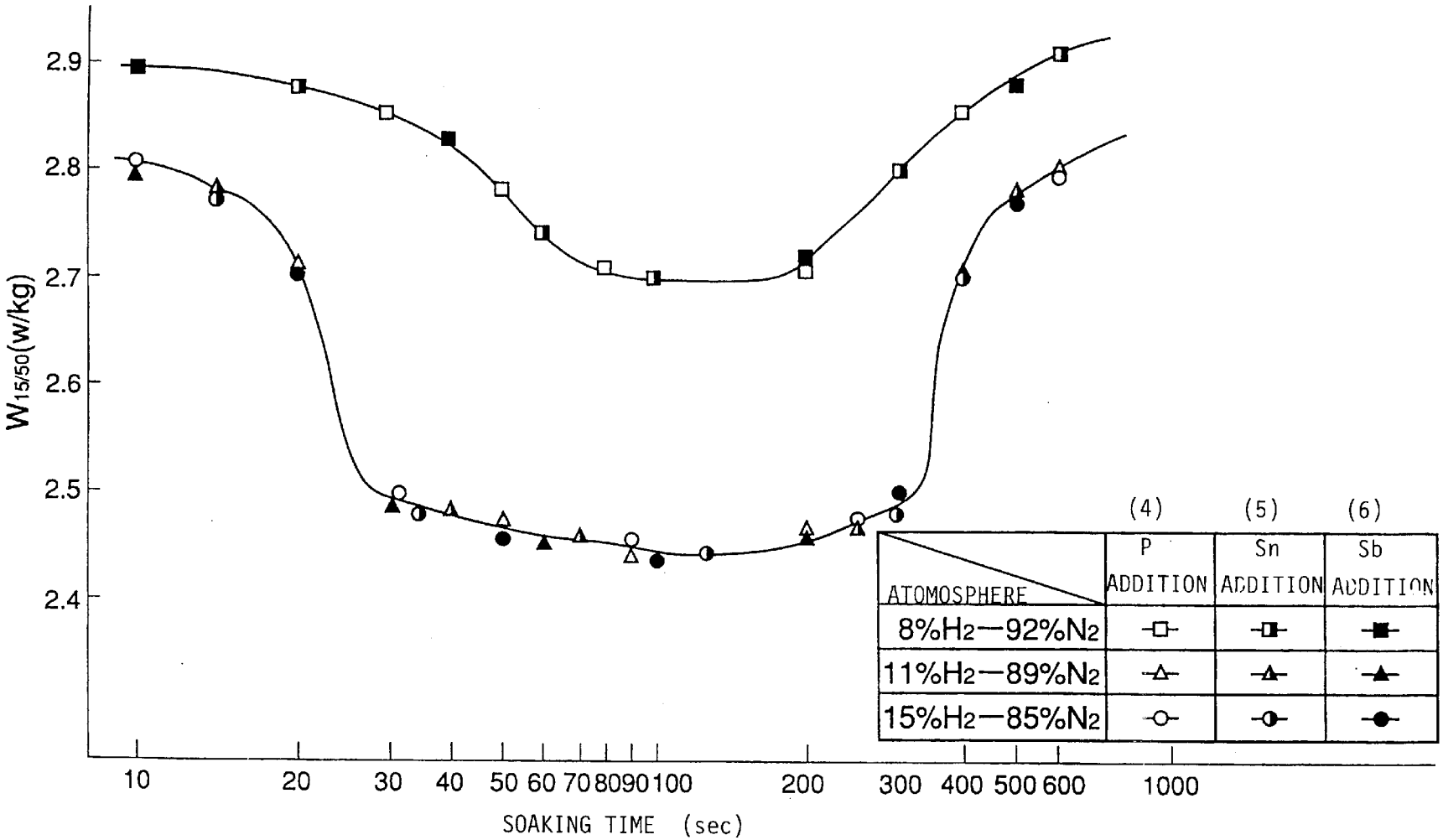
FIG. 33 is a graph indicating the relation between the soaking time for the finish annealing and iron loss after the finish annealing.

FIG. 33 shows the relation between the finish annealing time for each $H_2$ concentration and the iron loss $W_{15/50}$ for each sample obtained. It is evident from FIG. 33 that, for each composition system, the iron loss is decreased in the area of $H_2$concentration of 10% or more and the soaking time at finish annealing of 30 seconds to 5 minutes, attaining an iron loss value $W_{15/50}$ of 2.5 W/kg. Form this result, the $H_2$ concentration of the atmosphere of the continuous final annealing and the soaking time are defined to be 10% or more and 30 seconds to 5 minutes, respectively.

The Reason Why the Other Components are Limited

The reason why the contents of other components should be limited will be described hereinafter.

C: The C content is limited to 0.005% or less since the element involves a problem of magnetic aging.

Si: Since Si is an effective element for increasing inherent resistivity of the steel sheet, its lower limit is determined to be 1.5%. The upper limit of the Si content is limited to 3.5% because the magnetic flux density is decreased with the decrease of saturation magnetic flux density when its content exceeds 3.5%.

Mn: More than 0.05% of Mn is needed in order to prevent red brittleness during hot-rolling. However, since the magnetic flux density is decreased at the Mn content of 1.0% or more, its range is limited to 0.05 to 1.0%.

N: The content of N is limited to 0.005% or less since a lot of AlN is precipitated to increase the iron loss when a large amount of N is contained.

Al: Although Al is, like Si, an effective element for enhancing the inherent resistivity, the upper limit of the Al content was limited to 1.0% because the magnetic flux density is decreased with the decrease of saturation magnetic flux density when its content exceeds 1.0%. The lower limit is determined to be 0.1% because AlN grains becomes too fine for the grains to be well developed when the Al content is less than 0.1%.

P: Since P can suppress absorption of nitrogen during annealing of the hot-rolled sheet and finish annealing, its content is determined to be 0.03% or more and the upper limit is limited to 0.15% due to the problem of compatibility with the cold rolling.

Sb and Sn: Both of Sb and Sn are the effective elements for suppressing absorption of nitrogen during annealing of the hot-rolled sheet and finish annealing, and Sb has twice as large effect as that of Sn. Accordingly, the elements are allowed to contain in a combined amount of (Sb+Sn/2) in the range of 0.001% or more. The upper limit is 0.05% from the economical point of view. Any one of the elements of P, Sb and Sn may be selectively contained, or all of the three elements may be contained together.

Production Method

Conventional methods for producing the electromagnetic steel sheet, except the condition for the continuous final annealing (finish annealing) may be applied in the present invention provided the prescribed components including S, P, Sb and Sn be in a given range. The molten steel refined in a converter is de-gassed to adjust to a prescribed composition, followed by subjecting to casting and hot-rolling. The finish annealing temperature and coiling temperature at the hot rolling is not necessarily prescribed, but it may be an ordinary temperature range for producing conventional electromagnetic steel sheet. Annealing after the hot rolling is, though not prohibited, not essential. A continuous final annealing is applied after forming the steel into a sheet with a prescribed thickness by one cold rolling, or by twice or more of cold-rolling with an intermediate annealing inserted thereto.

Example

The steel shown in FIG. 18 was used and the molten steel refined in a converter is de-gassed to adjust to a prescribed composition (the composition is expressed in % by weight). The slab was hot-rolled to a sheet thickness of 2.0 mm after heating the slab at a temperature of 1160° C. for 1 hour. followed by subjecting to casting and hot-rolling. The finish annealing temperature of the hot-rolled sheet was 800° C. and the coiling temperature was 610° C. The hot-rolled sheet was annealed under the conditions shown in Table 19. The sheet was then cold-rolled to a thickness of 0.5 mm followed by an annealing by the finish annealing conditions shown in Table 19. Magnetic properties were measured using a 25 cm Epstein test piece. The magnetic characteristics are shown in Table 19 together. Table 18 and Table 19 have been originally one table, the steel sheet No.'s in each table corresponding with each other.

The Si content in the steel sheets No. 1 to No. 18 are in a level of 1.8% while the steel those of the sheets No. 19 to No. 26 are in the level of 2.5%. When the steel sheets with the same Si level are compared with each other, the steel sheet of the present invention has a lower iron loss $W_{15/50}$ as compared with the comparative steel sheet.

The results above indicate that, when the contents of S, P, and (Sb+Sn/2), the amount of addition of any one of the elements, the atmosphere of annealing during the continuous final annealing and the soaking time are all within the range of the present invention, a non-oriented electromagnetic sheet with a very low iron loss after the finish annealing can be obtained. It is also suggested that the magnetic flux density $B_{50}$ has not been reduced in these non-oriented electromagnetic steel sheets.

Meanwhile, the steel sheets No. 9 and No. 22 have high iron loss values $W_{15/50}$ since the S content is out of the range of the present invention.

The $H_2$ concentration during the finish annealing in the steel sheets No. 15 and No. 23, and the soaking time during the finish annealing in the steel sheets No. 16, No. 17, No. 24 and No. 25 are out of the range of the present invention, thereby the iron loss values $W_{15/50}$ are high.

The steel sheet No. 11 not only has a high iron loss $W_{15/50}$ but also involves a problem of magnetic aging, because the C content is over the range of the present invention.

Since the Mn content in the steel sheet No. 12 exceeds the range of the present invention, the magnetic flux density $B_{50}$ becomes low.

The Al content in the steel sheet No. 13 is below the range of the present invention, so that the iron loss $W_{15/50}$ is high.

The iron loss $W_{15/50}$ in the steel sheet No. 14 is high because the N content is over the range of the present invention.

The iron loss values $W_{15/50}$ of the steel sheets No. 18 and No. 26 are high since all of the P, Sn and Sb contents are out of the range of the present invention.

Although the iron loss value $W_{15/50}$ is controlled low, the magnetic flux density $B_{50}$ is also low in the steel sheet No. 27 because the Si content is higher than the range of the present invention.

TABLE 18

| No. | C | Si | Mn | P | S | Al | N | Sn | Sb |
|---|---|---|---|---|---|---|---|---|---|
| 1 | 0.0025 | 1.85 | 0.25 | 0.040 | 0.0003 | 0.30 | 0.0017 | tr. | tr. |
| 2 | 0.0024 | 1.84 | 0.26 | 0.039 | 0.0003 | 0.29 | 0.0018 | tr. | tr. |
| 3 | 0.0018 | 1.85 | 0.24 | 0.041 | 0.0004 | 0.30 | 0.0019 | tr. | tr. |
| 4 | 0.0019 | 1.86 | 0.27 | 0.040 | 0.0003 | 0.31 | 0.0020 | tr. | tr. |
| 5 | 0.0022 | 1.85 | 0.23 | 0.015 | 0.0003 | 0.30 | 0.0017 | 0.0050 | tr, |
| 6 | 0.0021 | 1.84 | 0.25 | 0.014 | 0.0004 | 0.29 | 0.0018 | 0.0050 | tr. |
| 7 | 0.0020 | 1.85 | 0.25 | 0.015 | 0.0003 | 0.30 | 0.0018 | tr. | 0.0040 |
| 8 | 0.0019 | 1.85 | 0.24 | 0.013 | 0.0004 | 0.31 | 0.0019 | tr. | 0.0040 |
| 9 | 0.0018 | 1.86 | 0.26 | 0.040 | 0.0020 | 0.30 | 0.0021 | tr. | tr. |
| 10 | 0.0021 | 1.84 | 0.26 | 0.180 | 0.0003 | 0.29 | 0.0020 | tr. | tr. |
| 11 | 0.0067 | 1.85 | 0.25 | 0.040 | 0.0004 | 0.30 | 0.0019 | tr. | tr. |
| 12 | 0.0022 | 1.83 | 1.49 | 0.040 | 0.0003 | 0.30 | 0.0018 | tr. | tr. |
| 13 | 0.0021 | 1.85 | 0.26 | 0.041 | 0.0003 | 0.05 | 0.0019 | tr. | tr. |
| 14 | 0.0022 | 1.86 | 0.24 | 0.039 | 0.0003 | 0.31 | 0.0065 | tr. | tr. |
| 15 | 0.0018 | 1.85 | 0.25 | 0.041 | 0.0004 | 0.29 | 0.0018 | tr. | tr. |
| 16 | 0.0019 | 1.85 | 0.26 | 0.040 | 0.0003 | 0.30 | 0.0019 | tr. | tr. |
| 17 | 0.0017 | 1.85 | 0.25 | 0.041 | 0.0004 | 0.30 | 0.0020 | tr. | tr, |
| 18 | 0.0016 | 1.85 | 0.24 | 0.015 | 0.0003 | 0.30 | 0.0019 | tr. | tr. |
| 19 | 0.0022 | 2.51 | 0.18 | 0.014 | 0.0004 | 0.50 | 0.0018 | 0.0050 | tr. |
| 20 | 0.0024 | 2.50 | 0.18 | 0.015 | 0.0003 | 0.49 | 0.0021 | tr. | 0.0040 |
| 21 | 0.0023 | 2.52 | 0.17 | 0.013 | 0.0003 | 0.51 | 0.0019 | tr. | 0.0040 |
| 22 | 0.0019 | 2.49 | 0.19 | 0.015 | 0.0020 | 0.52 | 0.0020 | tr. | 0.0040 |
| 23 | 0.0020 | 2.50 | 0.18 | 0.014 | 0.0003 | 0.50 | 0.0021 | 0.0050 | tr. |
| 24 | 0.0020 | 2.51 | 0.19 | 0.015 | 0.0004 | 0.51 | 0.0022 | 0.0050 | tr. |
| 25 | 0.0019 | 2.52 | 0.19 | 0.015 | 0.0004 | 0.50 | 0.0019 | 0.0050 | tr. |
| 26 | 0.0018 | 2.49 | 0.18 | 0.015 | 0.0003 | 0.49 | 0.0020 | tr. | tr. |
| 27 | 0.0017 | 4.00 | 0.25 | 0.050 | 0.0003 | 0.29 | 0.0018 | tr. | tr. |

TABLE 19

| No. | Annealing of hot-roll sheet Temp. (° C.) | Annealing of hot-roll sheet Time (min) | Finish annealing Temp. (° C.) | Finish annealing Atmosphere | Finish annealing Time (sec.) | W15/50 (W/kg) | B50 (T) | Note |
|---|---|---|---|---|---|---|---|---|
| 1 | 800 | 180 | 930 | 15% H2 + 85% N2 | 60 | 2.52 | 1.72 | Steel of the present invention |
| 2 | 800 | 180 | 930 | 15% H2 + 85% N2 | 120 | 2.51 | 1.72 | Steel of the present invention |
| 3 | 800 | 180 | 930 | 25% H2 + 75% N2 | 120 | 2.49 | 1.72 | Steel of the present invention |
| 4 | 980 | 2 | 930 | 15% H2 + 85% N2 | 120 | 2.50 | 1.72 | Steel of the present invention |
| 5 | 800 | 180 | 930 | 15% H2 + 85% N2 | 60 | 2.48 | 1.72 | Steel of the present invention |
| 6 | 800 | 180 | 930 | 15% H2 + 85% N2 | 120 | 2.46 | 1.72 | Steel of the present invention |
| 7 | 800 | 180 | 930 | 15% H2 + 85% N2 | 60 | 2.48 | 1.72 | Steel of the present invention |
| 8 | 800 | 180 | 930 | 15% H2 + 85% N2 | 120 | 2.46 | 1.72 | Steel of the present invention |
| 9 | 800 | 180 | 930 | 15% H2 + 85% N2 | 120 | 3.58 | 1.72 | Comparative steel (S out of the range) |
| 10 | 800 | 180 | — | — | — | — | — | The sheet is broken when cold-pressing (P out of the range) |
| 11 | 800 | 180 | 930 | 15% H2 + 85% N2 | 120 | 2.69 | 1.72 | Comparative steel (C out of the range) |
| 12 | 800 | 180 | 930 | 15% H2 + 85% N2 | 120 | 2.40 | 1.68 | Comparative steel (Mn out of the nange) |
| 13 | 800 | 180 | 930 | 15% H2 + 85% N2 | 120 | 3.61 | 1.71 | Comparative steel (Al out oftbe range) |
| 14 | 800 | 180 | 930 | 15% H2 + 85% N2 | 120 | 3.48 | 1.71 | Comparative steel (N out of the range) |
| 15 | 800 | 180 | 930 | 5% H2 + 95% N2 | 120 | 2.72 | 1.72 | Comparative steel (H2 % out of the range) |
| 16 | 800 | 180 | 930 | 15% H2 + 85% N2 | 20 | 2.75 | 1.72 | Comparative steel (Finish annealing time out of the range) |
| 17 | 800 | 180 | 930 | 15% H2 + 85% N2 | 600 | 2.79 | 1.72 | Comparative steel (Finish annealing time out of the range) |
| 18 | 800 | 180 | 930 | 15% H2 + 85% N2 | 120 | 2.79 | 1.72 | Comparative steel (P, Sn, Pb out of the range) |
| 19 | 830 | 180 | 950 | 25% H2 + 75% N2 | 120 | 2.32 | 1.70 | Steel of the present invention |
| 20 | 830 | 180 | 950 | 15% H2 + 85% N2 | 60 | 2.33 | 1.70 | Steel of the present invention |
| 21 | 830 | 180 | 950 | 15% H2 + 85% N2 | 120 | 2.30 | 1.70 | Steel of the present invention |
| 22 | 830 | 180 | 950 | 15% H2 + 85% N2 | 120 | 3.06 | 1.70 | Comparative steel (S out of the range) |
| 23 | 830 | 180 | 950 | 5% H2 + 95% N2 | 120 | 2.48 | 1.70 | Comparative steel (H2 % out of the range) |
| 24 | 830 | 180 | 950 | 15% H2 + 85% N2 | 20 | 2.47 | 1.70 | Comparative steel (Finish annealing time out of the range) |
| 25 | 830 | 180 | 950 | 15% H2 + 85% N2 | 600 | 2.49 | 1.70 | Comparative steel (Finish annealing time out of the range) |
| 26 | 830 | 180 | 950 | 15% H2 + 85% N2 | 120 | 2.47 | 1.70 | Comparative steel (P, Sn, Sb out of the range) |
| 27 | 800 | 180 | 930 | 15% H2 + 85% N2 | 120 | 2.31 | 1.65 | Comparative steel (Si out of the range) |

Embodiment 9

The crucial point of the present invention is to suppress the formation of nitrides for decreasing the iron loss by controlling the annealing temperature during the continuous final annealing and soaking time, based on the novel finding that the iron loss can not be reduced even when the S content is limited to a trace amount of 10 ppm or less because notable nitride layers are formed on the surface area in the region containing a trace amount of S.

The foregoing problem is solved by a method for producing a non-oriented electromagnetic steel sheet characterized by comprising the steps: of hot-rolling a slab containing, in % by weight, 0.005% or less of C, less than 1.5% of Si, 0.05 to 1.0% of Mn, 0.2% or less of P, 0.005% or less (including zero) of N, 0.1 to 1.0% of Al and 0.001% or less (including zero) of S, with a substantial balance of Fe; forming the hot-rolled sheet into a sheet with a given thickness by one time of cold-rolling or twice or more of cold-rolling by inserting an intermediate annealing thereto after annealing the hot-rolled sheet if necessary; and subjecting the cold-roll sheet to a continuous final annealing in an atmosphere with a $H_2$ concentration of 10% or more for a soaking time of 30 seconds to 5 minutes.

The foregoing problem is also solved by a method for producing a non-oriented electromagnetic steel sheet characterized by comprising the steps: of hot-rolling a slab containing, in % by weight, 0.005% or less of C, less than 1.5% of Si, 0.05 to 1.0% of Mn, 0.2% or less of P, 0.005% or less (including zero) of N, 0.1 to 1.0% of Al, 0.001% or less (including zero) of S, 0.001 to 0.05% of (Sb+Sn/2), with a substantial balance of Fe; forming the hot-rolled sheet into a sheet with a given thickness by one time of cold-rolling or twice or more of cold-rolling by inserting an intermediate annealing thereto after annealing the hot-rolled sheet if necessary; and subjecting the cold-roll sheet to a continuous final annealing in an atmosphere with a $H_2$ concentration of 10% or more for a soaking time of 30 seconds to 5 minutes.

The phrase of "a substantial balance of Fe" as used herein means that the steel containing trace amount of elements in a range not invalidating the effect of the present invention is within the scope of the patent property. In the descriptions hereinafter, "% of the steel component" and "ppm" refer to "% by weight" and "ppm by weight", respectively.

Procedure of the Invention and the Reason Why the S Content and Final Annealing Conditions are Limited Procedures of the present invention will be described in detail hereinafter, To investigate the effect of S on the iron loss first, a steel containing 0.0020% of C, 0.25% of Si, 0.55% of Mn, 0.11% of P, 0.25% of Al, 0.0018% of N and a trace amount of Sb, with a varying amount of S from trace to 15 ppm, was melted in the laboratory followed by washing with an acid solution after hot-rolling. The hot-rolled sheet was then cold-rolled to a sheet thickness of 0.5 mm, finish annealed at 750° C. with three kinds of combinations of the annealing atmosphere and soaking time and subjected to a magnetic annealing in an atmosphere of 100% N2 at 750° C. for 2 hours.

Figure 34:
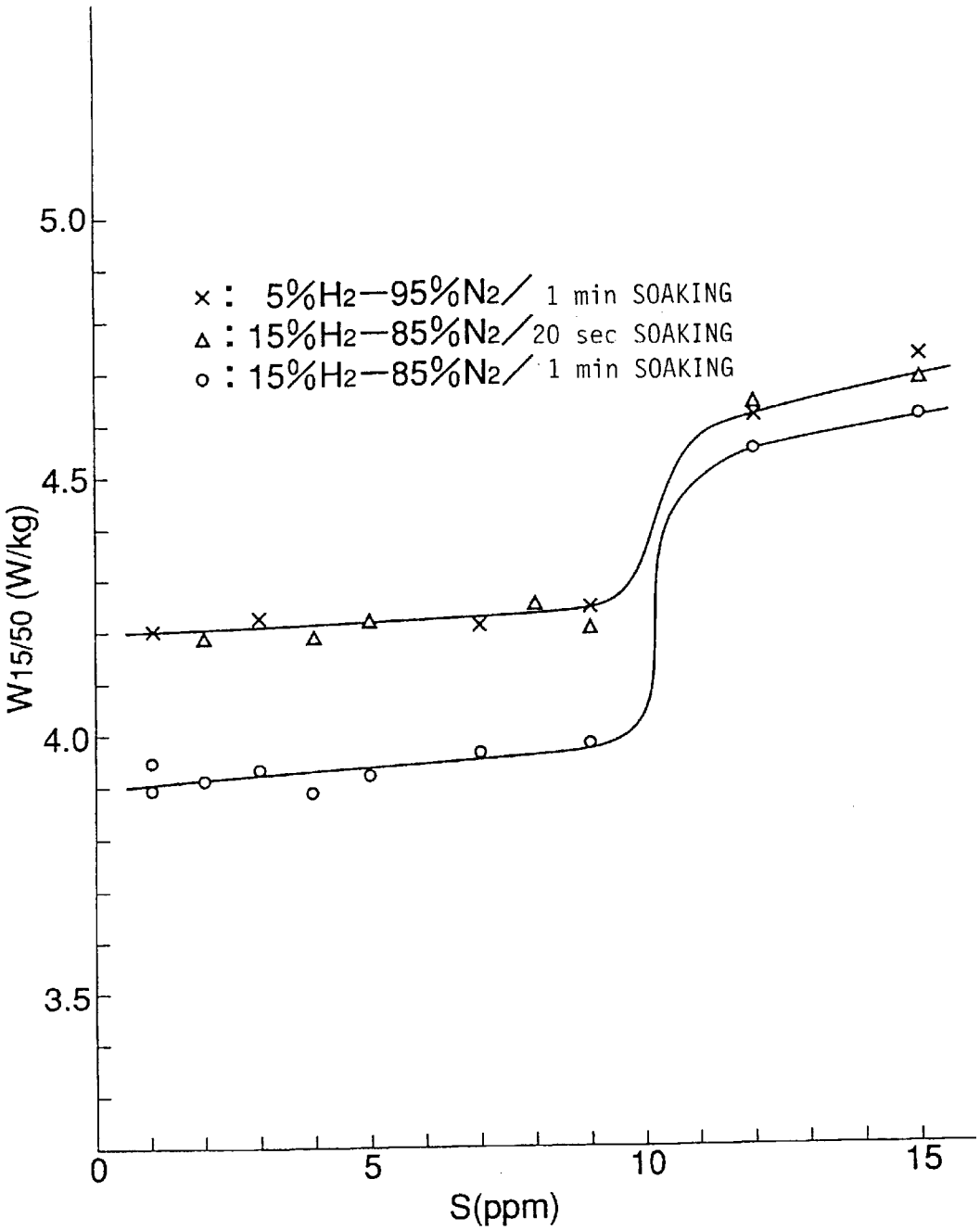
FIG. 34 is a graph indicating the relation between S content and iron loss after the finish annealing.

FIG. 34 shows the relation between the S content of the sample thus obtained and iron loss $W_{15/50}$ after the magnetic annealing. Magnetic properties were measured using a 25 cm Epstein test piece.

It is evident from FIG. 34 that the iron loss $W_{15/50}$ is largely reduced to 4.2 W/kg when the S content is 10 ppm or less. This is because the amount of the precipitated MnS was reduced by decreasing the S content, thereby ferrite grains was made to be well developed. From this result, the S content is limited to 10 ppm or less in the present invention.

However, it was also made clear that the degree of reduction of the iron loss at a S content of 10 ppm or less differs depending on the combination of the annealing atmosphere and soaking time. As shown in FIG. 34, decrease in the iron loss is far more larger at the S content of 10 ppm or less in the combination of 15% $H_2$—1 minute of soaking than in the combination of 5% $H_2$—20 seconds of soaking.

For the purpose of investigating the cause the above results, the investigators observed the texture of the steel under an optical microscope. Notable nitride layers were found on the surface layer of the steel sheet in the combination of 5% $H_2$—1 minute of soaking. In the combination of 15% H2— 1 minute of soaking, on the other hand, the nitride layers were rarely found. Accordingly, these nitride layers seem to be formed by the magnetic soaking carried out in an atmosphere of 100% of $N_2$.

The reason why the nitride forming reaction revealed different aspects can be elucidated as follows. Since S is an element liable to be concentrated on the surface and at grain boundaries, S was concentrated on the surface of the steel in the S content region of more than 10 ppm, thereby suppressing nitrogen absorption on the surface of the steel sheet during the magnetic annealing of the hot-press sheet or finish annealing. In the S content region of 10 ppm or less, on the other hand, the nitrogen absorption suppressing effect was so decreased in the S content region of 10 ppm or less that the decreased nitrogen absorption suppressing ability had been reflected on the degree of the iron loss.

To investigate the range of the optimum combination of the annealing atmosphere and soaking time, the steel with a composition of 0.0021% of C, 0.25% of Si, 0.52% of Mn, 0.100% of P, 0.26% of Al and 0.0015% of N, and a steel prepared by adding 0.0040% of Sb to the steel having a similar composition thereto were melted in the laboratory followed by an acid washing after a hot-rolling. This hot-toll sheet was subsequently cold-rolled to a thickness of 0.5 mm and, by varying the combinations of $H_2$ concentration and soaking time, subjected to a finish annealing at 750° C., finally subjecting to a magnetic annealing in an atmosphere of 100% $N_2$ at 750° C. for 2 hours.

Figure 35:
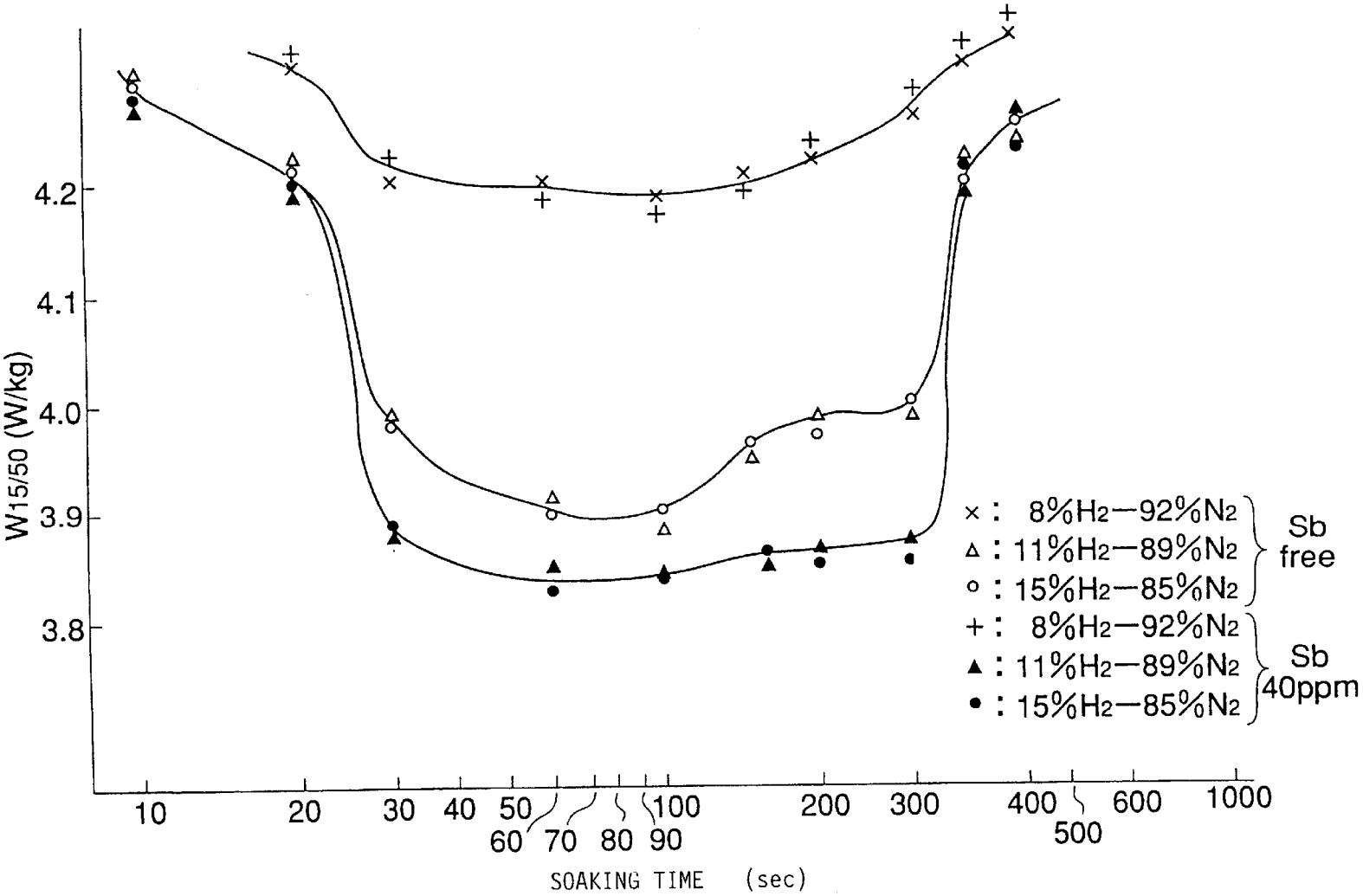
FIG. 35 is a graph indicating the relation between the soaking time for the finish annealing and iron loss after the finish annealing.

FIG. 35 shows the relation between the finish annealing—soaking time in each $H_2$ concentration of each sample thus obtained, and the iron loss $W_{15/50}$. It can be seen from FIG. 35 that the iron loss had decreased in the area of $H_2$ concentration of more than 10% and the soaking time at the finish annealing of 30 seconds to 5 minutes, attaining an iron loss value $W_{15/50}$ of 4.0 W/kg or less in either the steels containing and not containing Sb.

It is also evident that addition of Sb and an optimum combination of the annealing atmosphere and soaking time allow the iron loss to be more decreased than in the steel not containing Sb.

The Reason Why the Contents of Other Elements are Limited

The reason why the contents of other components should be limited will be described hereinafter.

C: Since C involves a problem of magnetic aging, its content was limited to 0.0005% or less.

Si: While Si is an effective element for increasing inherent resistivity of the steel sheet, the upper limit of the Si content is limited to 1.5% because the magnetic flux density is decreased with the decrease of saturation magnetic flux density when its content is 1.5% or more.

Mn: More than 0.05% of Mn is needed in order to prevent red brittleness during hot-rolling. However, since the magnetic flux density is decreased at the Mn content of 1.0% or more, its range is limited to 0.05 to 1.0%.

P: While P is an element essential for improving punching applicability of the steel sheet, its content is limited to 0.2% or less because the steel sheet becomes fragile when P is added in excess of 0.2%.

N: Since a lot of AlN precipitates when the Al content is large to increase the iron loss, its range is limited to 0.005% or less.

Al: Although Al is, like Si, an effective element for enhancing the inherent resistivity, the upper limit of the Al content was limited to 1.0% because the magnetic flux density is decreased with the decrease of saturation magnetic flux density when its content exceeds 1.0%. The lower limit is determined to be 0.1% because AlN grains becomes too fine for the grains to be well developed when the Al content is less than 0.1%.

Sb+Sn/2: While both elements of Sb and Sn equally serve for effectively suppressing nitride formation, Sb is twice as effective as Sn. Therefore, their content is prescribed by (Sb+Sn/2). Although a content of (Sb+Sn/2) of 0.001% or more is preferable in order to suppress the nitride formation during the magnetic annealing, its upper limit is limited to 500 ppm from the economical point of view. Either Sb or Sn is allowed to be contained provided that (Sb+Sn/2) remains within the range described above.

Production Method

Conventional methods for producing the electromagnetic steel sheet may be applied in the present invention provided the contents of S and prescribed components be in a given range. The molten steel refined in a converter is de-gassed to adjust to a prescribed composition, followed by subjecting to casting and hot-rolling. The finish annealing temperature and coiling temperature at the hot rolling is not necessarily prescribed, but it may be an ordinary temperature range for producing conventional electromagnetic steel sheet. Annealing after the hot rolling is, though not prohibited, not essential. After forming the steel into a sheet with a prescribed thickness by one cold rolling, or by twice or more of cold-rolling with an intermediate annealing inserted thereto, the steel sheet is subjected to a final annealing.

Example

The steel shown in Table 20 was used and the molten steel refined in a converter was de-gassed to adjust to a prescribed composition, followed by subjecting to casting and hot-rolling. After heating the slab at 1160° C. for 1 hour, the sheet was hot-rolled to a sheet thickness of 2.0 mm. The finish annealing temperature of the hot-rolled sheet was 800° C. and the coiling temperature was 670° C. After washing with an acid solution and cold-rolling of this hot-rolled sheet to a thickness of 0.5 mm, the sheet was subjected to a finish annealing under the conditions shown in Table 20, followed by a magnetic annealing in an atmosphere of 100% $N_2$ at 750° C. for 2 hours. Magnetic properties were measured using a 25 cm Epstein test piece. The magnetic characteristics are also listed in Table 20. "Retention time" as described in Table 20 refers to the soaking time.

The steel sheets No. 1 to No. 9 and No. 19 to No. 24 correspond to the examples of the present invention having 0.25 order of Si levels and 0.75 order of Si levels, respectively. The iron loss values $W_{15/50}$ are far more lower than 4.2 W/kg, which is a level considered to be difficult to attain in the conventional arts, reaching to 3.84 to 4.00 W/kg in the steels with the Si levels in the order of 0.25% and to 3.30 to 3.40 W/kg in the steels with the Si levels in the order of 0.75%. In addition, the iron loss of the steel in which Sb has been added is further decreased as compared with the steel not containing Sb.

The steels with a Si level in the order of 0.25%, and the steel with a Si level of the order of 0.75% also have high magnetic flux densities $B_{50}$ of 1.76T and 1.73T, respectively.

The steel sheet No. 10 has, on the other hand, a high iron loss $W_{15/50}$ because the S content is out of the range of the present invention.

Crystal grains can not be well developed and the iron loss $W_{15/50}$ becomes low in the steel sheet No. 11 since the Al content is lower than the range of the present invention.

Through the iron loss $W_{15/50}$ is decreased in the steel sheet No. 12, the magnetic flux density $B_{50}$is also low because the Al content is higher than the range of the present invention.

The steel sheet No. 13 not only has a high iron loss $W_{15/50}$ but also involves a problem of magnetic aging due to a higher C content out of the range of the present invention.

Although the iron loss $W_{15/50}$ in the steel sheet No. 14 is decreased, it is still higher than that of the steel of the present invention besides having a low $B_{50}$ because the Mn content is out of the range of the present invention.

The steel sheet No. 15 has a high iron loss $W_{15/50}$ since N is out of the range of the present invention.

The $H_2$ concentration during the finish annealing of the steel sheet No. 16, and the soaking time during the finish annealing of the steel sheet No. 17 and No. 18 are out of the range of the present invention, respectively, so that the iron loss values $W_{15/50}$ are high.

In the steel sheets with the Si level of 0.75%, the S content of the steel sheet No. 25 is out of the range of the present invention, so that the iron loss $W_{15/50}$ is higher than the steel sheet of the present invention having the same Si level.

Since the $H_2$ concentration during the finish annealing of the steel sheet No. 26, and the soaking time during the finish annealing of the steel sheet No. 27 and No. 28 are out of the range of the present invention, respectively, the iron loss values $W_{15/50}$ are high.

Since the Si content is higher than the range of the present invention in the steel sheet No. 29, the magnetic flux density $B_{50}$ is low despite the iron loss $W_{15/50}$ is controlled in a low range.

As will be apparent from the foregoing examples and comparative examples, a non-oriented electrostatic steel sheet having a very low iron loss after the magnetic annealing and not suffering a reduction in the magnetic flux density can be obtained by adjusting the concentrations of S and other prescribed components in the steel, the atmosphere during the continuous final annealing and the soaking time within the range of the present invention.

| No. | C | Si | Mn | P | S | Al | N | Sb | Sn | Annealing temp.(° C.) | Annealing atmosphere | Retention time(sec) | W15/50 (W/kg) | B50 (T) | Note |
|---|---|---|---|---|---|---|---|---|---|---|---|---|---|---|---|
| 1 | 0.0022 | 0.27 | 0.50 | 0.101 | 0.0004 | 0.27 | 0.0019 | tr. | tr. | 750 | 15% H2 + 85% N2 | 40 | 3.94 | 1.76 | Steel of the present invention |
| 2 | 0.0020 | 0.26 | 0.51 | 0.100 | 0.0003 | 0.25 | 0.0020 | tr. | tr. | 750 | 15% H2 + 85% N2 | 60 | 3.91 | 1.76 | Steel of the present invention |
| 3 | 0.0021 | 0.25 | 0.48 | 0.098 | 0.0004 | 0.24 | 0.0019 | tr. | tr. | 750 | 15% H2 + 85% N2 | 120 | 3.93 | 1.76 | Steel of the present invention |
| 4 | 0.0018 | 0.25 | 0.49 | 0.100 | 0.0004 | 0.26 | 0.0018 | tr. | tr. | 750 | 15% H2 + 85% N2 | 280 | 4.00 | 1.76 | Steel of the present invention |
| 5 | 0.0023 | 0.24 | 0.50 | 0.102 | 0.0003 | 0.25 | 0.0019 | tr. | tr. | 750 | 25% H2 + 75% N2 | 60 | 3.95 | 1.76 | Steel of the present invention |
| 6 | 0.0016 | 0.25 | 0.51 | 0.103 | 0.0004 | 0.25 | 0.0021 | 0.0040 | tr. | 750 | 15% H2 + 85% N2 | 60 | 3.84 | 1.76 | Steel of the present invention |
| 7 | 0.0022 | 0.25 | 0.50 | 0.099 | 0.0003 | 0.26 | 0.0022 | 0.0040 | tr. | 750 | 15% H2 + 85% N2 | 120 | 3.85 | 1.76 | Steel of the present invention |
| 8 | 0.0020 | 0.25 | 0.47 | 0.099 | 0.0003 | 0.25 | 0.0022 | tr. | 0.01 | 750 | 15% H2 + 85% N2 | 60 | 3.85 | 1.76 | Steel of the present invention |
| 9 | 0.0019 | 0.24 | 0.50 | 0.010 | 0.0004 | 0.26 | 0.0020 | 0.0040 | 0.01 | 750 | 15% H2 + 85% N2 | 60 | 3.83 | 1.76 | Steel of the present invention |
| 10 | 0.0021 | 0.25 | 0.50 | 0.100 | 0.0014 | 0.27 | 0.0021 | tr. | tr. | 750 | 15% H2 + 85% N2 | 60 | 4.59 | 1.76 | Comparative steel (S out of the range) |
| 11 | 0.0021 | 0.25 | 0.49 | 0.103 | 0.0004 | 0.04 | 0.0020 | tr. | tr. | 750 | 15% H2 + 85% N2 | 60 | 4.74 | 1.74 | Comparative steel (Al out of the range) |
| 12 | 0.0021 | 0.26 | 0.51 | 0.098 | 0.0004 | 1.25 | 0.0019 | tr. | tr. | 750 | 15% H2 + 85% N2 | 60 | 3.19 | 1.70 | Comparative steel(Al outof therange) |
| 13 | 0.0065 | 0.24 | 0.51 | 0.100 | 0.0004 | 0.26 | 0.0019 | tr. | tr. | 750 | 15% H2 + 85% N2 | 60 | 4.22 | 1.75 | Comparative steel (C out of the range) |
| 14 | 0.0019 | 0.25 | 1.06 | 0.099 | 0.0004 | 0.25 | 0.0018 | tr. | tr. | 750 | 15% H2 + 85% N2 | 60 | 4.16 | 1.72 | Comparative steel (Mn out of the range) |
| 15 | 0.0018 | 0.26 | 0.49 | 0.102 | 0.0004 | 0.27 | 0.0065 | tr. | tr. | 750 | 15% H2 + 85% N2 | 60 | 4.40 | 1.75 | Comparative steel (N out of the range) |
| 16 | 0.0018 | 0.26 | 0.50 | 0.096 | 0.0004 | 0.25 | 0.0020 | tr. | tr. | 750 | 5% H2 + 95% N2 | 60 | 4.21 | 1.76 | Comparative steel (H2% out of the range) |
| 17 | 0.0024 | 0.24 | 0.51 | 0.102 | 0.0004 | 0.24 | 0.0021 | 0.0040 | tr. | 750 | 15% H2 + 85% N2 | 20 | 4.24 | 1.76 | Comparative steel (soaking time out of the range) |
| 18 | 0.0021 | 0.25 | 0.51 | 0.103 | 0.0004 | 0.25 | 0.0022 | tr. | tr. | 750 | 15%It2 + 85% N2 | 600 | 4.25 | 1.76 | Comparative steel (soaking time out of the range) |
| 19 | 0.0019 | 0.75 | 0.25 | 0.100 | 0.0004 | 0.31 | 0.0018 | tr. | tr. | 850 | 15% H2 + 85% N2 | 60 | 3.38 | 1.73 | Steel of the present invention |
| 20 | 0.0021 | 0.76 | 0.24 | 0.101 | 0.0003 | 0.32 | 0.0019 | tr. | tr. | 850 | 15% H2 + 85% N2 | 120 | 3.36 | 1.73 | Steel of the present invention |
| 21 | 0.0020 | 0.75 | 0.25 | 0.099 | 0.0003 | 0.30 | 0.0021 | tr. | tr. | 850 | 25% H2 + 75% N2 | 60 | 3.40 | 1.73 | Steel of the present invention |
| 22 | 0.0018 | 0.74 | 0.23 | 0.100 | 0.0004 | 0.31 | 0.0022 | 0.0040 | tr. | 850 | 15% H2 + 85% N2 | 60 | 3.30 | 1.73 | Steel of the present invention |
| 23 | 0.0022 | 0.75 | 0.27 | 0.098 | 0.0003 | 0.29 | 0.0018 | tr. | 0.01 | 850 | 15% H2 + 85% N2 | 60 | 3.32 | 1.73 | Steel of the present invention |
| 24 | 0.0021 | 0.74 | 0.25 | 0.010 | 0.0004 | 0.31 | 0.0022 | 0.0040 | 0.01 | 850 | 15% H2 + 85% N2 | 60 | 3.27 | 1.73 | Steel of the present invention |
| 25 | 0.0019 | 0.73 | 0.25 | 0.102 | 0.0040 | 0.31 | 0.0023 | tr. | tr. | 850 | 15% H2 + 85% N2 | 60 | 4.02 | 1.73 | Comparative steel (S out of the range) |
| 26 | 0.0019 | 0.75 | 0.24 | 0.102 | 0.0004 | 0.29 | 0.0021 | 0.0040 | tr. | 850 | 5% H2 + 95% N2 | 60 | 3.71 | 1.73 | Comparative steel (H2 % out of the range) |
| 27 | 0.0023 | 0.74 | 0.25 | 0.100 | 0.0004 | 0.31 | 0.0019 | 0.0040 | tr. | 850 | 15% H2 + 85% N2 | 15 | 3.69 | 1.73 | Comparative steel (soaking time out of the range) |
| 28 | 0.0022 | 0.75 | 0.25 | 0.099 | 0.0004 | 0.30 | 0.0019 | tr. | tr. | 850 | 15% H2 + 85% N2 | 650 | 3.70 | 1.73 | Comparative steel (soaking time out of the range) |
| 29 | 0.0021 | 1.76 | 0.20 | 0.101 | 0.0004 | 0.25 | 0.0018 | tr. | tr. | 900 | 15% H2 + 85% N2 | 60 | 3.29 | 1.69 | Comparative steel (Si out of the range) |

Embodiment 10

The crucial point of the present invention is to produce a non-oriented electromagnetic steel sheet having a low iron loss after the finish annealing by prescribing the S content, and Sb and Sn content, to a given level, as well as properly adjusting the annealing conditions of the hot-rolled sheet.

The foregoing problem can be solved by a method for producing a non-oriented electromagnetic steel sheet comprising the steps of: hot-rolling a slab containing, in % by weight, 0.005% or less of C, 1.5 to 4.0% of Si, 0.05 to 1.0% of Mn, 0.2 or less of P, 0.005% or less of N, 0.1 to 1.0% of Al, 0.001 or less of S and 0.001 to 0.05% of (Sb+Sn/2), with a substantial balance of Fe and inevitable impurities, followed by an annealing; and forming into a non-oriented electromagnetic steel sheet via a cold rolling and finish annealing, characterized by controlling the heating speed of hot-rolled sheet annealing carried out in a mixed atmosphere of hydrogen and nitrogen to 40° C./s or less.

Limiting the content of (Sb+Sn/2) in a range of 0.001 to 0.005% allows the iron loss of a non-oriented electromagnetic steel sheet to be more lowered.

The phrase of "a substantial balance of Fe" as used herein means that the steel containing trace amount of elements as well as other trace elements in a range not invalidating the effect of the present invention is within the scope of the present invention. "Heating speed during annealing of the hot-rolled sheet" refers to a mean heating speed from room temperature to a soaking temperature.

Procedure of the Invention and the Reason Why the Contents of S, Sb and Sn are Limited The investigators of the present invention investigated the factors that interferes the iron loss from being decreased in the material containing a trace amount of S of 10 ppm or less, thereby making it clear that notable nitride layers had appeared on the surface layer of the steel sheet with the decrease of S content to inhibit the iron loss from being reduced.

The investigators found that, through intensive studies on the methods for suppressing nitride formation to further reduce the iron loss, the iron loss of a material containing a trace amount of S could be largely reduced by adding Sb or Sn in a combined amount of (Sb+Sn/2) of 0.001 to 0.05% along with properly adjusting the annealing conditions of the hot-rolled sheet.

Figure 36:
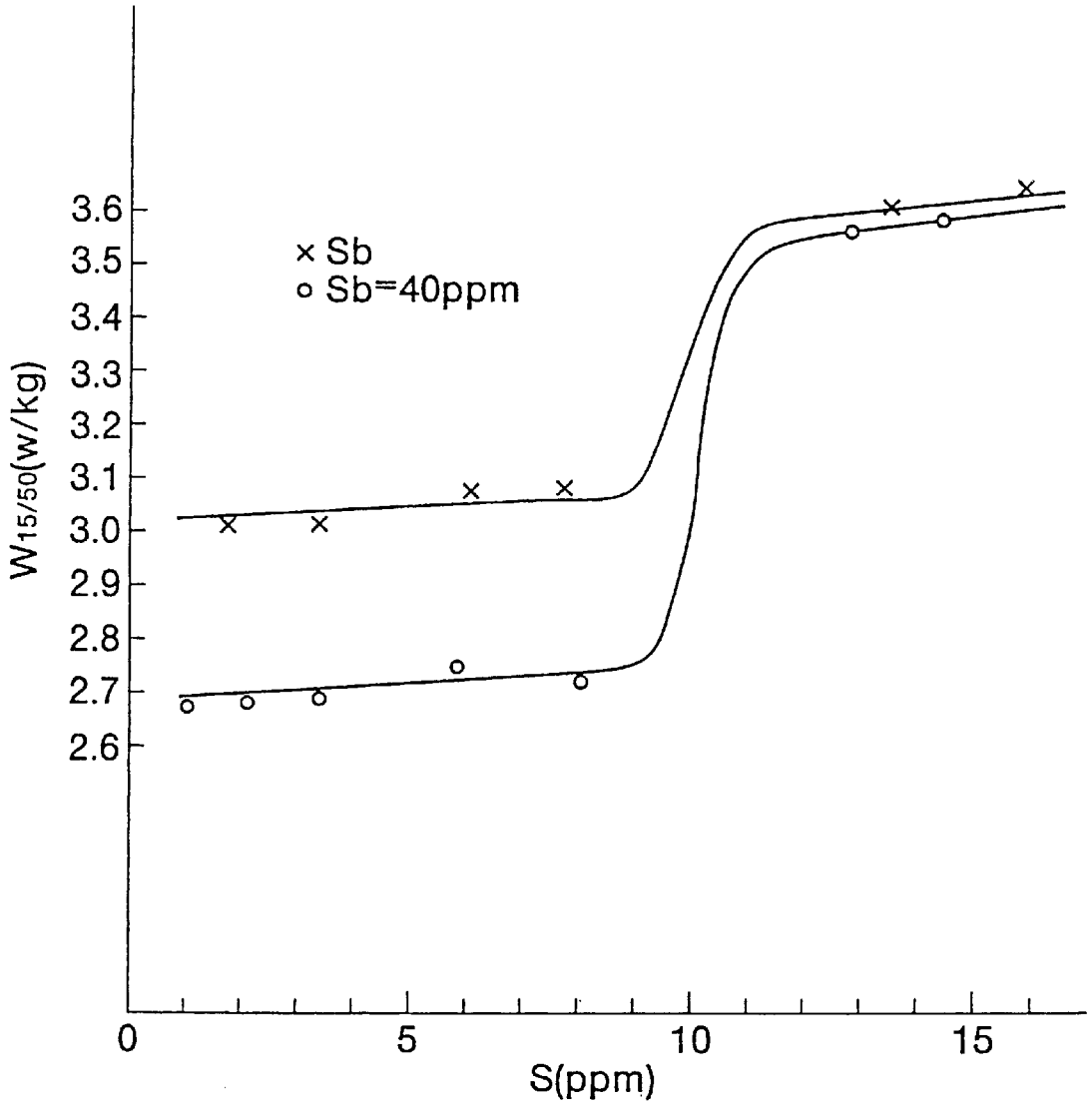
FIG. 36 is a graph indicating the relation between S content and iron loss after the finish annealing.

To investigate the effect of S on the iron loss, a steel containing 0.0025% of C, 1.65% of Si, 0.20% of Mn, 0.01% of P, 0.31% of Al and 0.0021% of N, with a varying amount of S from trace to 15 ppm, was melted in the laboratory followed by washing with an acid solution after hot-rolling. The hot-rolled sheet was then annealed under a condition of an annealing atmosphere of 75% $H_2$-25% $N_2$, heating speed of 1° C./s and soaking temperature of 800° C. for 3 hours. The heating speed as used herein refers to a mean heating speed from the room temperature to the soaking temperature (the same hereinafter). The hot-rolled sheet was then cold-rolled to a thickness of 0.5 mm followed by a finish annealing in an atmosphere of 10% $H_2$-90% $N_2$ at 930° C. for 2 minutes. FIG. 36 shows the relation between the S content of the sample thus obtained and the iron loss $W_{15/50}$ (the marks × in the figure). Magnetic properties were measured by a 25 cm Epstein test.

It is evident from FIG. 36 that the iron loss is large decreased when the S content is adjusted to 10 ppm or less, attaining an iron loss value of $W_{15/50}$=3.2 W/kg. This is because grains have made to be well developed by decreasing the S content. From these results, the S content is limited to 10 ppm or less in the present invention.

Meanwhile, decrease in the iron loss becomes slow at the S content of 10 ppm or below, the iron loss reaching to merely about 3.1 W/kg even when the S content is further decreased.

On the assumption that decrease of iron loss in the material containing a trace amount of S of 10 ppm or less might be inhibited by some unknown factors other than MnS, the investigators of the present invention observed the texture of the material under an optical microscope, finding notable nitride layers on the surface of the steel sheet in the region of the S content of 10 ppm or less. On the contrary, few nitride layers were found in the S content region of more than 10 ppm. These nitride layers may be probably formed during annealing of the hot-rolled sheet and finish annealing carried out in a mixed atmosphere of hydrogen and nitrogen.

The cause of acceleration of the nitride forming reaction with the decrease of the S content can be elucidated as follows. Since S is an element liable to be concentrated on the surface and at grain boundaries, S was concentrated on the surface of the steel in the S content region of more than 10 ppm, thereby suppressing nitrogen absorption on the surface of the steel sheet during the annealing of the hot-rolled sheet and finish annealing. In the S content region of 10 ppm or less, on the other hand, the nitrogen absorption suppressing effect was so decreased in the S content region of 10 ppm or less that nitride layers were formed.

The investigators supposed that the nitride layer notably formed in the material containing a trace amount of S might prevent crystal grains from being developed on the surface of the steel sheet to suppress decrease of the iron loss. Based on this concept, the investigators had an idea that the iron loss of the material containing a trace amount of S might be further decreased when elements capable of suppressing absorption of nitrogen and not interfering the ability of the material containing a trace amount of S for allowing the grains to be well developed could be added. Based on this concept, the investigators found that, thorough intensive studies, addition of a trace amount of Sb is effective.

A sample prepared by adding Sb in a concentration of 40 ppm into the foregoing sample denoted by a mark × was tested under the same condition. The results are shown by a mark ○ in FIG. 36. Let the iron loss reduction effect of Sb be noticed. While the iron loss value decreases only by 0.02 to 0.04 W/kg by adding Sb in the S content region of more than 10 ppm, the value has decreased by about 0.2 to 0.3 W/kg by the addition of Sb in the S content region of more 10 ppm or less, showing an evident iron loss decreasing effect of Sb when the S content is low. No nitride layers were observed in this sample irrespective of the S content, probably due to concentrated Sb on the surface layer of the steel sheet during the annealing of the hot-rolled sheet and finish annealing to suppress absorption of nitrogen.

The results above suggest that segregation of Sb prior to onset of the nitride forming reaction on the surface layer of the steel sheet is necessary to suppress nitride formation in the material containing a trace amount of S.

Noticing the heating process when surface segregation of Sb competes with the nitride forming reaction, the investigators studied the relation between the heating speed during annealing of the hot-rolled sheet and iron loss. A test sample of a steel with a composition of 0.0026 5 of C, 1.62% of Si, 0.20% of Mn, 0.010% of P, 0.30% of Al, 0.0004% of S, 0.0020% of N and 0.004% of Sb was melted in vacuum in the laboratory. The slab obtained was washed with an acid solution after hot-rolling and the hot-rolled sheet was annealed. The annealing conditions of the hot-rolled sheet was 75% $H_2$-25% $N_2$ and a soaking temperature of 800° C. for 3 hours with a varying heating speed of 1 to 50° C./sec. The sheet was then cold-rolled to a thickness of 0.5 mm and was subjected to a finish annealing in an atmosphere of 10% $H_2$-90% $N_2$.

Figure 37:
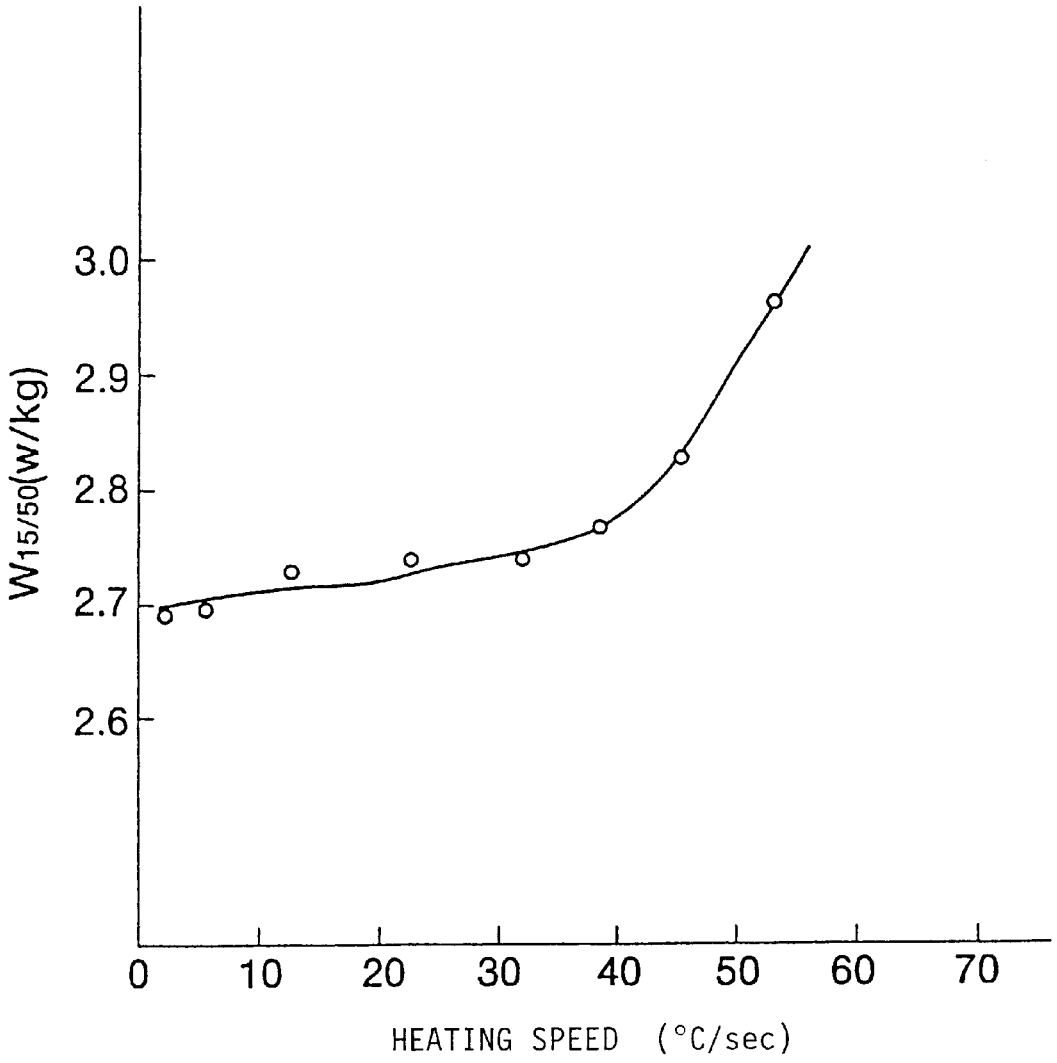
FIG. 37 is a graph indicating the relation between the heating speed at annealing of the hot-rolled sheet and iron loss after the finish annealing.

FIG. 37 shows the relation between the heating speed during annealing of the hot-rolled sheet thus obtained and the iron loss $W_{15/50}$. It can be understood that the iron loss had increased in the region of the heating speed exceeding 40° C./sec. An observation of the texture of these materials revealed that nitrides were formed on the surface layer of the steel in the sample heated at a heating speed of exceeding 40° C./sec irrespective of addition of Sb. This is probably because the nitride formation suppressing effect could not be well displayed and the nitrides were formed since the steel sheet had been exposed to a high temperature nitride forming atmosphere prior to segregation of Sb on the steel surface when the heating speed is high. From these facts, the heating speed for annealing the hot-rolled sheet is determined to be 40° C./sec or less, being 10° C./sec or less considering the iron loss.

To investigate the optimum amount of addition of Sb, a steel with a composition of 0.0026% of C, 1.60% of Si, 0.20% of Mn, 0.020% of P, 0.30% of Al, 0.0004% of S, 0.0020% of N, with a varying amount of Sb from trace to 600 ppm, was melted in vacuum in the laboratory. The slab obtained was washed with an acid solution after hot-rolling and the hot-rolled sheet was annealed. The annealing conditions of the hot-rolled sheet were an annealing atmosphere of 75% $H_2$-25% $N_2$, a heating speed of 1° C./sec and a soaking temperature of 800° C. for 3 hours. The sheet was then cold-rolled to a thickness of 0.5 mm and was subjected to a finish annealing in an atmosphere of 10% $H_2$-90% $N_2$ For 2 minutes.

Figure 38:
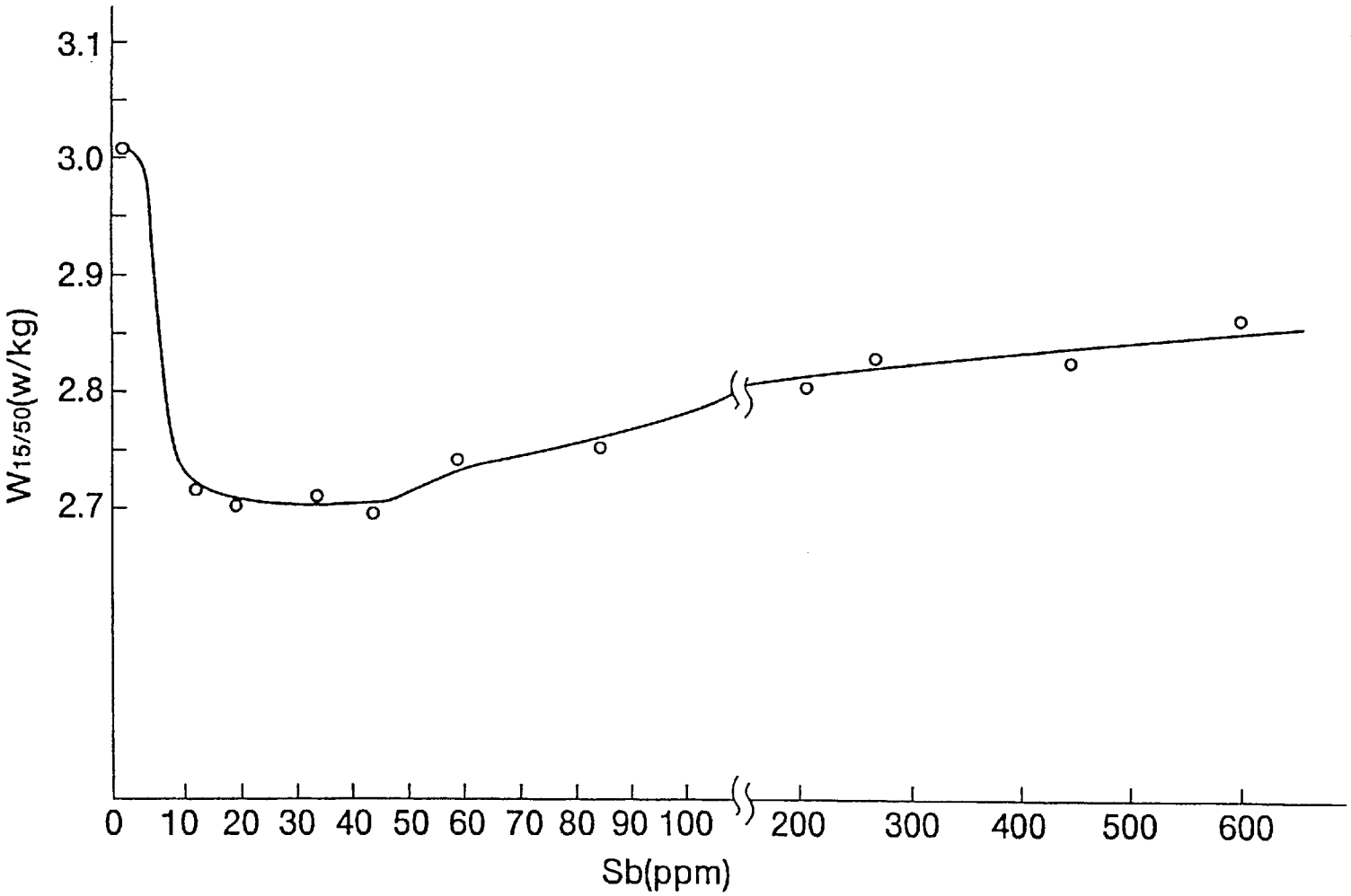
FIG. 38 is a graph indicating the relation between the Sb content and iron loss after the finish annealing.

FIG. 38 shows the relation between the Sb content and the iron loss $W_{15/50}$. It is evident from FIG. 38 that the iron loss is decreased in the region of the Sb content of 10 ppm or less, showing also that the iron loss is again increased when the Sb content is increased to more than 50 ppm by further adding Sb.

To investigate the cause of this iron loss increase in the Sb content region of more than 50 ppm, the texture of the material was observed under an optical microscope. The result showed that, though no fine grain texture were observed on the surface layer, the mean crystal diameter had became a little smaller. Since Sb is an element liable to be segregated at the grain boundaries, though not certain, the ability for allowing the grains to be well developed was deteriorated due to a grain boundary drag effect of Sb.

However, the iron loss remains small as compared with the iron loss of the steel not containing Sb even when Sb is added up to 600 ppm. For these reasons, the Sb content is determined to be 10 ppm or more, its upper limit being 500 ppm from the economical point of view. By considering the iron loss, the desirable Sb content is 10 ppm or more and 50 ppm or less.

The iron loss decreasing effect as described above was also observed when 20 ppm or more of Sn, a surface segregation type element like Sb, was added. The iron loss was a little increased when 100 ppm or more of Sn was added. Accordingly, the Sn content is determined to be 20 ppm or more, the upper limit being 1000 ppm from the economical point of view. By considering the iron loss, the Sn content is 20 ppm or more and 100 ppm or less.

When Sb and Sn were simultaneously added, iron loss decreased at a combined amount of (Sb+Sn/2) of 10 ppm or more while a little increase in the iron loss was observed at a combined amount of (Sb+Sn/2) of 50 ppm or more. Accordingly, the (Sb+Sn/2) content is determined to be 10 ppm or more in the simultaneous addition of Sb and Sn, its upper limit being 500 ppm or less from the economical point of view. By considering the iron loss, the content is desirably 10 ppm or more and 50 ppm or less.

The Reason Why the Contents of Other Elements are Limited

The reason why the contents of other components should be limited will be described hereinafter.

C: Since C involves a problem of magnetic aging, its content is limited to 0.005% or less.

Si: Since Si is an effective element for increasing inherent resistivity of the steel sheet, 1.0% or more of Si is added. The upper limit of the Si content is limited to 4.0% because the magnetic flux density is decreased with the decrease of saturation magnetic flux density when its content exceeds 4.0%.

Mn: More than 0.05% of Mn is needed in order to prevent red brittleness during hot-rolling. However, since the magnetic flux density is decreased at the Mn content of 1.0% or more, its range is limited to 0.05 to 1.0%.

P: While P is an element essential for improving punching applicability of the steel sheet, its content was limited to 0.2% or less because an addition exceeding 0.2% makes the steel sheet fragile.

N: Since a lot of AlN is precipitated when the N content is large decreasing the iron loss, its range is limited to 0.005% or less.

Al: Although Al is, like Si, an effective element for enhancing the inherent resistivity, the upper limit of the Al content was limited to 1.0% because the magnetic flux density is decreased with the decrease of saturation magnetic flux density when its content exceeds 1.0%. The lower limit is determined to be 0.1% because AlN grains becomes too fine for the grains to be well developed when the Al content is less than 0.1%.

Production Method

Conventional methods for producing the electromagnetic steel sheet may be applied in the present invention provided the S, Sb and Sn contents as well as the contents of other prescribed components be in a given range and the heating speed at annealing of the hot-rolled sheet be in the range of the present invention. The molten steel refined in a converter is de-gassed to adjust to a prescribed composition, followed by subjecting to casting and hot-rolling. The finishing temperature and coiling temperature at the hot rolling is not necessarily prescribed, but it may be an ordinary temperature range for producing conventional electromagnetic steel sheet. The hot-rolled sheet is subsequently washed with an acid solution and hot rolled. Either a batch furnace or a continuous annealing furnace may be used for annealing provided that the heating speed of annealing of the hot-rolled sheet is within the range of the present invention. After forming the hot-rolled sheet a prescribed thickness by one cold rolling, or by twice or more of cold-rolling with an intermediate annealing inserted thereto, the steel sheet is subjected to a final annealing.

Example

The steel shown in Table 21 was used and the molten steel refined in a converter was de-gassed to adjust to a prescribed composition, followed by subjecting to casting and hot-rolling. After heating the slab at 1140° C. for 1 hour, the sheet was hot-rolled to a sheet thickness of 2.3 mm. The finishing temperature of the hot-rolled sheet was 800° C. and the coiling temperature was 610° C. After coiling, the hot-rolled sheet was washed with an acid solution and annealed by the conditions shown in Table 21. The annealed sheet was then cold-rolled to a thickness of 0.5 mm, followed by a finish annealing under the conditions shown in Table 21. The annealing atmosphere of the hot-rolled sheet and the finish annealing atmosphere were 75% $H_2$-25% $N_2$ and 75% $H_2$-25% $N_2$, respectively. Magnetic properties were measured using a 25 cm Epstein test piece. The magnetic characteristics are also listed in Table 21.

As are evident from the steel sheets No. 1 to No. 13 of the present invention in Table 21, a steel sheet with a very low iron loss after the finish annealing and high magnetic flux density can be obtained by controlling the prescribed steel sheet components including S, Sb and Sn as well as the contents of the other prescribed components to the contents of the present invention and by adjusting the heating speed during annealing of the hot-rolled sheet within the range of the present invention.

The iron loss values $W_{15/50}$ in the steel sheets No. 14 and No. 15 are high because the contents of S and (Sb+Sn/2) in the former and the content of (Sb+Sn/2) in the latter are out of the range of the present invention.

Since the heating speed of the steel sheets No. 16 and No. 17 is higher than the range of the present invention, the iron loss $W_{15/50}$ is higher than the value of the steel of the present invention.

The iron loss $W_{15/50}$ is high in the steel sheet No. 18 because the C content is over the range of the present invention.

Although the iron loss $W_{15/50}$ is low but the magnetic flux density $B_{50}$ is also low in the steel sheet No. 19 because the Si content is over the range of the present invention.

Since the Mn content in the steel sheet No. 20 is lower than the range of the present invention, the iron loss $W_{15/50}$ is high.

Although the iron loss $W_{15/50}$ is low but the magnetic flux density $B_{50}$ is also low in the steel sheet No. 21 because the Mn content is over the range of the present invention.

The N content is over the range of the present invention in the steel sheet No. 22, so that the iron loss $W_{15/50}$ is high.

The iron loss $W_{15/50}$ is high in the steel sheet No. 23 because the Al content is lower than the range of the present invention.

Although the iron loss $W_{15/50}$ is low but the magnetic flux density $B_{50}$ is also low in the steel sheet No. 24 because the Al content is over the range of the present invention.

TABLE 21

| No. | C | Si | Mn | P | S | Al | N | Sb | Sn | Heating speed (° C./s) | Hot-roll plate annealing temp (° C.) | Hot-roll plate annealing temp. (min) | Finish annealing temp. (° C.) × 2 min | W15/50 (W/kg) | B50 (T) | Note |
|---|---|---|---|---|---|---|---|---|---|---|---|---|---|---|---|---|
| 1 | 0.0025 | 1.62 | 0.18 | 0.011 | 0.0002 | 0.31 | 0.0017 | 0.0020 | tr. | 1 | 800 | 180 | 950 | 2.70 | 1.72 | Steel of the present invention |
| 2 | 0.0015 | 1.64 | 0.19 | 0.013 | 0.0002 | 0.30 | 0.0019 | 0.0040 | tr. | 1 | 800 | 180 | 950 | 2.71 | 1.72 | Steel of the present invention |
| 3 | 0.0016 | 1.63 | 0.17 | 0.015 | 0.0002 | 0.29 | 0.0016 | 0.0070 | tr. | 1 | 800 | 180 | 950 | 2.75 | 1.72 | Steel of the present invention |
| 4 | 0.0017 | 1.65 | 0.18 | 0.010 | 0.0002 | 0.29 | 0.0019 | 0.0400 | tr. | 1 | 800 | 180 | 950 | 2.83 | 1.72 | Steel of the preaent invention |
| 5 | 0.0019 | 1.64 | 0.18 | 0.012 | 0.0002 | 0.30 | 0.0018 | tr. | 0.0040 | 1 | 800 | 180 | 950 | 2.70 | 1.72 | Steel of the present invention |
| 6 | 0.0016 | 1.63 | 0.18 | 0.011 | 0.0002 | 0.29 | 0.0020 | tr. | 0.0080 | 1 | 800 | 180 | 950 | 2.71 | 1.72 | Steel of the present invention |
| 7 | 0.0019 | 1.62 | 0.17 | 0.012 | 0.0002 | 0.30 | 0.0018 | tr. | 0.0120 | 1 | 800 | 180 | 950 | 2.74 | 1.72 | Steel of the present invention |
| 8 | 0.0018 | 1.6t | 0.19 | 0.010 | 0.0002 | 0.28 | 0.0019 | 0.0020 | 0.0030 | 1 | 800 | 180 | 950 | 2.70 | 1.72 | Steel of the present invention |
| 9 | 0.0020 | 1.63 | 0.18 | 0.013 | 0.0002 | 0.27 | 0.0017 | 0.0040 | tr. | 0.05 | 800 | 180 | 950 | 2.69 | 1.72 | Steel of the present invention |
| 10 | 0.0019 | 1.65 | 0.18 | 0.015 | 0.0002 | 0.28 | 0.0018 | 0.0040 | tr. | 0.1 | 800 | 180 | 950 | 2.70 | 1.72 | Steel of the present invention |
| 11 | 0.0022 | 1.62 | 0.18 | 0.010 | 0.0002 | 0.29 | 0.0020 | 0.0040 | tr. | 8 | 800 | 180 | 950 | 2.72 | 1.72 | Steel of the present invention |
| 12 | 0.0024 | 1.65 | 0.18 | 0.010 | 0.0002 | 0.29 | 0.0021 | 0.0040 | tr. | 8 | 950 | 2 | 950 | 2.72 | 1.72 | Steel of the present invention |
| 13 | 0.0024 | 1.06 | 0.18 | 0.011 | 0.0002 | 0.28 | 0.0018 | 0.0040 | tr. | 25 | 800 | 180 | 950 | 2.75 | 1.72 | Steel of the present invention |
| 14 | 0.0020 | 1.60 | 0.18 | 0.011 | 0.0002 | 0.28 | 0.0015 | tr. | tr. | 1 | 800 | 180 | 950 | 3.55 | 1.72 | Comparative steel (S Sb + Sn/2 out of the range) |
| 15 | 0.0022 | 1.63 | 0.17 | 0.012 | 0.0002 | 0.29 | 0.0016 | tr. | tr. | 1 | 800 | 180 | 950 | 3.05 | 1.72 | Comparative steel (Sb + Sn/2 out of the range) |
| 16 | 0.0015 | 1.63 | 0.20 | 0.010 | 0.0002 | 0.30 | 0.0019 | 0.0040 | tr. | 45 | 800 | 180 | 950 | 2.80 | 1.72 | Comparative steel (heating speed out of the range) |
| 17 | 0.0018 | 1.64 | 0.21 | 0.011 | 0.0002 | 0.29 | 0.0019 | 0.0040 | tr. | 57 | 800 | 180 | 950 | 2.98 | 1.72 | Comparative steel (heating speed out of the range) |
| 18 | 0.0065 | 1.65 | 0.20 | 0.009 | 0.0002 | 0.30 | 0.0019 | 0.0040 | tr. | 1 | 800 | 180 | 950 | 3.06 | 1.72 | Coenparative steel(C out of the range) |
| 19 | 0.0018 | 4.20 | 0.19 | 0.012 | 0.0002 | 0.30 | 0.0019 | 0.0040 | tr. | 1 | 850 | 180 | 950 | 2.05 | 1.63 | Comparative steel (Si out of the range) |
| 20 | 0.0018 | 1.62 | 0.02 | 0.012 | 0.0002 | 0.30 | 0.0019 | 0.0040 | tr. | 1 | 800 | 180 | 950 | 3.01 | 1.72 | Comparative steel (Mn out of the range) |
| 21 | 0.0018 | 1.60 | 1.50 | 0.012 | 0.0002 | 0.30 | 0.0019 | 0.0040 | tr. | 1 | 800 | 180 | 950 | 2.43 | 1.68 | Comparative steel (Mn out of the range) |
| 22 | 0.0018 | 1.66 | 0.18 | 0.015 | 0.0002 | 0.29 | 0.0065 | 0.0040 | tr. | 1 | 800 | 180 | 950 | 3.55 | 1.70 | Comparative steel (N out of the range) |
| 23 | 0.0020 | 1.65 | 0.18 | 0.010 | 0.0002 | 0.05 | 0.0018 | 0.0040 | tr. | 1 | 800 | 180 | 950 | 3.60 | 1.71 | Comparative steel (Al out of the range) |
| 24 | 0.0025 | 1.63 | 0.17 | 0.012 | 0.0002 | 1.25 | 0.0015 | 0.0040 | tr. | 1 | 800 | 180 | 950 | 2.45 | 1.67 | Comparative steel (Al out of the range) |

Embodiment 11

The crucial point of the present invention is to largely reduce the iron loss of a non-oriented electromagnetic steel sheet, in the material containing a trace amount of S of 10 ppm or less, by allowing 0.03 to 0.15% of P or 0.001 to 0.05% of (Sb+Sn/2) to contain and controlling the annealing atmosphere during annealing of the hot-rolled sheet and soaking time.

The foregoing problem can be solved by a method for producing a non-oriented electromagnetic steel sheet characterized by comprising the steps of: hot-rolling a slab containing, in % by weight, 0.005% or less of C, 1.5 to 3.5% of Si, 0.05 to 1.0% of Mn, 0.005% or less (including zero) of N, 0.1 to 1.0% of Al, 0.001 or less (including zero) of S and 0.03 to 0.15% of P, with a substantial balance of Fe and inevitable impurities; forming into a given sheet thickness by one time of cold-rolling or twice or more of cold rolling by inserting an intermediate annealing thereto after washing with an acid solution and annealing of the hot-rolled sheet in an atmosphere containing 60% or more of $H_2$ for a soaking time of 1 to 6 hours; and subjecting the annealed sheet to a finish annealing.

The foregoing problem can be also solved by a method for producing a non-oriented electromagnetic steel sheet characterized by comprising the steps of: hot-rolling a slab containing, in % by weight, 0.005% or less of C, 1.5 to 3.5% of Si, 0.05 to 1.0% of Mn, 0.005% or less (including zero) of N, 0.1 to 1.0% of Al, 0.001 or less (including zero) of S, 0.003 to 0.15% of P and 0.001 to 0.05% of (Sb+Sn/2), with a substantial balance of Fe and inevitable impurities; forming into a given sheet thickness by one time of cold-rolling or twice or more of cold rolling by inserting an intermediate annealing thereto after washing with an acid solution and annealing of the hot-rolled sheet in an atmosphere containing 60% or more of $H_2$ for a soaking time of 1 to 6 hours; and subjecting the annealed sheet to a finish annealing.

The phrase of "a substantial balance of Fe" as used herein means that the steel to which trace amount of elements other than inevitable impurities are added in a range not invalidating the effect of the present invention is within the scope of the present invention. In the descriptions hereinafter, "%" and "ppm" representing the composition of the steel refers to "% by weight" and "ppm by %", respectively.

Procedure of the Invention and the Reason Why the S Content and Annealing Conditions are Limited The investigators of the present invention made detailed studies on the factors inhibiting the iron loss from being decreased in the material containing a trace amount of S of 10 ppm or less. The results clearly showed that notable nitride layers were found on the surface layer of the steel sheet with the decrease of the S content and these nitride layers had inhibited decrease of the iron loss.

Accordingly, the investigators found that, through the collective studies on the methods for further reducing the iron loss, the iron loss in the material containing a trace amount of S could be largely reduced by allowing 0.03 to 0.15% of P, or (Sb+Sn/2) in a rage of 0.001 to 0.05%, to contain and by controlling the annealing atmosphere and soaking time of the hot-rolled sheet.

The present invention will be described in more detail referring to the experimental results.

To investigate the effect of S on the iron loss first, steels with the following three composition systems and containing a varying amount of S from trace to 15 ppm, were melted in the laboratory, followed by washing with an acid solution. The hot-rolled sheet obtained was annealed under three kind of combinations of annealing atmosphere and soaking time of 75% $H_2$/3 hours' soaking, 50% $H_2$/3 hours' soaking and 75% $H_2$/0.5 hour's soaking at an annealing temperature of 800° C. The annealed sheet was then cold-rolled to a thickness of 0.5 mm followed by a finish annealing in an atmosphere of 10% $H_2$-90% $N_2$ for 2 minutes.

(1) C: 0.0025%, Si: 1.85%, Mn: 0.20%, P: 0.040%, Al: 0.31%, N: 0.0018%

(2) C: 0.0025%, Si: 1.85%, Mn: 0.20%, P: 0.010%, Al: 0.31%, N: 0.0018%, Sn: 0.0050%

(3) C: 0.0025%, Si: 1.85%, Mn: 0.20%, P: 0.010%, Al: 0.31%, N: 0.0018%, Sb: 0.0040%

Figure 39:
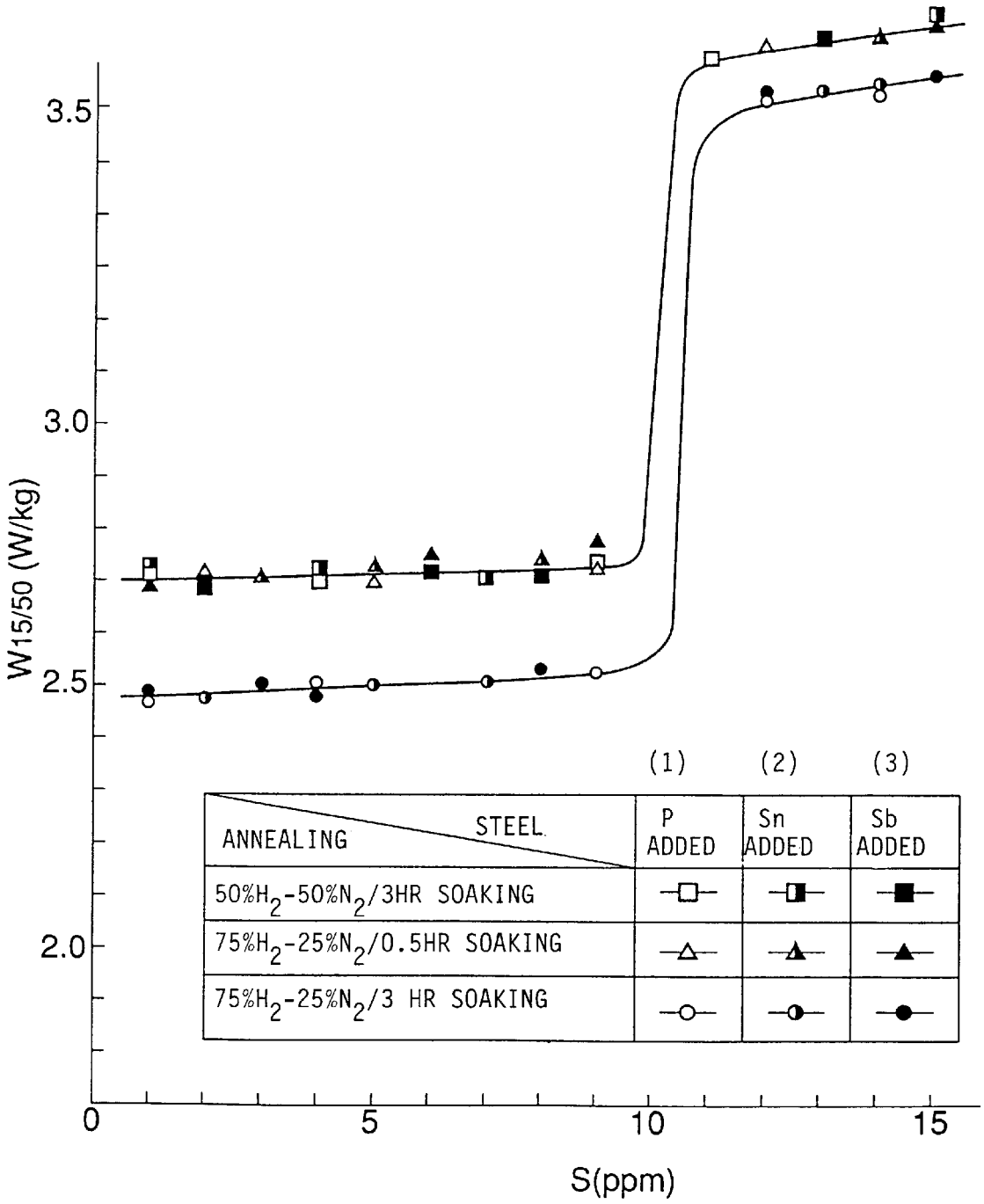
FIG. 39 is a graph indicating the relation between the S content and iron loss after the finish annealing.

The relation between the S content of the sample thus obtained and the iron loss $W_{15/50}$ is shown in FIG. 39. It is clear from FIG. 39 that the iron loss is largely decreased when the S content is 10 ppm or less. This is because grains are made to be well developed by decreasing the S content. Accordingly, the S content is determined to be 10 ppm or less, desirably to 5 ppm or less.

However, it was found that the decreasing level of the iron loss differs depending on the combination of the annealing atmosphere and soaking time. As is evident from FIG. 39, the iron loss is far more decreased in the combination of 75% H2 /3 hours' soaking than in the combinations of 50% $H_2$/3 hours' soaking and 75% $H_2$/0.5 hour's soaking.

For the purpose of investigating the causes above, the investigators observed the texture of the material under an optical microscope, finding notable nitride layers on the surface layer of the steel sheet in all of the three components systems when the combinations are 50% $H_2$/3 hours' soaking and 75% $H_2$/0.5 hour's soaking. In the case of 75% $H_2$/3 hours' soaking, on the other hand, the nitride layers were rarely found. The nitride layer was probably formed during annealing of the hot-rolled sheet carried out in a nitride forming atmosphere.

The reason why different nitride forming reactions were caused can be elucidated as follows. Since S is an element liable to be concentrated on the surface and at the grain boundaries, concentrated S on the surface of the steel sheet suppressed absorption of nitrogen during annealing of the hot-rolled sheet in the S content region of more than 10 ppm. The suppressing effect for absorption of nitrogen was deteriorated, on the other hand, in the s content region of 10 ppm or less. Although deterioration of this suppressing effect was attempted to be supplemented by controlling the contents of P or Sn, or the combination of the Sb content and annealing atmosphere of the hot-rolled sheet (annealing atmosphere—soaking time), there were some differences in the nitrogen absorption suppressing ability by the combination of the annealing atmosphere—soaking time. These results were supposed to reflect on the iron loss revel.

To investigate the optimum combinations of the annealing atmosphere and soaking time next, steels with the following composition systems were melted in the laboratory, followed by washing with an acid solution. The hot-rolled sheet obtained was annealed by changing the an annealing temperature of 800° C. The annealed sheet was then cold-rolled to a thickness of 0.5 mm followed by a finish annealing in an atmosphere of 10% $H_2$-90% $N_2$ for 2 minutes.

(4) C: 0.0020%, Si: 1.87%, Mn: 0.20%, P: 0.040%, Al: 0.30%, S: 0.0003%, N: 0.0017%

(5) C: 0.0020%, Si: 1.87%, Mn: 0.20%, P: 0.010%, Al: 0.30%, S: 0.0003%, N: 0.0017%, Sn: 0.0050%

(6) C: 0.0020%, Si: 1.87%, Mn: 0.20%, P: 0.010%, Al: 0.30%, S: 0.0003%, N: 0.0017%, Sb: 0.0040%

Figure 40:
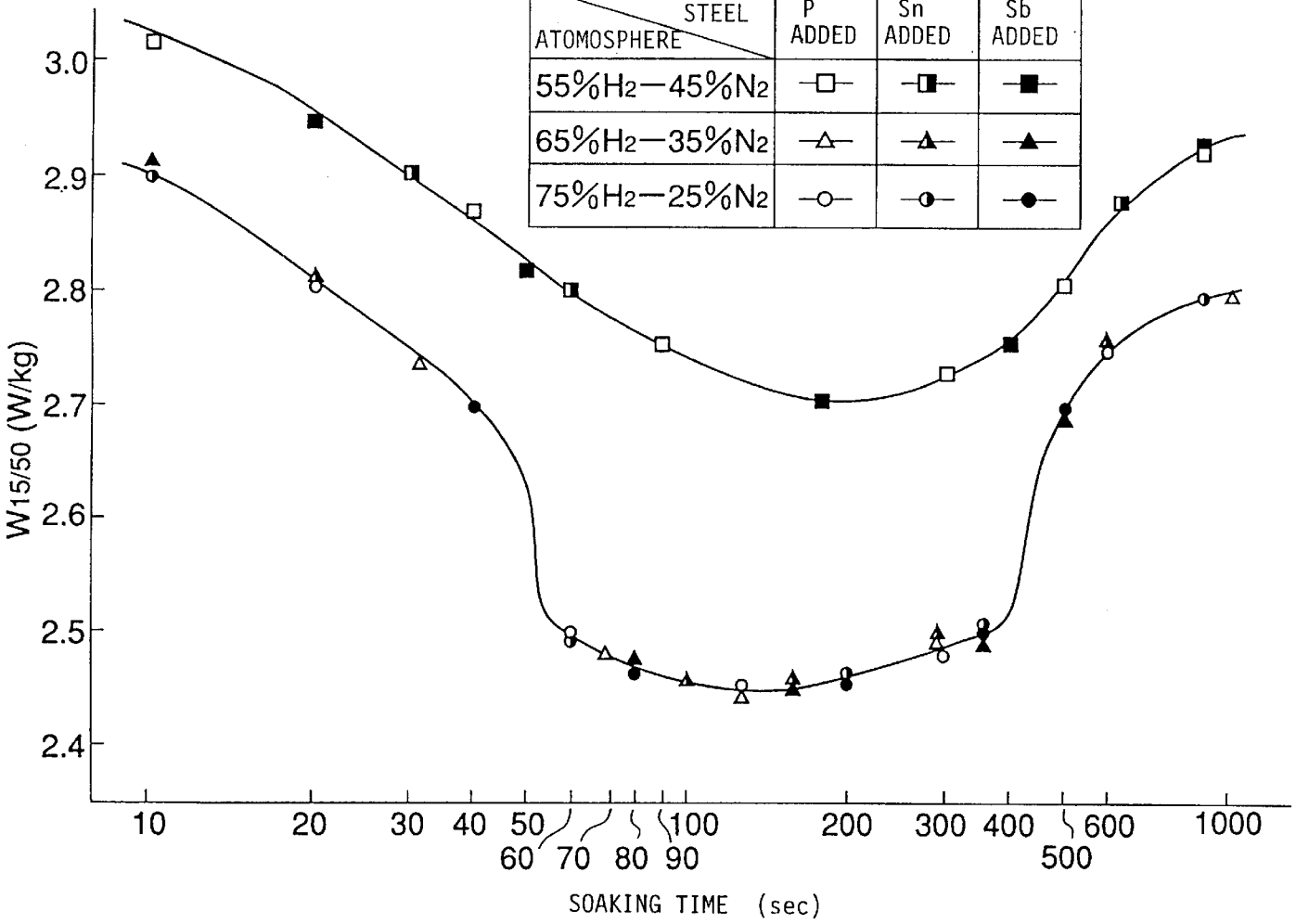
FIG. 40 is a graph indicating the relation between the soaking time for annealing a hot-rolled sheet and iron loss after the finish annealing.

FIG. 40 shows the relation between each soaking time of the hot-rolled sheet in each $H_2$ concentration and the iron loss $W_{15/50}$ of the samples thus obtained.

It can be understood from FIG. 40 that the iron loss is decreased in the region where the $H_2$ concentration is 60% or more and the soaking time during annealing of the hot-rolled sheet is 1 to 6 hours in any of the composition systems, attaining an iron loss value $W_{15/50}$ of 2.5 W/kg.

The Reason Why the Contents of the Other Components are Limited

The reason why the contents of other components should be limited will be described hereinafter.

C: Since C involves a problem of magnetic aging, its content is limited to 0.005% or less.

N: Since a lot of AlN is precipitated when the N content is large decreasing the iron loss, its range is limited to 0.005% or less.

Si: Since Si is an effective element for increasing inherent resistivity of the steel sheet, its lower limit is determined to be 1.5%. The upper limit of the Si content is limited to 3.5% because the magnetic flux density is decreased with the decrease of saturation magnetic flux density when its content exceeds 3.5%.

Mn: More than 0.05% of Mn is needed in order to prevent red brittleness during hot-rolling. However, since the magnetic flux density is decreased at the Mn content of 1.0% or more, its range is limited to 0.05 to 1.0%.

Al: Although Al is, like Si, an effective element for enhancing the inherent resistivity, the upper limit of the Al content was limited to 1.0% because the magnetic flux density is decreased with the decrease of saturation magnetic flux density when its content exceeds 1.0%. The lower limit is determined to be 0.1% because AlN grains becomes too fine for the grains to be well developed when the Al content is less than 0.1%.

P: The P content is determined to be 0.03% or more to suppress the absorption of nitrogen during annealing of the hot-rolled sheet and finish annealing, and the upper limit is determined to 0.15% considering the problem of compatibility to hot-rolling. However, when 0.001% or more of (Sb+Sn/2) is contained, the lower limit is not defined while the upper limit is determined to be 0.15% considering compatibility with cold-rolling because Sb and Sn suppress absorption of nitrogen during annealing of the hot-rolled sheet and finish annealing. Sb+Sn/2: While Sb and Sn equally serve for effectively suppressing nitride formation, Sb is twice as effective as Sn. Therefore, their content is prescribed by (Sb+Sn/2). Although a content of (Sb+Sn/2) of 0.001% or more is preferable in order to suppress the nitride formation during annealing of the hot-press sheet and finish annealing, its upper limit is limited to 500 ppm from the economical point of view. Either Sb or Sn is allowed to be contained provided that (Sb+Sn/2) remains within the range described above.

Production Method

Conventional methods for producing the electromagnetic steel sheet may be applied in the present invention provided the contents of S and prescribed components except the annealing conditions of the hot-rolled sheet be in a given range. The molten steel refined in a converter is de-gassed to adjust to a prescribed composition, followed by subjecting to casting and hot-rolling. The finish annealing temperature and coiling temperature at the hot rolling is not necessarily prescribed, but it may be an ordinary temperature range for producing conventional electromagnetic steel sheet. The hot-rolled sheet is subsequently washed with an acid solution and hot rolled. After forming the hot-rolled sheet to a prescribed thickness by one cold rolling, or by twice or more of cold-rolling with an intermediate annealing inserted thereto, the steel sheet is subjected to a final annealing.

Example

The steel shown in Table 22 was used and the molten steel refined in a converter was de-gassed to adjust to a prescribed composition, followed by subjecting to casting and hot-rolling. After heating the slab at 1160° C. for 1 hour, the sheet was hot-rolled to a sheet thickness of 2.0 mm. The finish annealing temperature of the hot-rolled sheet was 800° C. and the coiling temperature was 610° C. followed by an annealing of the hot-rolled sheet under the conditions listed in Table 22. The annealed sheet was then cold-rolled to a thickness of 0.5 mm, followed by a finish annealing under the conditions shown in Table 22. Magnetic properties were measured using a 25 cm Epstein test piece. The magnetic characteristics of each steel sheet are also shown in Table 22. The soaking time is denoted by the annealing time of the hot-rolled sheet in Table 22.

In Table 22, the steel sheets No. 1 to No. 17 have a Si level of the order of 1.8% while the steel sheets No. 18 to No. 25 have a Si level of the order of 2.5%. When the steel sheets with the same level of Si contents are compared with each other, the steels of the present invention have lower iron loss values.

These facts indicate that a non-oriented electromagnetic steel sheet with a very low magnetic loss could be obtained when the S content, the amount of addition of either one of P, Sn or Sb, the annealing atmosphere of the hot-rolled sheet and soaking time are within the range of the present invention.

The steel sheets No. 8 and No. 21 have, on the other hand, a high $W_{15/50}$ because the s content is out of the range of the present invention.

Since the $H_2$ concentration during annealing of the hot-rolled sheet in the steel sheets No. 14 and No. 22, the soaking time during annealing of the hot-rolled sheet in the steel sheets No. 15, No. 16, No. 23 and No. 24 are out of the range of the present invention, the iron loss $W_{15/50}$ becomes high.

The steel sheet No. 10 not only has a high iron loss $W_{15/50}$ but also involves the problem of magnetic aging because the C content is over the rage of the present invention.

Although the iron loss $W_{15/50}$ is low, the magnetic flux density $B_{50}$ is also low in the steel sheet No. 11 because the Mn content is higher than the range of the present invention.

The steel sheet No. 12 has an Al content lower than the range of the present invention, so that the iron loss $W_{15/50}$ is high.

The iron loss $W_{15/50}$ is high in the steel sheet No. 13 because The N content is over the range of the present invention.

Since all of the P, Sn and Sb content are out of the range of the present invention in the steel sheet No. 17 and No. 25, the iron loss $W_{15/50}$ is high.

The steel sheet No. 26 has a Si content higher than the range of the present invention, so that the magnetic flux density $B_{50}$ is low despite the high iron loss $W_{15/50}$.

The P content of the steel sheet no. 9 was too high to be formed into a commercial product because the sheet was broken during cold-rolling.

TABLE 22

| No. | C | Si | Mn | P | S | Al | N | Sn | Sb | Hot roll plate annealing Temp (° C.) | Atmosphere | Time (min) | Finish annealing (° C.) × 2 min | W15/50 (W/kg) | B50 (T) | Note |
|---|---|---|---|---|---|---|---|---|---|---|---|---|---|---|---|---|
| 1 | 0.0025 | 1.85 | 0.25 | 0.040 | 0.0003 | 0.30 | 0.0017 | tr. | tr. | 800 | 75% H2 + 25% N2 | 90 | 930 | 2.48 | 1.72 | Steel of the present Invention |
| 2 | 0.0024 | 1.84 | 0.26 | 0.039 | 0.0003 | 0.29 | 0.0018 | tr. | tr. | 800 | 75% H2 + 25% N2 | 300 | 930 | 2.50 | 1.72 | Steel of the present invention |
| 3 | 0.0018 | 1.85 | 0.24 | 0.041 | 0.0004 | 0.30 | 0.0019 | tr. | tr. | 800 | 100% H2 | 180 | 930 | 2.46 | 1.72 | Steel of the present invention |
| 4 | 0.0022 | 1.85 | 0.23 | 0.040 | 0.0003 | 0.30 | 0.0017 | 0.0050 | tr. | 800 | 75% H2 + 25% N2 | 90 | 930 | 2.45 | 1.72 | Steel of the present invention |
| 5 | 0.0021 | 1.84 | 0.25 | 0.014 | 0.0004 | 0.29 | 0.0018 | 0.0050 | tr. | 800 | 75% H2 + 25% N2 | 300 | 930 | 2.49 | 1.72 | Steel of the present invention |
| 6 | 0.0020 | 1.85 | 0.25 | 0.015 | 0.0003 | 0.30 | 0.0018 | tr. | 0.0040 | 800 | 75% H2 + 25% N2 | 90 | 930 | 2.47 | 1.72 | Steel of the present invention |
| 7 | 0.0019 | 1.85 | 0.24 | 0.013 | 0.0004 | 0.31 | 0.0019 | tr. | 0.0040 | 800 | 75% H2 + 25% N2 | 300 | 930 | 2.49 | 1.72 | Steel of the present invention |
| 8 | 0.0018 | 1.86 | 0.26 | 0.040 | 0.0020 | 0.30 | 0.0021 | tr. | tr. | 800 | 75% H2 + 25% N2 | 180 | 930 | 3.54 | 1.72 | Comparativesteel (S out of the range) |
| 9 | 0.0021 | 1.84 | 0.26 | 0.180 | 0.0003 | 0.29 | 0.0020 | tr. | tr. | 800 | " | 180 | — | — | — | Plate is broken at cold press (P out of the range) |
| 10 | 0.0067 | 1.85 | 0.25 | 0.040 | 0.0004 | 0.30 | 0.0019 | tr. | tr. | 800 | 75% H2 + 25% N2 | 180 | 930 | 2.68 | 1.72 | Comparative steel (C out of the range) |
| 11 | 0.0022 | 1.83 | 1.49 | 0.040 | 0.0003 | 0.30 | 0.0018 | tr. | tr. | 800 | 75% H2 + 25% N2 | 180 | 930 | 2.41 | 1.68 | Comparative steel (Mn out of the range) |
| 12 | 0.0021 | 1.85 | 0.26 | 0.041 | 0.0003 | 0.05 | 0.0019 | tr. | tr. | 800 | 75% H2 + 25% N2 | 180 | 930 | 3.60 | 1.71 | Comparative steel (Al out of the range) |
| 13 | 0.0022 | 1.86 | 0.24 | 0.039 | 0.0003 | 0.31 | 0.0065 | tr. | tr. | 800 | 75% H2 + 25% N2 | 180 | 930 | 3.49 | 1.71 | Comparative steel (N out of the range) |
| 14 | 0.0018 | 1.85 | 0.25 | 0.041 | 0.0004 | 0.29 | 0.0018 | tr. | tr. | 800 | 50% H2 + 50% N2 | 180 | 930 | 2.72 | 1.72 | Comparative steel (H2 % out of the range) |
| 15 | 0.0019 | 1.85 | 0.26 | 0.040 | 0.0003 | 0.30 | 0.0019 | tr. | tr. | 800 | 75% H2 + 25% N2 | 30 | 930 | 2.75 | 1.72 | Comparative steel (Hot roll plate annealing time out of the range) |
| 16 | 0.0017 | 1.85 | 0.25 | 0.041 | 0.0004 | 0.30 | 0.0020 | tr. | tr | 800 | 75% H2 + 25% N2 | 500 | 930 | 2.72 | 1.72 | Comparative steel (Hot roll plate annealing time out of the range) |
| 17 | 0.0016 | 1.85 | 0.24 | 0.015 | 0.0003 | 0.30 | 0.0019 | tr | tr. | 800 | 75% H2 + 25% N2 | 180 | 930 | 2.79 | 1.72 | Comparative steel (P, Sn Sb out of the range) |
| 18 | 0.0022 | 2.51 | 0.18 | 0.014 | 0.0004 | 0.50 | 0.0018 | 0.0050 | tr. | 830 | 75% H2 + 25% N2 | 180 | 950 | 2.32 | 1.70 | Steel of the present invention |
| 19 | 0.0024 | 2.50 | 0.18 | 0.015 | 0.0003 | 0.49 | 0.0021 | tr. | 0.0040 | 830 | 75% H2 + 25% N2 | 180 | 950 | 2.33 | 1.70 | Steel of the present invention |
| 20 | 0.0023 | 2.52 | 0.17 | 0.040 | 0.0003 | 0.51 | 0.0019 | tr. | 0.0040 | 830 | 75% H2 + 25% N2 | 180 | 950 | 2.30 | 1.70 | Steel of the present invention |
| 21 | 0.0019 | 2.49 | 0.19 | 0.015 | 0.0020 | 0.52 | 0.0020 | tr. | 0.0040 | 830 | 75% H2 + 25% N2 | 180 | 950 | 3.06 | 1.70 | Comparative steel (S out of the range) |
| 22 | 0.0020 | 2.50 | 0.18 | 0.014 | 0.0003 | 0.50 | 0.0021 | 0.0050 | tr. | 830 | 50% H2 + 50% N2 | 180 | 950 | 2.48 | 1.70 | Comparative steel (H2 % out of the range) |
| 23 | 0.0020 | 2.51 | 0.19 | 0.015 | 0.0004 | 0.51 | 0.0022 | 0.0050 | tr. | 830 | 75% H2 + 25% N2 | 30 | 950 | 2.47 | 1.70 | Comparative steel (Hot roll plate amnealing time out of the range) |
| 24 | 0.0019 | 2.52 | 0.19 | 0.015 | 0.0004 | 0.50 | 0.0019 | 0.0050 | tr. | 830 | 75% H2 + 25% N2 | 500 | 950 | 2.49 | 1.70 | Comparative steel (Hot roll plate annealing time out of the range) |
| 25 | 0.0018 | 2.49 | 1.18 | 0.015 | 0.0000 | 0.49 | 0.0020 | tr. | tr | 830 | 75% H2 + 25% N2 | 180 | 950 | 2.47 | 1.70 | Comparative steel (P, Sn, Sb out of the range) |
| 26 | 0.0017 | 4.00 | 0.25 | 0.050 | 0.0003 | 1.29 | 0.0018 | tr. | tr. | 800 | 75% H2 + 25% N2 | 180 | 930 | 2.31 | 1.65 | Comparative steel (Si out of the range) |

What is claimed is:

1. A non-oriented electromagnetic steel-sheet consisting essentially of:

0.005 wt. % or less C, 0.2 wt. % or less P, 0.005 wt. % or less N, 4.0 wt. % or less Si, 0.05 to 1 wt. % Mn, 1.5 wt. % or less Al, 0.001 wt. % or less S, at least one element selected from the group consisting of Sb and Sn, Sb+0.5×Sn being 0.001 to 0.5 wt. % or less, and the balance being Fe and inevitable impurities.

2. The non-oriented electromagnetic steel sheet of claim 1, wherein the S has a content of 0.0005 wt. % or less.

3. The non-oriented electromagnetic steel sheet of claim 1, wherein the content of Sb+0.5×Sn is from 0.001 to 0.005 wt. %.

4. The non-oriented electromagnetic steel sheet of claim 1, wherein said at least one element is Sb; and the Sb has a content of from 0.001 to 0.05 wt %.

5. The non-oriented electromagnetic steel sheet of claim 4, wherein the Sb has a content of from 0.001 to 0.005 wt. %.

6. The non-oriented electromagnetic steel sheet of claim 4, wherein then S has a content of 0.0005 wt. % or less.

7. The non-oriented electromagnetic steel sheet of claim 1, wherein said at least one element is Sn; and the Sn has a content of from 0.002 to 0.1 wt. %.

8. The non-oriented electromagnetic steel sheet of claim 7, wherein the Sn has a content of from 0.002 to 0.01 wt. %.

9. The non-oriented electromagnetic steel sheet of claim 7, wherein the S has a content of 0.0005 wt. % or less.

10. A non-oriented electromagnetic steel sheet consisting essentially of:

0.005 wt. % or less C, 0.2 wt. % or less P, 0.005 wt. % or less N, 4 wt. % or less Si, 0.05 to 1 wt. % Mn, 0.1 to 1 wt. % Al, 0.001 wt. % or less S, at least one element selected from the group consisting of Se and Te; Se+Te being from 0.0005 to 0.01 wt. %, and the balance being Fe and inevitable impurities.

11. The non-oriented electromagnetic steel sheet of claim 10, wherein the content of Se+Te is from 0.0005 to 0.002 wt. %.

12. The non-oriented electromagnetic steel sheet of claim 10, wherein the S has a content of 0.0005 wt. % or less.

13. The non-oriented electromagnetic steel sheet of claim 10, wherein said at least one element is Se; and the Se has a content of from 0.0005 to 0.01 wt. %.

14. The non-oriented electromagnetic steel sheet of claim 13, wherein the Se has a content of from 0.0005 to 0.002 wt. %.

15. The non-oriented electromagnetic steel sheet of claim 13, wherein the S has a content of 0.0005 wt. % or less.

16. The non-oriented electromagnetic steel sheet of claim 10, wherein said at least one element is Te; and the Te has a content from 0.0005 to 0.01 wt. %.

17. The non-oriented electromagnetic steel sheet of claim 16, wherein the Te has a content of from 0.0005 to 0.002 wt. %.

18. The non-oriented electromagnetic steel sheet of claim 16, wherein the S has a content of 0.0005 wt. % or less.

19. The non-oriented electromagnetic steel sheet of claim 1, wherein the inevitable impurities includes 0.005 wt. % or less Ti.

20. A non-oriented electromagnetic steel sheet consisting essentially of: 0.005 wt. % or less C, 0.2 wt. % or less P, 0.005 wt % or less N, 1.5 to 3 wt. % Si, 0.05 to 1.5 wt. % Mn, 0.1 to 1 wt. % Al, 3.5 wt. % or less of Si+Al, 0.001 wt. % or less S, at least one element selected from the group consisting of Sb and Sn, Sb+0.5×Sn being 0.001 to 0.05 wt. %, and the balance being Fe and inevitable impurities, said sheet having a thickness of from 0.1 to 0.35 mm.

21. The non-oriented electromagnetic steel sheet of claim 20, wherein the content of Sb+0.5×Sn is from 0.001 to 0.005 wt. %.

22. The non-oriented electromagnetic steel sheet of claim 20, wherein the S has a content of 0.0005 wt. % or less.

23. The non-oriented electromagnetic steel sheet of claim 20, wherein said non-oriented electromagnetic steel sheet has a mean crystal grain diameter of 70 to 200 μm.

24. The non-oriented electromagnetic steel sheet of claim 20, wherein said at least one element is Sb; the Sb has a content of from 0.001 to 0.05 wt. %.

25. The non-oriented electromagnetic steel sheet of claim 24, wherein the content of Sb is from 0.001 to 0.005 wt. %.

26. The non-oriented electromagnetic steel sheet of claim 24, wherein the S has a content of 0.0005 wt. % or less.

27. The non-oriented electromagnetic steel sheet of claim 24, wherein said non-oriented electromagnetic steel sheet has a mean crystal grain diameter of 70 to 200 μm.

28. The non-oriented electromagnetic steel sheet of claim 20, wherein said at least one element is Sn; the Sn has a content of from 0.002 to 0.1 wt. %.

29. The non-oriented electromagnetic steel sheet of claim 28, wherein the content of Sn is from 0.002 to 0.01 wt. %.

30. The non-oriented electromagnetic steel sheet of claim 28, wherein the S has a content of 0.0005 wt. % or less.

31. The non-oriented electromagnetic steel sheet of claim 28, wherein said non-oriented electromagnetic steel sheet has a mean crystal grain diameter of 70 to 200 μm.

32. A non-oriented electromagnetic steel sheet consisting essentially of: 0.005 wt. % or less C, 0.2 wt. % or less P, 0.005 wt. % or less N, more than 3 wt. % and 4.5 wt. % or less Si, 0.05 to 1.5 wt. % Mn, 0.1 to 1.5 wt. % Al 4.5 wt. % or less Si+Al, 0.001 wt. % or less S, at least one element selected from the group consisting of Sb and Sn, Sb+0.5×Sn being 0.001 to 0.05 wt. % or less and the balance being Fe and inevitable impurities, said sheet having a thickness of from 0.1 to 0.35 mm.

33. The non-oriented electromagnetic steel sheet of claim 32, wherein the content of Sb+0.5×Sn is from 0.001 to 0.005 wt. %.

34. The non-oriented electromagnetic steel sheet of claim 32, wherein the S has a content of 0.0005 wt. % or less.

35. The non-oriented electromagnetic steel sheet of claim 32, wherein said at least one element is Sb; the Sb has a content of from 0.001 to 0.05 wt. %.

36. The non-oriented electromagnetic steel sheet of claim 35, wherein the Sb content is from 0.001 to 0.005 wt. %.

37. The non-oriented electromagnetic steel sheet of claim 35, wherein the S has a content of 0.0005 wt. % or less.

38. The non-oriented electromagnetic steel sheet of claim 38, wherein said at least one element is Sn; the Sn has a content of from 0.002 to 0.1 wt %.

39. The non-oriented electromagnetic steel sheet of claim 38, wherein the Sn content is from 0.002 to 0.01 wt. %.

40. The non-oriented electromagnetic steel sheet of claim 38, wherein the S has a content of 0.0005 wt. % or less.

41. A non-oriented electromagnetic steel sheet consisting essentially of:

4 wt. % or less Si, 0.05 to 1 wt. % Mn, 0.1 to 1 wt. % Al, 0.001 wt. % or less S, and the balance being Fe and inevitable impurities; and nitrides within an area of 30 μm from the surface of the steel sheet after a finish annealing being 300 ppm or less.

42. A method for producing a non-oriented electromagnetic steel sheet comprising the steps of:

(a) preparing a slab consisting essentially of 0.005 wt. % or less C, 0.2 wt. % or less P, 0.005 wt. % or less N, 4 wt. % or less Si, 0.05 to 1 wt. % Mn, 1.5 wt. % or less Al, 0.001 wt. % or less S, at least one element selected from the group consisting of 0.001 to 0.05 wt. % Sb, 0.002 to 0.1 wt. % Sn, 0.0005 to 0.01 wt. % Se and 0.0005 to 0.01 wt. % Te and the balance being Fe and inevitable impurities;

(b) hot-rolling the slab to form a hot-rolled steel sheet;

(c) cold-rolling the hot-rolled steel sheet to form a cold-rolled steel sheet; and (d) finish-annealing the cold-rolled steel sheet.

43. The method of claim 42, wherein said at least one element is selected from the group consisting of 0.001 to 0.05 wt. % Sb and 0.002 to 0.1 wt. % Sn.

44. The method of claim 42, wherein said at least one element is selected from the group consisting of 0.0005 to 0.01 wt. % Se and 0.0005 to 0.01 wt. % Te.

45. The method of claim 42, wherein said slab consists essentially of 0.005 wt. % or less C, 0.2 wt. % or less P, 0.005 wt. % or less N, 1 to 4 wt. % Si, 0.05 to 1 wt. % Mn, 0.1 to 1 wt. % Al, 0.001 wt. % or less S, 0.001 to 0.05 wt. % of Sb+0.5×Sn and the balance being Fe and inevitable impurities; and said finish annealing comprises heating the steel sheet at a heating speed of 40° C./sec or less.

46. The method of claim 45, wherein the content of Sb+0.5×Sn is from 0.001 to 0.005 wt. %.

47. The method of claim 42, wherein said slab consists essentially of 0.005 wt. % or less C, 0.03 to 0.15 wt. % P, 0.005 wt. % or less N, 1 to 3.5 wt. % Si, 0.05 to 1 wt. % Mn, 0.1 to 1 wt. % Al, 0.001 wt. % or less S, 0.001 to 0.05 wt. % of Sb+0.5×Sn and the balance being Fe and inevitable impurities; and said finish annealing comprises annealing continuously in an atmosphere having a hydrogen concentration of 10% or more for a time of 30 seconds to 5 minutes.

48. The method of claim 42, wherein said slab consists essentially of 0.005 wt. % or less C, 0.2 wt. % or less P, 0.005 wt. % or less N, less than 1.5 wt. % Si, 0.05 to 1 wt. % Mn, 0.1 to 1 wt. % Al, 0.001 wt. % or less S, 0.001 to 0.05 wt. % of Sb+0.5×Sn and the balance being Fe and inevitable impurities; and said finish annealing comprises annealing continuously in an atmosphere having a hydrogen concentration of 10% or more for a time of 30 seconds to 5 minutes.

49. The method of claim 49, further comprising the step of annealing the hot-rolled steel sheet.

50. The method of claim 49, wherein said slab consists essentially of 0.005 wt. % or less C, 0.2 wt. % or less P, 0.005 wt. % or less N, 1.5 to 4 wt. % Si, 0.05 to 1 wt. % Mn, 0.1 to 1 wt. % Al, 0.001 wt. % or less S, 0.001 to 0.05 wt. % of Sb+0.5×Sn and the balance being Fe and inevitable impurities; and the step of annealing the hot-rolled steel sheet comprises heating the hot-rolled steel sheet at a heating speed of 40° C./sec. or less in a mixed atmosphere of hydrogen and nitrogen.

51. The method of claim 49, wherein the content of Sb+0.5×Sn is 0.001 to 0.005 wt. %.

52. The method of claim 49, wherein said slab consists essentially of 0.005 wt. % or less C, 0.15 wt. % or less P, 0.005 wt. % or less N, 1.5 to 3.5 wt. % Si, 0.05 to 1 wt. % Mn, 0.1 to 1 wt. % Al, 0.001 wt. % or less S, 0.001 to 0.05 wt. % of Sb+0.5×Sn and the balance being Fe and inevitable impurities; and the step of annealing the hot-rolled steel sheet comprises heating the hot-rolled steel sheet for 1 to 6 hours in an atmosphere having a hydrogen concentration of 60% or more.

53. The method of claim 49, wherein the step of annealing the hot-rolled steel sheet comprises heating the hot-rolled steel sheet for 1 to 5 minutes in an atmosphere having a hydrogen concentration of 10% or more.

* * * * *